US012173528B2

(12) United States Patent
Harris

(10) Patent No.: US 12,173,528 B2
(45) Date of Patent: Dec. 24, 2024

(54) FLOOD HINGE

(71) Applicant: Kevin Harris, Baton Rouge, LA (US)

(72) Inventor: Kevin Harris, Baton Rouge, LA (US)

( * ) Notice: Subject to any disclaimer, the term of this patent is extended or adjusted under 35 U.S.C. 154(b) by 179 days.

(21) Appl. No.: 17/505,595

(22) Filed: Oct. 19, 2021

(65) Prior Publication Data

US 2022/0120108 A1 Apr. 21, 2022

Related U.S. Application Data

(60) Provisional application No. 63/093,405, filed on Oct. 19, 2020.

(51) Int. Cl.
*E04H 9/14* (2006.01)

(52) U.S. Cl.
CPC ..... *E04H 9/145* (2013.01)

(58) Field of Classification Search
None
See application file for complete search history.

(56) References Cited

U.S. PATENT DOCUMENTS 5,131,109 A * 7/1992 Grip ..... E01D 15/14 114/45
5,347,949 A * 9/1994 Winston ..... E02B 3/064 52/169.9
5,647,693 A * 7/1997 Carlinsky ..... E02D 5/00 52/169.9
5,775,847 A * 7/1998 Carlinsky ..... E02D 27/32 52/169.9
6,347,487 B1 * 2/2002 Davis ..... E04H 9/145 52/64
7,607,864 B2 * 10/2009 Kenady ..... B63B 35/44 405/196
8,777,519 B1 * 7/2014 Henderson ..... E04H 9/0235 52/167.1
10,081,962 B1 * 9/2018 Sluss ..... E02D 27/06
2007/0166110 A1 * 7/2007 Kenady ..... B63B 21/50 405/224
2010/0183374 A1 * 7/2010 Ewers ..... E04H 9/14 405/211

* cited by examiner

*Primary Examiner* — Brian E Glessner
*Assistant Examiner* — Adam G Barlow
(74) *Attorney, Agent, or Firm* — Next IP Law Group

(57) ABSTRACT

Flood Hinge is a novel system that allows an object to remain on its foundation in its normal resting position, to vertically and asymmetrically separate from this foundation upon application of an external force, while remaining securely tethered to the foundation, only to be guided to return to its original resting position as the external force subsides or is removed. This is accomplished by use of multiple parallel strut systems, each arranged in opposing positions.

20 Claims, 238 Drawing Sheets

1500
704
702
104A
700A
701A
703
201
106A
600

FLOOD HINGE

This application claims benefit to U.S. provisional patent 63/093,405 filed on Oct. 19, 2020.

BACKGROUND

Throughout history, humans have tended to settle in areas close to water access. Water is one of the basic requirements needed for farming, and to quench our thirst. Across the world, populations have established settlements adjacent to rivers in order to take advantage of the rich soils made so from nutrients periodically deposited as sediment by seasonal flood waters. Architectural designs, developed in response to mitigating undesirable construction damage from floodwater inundation, lifted the living spaces that were susceptible to water damage, to higher elevations. This was accomplished either by finding higher ground on which to build, or by building on top of flood resistant structural materials such as masonry walls or pilings. Today it has been estimated that over 20 percent of the world's population inhabits areas in these river basins that experience frequent flooding. In addition, another 40 percent of the world's population lives in coastal areas. Global warming today is causing weather events to become more extreme and sea levels to rise as well. Increased weather events bring storm surge rises in sea level to coastal areas and increased rainfall that results in flooding in affected riverine basins. In summary, over 60% of the world's population is at risk of flooding. As of September, 2020, with more than two months left in hurricane season, the Atlantic had produced 23 named storms—roughly double its long-term average for an entire season. For only the second time in its history, the National Hurricane Center exhausted its regular list of 21 names last week and began using the Greek alphabet. In October, hurricane Delta devastated South West Louisiana, just six weeks after hurricane Laura and its Category 4 winds, the strongest hurricane on record to make landfall in the U.S. state of Louisiana, created over $10.1 billion in damage. Few coastal zones in the Gulf of Mexico and along the East Coast have remained untouched. Nearly 90 percent of these U.S. shores have been under a tropical storm or hurricane advisory in 2020, with a record nine storms making landfall. Flooding caused by these events is typically short in duration. Conditions rapidly return to the dry normal as floodwaters naturally recede. Unfortunately, all architecture that is not resilient to water inundation experiences devastating damage that totals in the hundreds of Billions US each year. Flood Hinge addresses many of the problems posed by these weather events. Rising water, high winds, wave action, and continuous connection to utilities are all made possible with this device which allows a structure to be amphibious and to float vertically with rising water, to tilt as a result of resisting the forces of high winds and wave action, to remain connected to under-ground supplied utilities, and to return safely to its original resting position as the flood waters recede.

SUMMARY

Flood Hinge is a novel system that allows an object to remain on its foundation in its normal resting position, to vertically and asymmetrically separate from this foundation upon application of an external force, while remaining securely tethered to the foundation, only to be guided to return to its original resting position as the external force subsides or is removed. This is accomplished by use of multiple parallel strut systems, each arranged in opposing positions. Each of these systems are anchored to the foundation on one end, and to the object on the other, effectively tethering the object to its foundation. Separation movement of the object from its foundation is freely allowed along the Z axis, but restricted to a narrow movement cone in both the X and Y axes. This movement cone exists for each parallel strut system, thus with multiple systems, each independent point of connection to the object is limited to its own movement cone. The allowable movement of one parallel strut system is influenced by the positioning of multiple such systems whose movement planes are set opposing to or angled to its movement plane. The result of an array of such opposing and angled systems is a narrow cone of possible movement for each strut connection to the object. This cone widens with the amount of vertical separation and narrows as the object approaches the foundation. Multiple parallel strut systems will each have an independent point of connection to the object. The allowable movement of each point of connection is limited to its cone of movement however, each point is independent and the amount of vertical separation for each can vary from its neighboring systems. This allows for the width and length of the object to separate from the foundation unevenly, limited only by the allowable movement cones of each parallel strut connection to the object. The points of connection to the foundation remain fixed relative to the foundation plane in the X, Y, and Z dimensions. The points of connection to the object remain fixed in the X, Y, and Z dimensions relative to the base of the object. For each parallel strut system, the points of connection between the foundation and the object may vary in the Z axis freely, while limited in movement along in the X and Y axes by the allowable movement cone for its opposing strut system. One application of Flood Hinge is to enable architecture in flood prone regions of the world to remain close to the ground resting on their foundations during normal circumstances, to rise in elevation with rising water and uneven waves, remain tethered to their foundations, guided to return to their original resting positions as waters recede. The house is to be outfitted with a buoyancy system that will float the house in rising water, and the Flood Hinge tethering system, which will allow the asymmetrical vertical movement expected during high water, waves, and high winds conditions, and safely return the house to its original resting position. High winds may occur independent of rising water, and are also capable of removing a house from its foundation. In these situations the house is to be securely anchored to its foundation. A locking system is described that can discriminate between which forces are to be allowed to lift the house vertically, and which are to be resisted. Locking systems can be released deliberately in anticipation of high water relying either on an attended lock release system, or passively using an unattended release system. An unattended lock release system reacts to the presence of rising water by relying upon a water sensor or a mechanical float to release the locking mechanism. The float release lock assembly is comprised of a hold down strap that is anchored to the foundation and locks onto the house, preventing vertical separation. This lock is released via removal of a connecting pin from the anchoring strap. Rising water will vertically lift a buoyant float attached to a lever arm outfitted with this connecting pin. The lever arm rotates as the float rises until fully extracting the pin and vertically releasing the house from the foundation. This same pin reinserts back into the strap when the house returns to its original resting position, again locking the house to the foundation until the next high water event. The foundation system resists all gravity loads of the house at rest, as well as the lateral forces of high winds and moving water pushing against the floating house. High winds will push against the house, resulting in a lateral force and an overturning force. The foundation resists both of these forces when the house is in its normal resting position. In rising water, this overturning force is absorbed by the buoyancy system. The house will sit deeper in the water on the leeward side. The uplifting force of the high wind acting on the windward side of the house is counterbalanced by the increased buoyant force of the leeward side of the house sitting deeper. The flood hinge system freely moves vertically and thus prevents the foundation from also having to resist these upward forces. The flood hinge system transfers the remaining lateral forces directly to the foundation as a lateral force. The parallel strut system reduces these lateral forces to compression or tension in each strut, and transfers this directly to the foundation laterally. The utility system connections ride up and down with the house as well as tilt with the house when experiencing high winds as well as the unlevel conditions of water waves. Utility system conduits configured as flexible coils will allow for uninterrupted utility services during periods of high water. Vehicles can be outfitted with one or more Flood Hinges as permanent connections that can be deployed and anchored prior to flooding events, or connected to anchored flood hinges. So attached, these vehicles can be either made buoyant or outfitted with a deployable buoyancy system. So equipping vehicles of any size and kind would prevent or greatly lessen their damage due flood waters.

Figure 120:
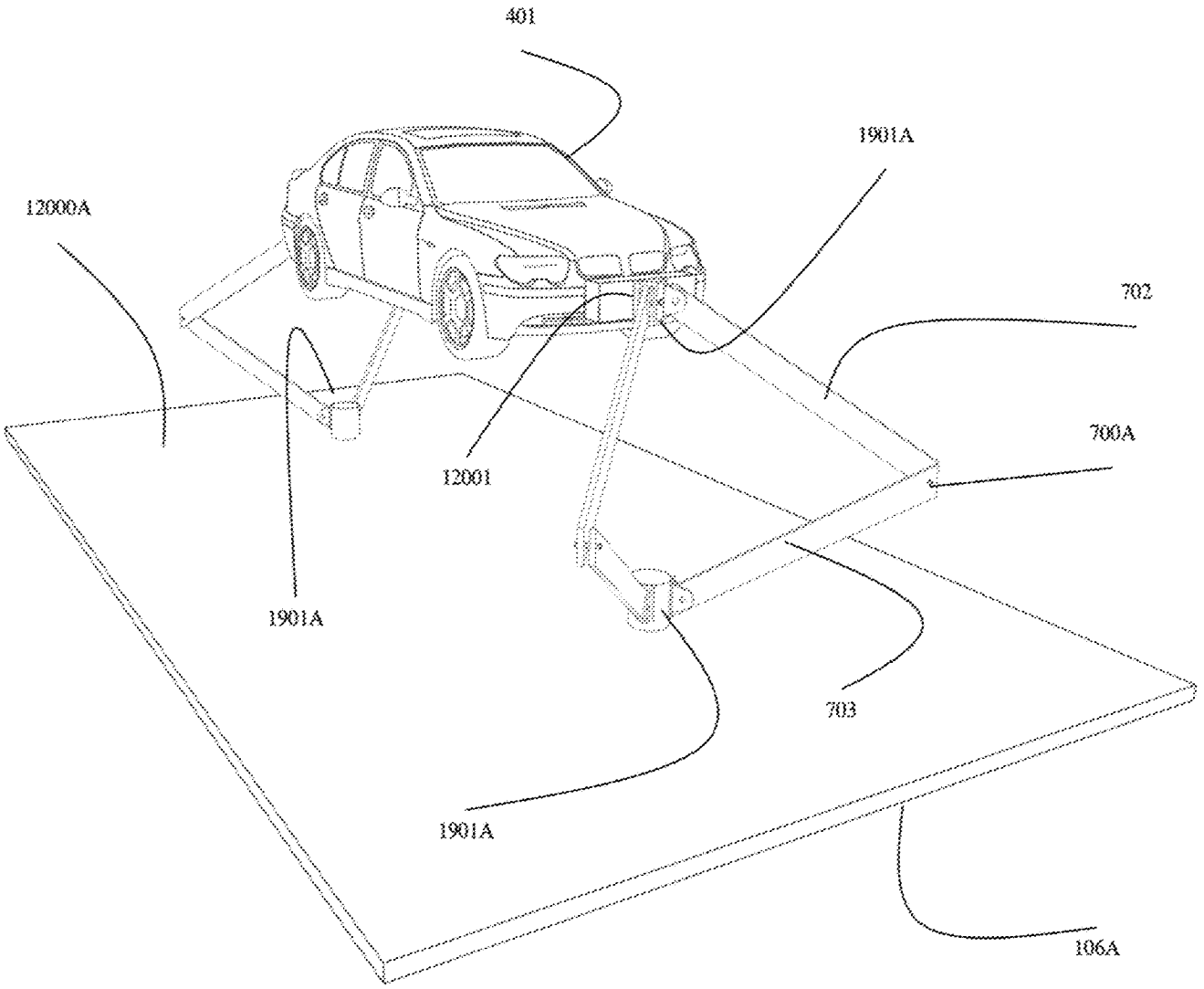

FIG. 120 illustrates a perspective view that shows a car equipped as a buoyant object that is floating above grade while tethered to its foundation system using two double hinge clustered hinge system units that are anchored to a shaft as pier foundation. The two upper clustered hinge system units have been attached to the front and rear bumpers of the car using a tilting hinge which allows for asymmetrical movement of the car due to the forces of high velocity wind or from water waves as the vehicle floats on the water surface, according to an example embodiment of the present disclosure.

Figure 121:
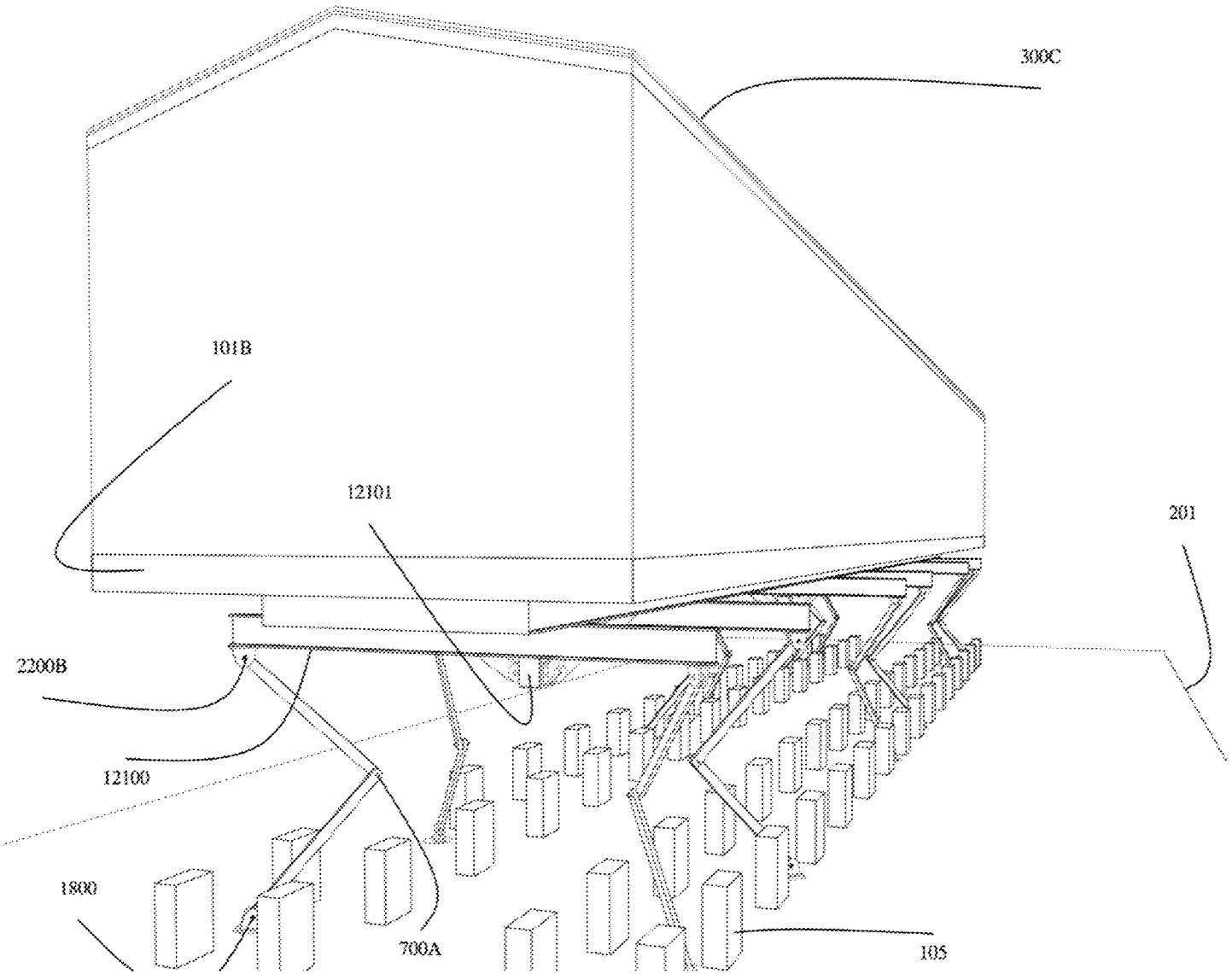

FIG. 121 illustrates a perspective view that shows a mobile home floating in rising water while tethered to its foundation by a series of primary parallel struts system units arranged in an opposing elbow system oriented with inward acting elbow hinges that are concealed beneath in the crawl space when the mobile is in an object at rest position. This system of using a series of anchored girders to support two or more parallel main beam units that support the supporting frame, is a cost efficient alternative for retrofitting existing houses on raised foundations in order to give them the amphibious architecture qualities of being safely tethered while riding on the water's surface during flooding events, and returning to the original resting position as the water inundation recedes. Utilizing a drilled pile foundation system allows access for machinery to insert these stabilizing anchor devices into the existing grade, according to an example embodiment of the present disclosure.

Figure 122:
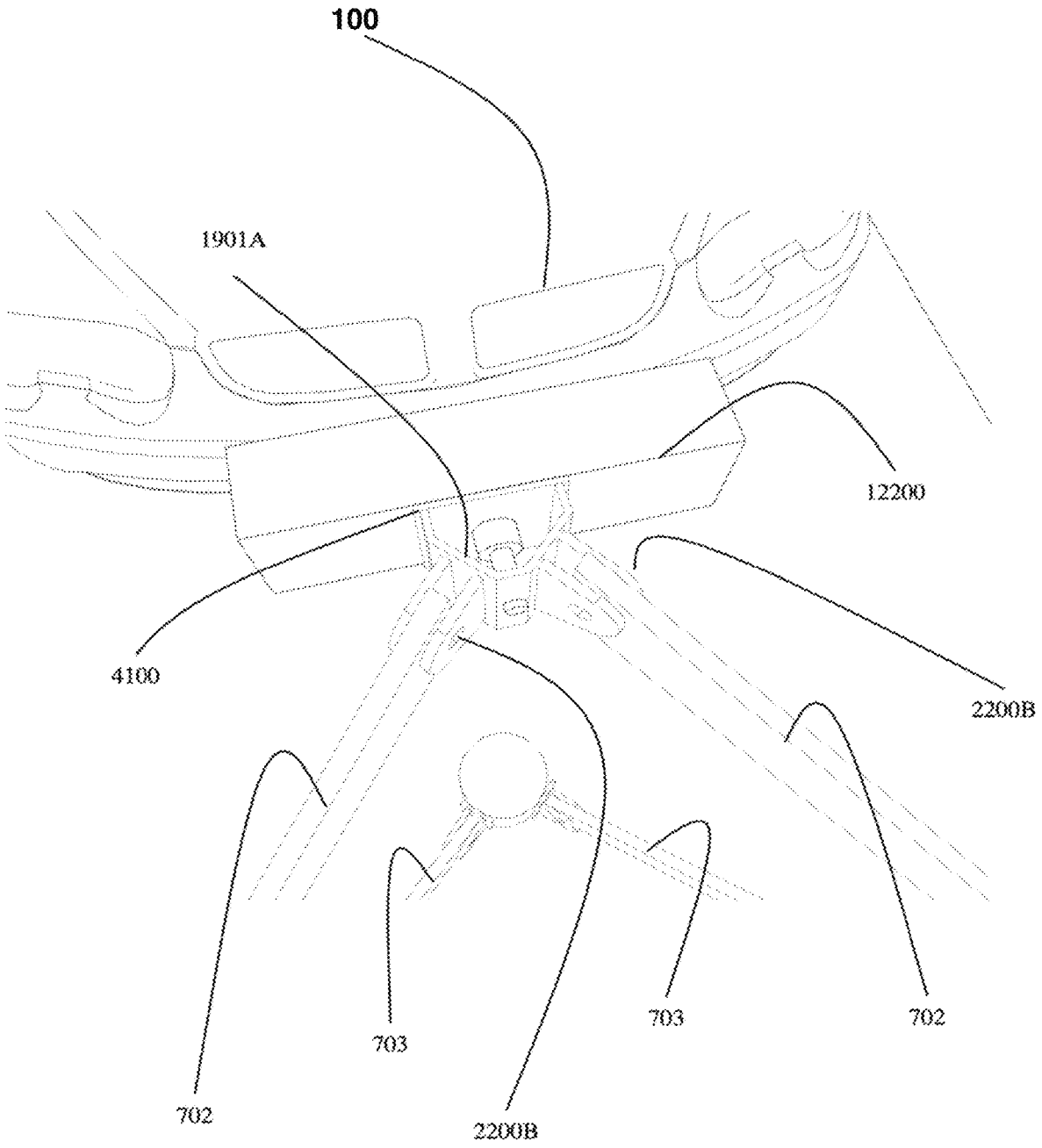

FIG. 122 illustrates a perspective detail view that shows a car equipped as a buoyant object that is floating above grade while tethered to its foundation system using a double hinge clustered hinge system unit anchored to a shaft as pier foundation. The upper clustered hinge system unit is attached to the front bumper of the car using a Buoyant Object Connector and a tilting hinge which allows for asymmetrical movement of the car due to the forces of high velocity wind or from water waves as the vehicle floats on the water surface, according to an example embodiment of the present disclosure.

Figure 123:
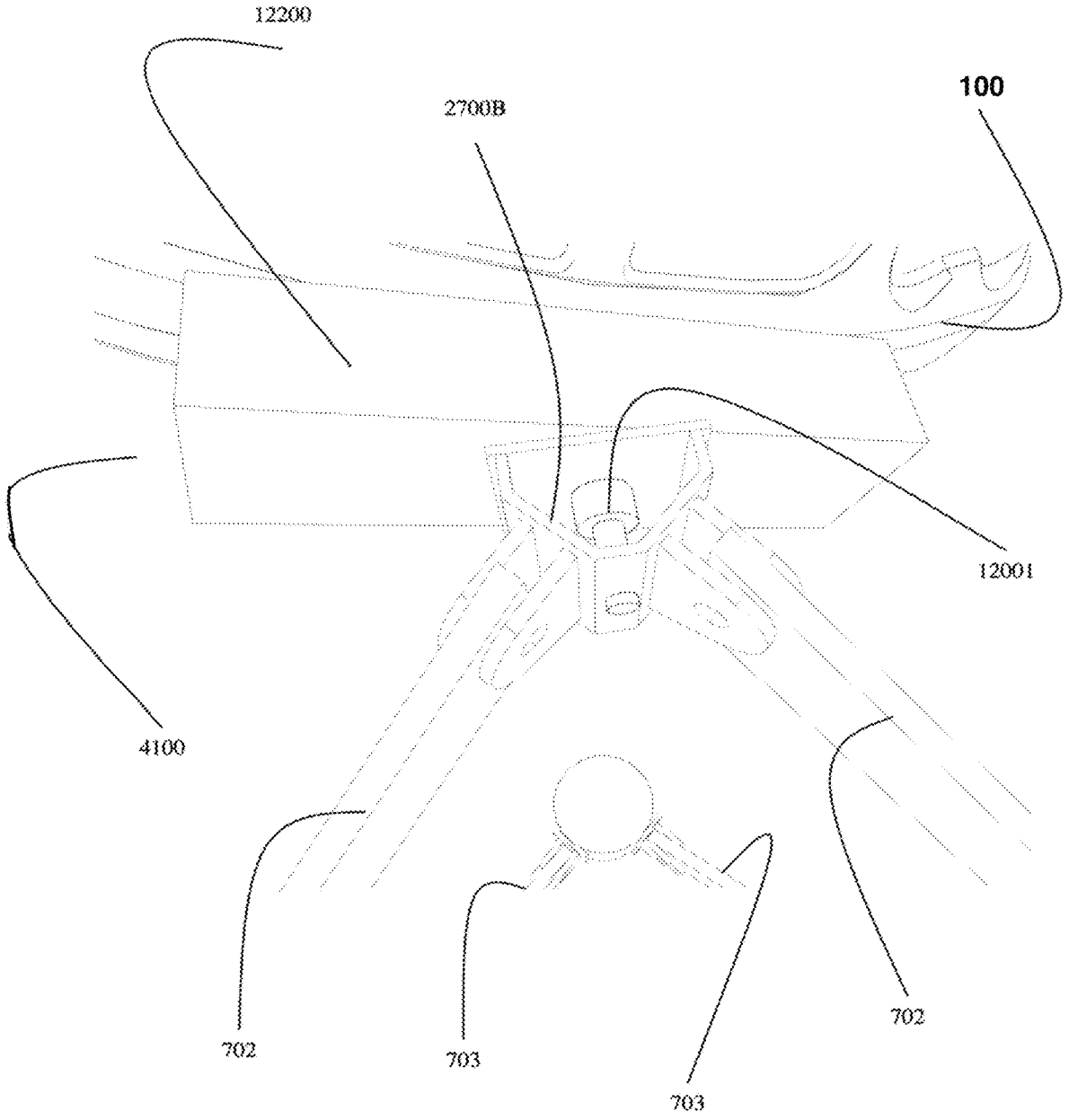

FIG. 123 illustrates a perspective detail view that shows a tilting hinge which allows for asymmetrical movement of the car due to the forces of high velocity wind or from water waves as a buoyant vehicle floats on the water surface. The tilting hinge is anchored to a buoyant object connector that is attached to the vehicle, according to an example embodiment of the present disclosure.

Figure 124:
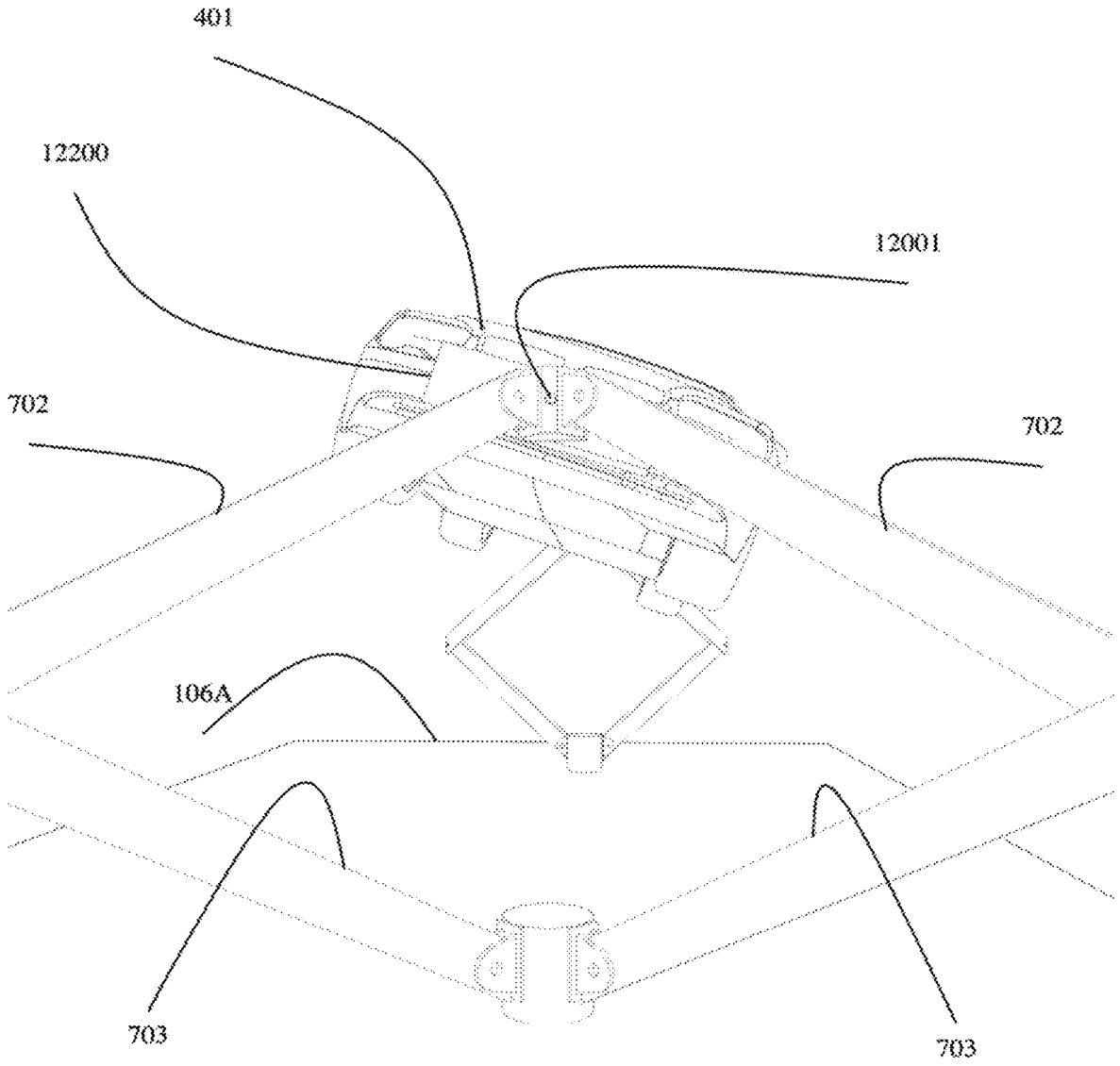

FIG. 124 illustrates a perspective view that shows a tilting hinge which allows for asymmetrical movement of the car due to the forces of high velocity wind or from water waves as a buoyant vehicle floats on the water surface. The tilting hinge is anchored to a buoyant object connector that is attached to the vehicle, according to an example embodiment of the present disclosure.

Figure 125:
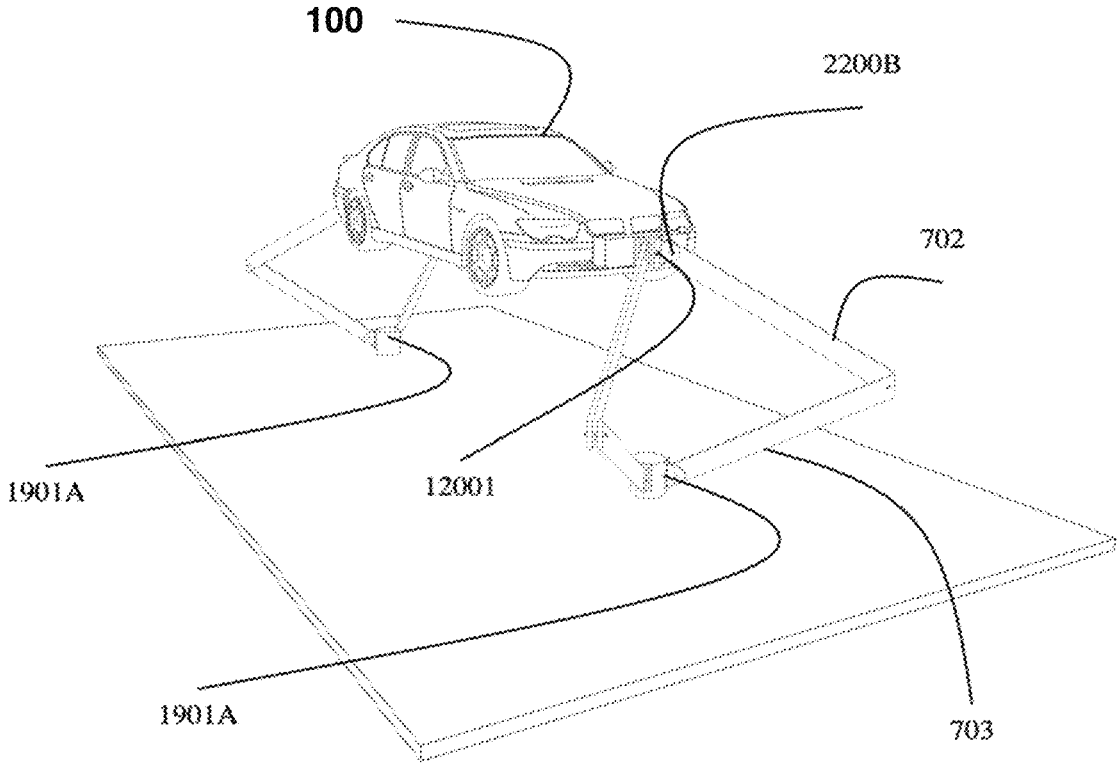

FIG. 125 illustrates a perspective view that shows a tilting hinge which allows for asymmetrical movement of the car due to the forces of high velocity wind or from water waves as a buoyant vehicle floats on the water surface. The tilting hinge is anchored to a buoyant object connector that is attached to the vehicle, according to an example embodiment of the present disclosure.

Figure 126:
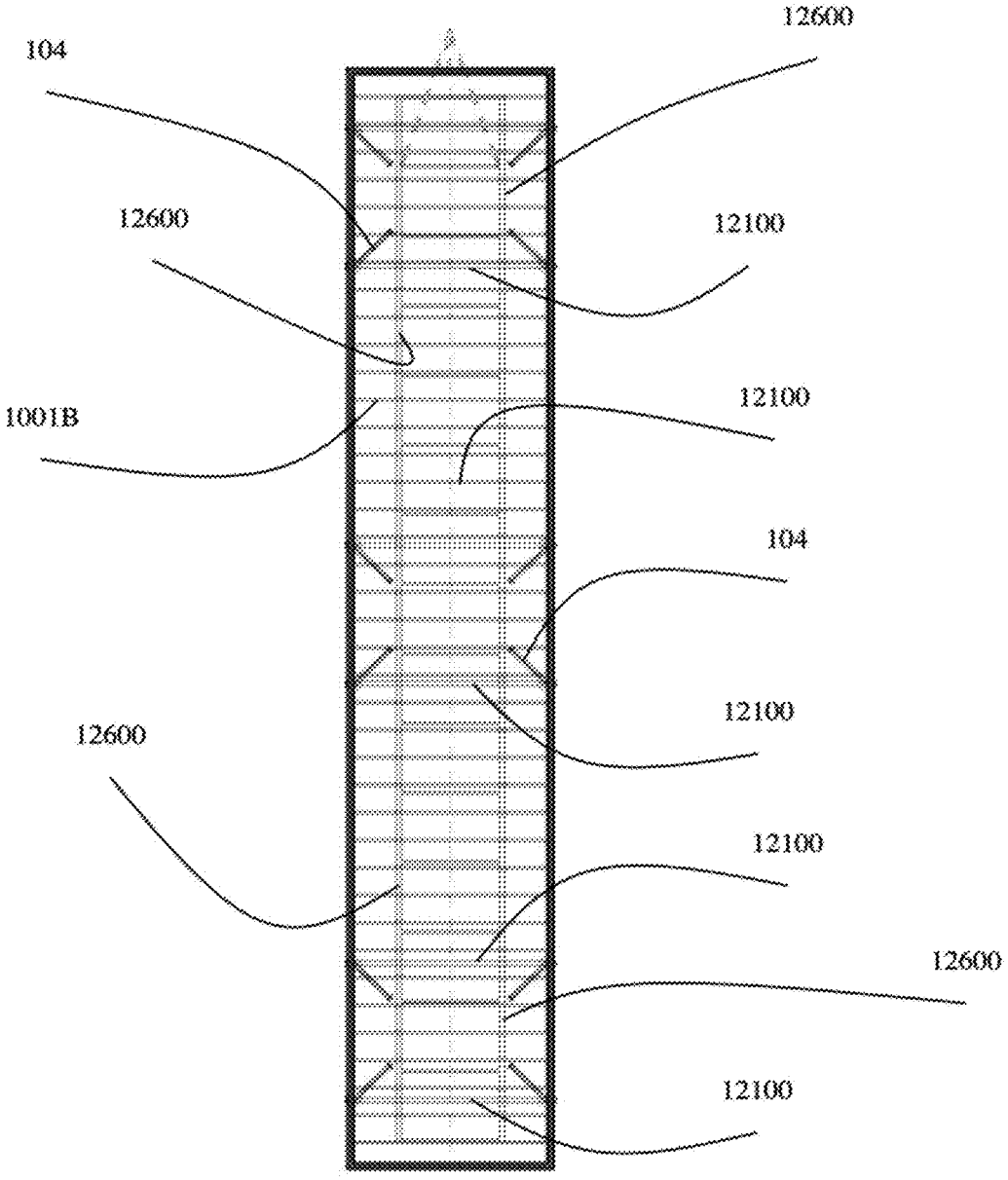

FIG. 126 illustrates a worm's eye plan view that shows the underside framing for a typical mobile home structure tethered to a series of primary parallel struts system units. This structural system is also applicable for retrofitting existing structures using a pier on gradebeam system with a crawlspace. The system supports the object platform system of multiple parallel platform joist units with two or more main beam units that are supported by a multiplicity of girders. Each end of these girders is anchored to a primary parallel struts system whose opposite ends are anchored to a foundation system. The structure rests on a pier system. To anchor the tethering system a more resilient foundation system is used, hence each primary parallel struts system unit is attached to a piling that has been inserted deep into the soil, according to an example embodiment of the present disclosure.

Figure 127:
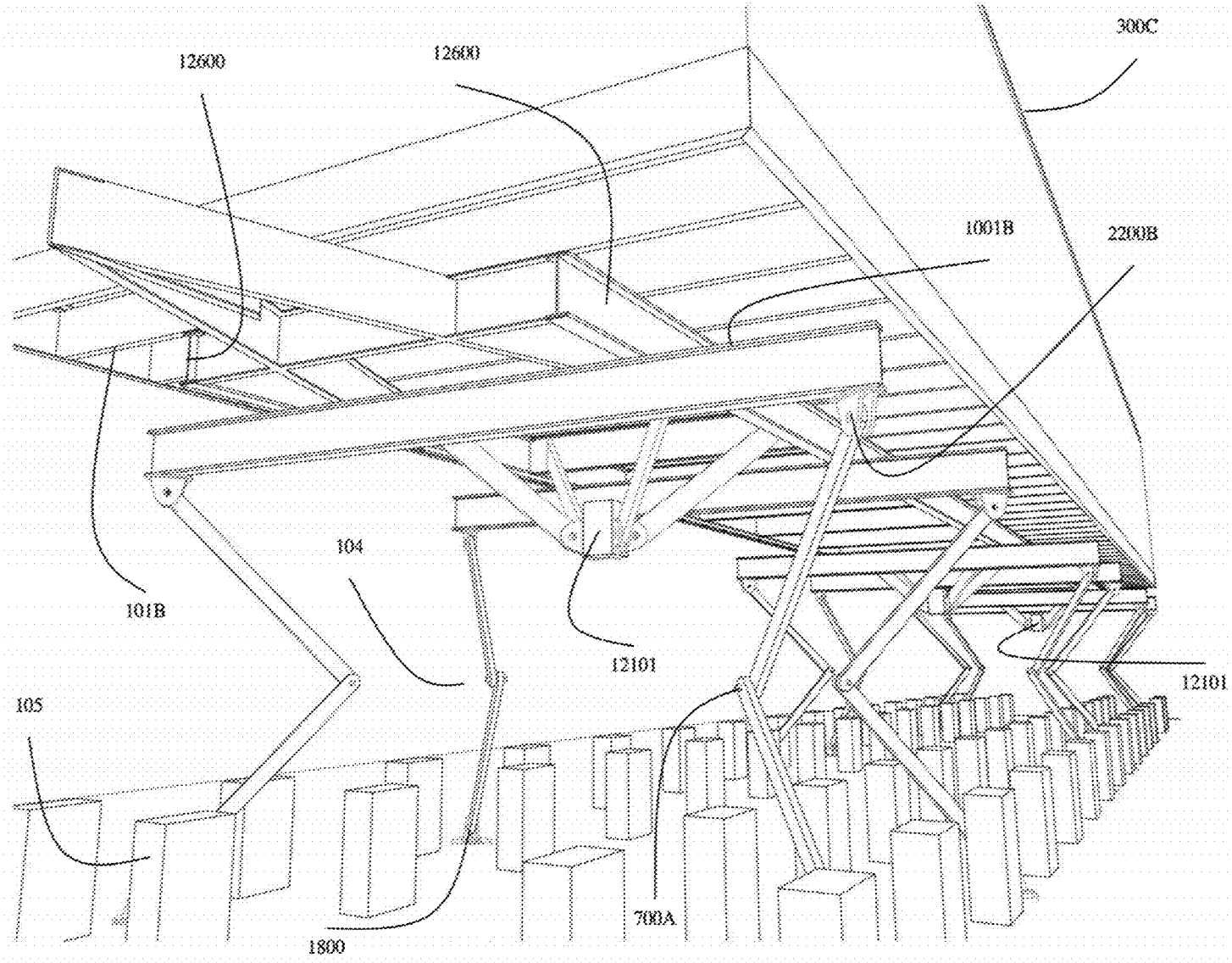

FIG. 127 illustrates a worm's eye perspective view that shows the underside of an existing building resting on a pier on gradebeam system that has been retrofitted with a series of main beam units resting on girders that are anchored to primary parallel struts system units whose foundation hinge blocks are anchored to a driven pile, drilled pile, helical pile, or some other form of foundation system. Weighted keel units are suspended from the supporting frame to lower the center of gravity of the structure and lessen the possibility of its capsizing or overturning due to an otherwise high center of gravity. The crawl space between the supporting frame and grade accommodates and conceals the primary parallel struts system units as well as any hull buoyancy system to convert the structure into a buoyant object so that it can float up with rising water, according to an example embodiment of the present disclosure.

Figure 128:
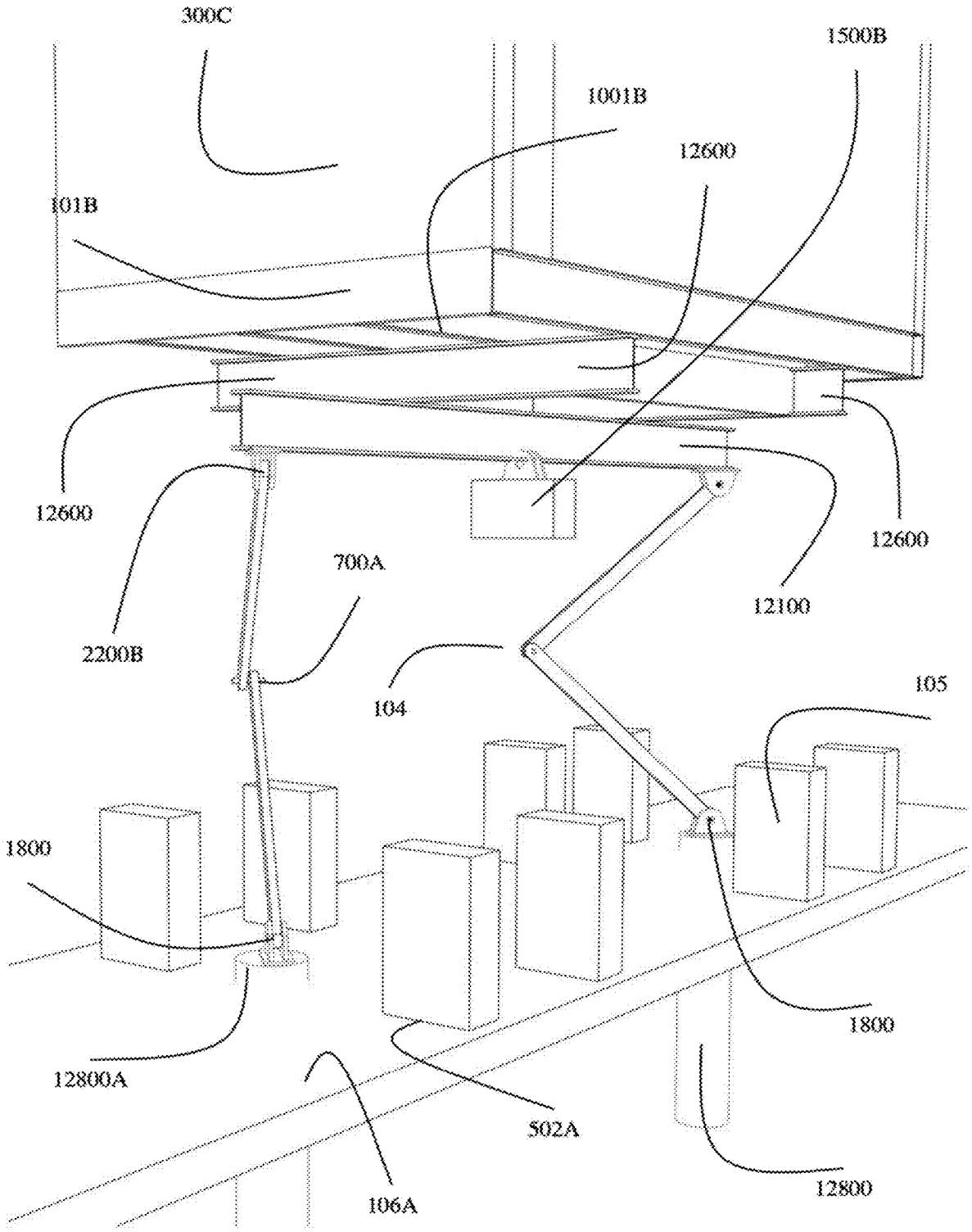

FIG. 128 illustrates an a perspective cut-away detail view that shows one method of attaching a weighted ballast keel to lower the center of gravity of a structure. In this illustration the keel is made of concrete suspended from one of a series of girders. Each of the supporting girders supports two or more main beam units that run the length of the platform structure to support the supporting frame of the building. Each end of the girders is anchored to the object hinge of a primary parallel struts system that tethers the building to its foundation system. The object hinge of each primary parallel struts system is anchored to one of the girders while the foundation hinge is cleated to the shaft system which provides the stationary support to anchor the system during flooding events, according to an example embodiment of the present disclosure.

Figure 129:
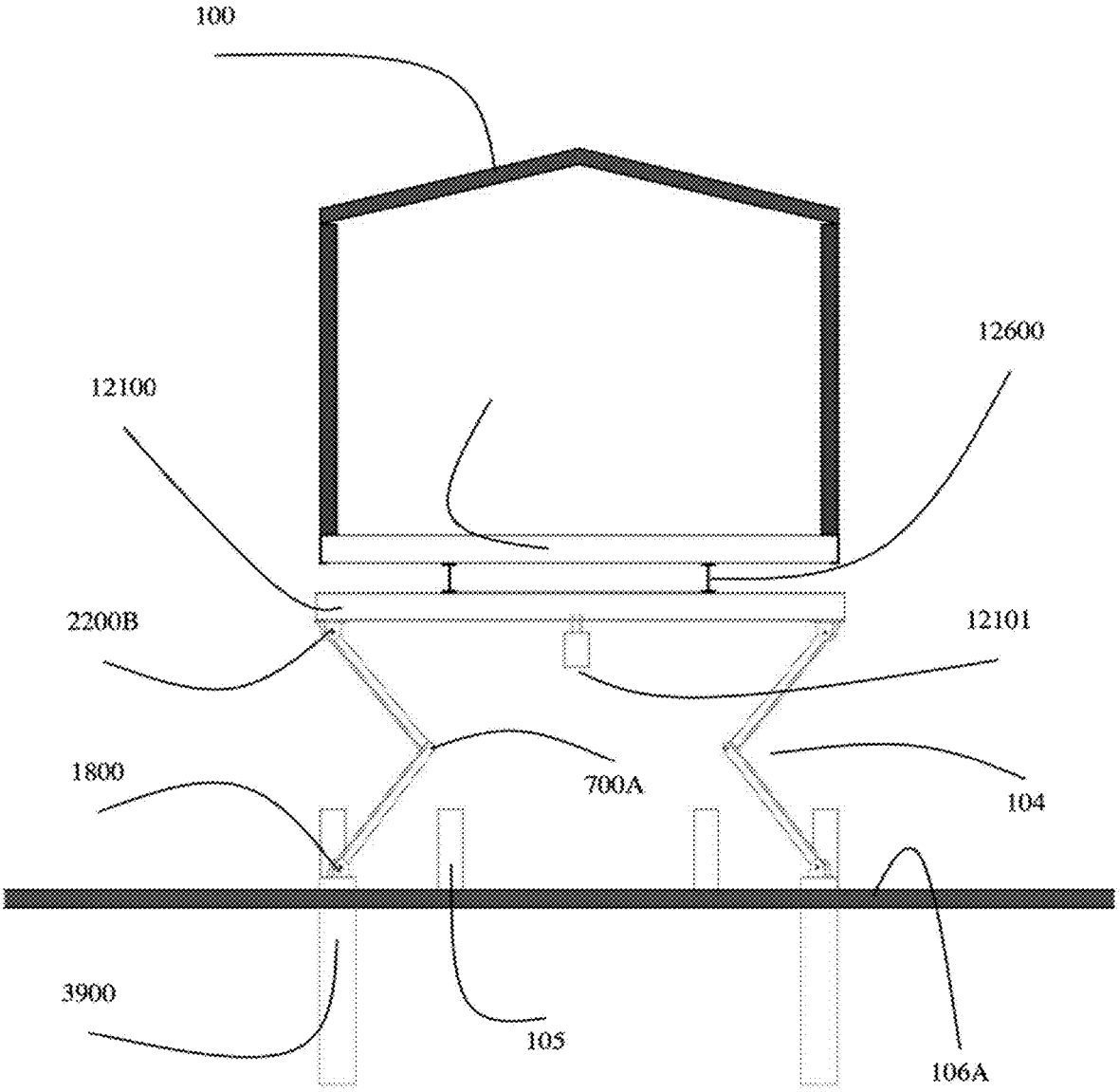

FIG. 129 illustrates a section view that shows the two main beam units of a typical mobile home structure that is floating while anchored to and resting on a series of inserted girders from which a weighted keel is suspended. The weighted ballast of the keel lowers the center of gravity of the mobile home structure and lessens the possibility of its overturning or capsizing. The entire assembly is tethered to the foundation system with multiple primary parallel struts system units arranged in an opposing elbow system which limits the possible lateral and vertical movement of each platform cleat to within a limited platform movement cone. This limited movement allows the platform to rise to the elevation of the rising water and to return to its original platform at resting position once the water subsides. In this example each foundation hinge is anchored to a drilled pile that is independent of the pier system which supports the mobile home structure when at rest. The drilled pile shafts anchor each primary parallel struts system, according to an example embodiment of the present disclosure.

Figure 130:
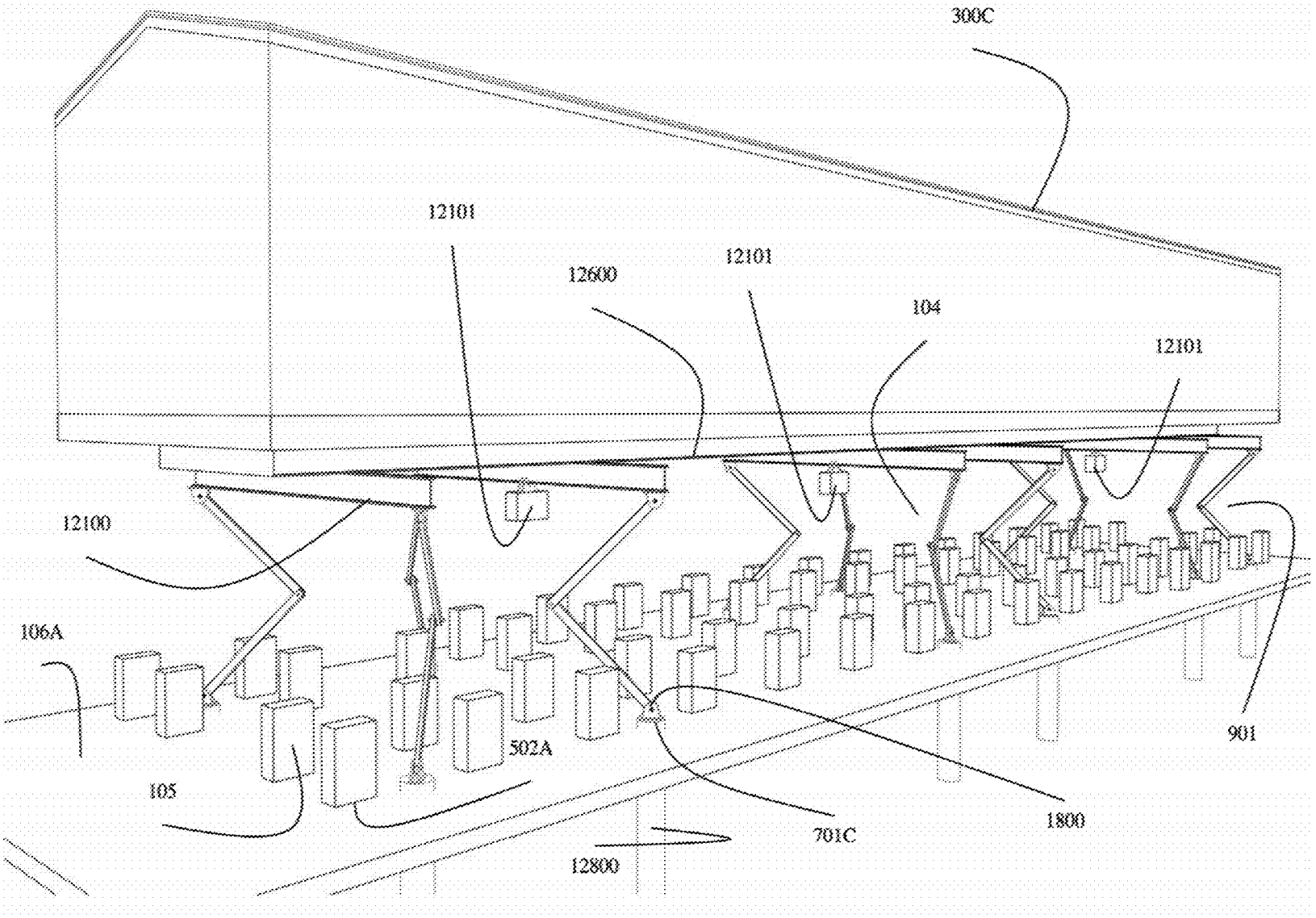

FIG. 130 illustrates a perspective view that shows a mobile home floating in rising water that is counterbalanced against overturning by a series of suspended keel weights attached below the #girders. The building is safely tethered to its foundation by a series of primary parallel struts system units arranged in an opposing elbow system oriented with inward acting elbow hinges that are concealed beneath in the crawl space when the mobile is in an object at rest position. This system of using a series of anchored girders to support two or more parallel main beam units that support the supporting frame, is a cost efficient alternative for retrofitting existing houses on raised foundations in order to give them the amphibious architecture qualities of being safely tethered while riding on the water's surface during flooding events, and returning to the original resting position as the water inundation recedes. Utilizing a drilled pile foundation system allows access for machinery to insert these stabilizing anchor devices into the existing grade, according to an example embodiment of the present disclosure.

Figure 131:
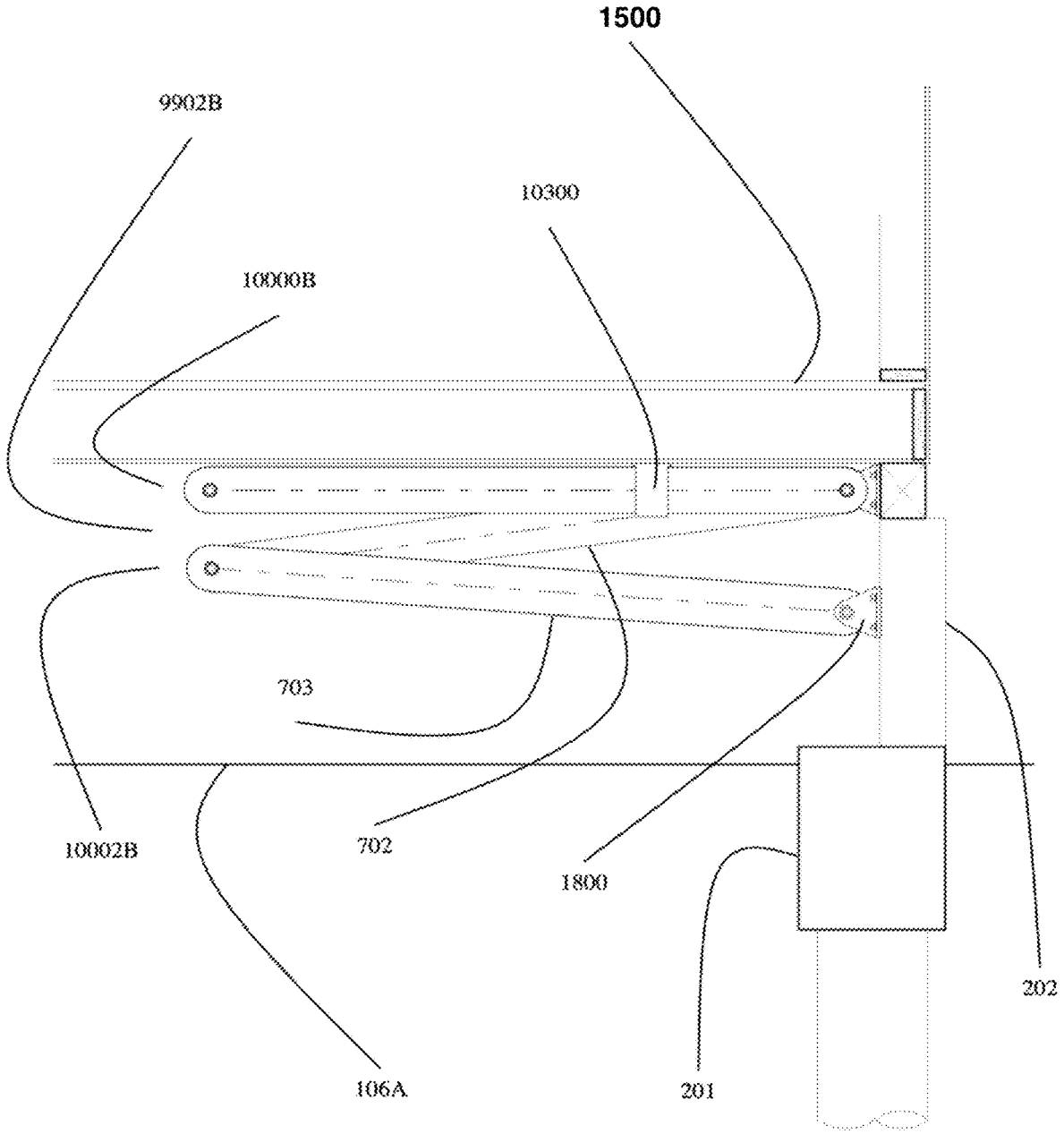

FIG. 131 illustrates a section elevation view that shows a building at rest on its pier on gradebeam system. Under the object platform system the building is outfitted with a tethering system of stacked struts. The lower of these two primary parallel struts system units acts first when rising water lifts the building to separate vertically from its resting position. This lower set of parallel struts are the initial struts. Whenever the vertical separation of the building reaches the outer limits of the upper strut movement arc, the upper strut of the set of initial struts, because it is attached to the lower strut of the set of reserve struts, with further vertical movement it unclips the reserve struts unit from the struts clip and allows additional vertical movement. When the rising water recedes and the building returns to its original resting position, the set of reserve struts moves back inside the struts clip, according to an example embodiment of the present disclosure.

Figure 132:
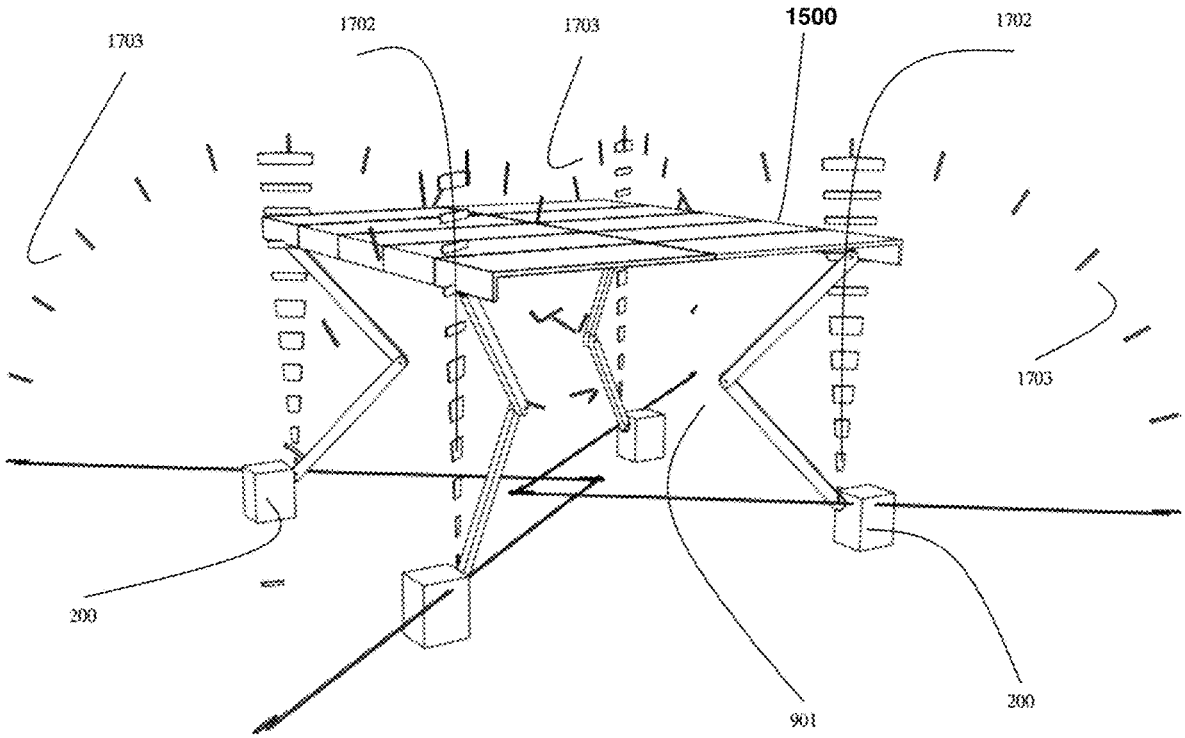

FIG. 132 illustrates a perspective view that shows a platform in an object separated position overlaid with diagrams illustrating each of the four upper strut movement arc paths and the resultant limited platform movement cone for the point of attachment to the platform for each upper strut when arranged in an opposing elbow system. When anchoring each lower strut to a rigid foundation system, the distance between each foundation hinge becomes fixed. When the object hinge of each primary parallel struts system is anchored to a rigid platform, the distance between each object hinge becomes fixed. As the rigid platform moves vertically, the arc of limited movement of each is tied to the others. The result is a limited platform movement cone of movement for each point of connection to the platform. This movement cone is a single point at its base, the point of rotation for the lower strut anchored to the foundation hinge. This cone widens vertically, allowing each connection point to freely move within its boundaries. The resultant combination of possible movement points that lie within the restricted boundaries of each cone allows for the asymmetrical positioning of the platform caused by wind forces or wave action, according to an example embodiment of the present disclosure.

Figure 133:
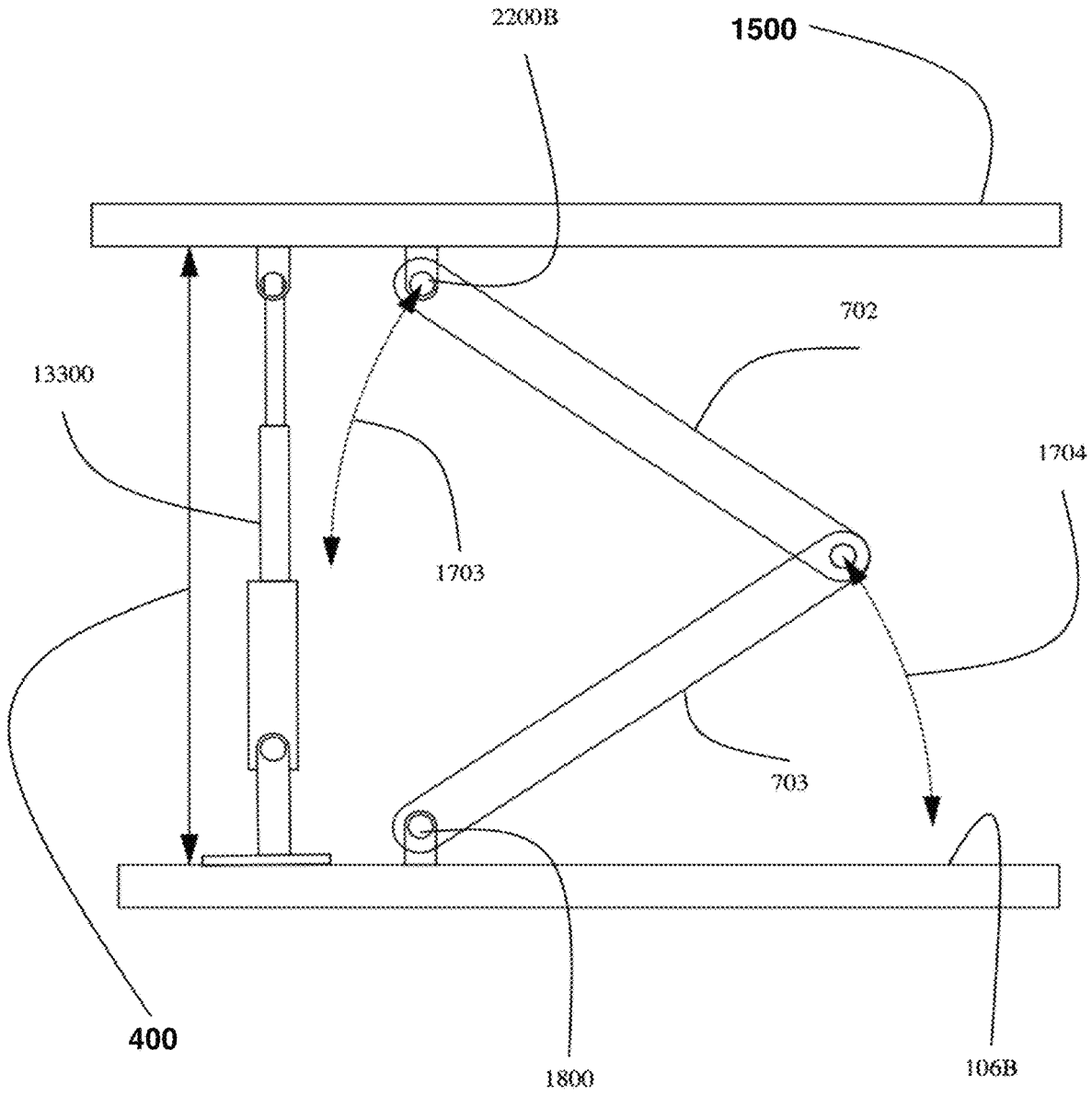

FIG. 133 illustrates an elevation view that shows a mechanical force device acting as the external force in raising and lowering the object platform system tethered by a primary parallel struts system, according to an example embodiment of the present disclosure.

Figure 134:
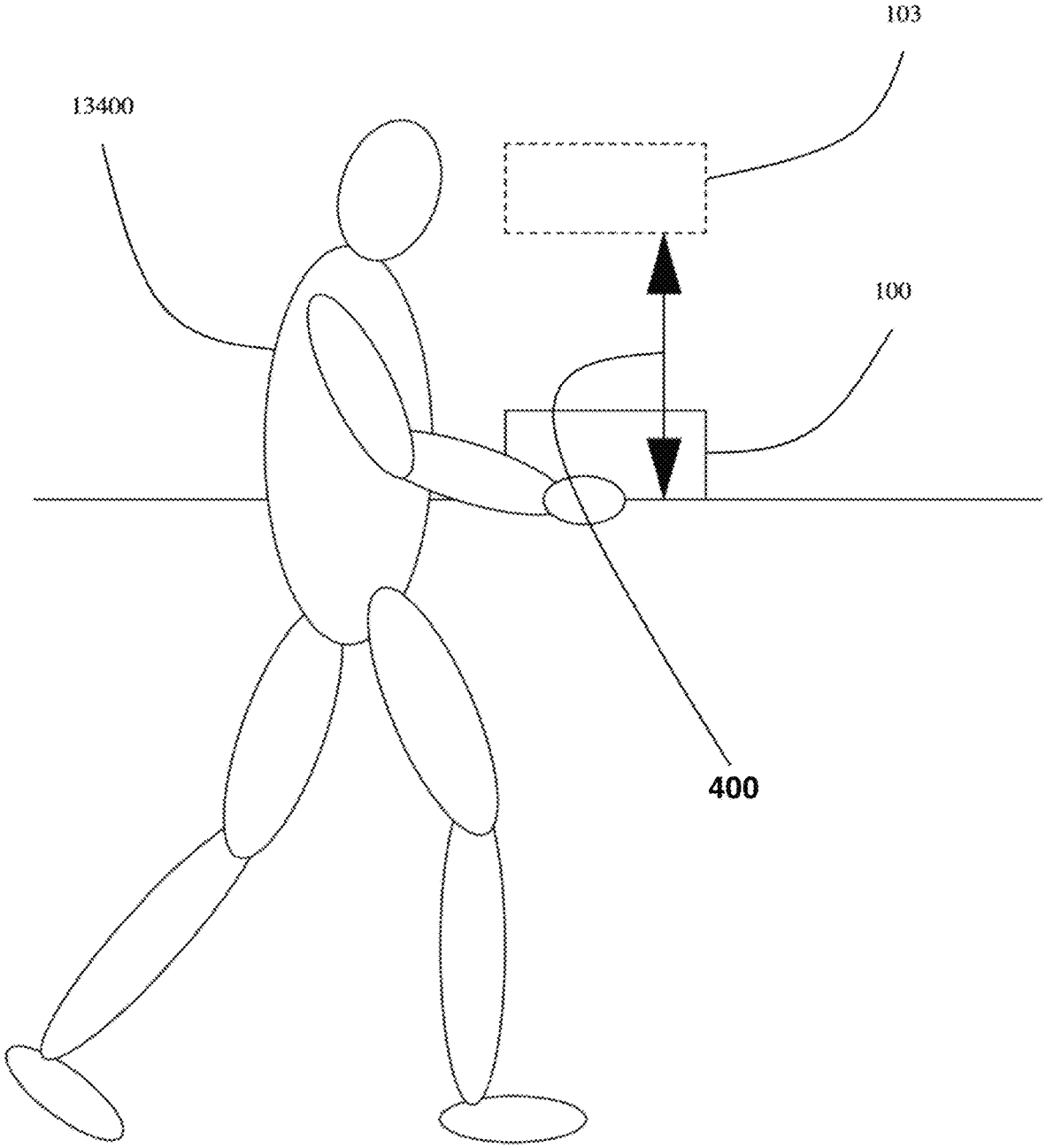

FIG. 134 illustrates an elevation view that shows a human force acting as the external force in raising and lowering the object, according to an example embodiment of the present disclosure.

Figure 135:
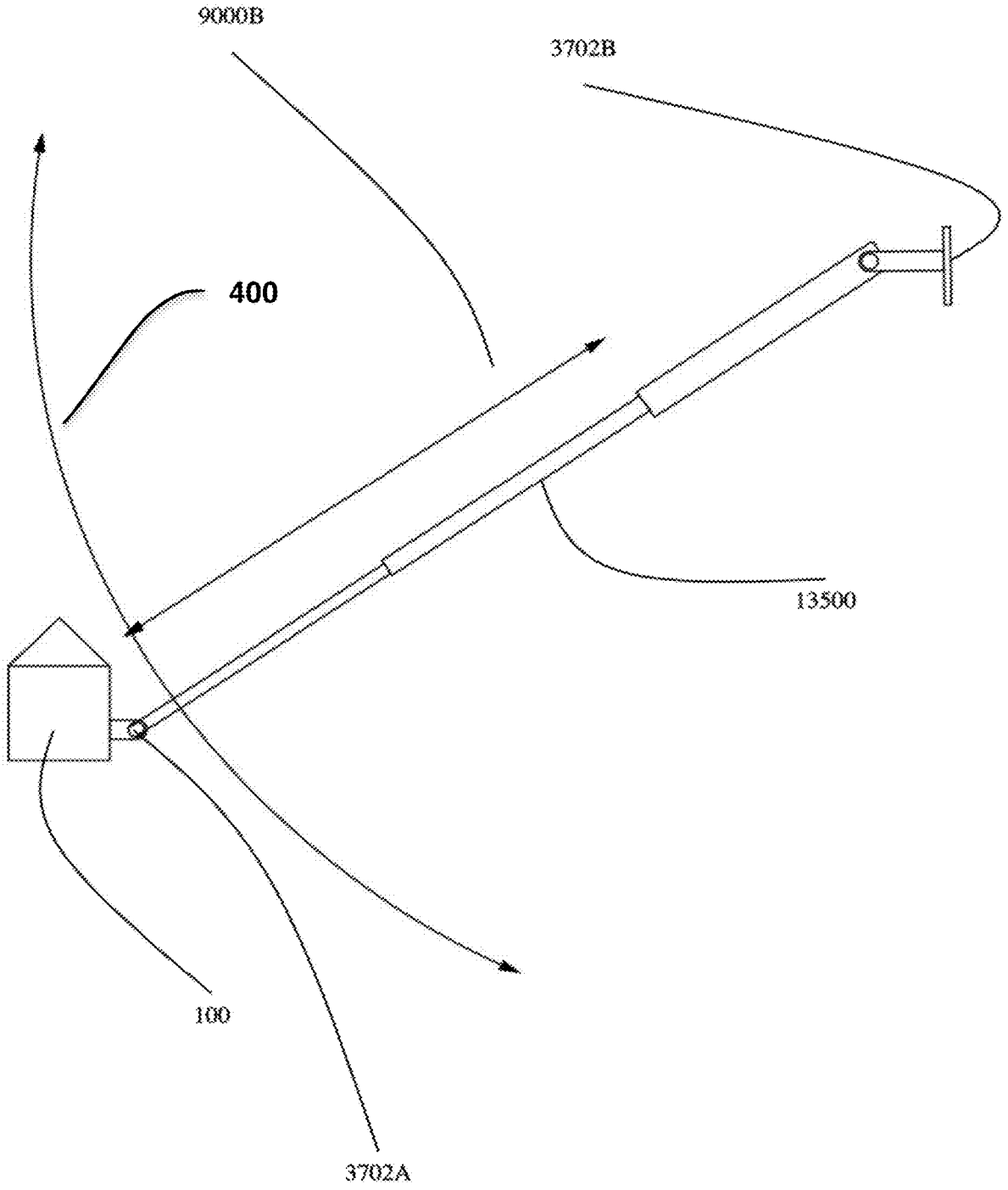

FIG. 135 illustrates an elevation view that shows a telescoping system of tethering an object while allowing vertical movement about an arc whose center is the stationary cleat and whose length is variable, according to an example embodiment of the present disclosure.

Figure 136:
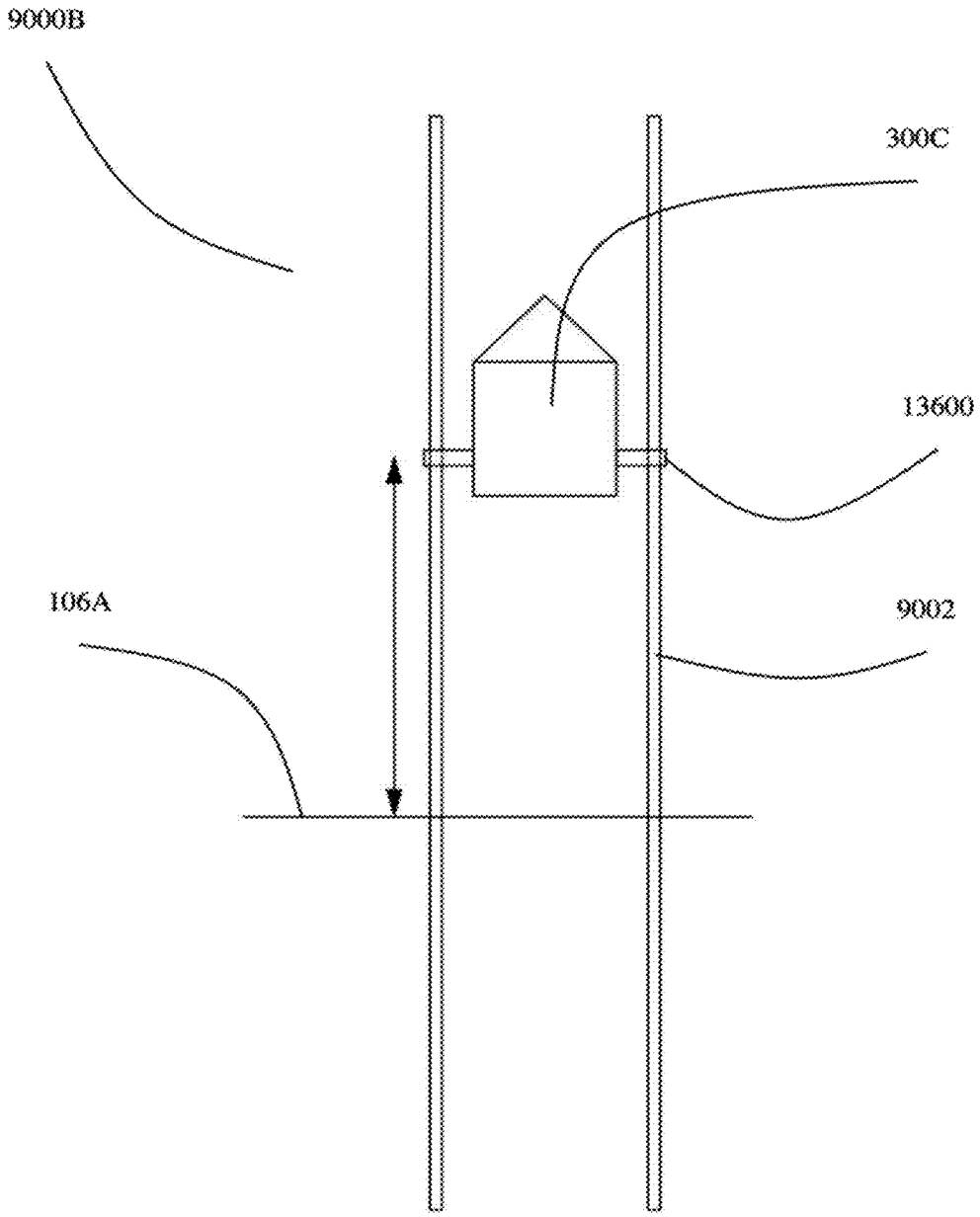

FIG. 136 illustrates an elevation view that shows a piling with sleeve device to tether an amphibious house using multiple driven pile units to guide sleeves or rollers attached to the object or house. This system allows vertical separation of the object platform system from the foundation system however, this system does not allow for the asymmetrical movement of a tilting object subjected to the tilting forces of high winds or wave action on the surface of rising water, according to an example embodiment of the present disclosure.

Figure 137:
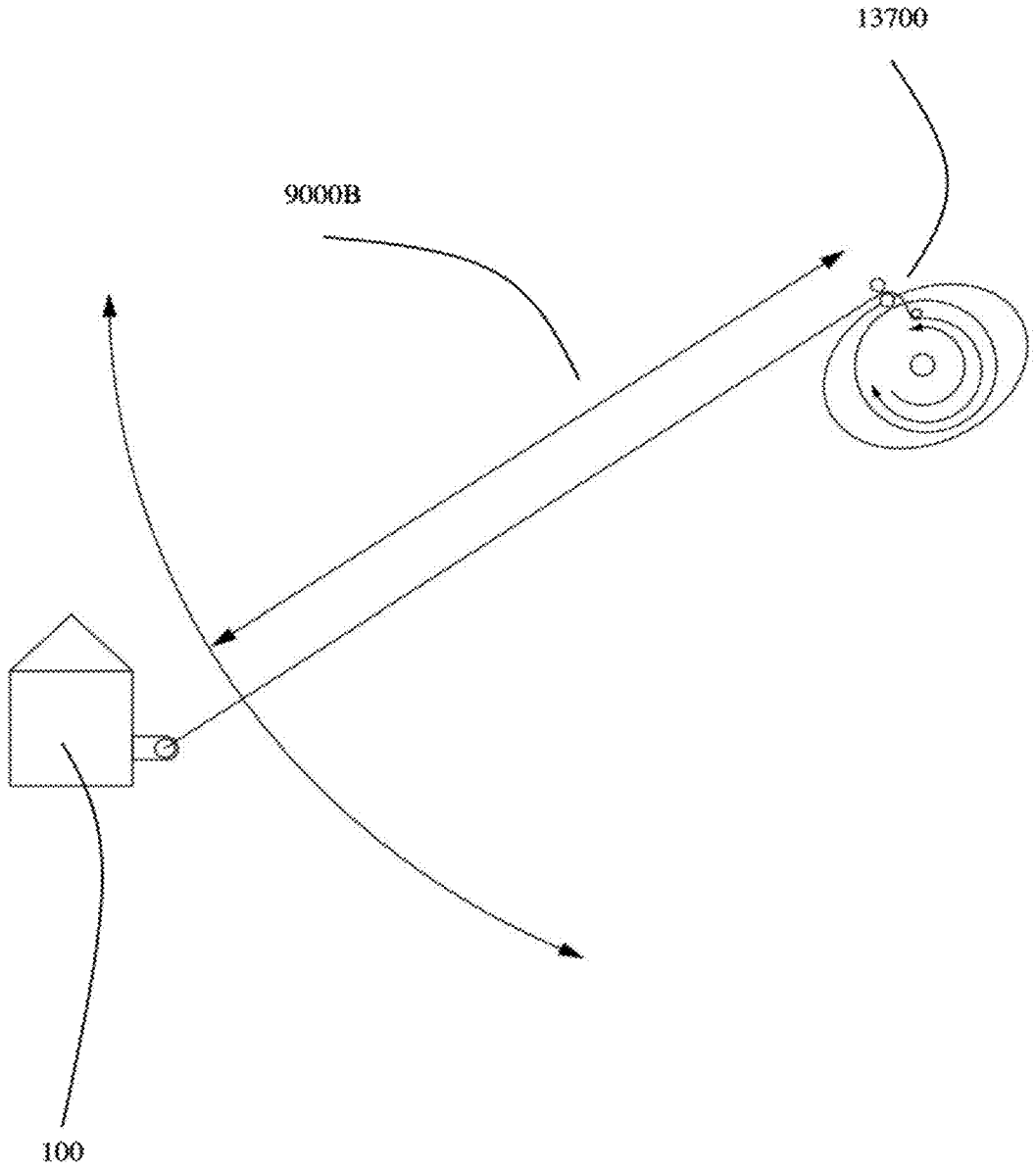

FIG. 137 illustrates an elevation view that shows a retractable tether system used to anchor an object while allowing an extendable length vertical movement about an arc whose center is the core of the retractable tether system device, according to an example embodiment of the present disclosure.

Figure 138:
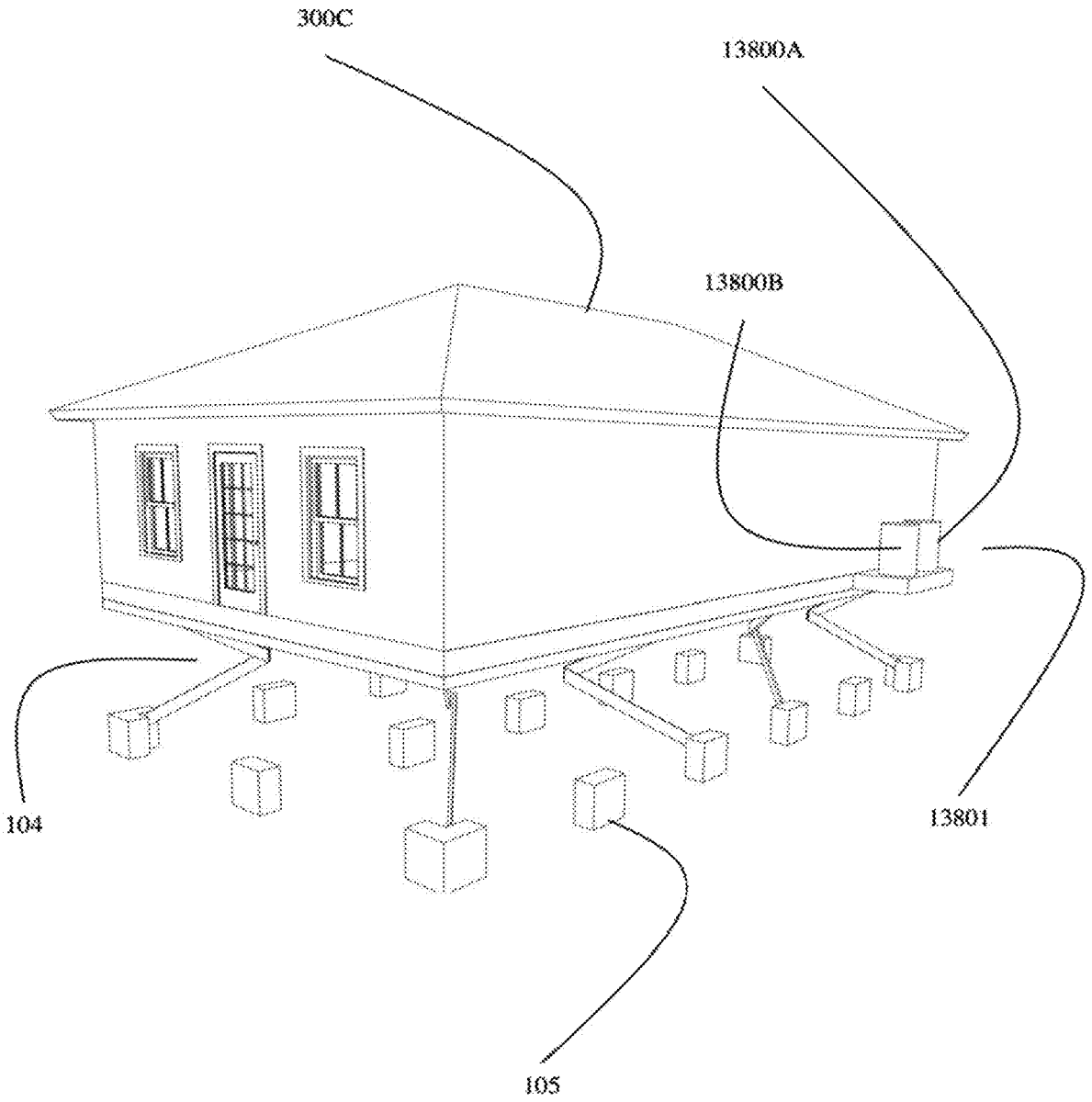

FIG. 138 illustrates a perspective view that shows the ice cream sandwich in a melted state, according to an example embodiment of the present disclosure.

Figure 139:
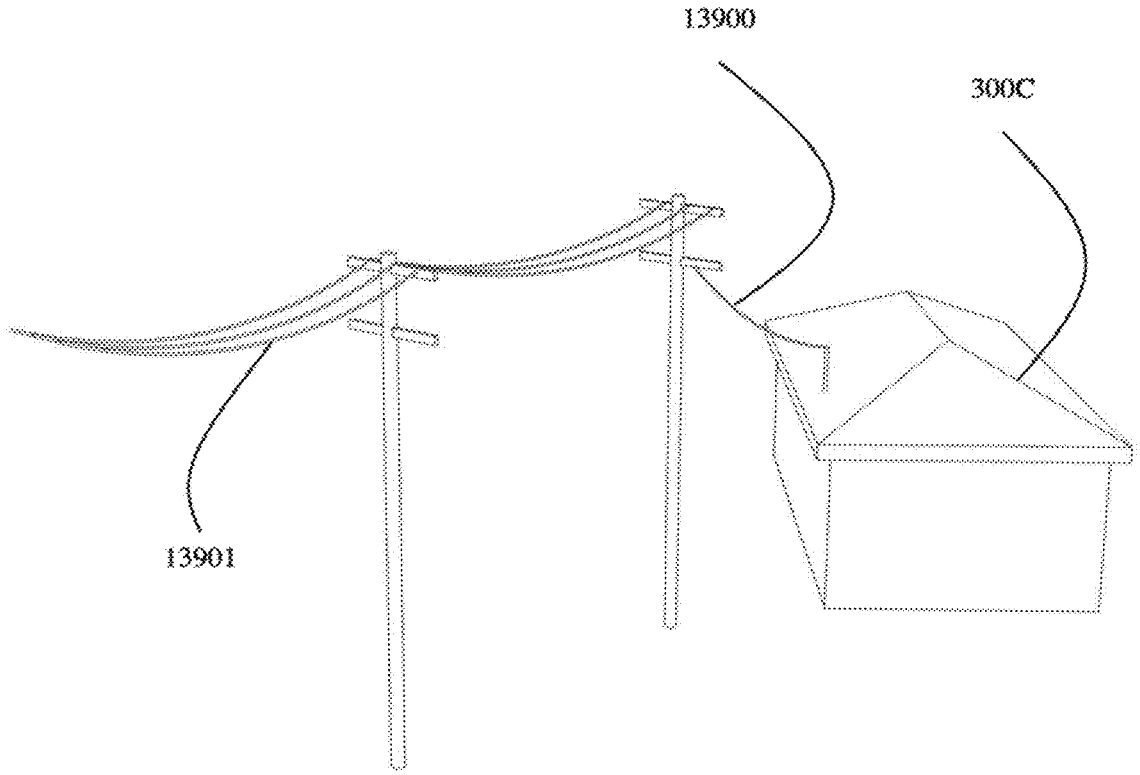

FIG. 139 illustrates a perspective view that shows the ice cream sandwich in a melted state, according to an example embodiment of the present disclosure.

Figure 140:
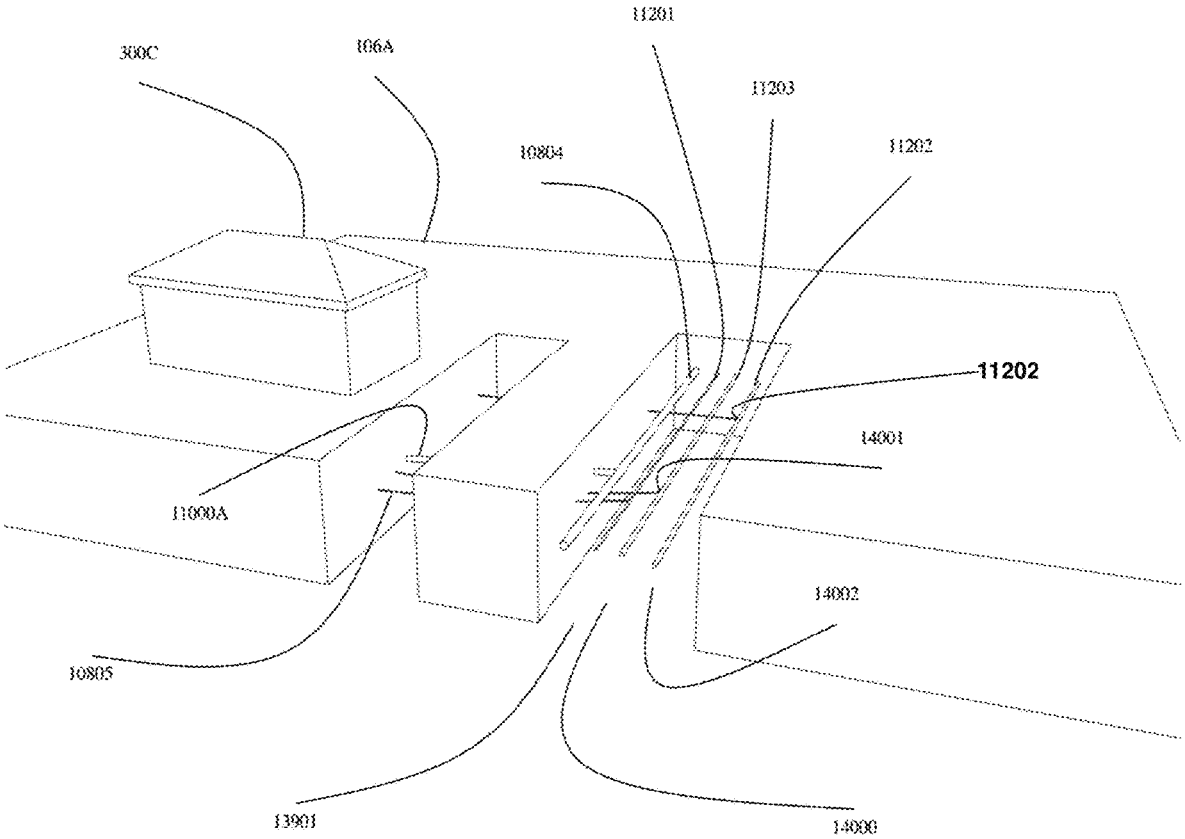

FIG. 140 illustrates a perspective view that shows a cutaway view showing underground service delivering utilities to a house. The utility service origination for delivery method is from off-site. The connections between the house and the linear conduits involve a hard connection to the rigid conduit pipes for potable water, gas, and sewer. The hard connection to the electrical service is a hard wired connection, according to an example embodiment of the present disclosure.

Figure 141:
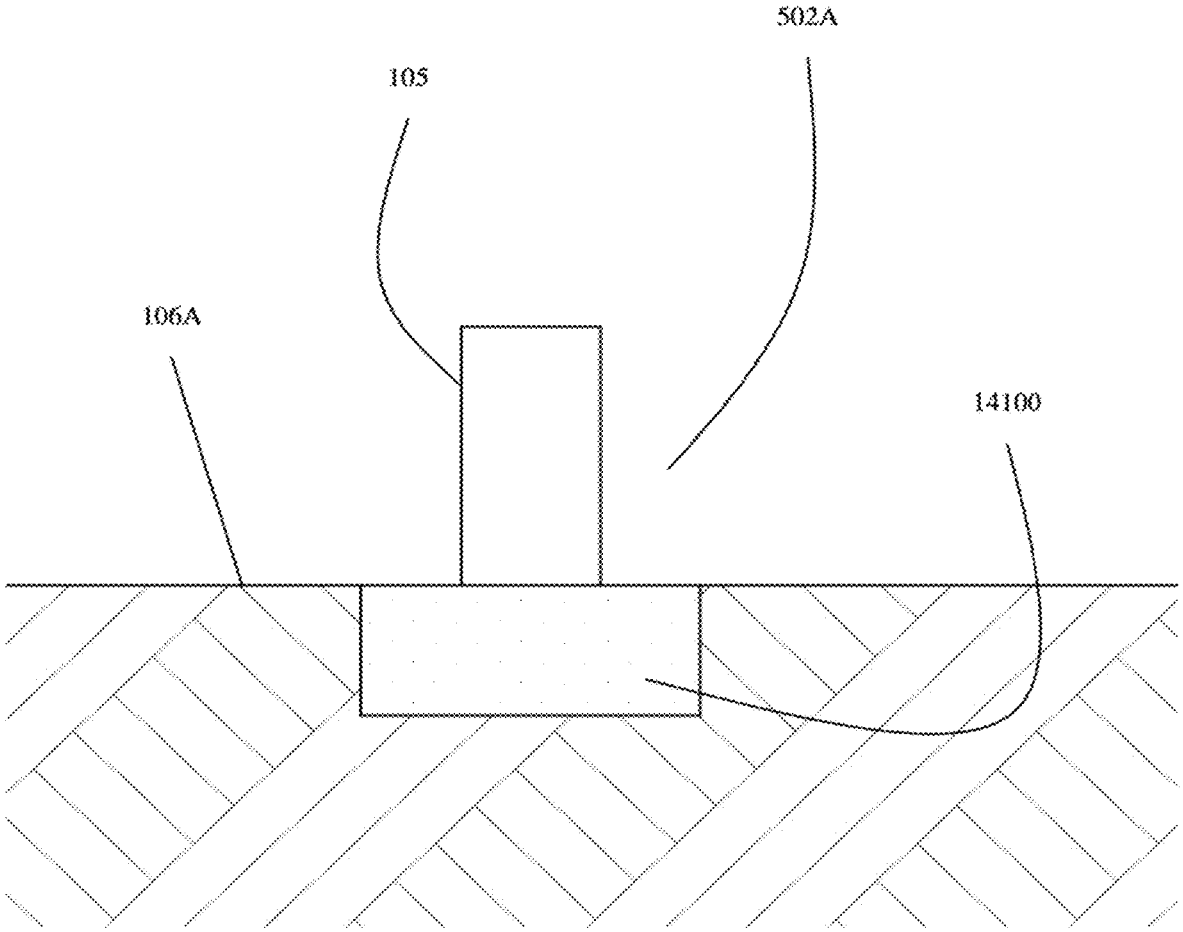

FIG. 141 illustrates a section view that shows a pier resting on top of a spot footing that widens for area footprint on the soil to increase the weight capacity that each pier can safely support on grade without undesirable settlement or failure, according to an example embodiment of the present disclosure.

Figure 142:
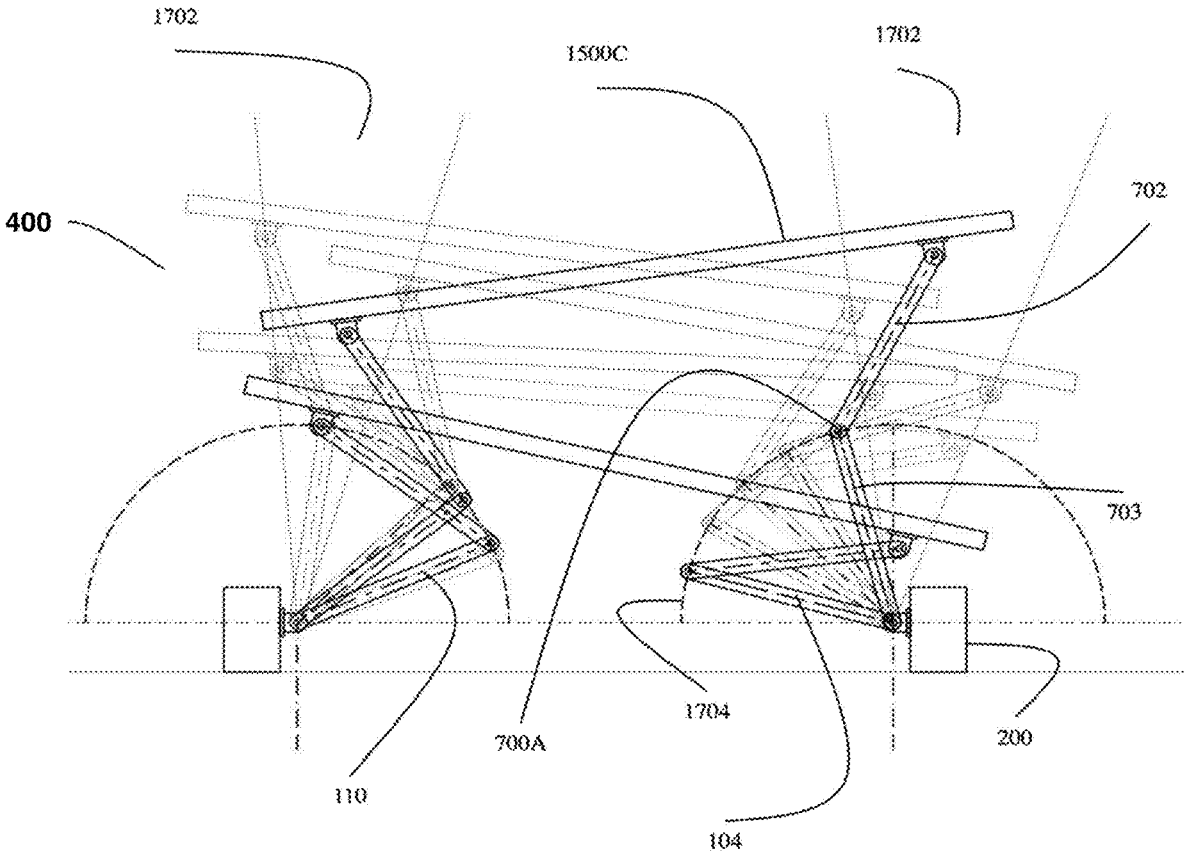

FIG. 142 illustrates an Elevation view that shows multiple possible asymmetrical platform anchor positions with two opposing folding strut assemblies that have their lower struts anchored to the foundation and their upper struts anchored to a platform, according to an example embodiment of the present disclosure.

Figure 143:
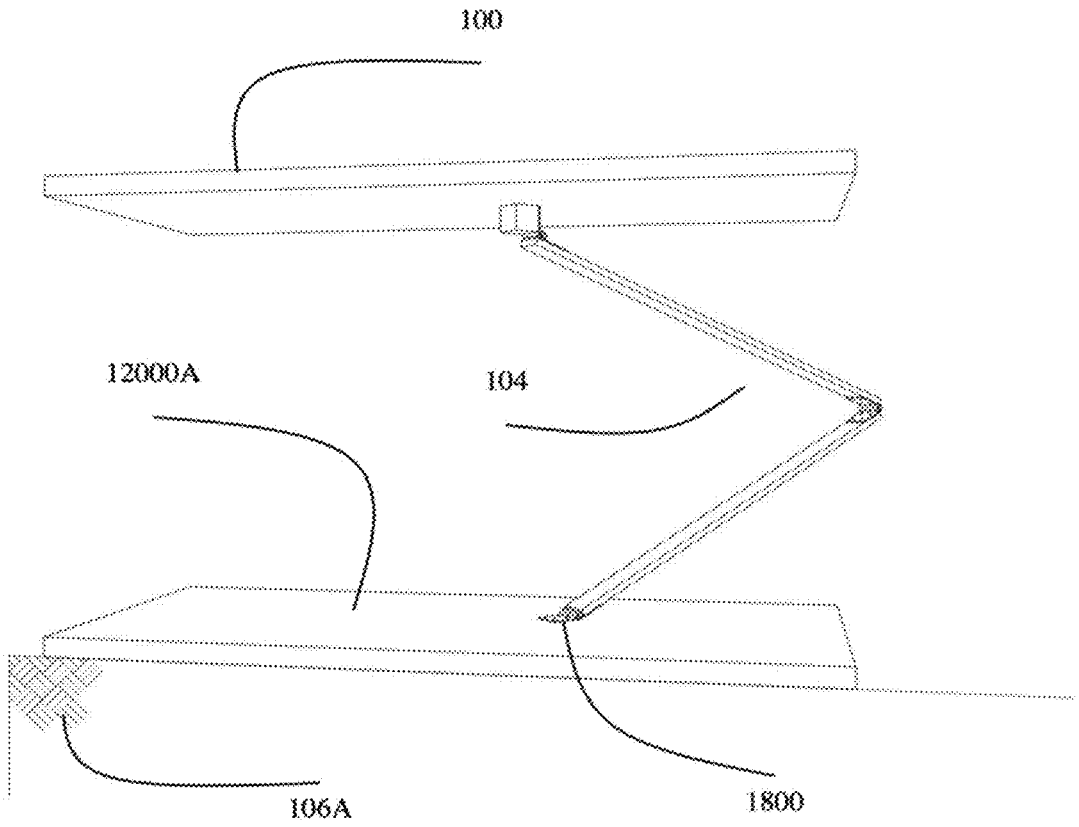

FIG. 143 illustrates a perspective view that shows a primary parallel struts system anchored directly to a slab foundation, according to an example embodiment of the present disclosure.

Figure 144:
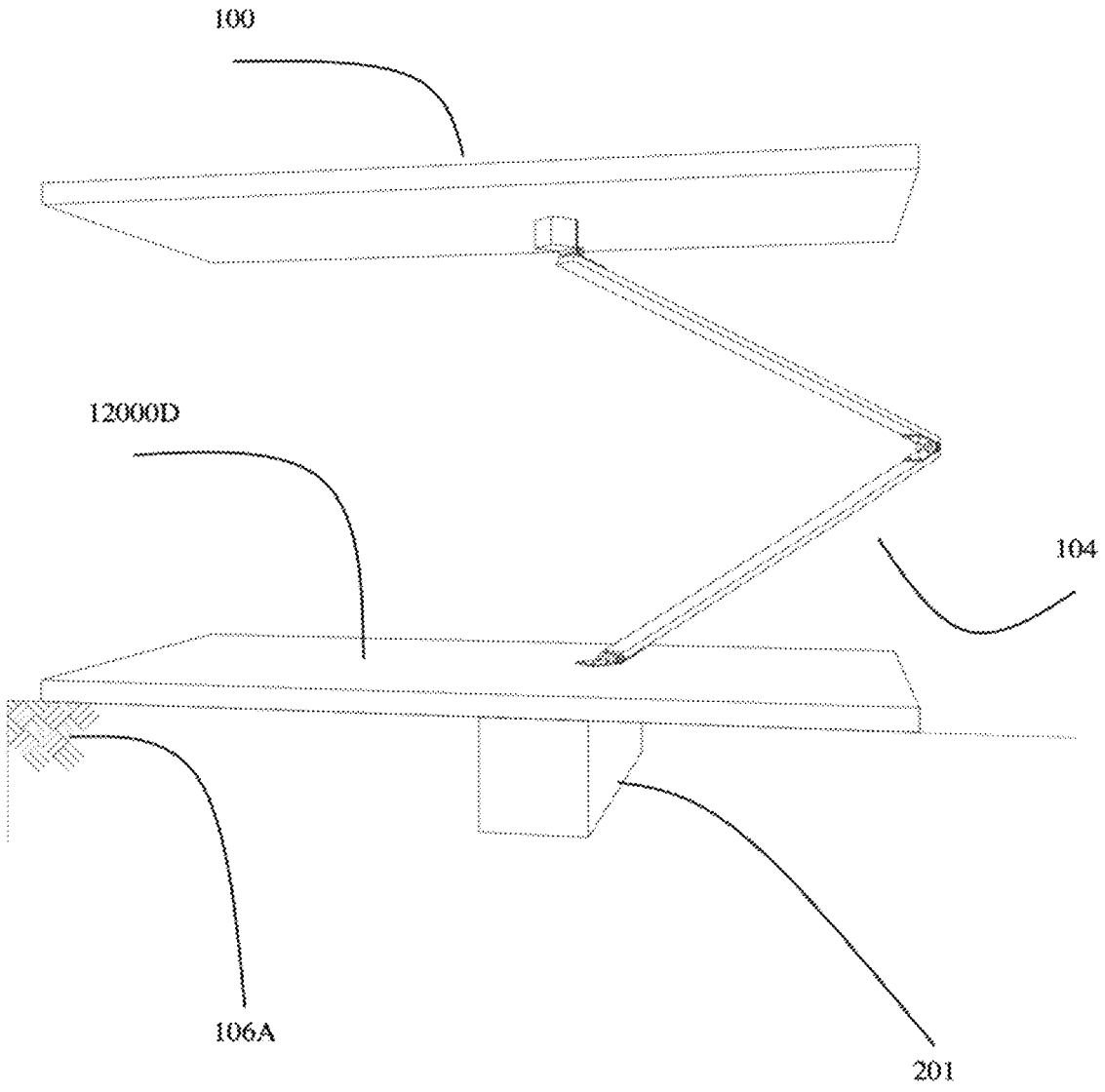

FIG. 144 illustrates a perspective view that shows a primary parallel struts system anchored directly to a slab foundation that is attached to a grade beam that is anchored to grade, according to an example embodiment of the present disclosure.

Figure 145:
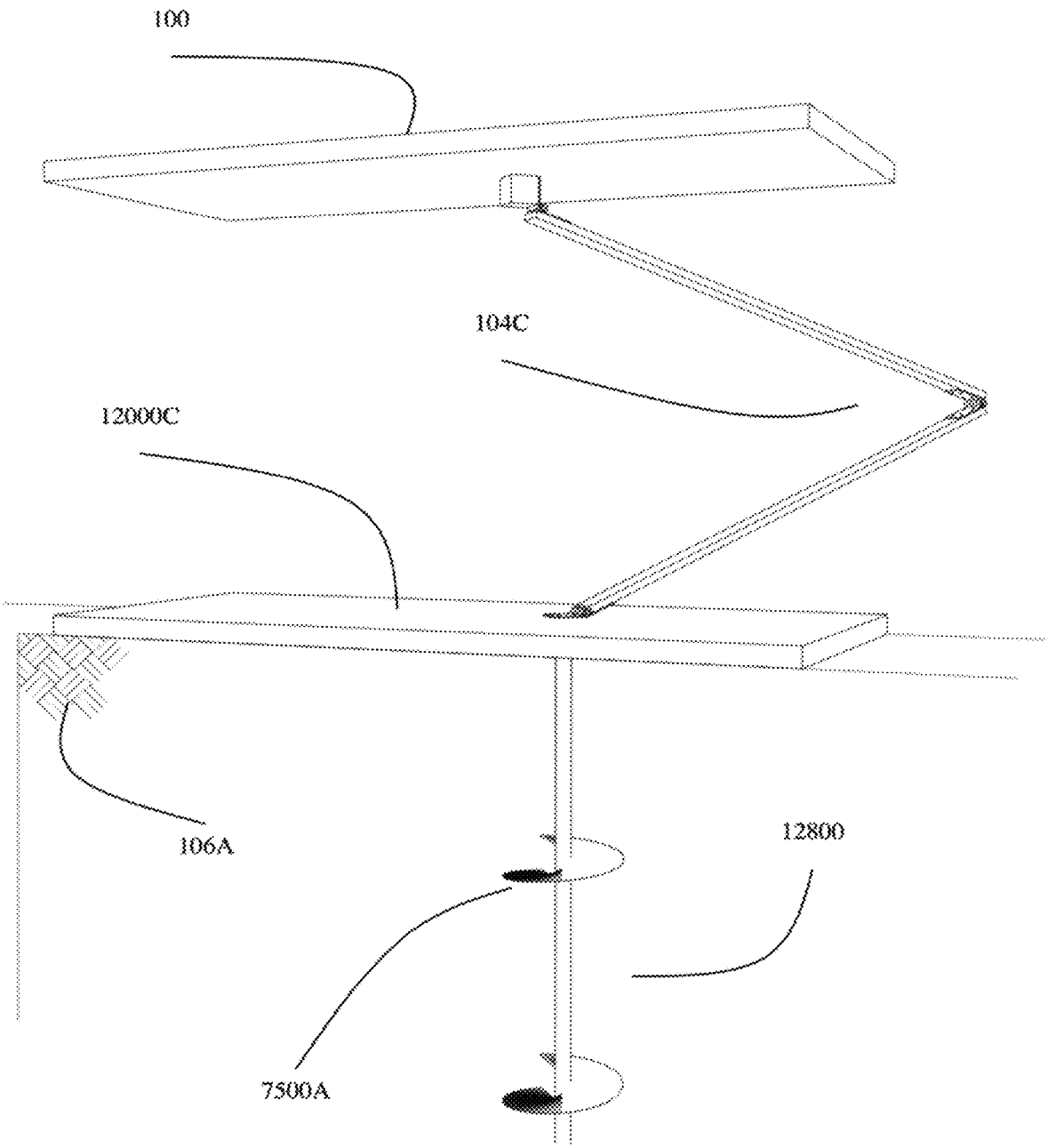

FIG. 145 illustrates a perspective view that shows an object tethered to the foundation system by a primary parallel struts system that is anchored to a slab foundation that is supported and anchored to grade by a shaft system, according to an example embodiment of the present disclosure.

Figure 146:
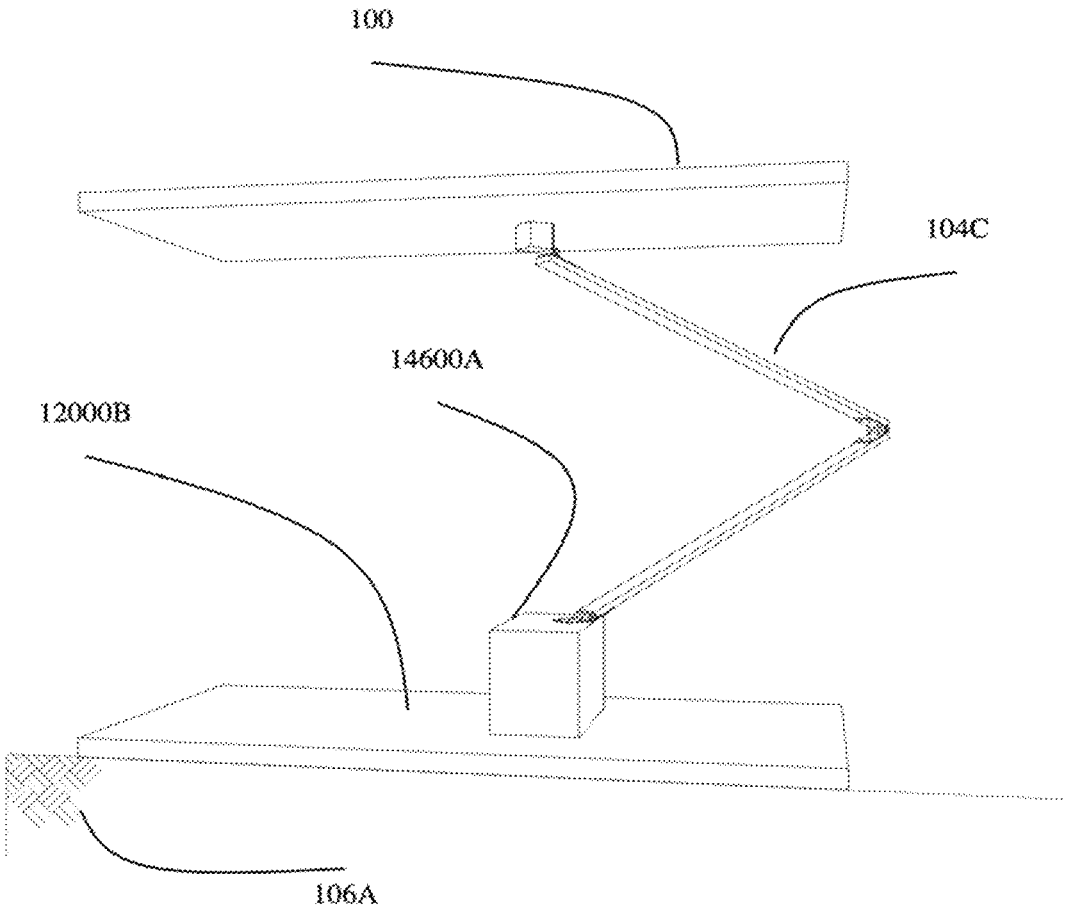

FIG. 146 illustrates a perspective view that shows an object tethered to the foundation system by a primary parallel struts system that is anchored to a pier on slab foundation that is supported by and anchored to grade, according to an example embodiment of the present disclosure.

Figure 147:
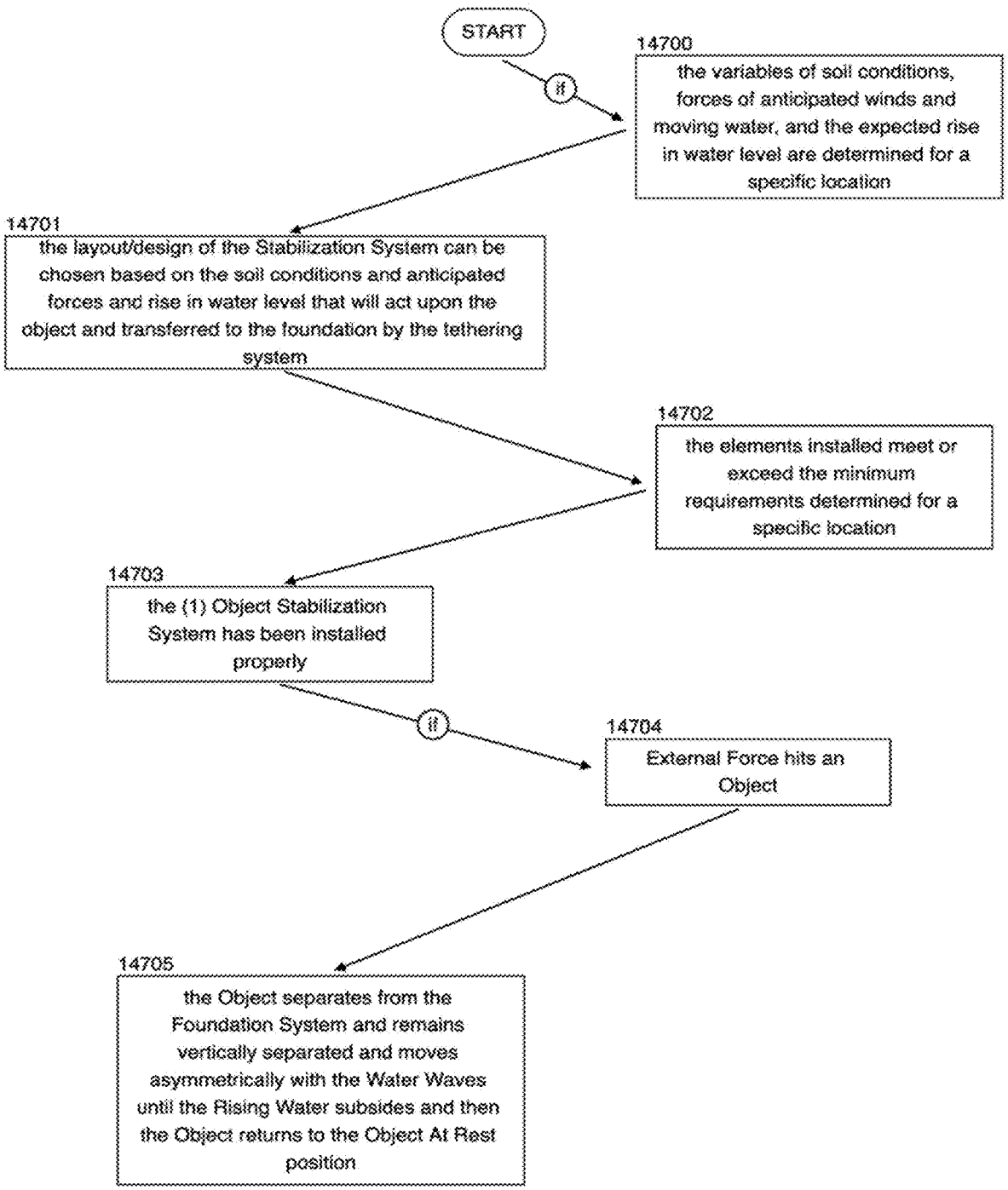

FIG. 147 is a method diagram which describes the flood hinge system according to an example embodiment of the present disclosure.

Figure 148:
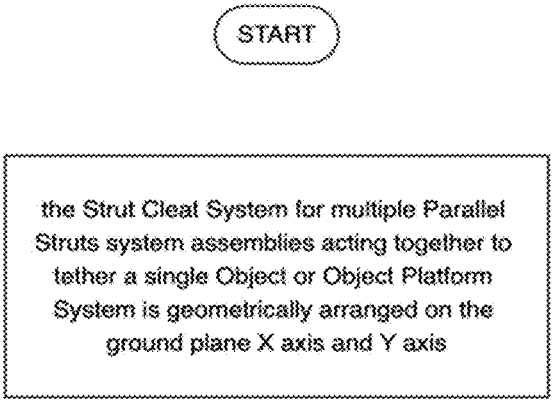

FIG. 148 is a method diagram which describes the layout system according to an example embodiment of the present disclosure.

Figure 149:
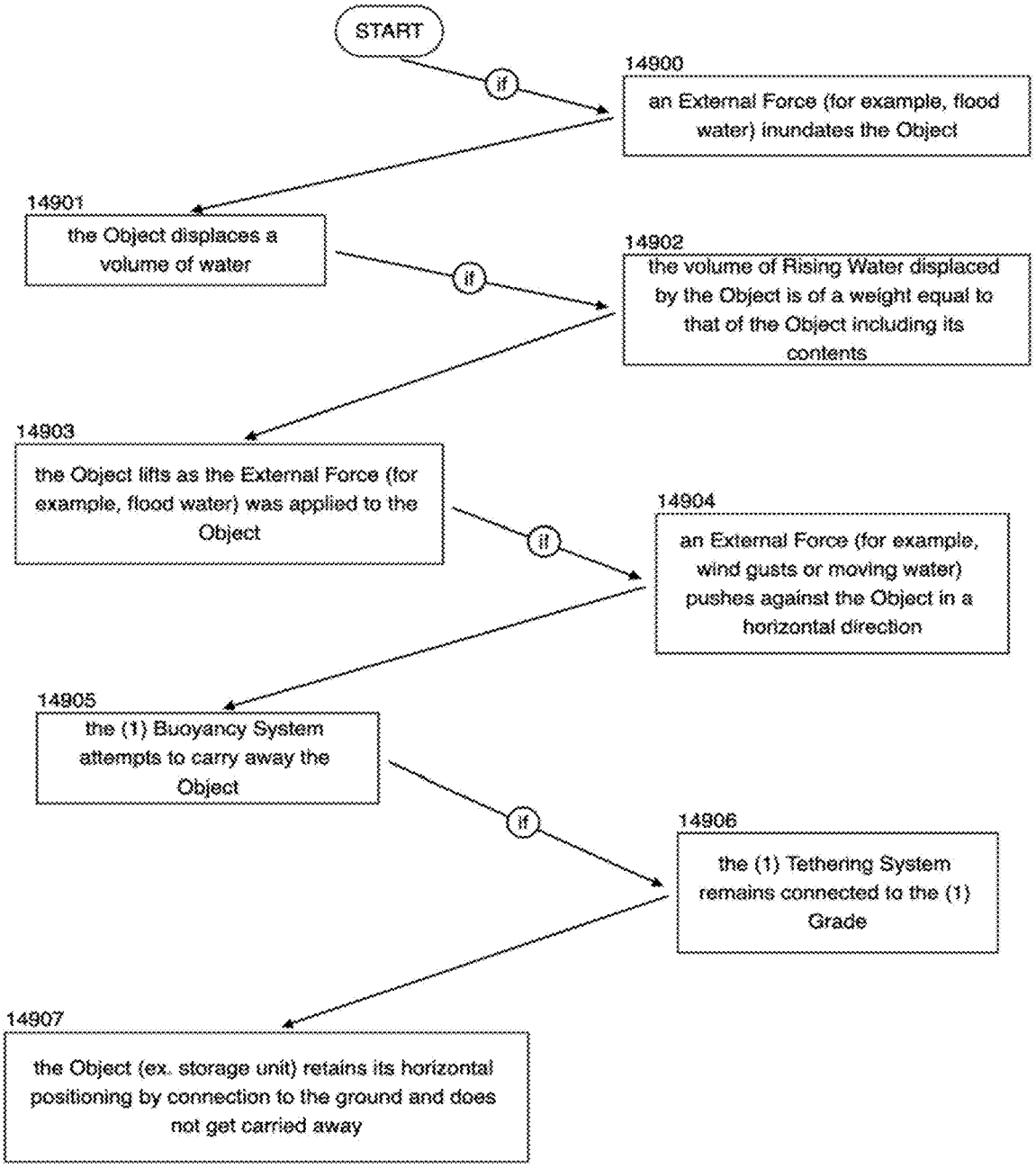

FIG. 149 is a method diagram which describes the stabilization system according to an example embodiment of the present disclosure.

Figure 150:
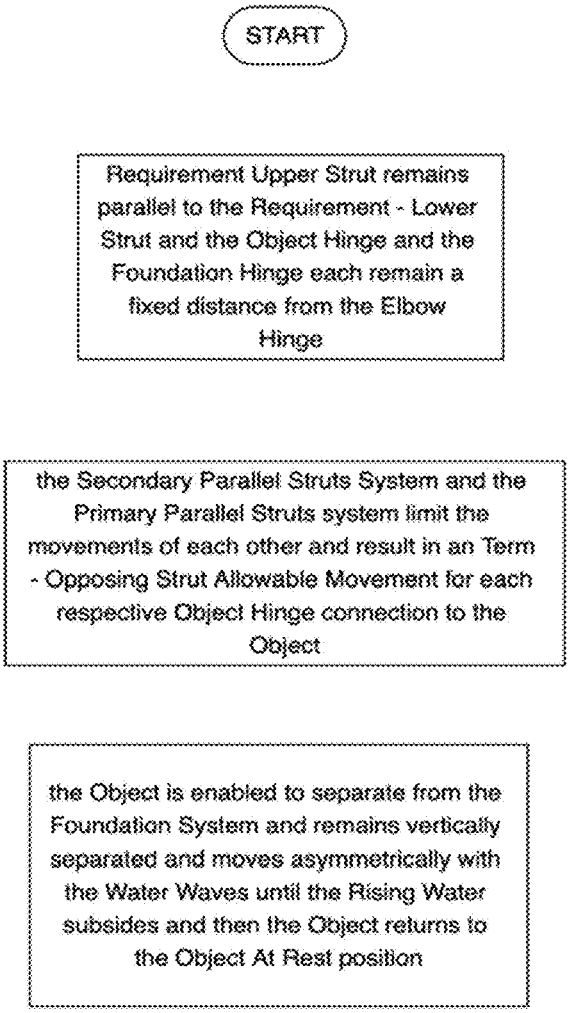

FIG. 150 is a method diagram which describes the tethering system according to an example embodiment of the present disclosure.

Figure 151:
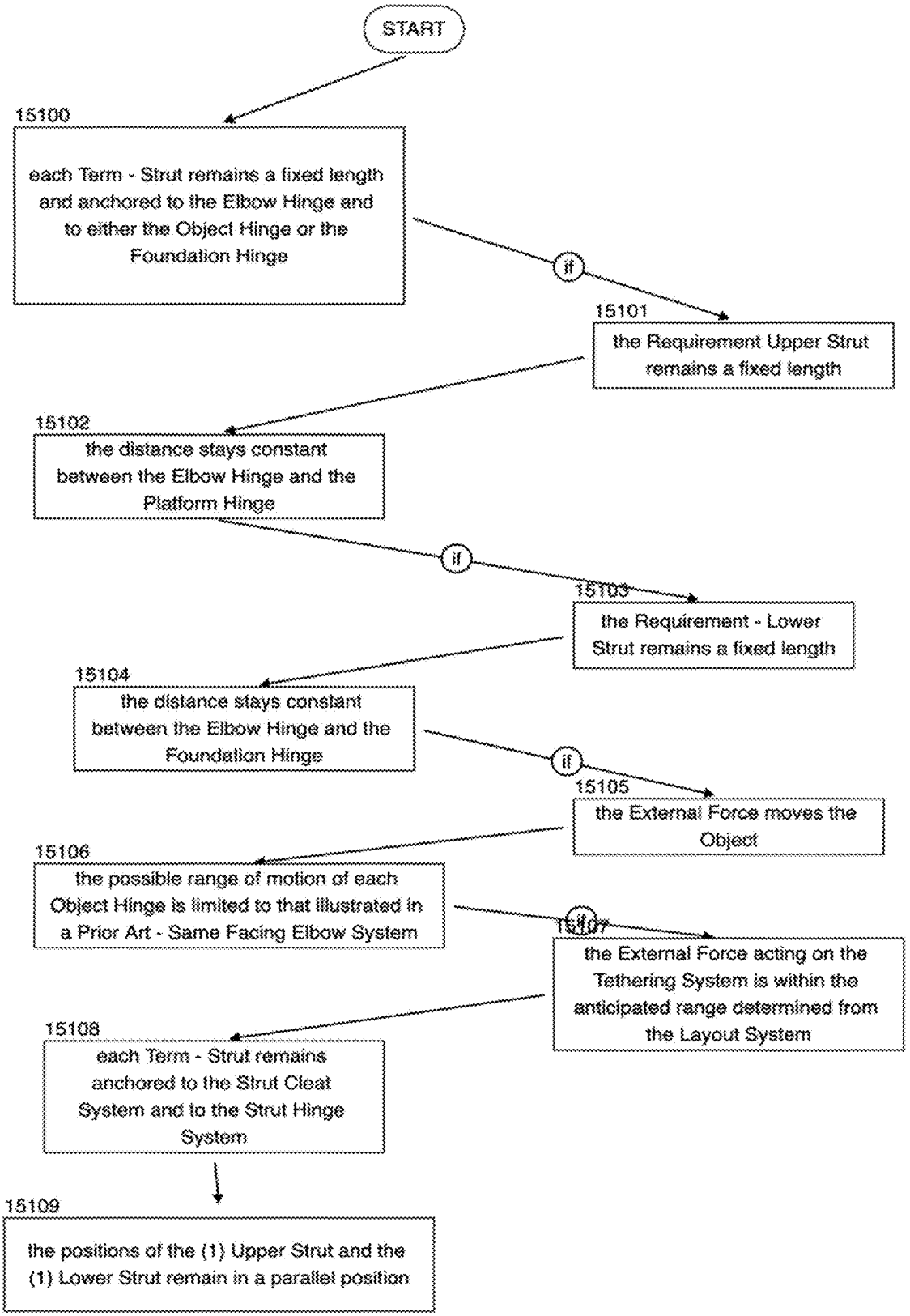

FIG. 151 is a method diagram which describes the primary parallel struts system according to an example embodiment of the present disclosure.

Figure 152:
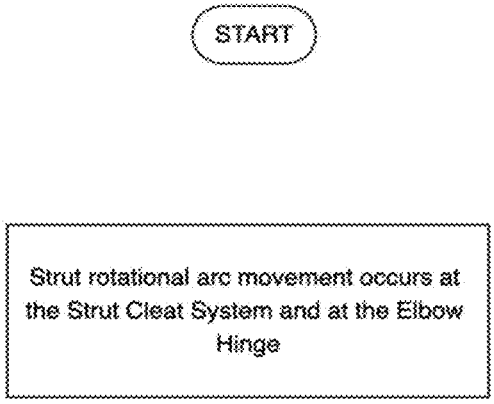

FIG. 152 is a method diagram which describes the strut attachment system according to an example embodiment of the present disclosure.

Figure 153:
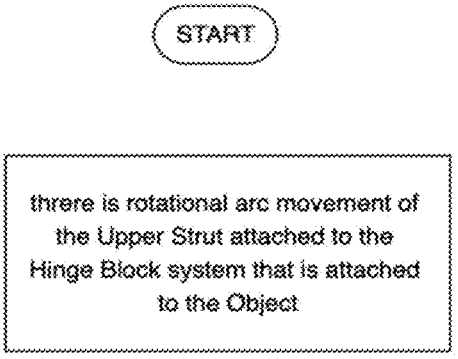

FIG. 153 is a method diagram which describes the strut hinge system according to an example embodiment of the present disclosure.

Figure 154:
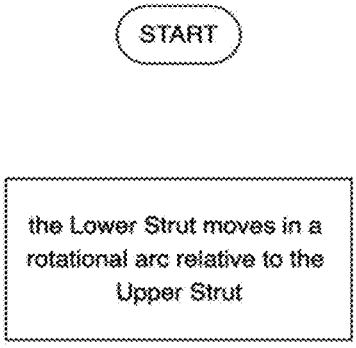

FIG. 154 is a method diagram which describes the strut hinge system according to an example embodiment of the present disclosure.

Figure 155:
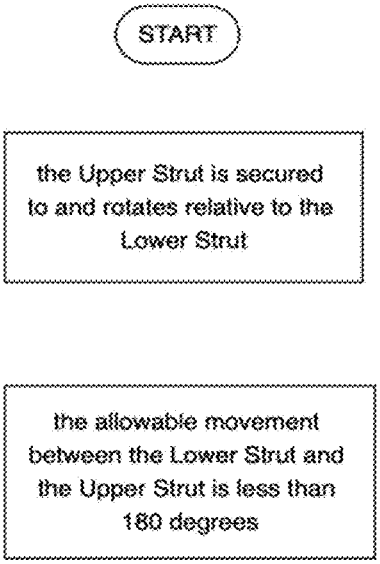

FIG. 155 is a method diagram which describes the elbow hinge according to an example embodiment of the present disclosure.

Figure 156:
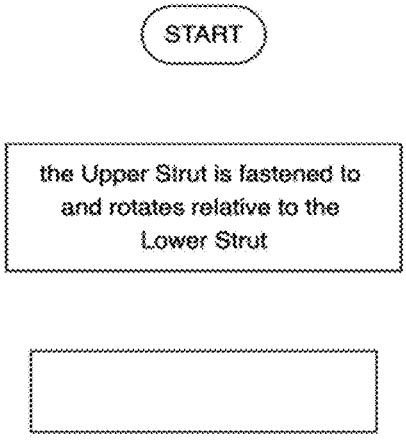

FIG. 156 is a method diagram which describes the elbow hinge according to an example embodiment of the present disclosure.

Figure 157:
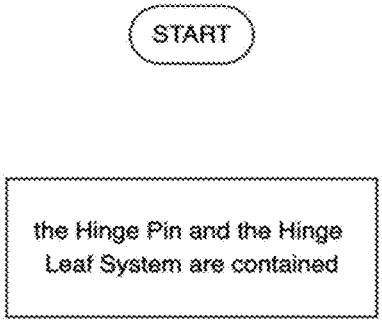

FIG. 157 is a method diagram which describes the strut hinge system according to an example embodiment of the present disclosure.

Figure 158:
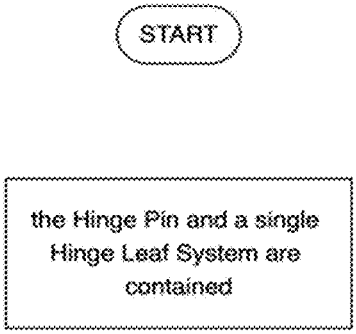

FIG. 158 is a method diagram which describes the hinge block system according to an example embodiment of the present disclosure.

Figure 159:
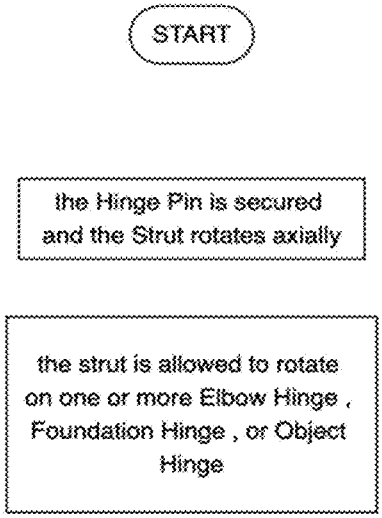

FIG. 159 is a method diagram which describes the single hinge system according to an example embodiment of the present disclosure.

Figure 160:
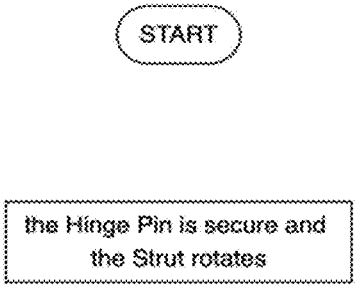

FIG. 160 is a method diagram which describes the hinge leaf system according to an example embodiment of the present disclosure.

Figure 161:
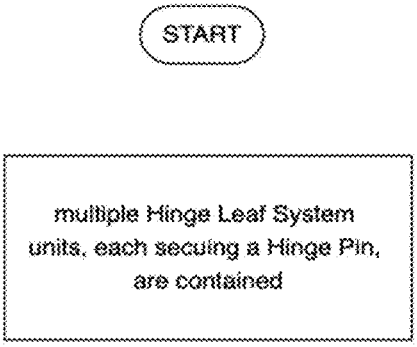

FIG. 161 is a method diagram which describes the hinge block system according to an example embodiment of the present disclosure.

Figure 162:
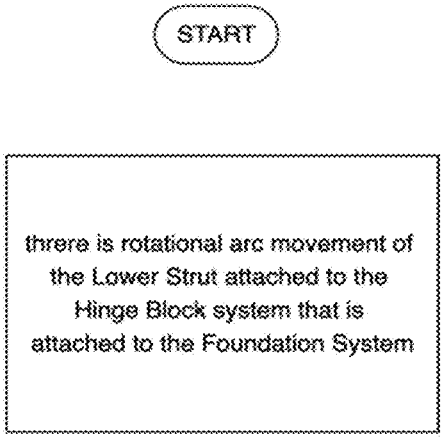

FIG. 162 is a method diagram which describes the strut hinge system according to an example embodiment of the present disclosure.

Figure 163:
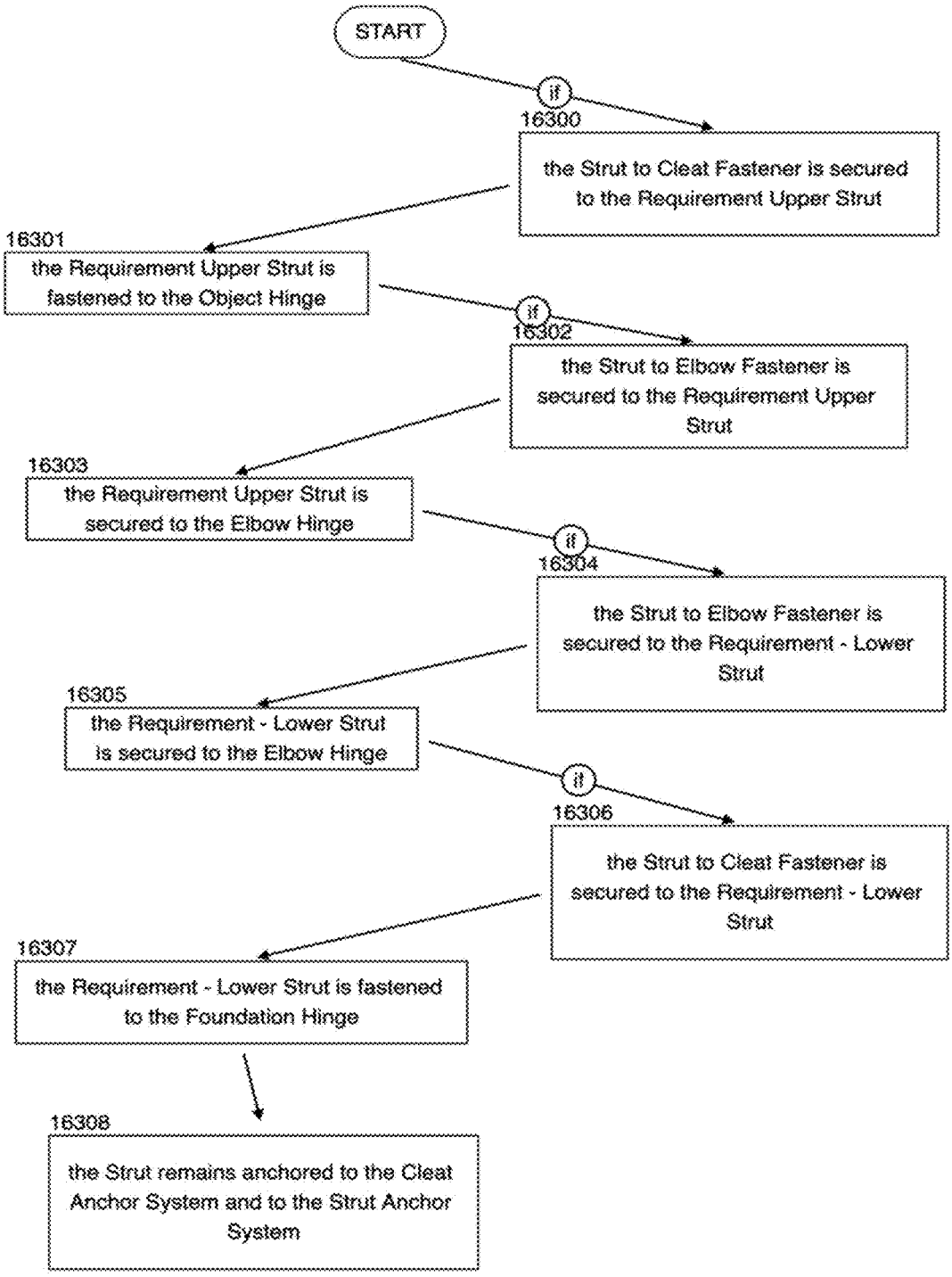

FIG. 163 is a method diagram which describes the strut attachment system according to an example embodiment of the present disclosure.

Figure 164:
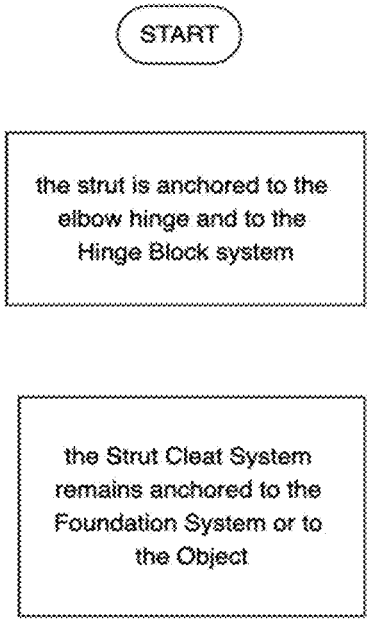

FIG. 164 is a method diagram which describes the strut cleat system according to an example embodiment of the present disclosure.

Figure 165:
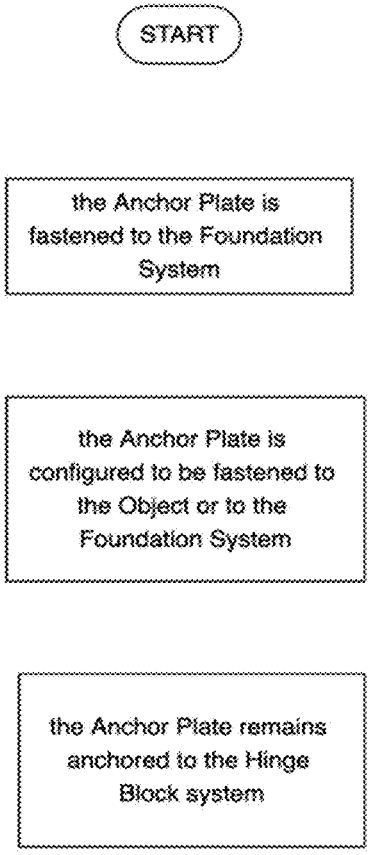

FIG. 165 is a method diagram which describes the cleat anchor system according to an example embodiment of the present disclosure.

Figure 166:
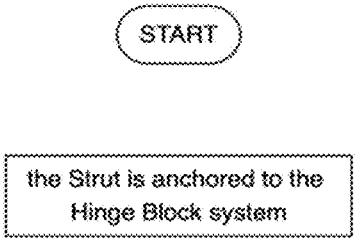

FIG. 166 is a method diagram which describes the strut anchor system according to an example embodiment of the present disclosure.

Figure 167:
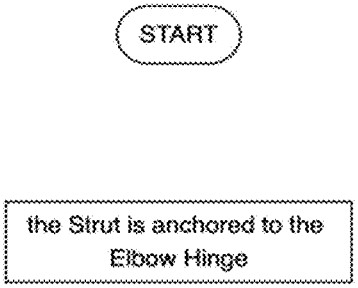

FIG. 167 is a method diagram which describes the strut anchor system according to an example embodiment of the present disclosure.

Figure 168:
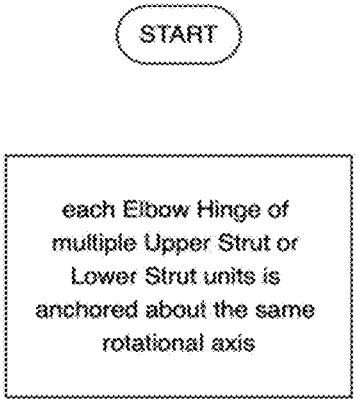

FIG. 168 is a method diagram which describes the primary parallel struts system according to an example embodiment of the present disclosure.

Figure 169:
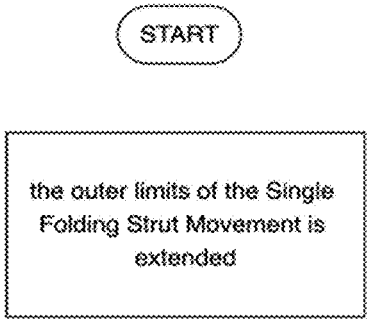

FIG. 169 is a method diagram which describes the primary parallel struts system according to an example embodiment of the present disclosure.

Figure 170:
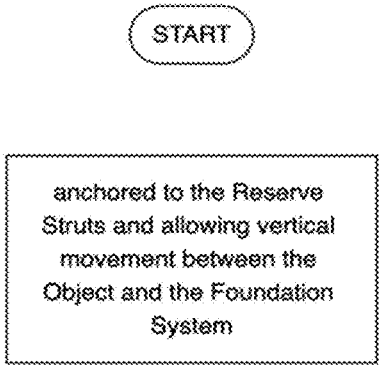

FIG. 170 is a method diagram which describes the stacked struts according to an example embodiment of the present disclosure.

Figure 171:
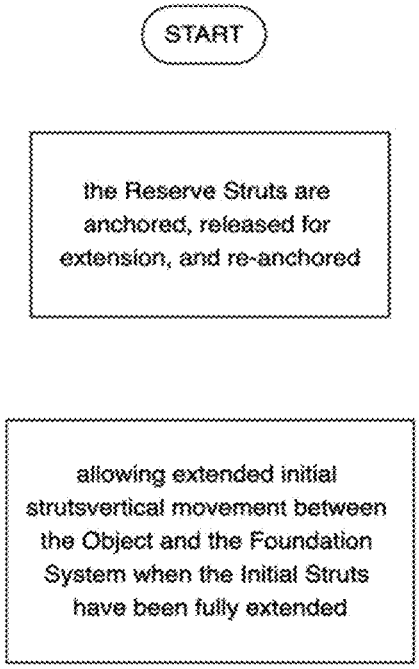

FIG. 171 is a method diagram which describes the stacked struts according to an example embodiment of the present disclosure.

Figure 172:
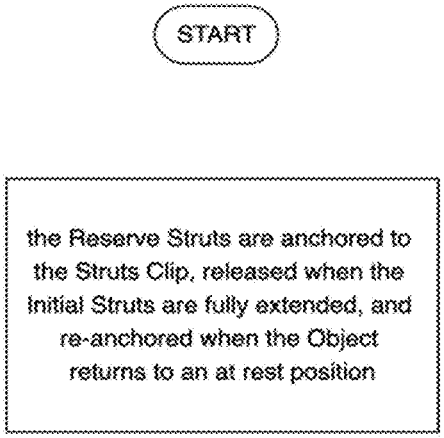

FIG. 172 is a method diagram which describes the clipping system according to an example embodiment of the present disclosure.

Figure 173:
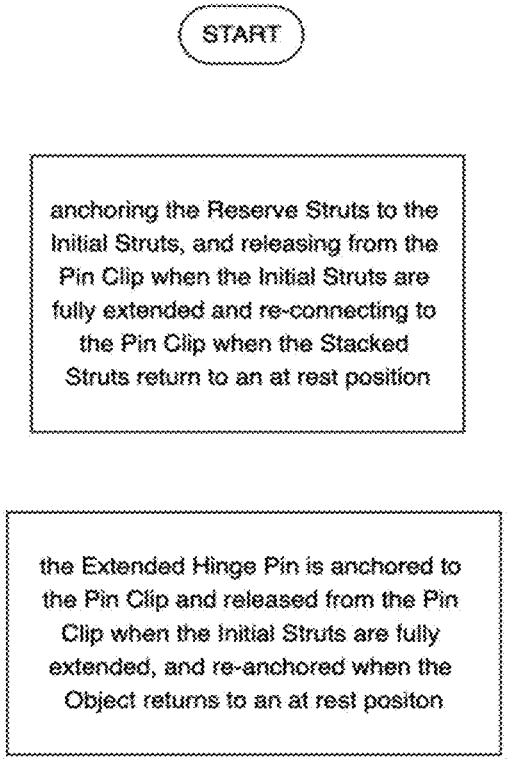

FIG. 173 is a method diagram which describes the clipping system according to an example embodiment of the present disclosure.

Figure 174:
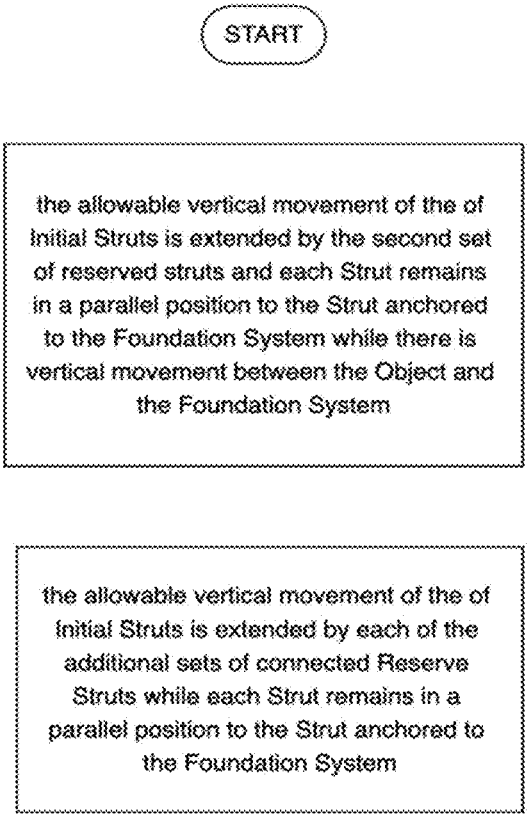

FIG. 174 is a method diagram which describes the stacked struts according to an example embodiment of the present disclosure.

Figure 175:
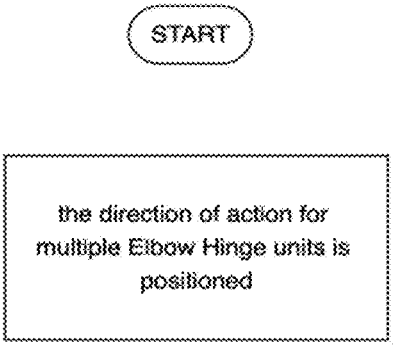

FIG. 175 is a method diagram which describes the primary parallel struts system according to an example embodiment of the present disclosure.

Figure 176:
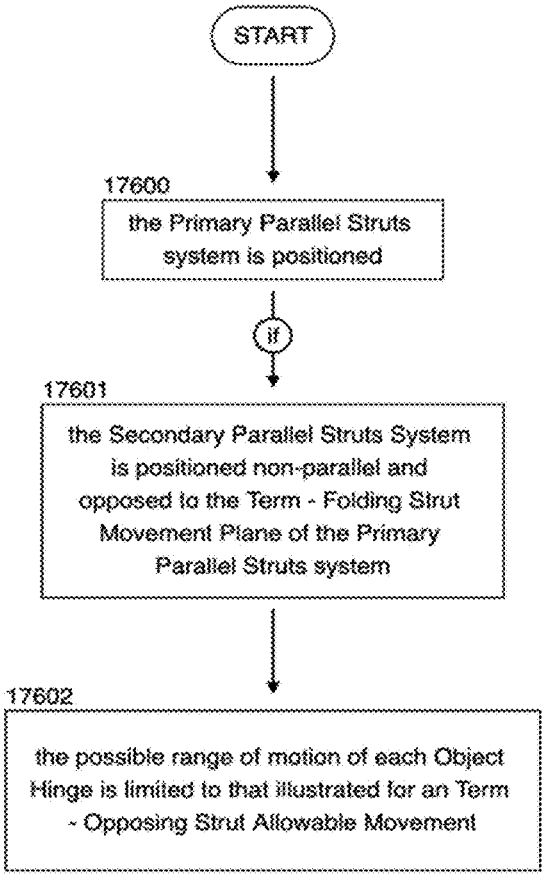

FIG. 176 is a method diagram which describes the secondary parallel struts system according to an example embodiment of the present disclosure.

Figure 177:
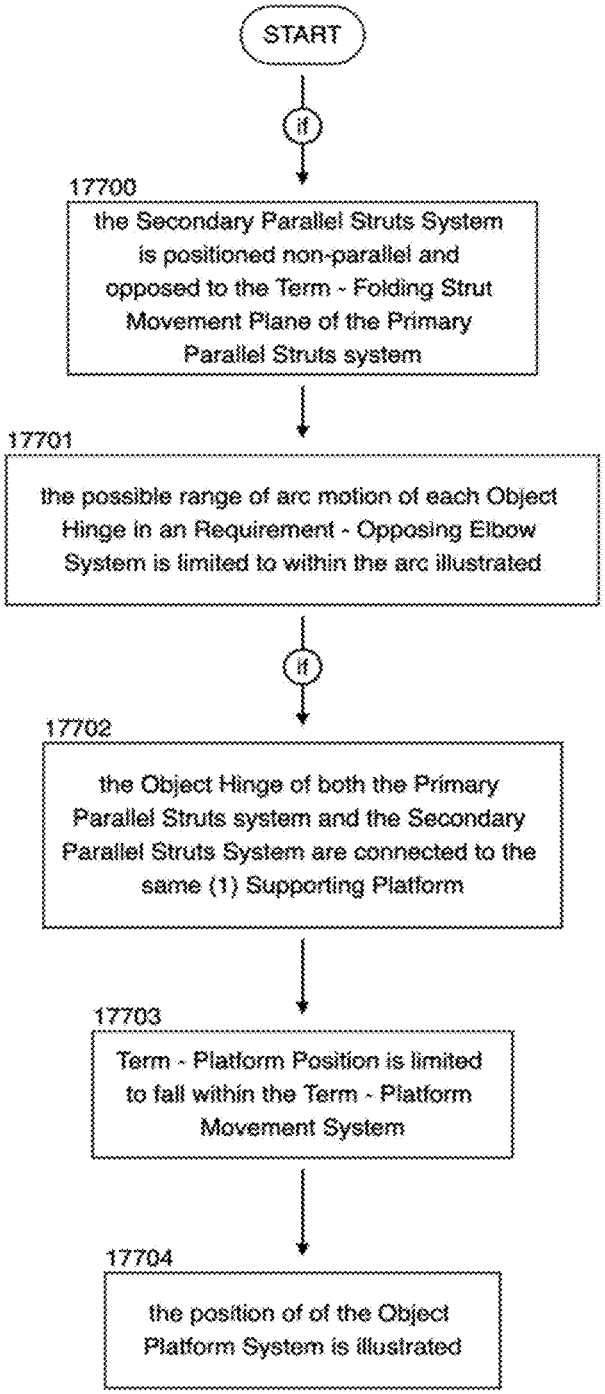

FIG. 177 is a method diagram which describes the platform movement system according to an example embodiment of the present disclosure.

Figure 178:
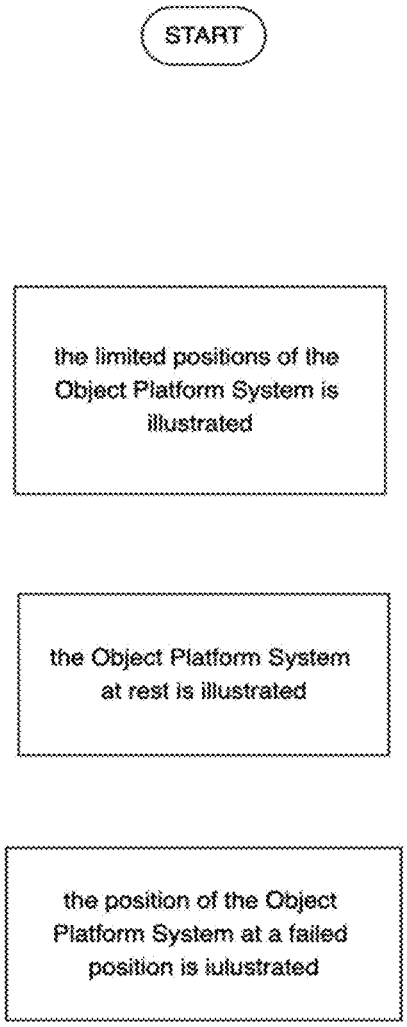

FIG. 178 is a method diagram which describes the platform position according to an example embodiment of the present disclosure.

Figure 179:
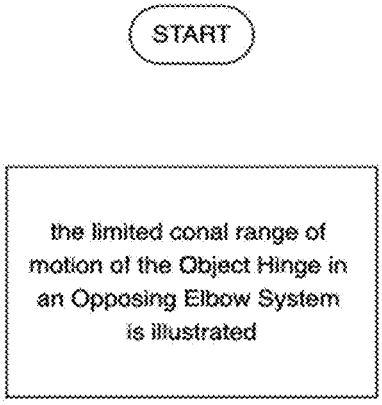

FIG. 179 is a method diagram which describes the platform movement arc according to an example embodiment of the present disclosure.

Figure 180:
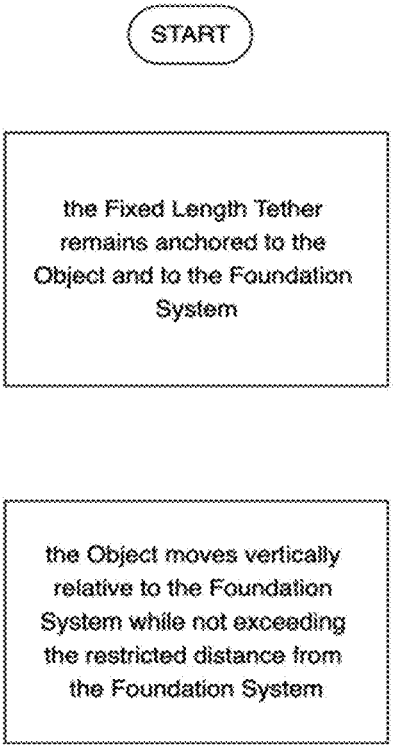

FIG. 180 is a method diagram which describes the tethering system according to an example embodiment of the present disclosure.

Figure 181:
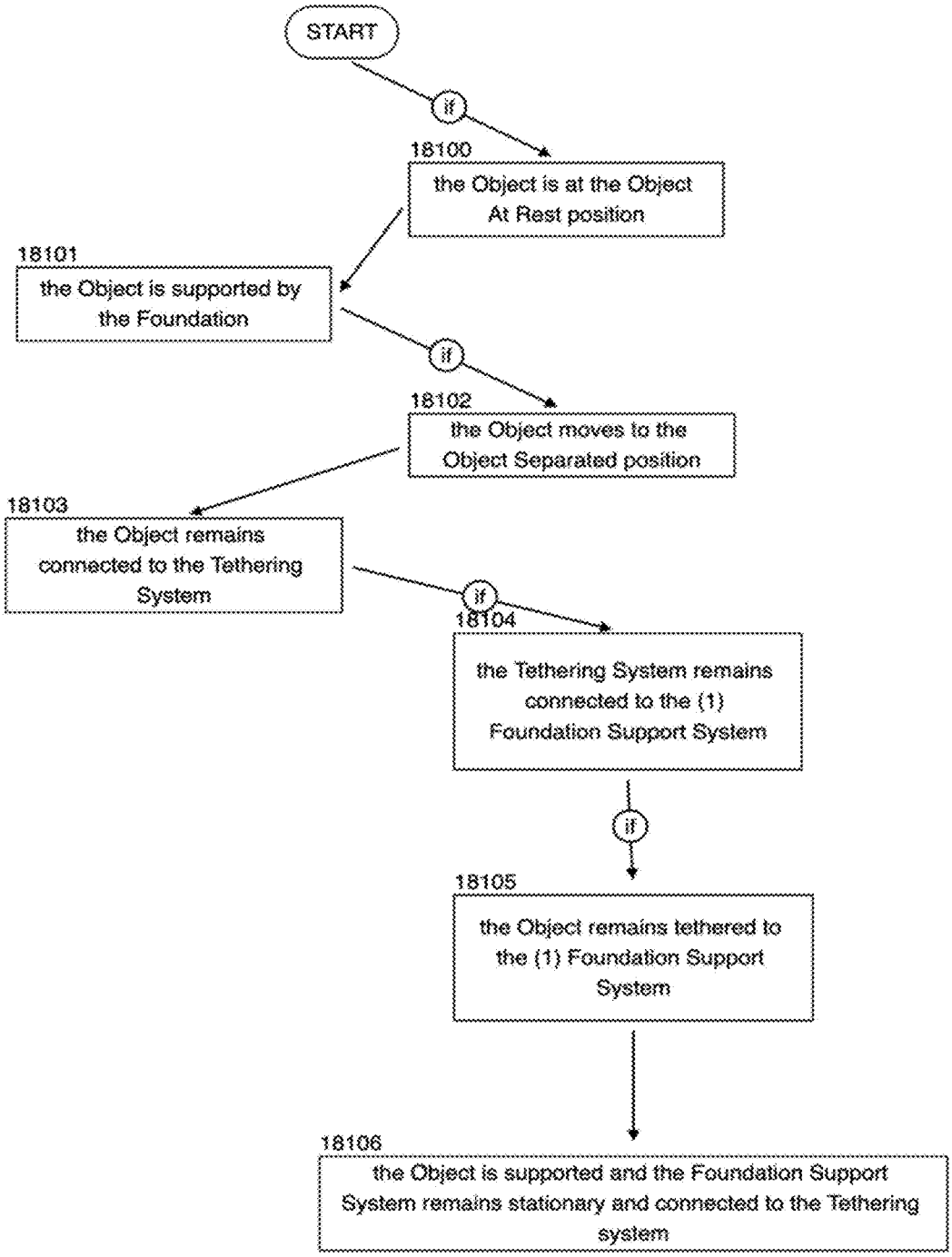

FIG. 181 is a method diagram which describes the foundation system according to an example embodiment of the present disclosure.

Figure 182:
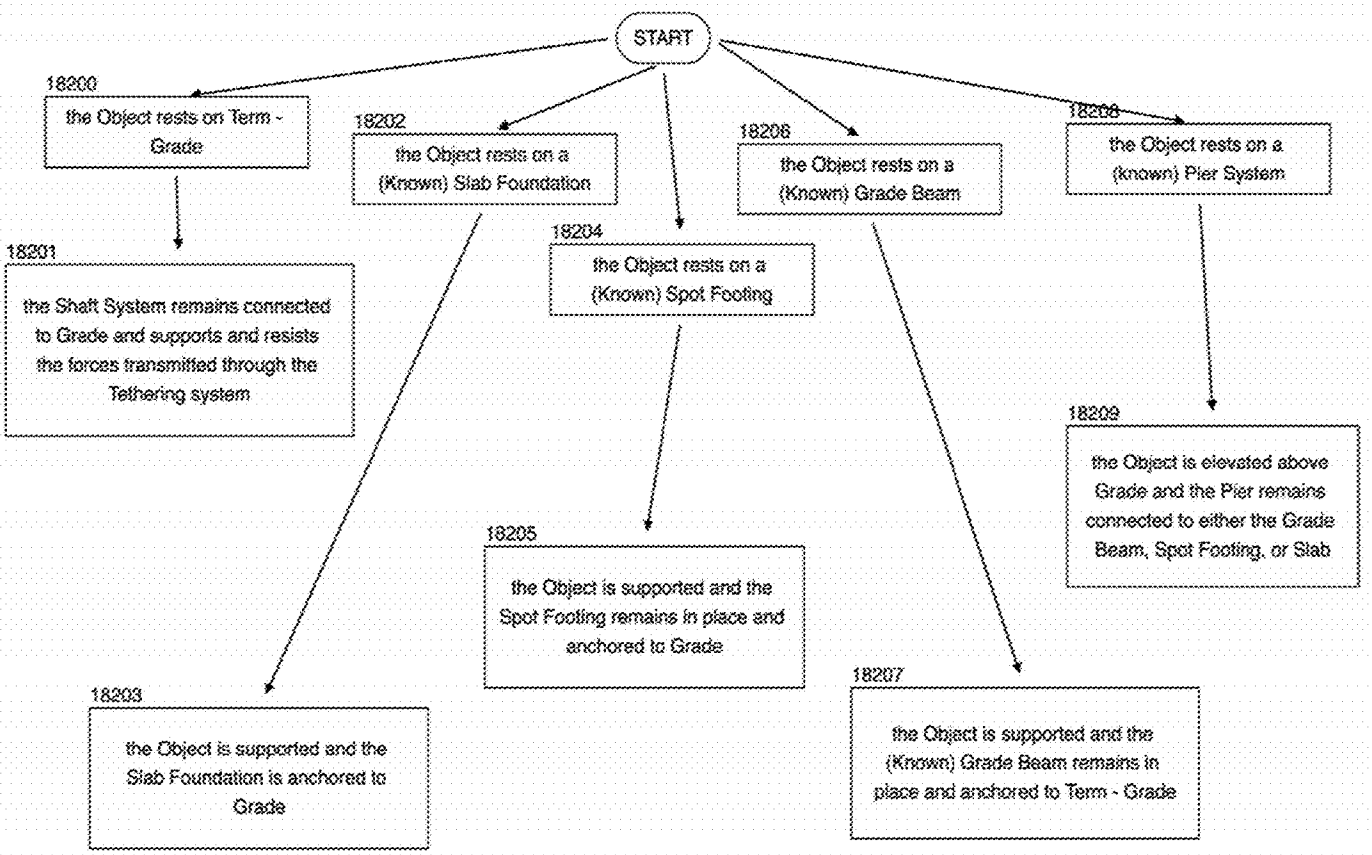

FIG. 182 is a method diagram which describes the foundation support system according to an example embodiment of the present disclosure.

Figure 183:
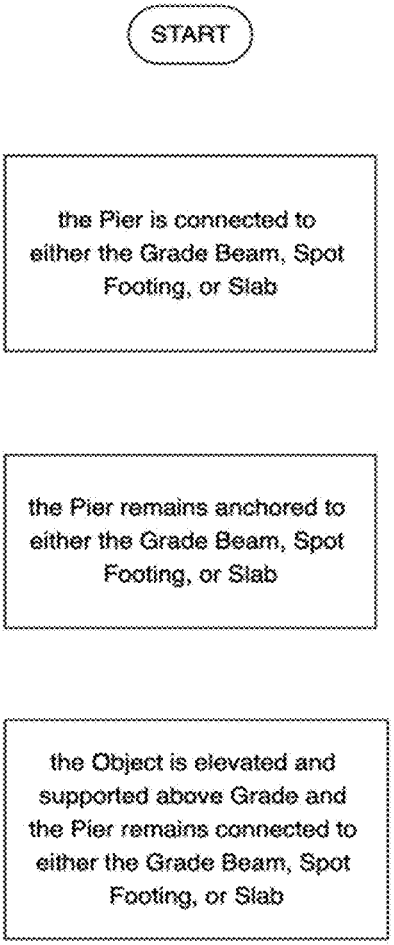

FIG. 183 is a method diagram which describes the pier system according to an example embodiment of the present disclosure.

Figure 184:
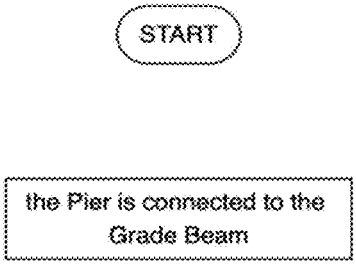

FIG. 184 is a method diagram which describes the pier location system according to an example embodiment of the present disclosure.

Figure 185:
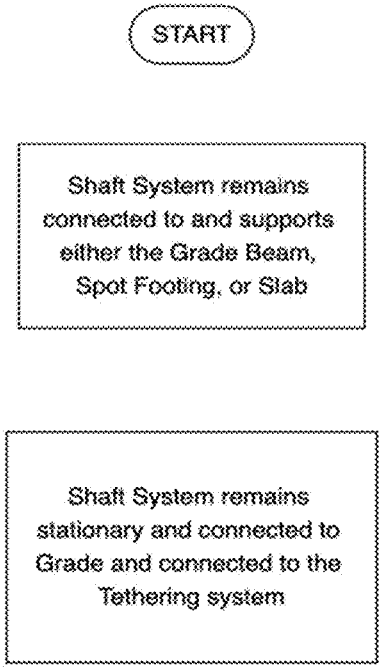

FIG. 185 is a method diagram which describes the shaft system according to an example embodiment of the present disclosure.

Figure 186:
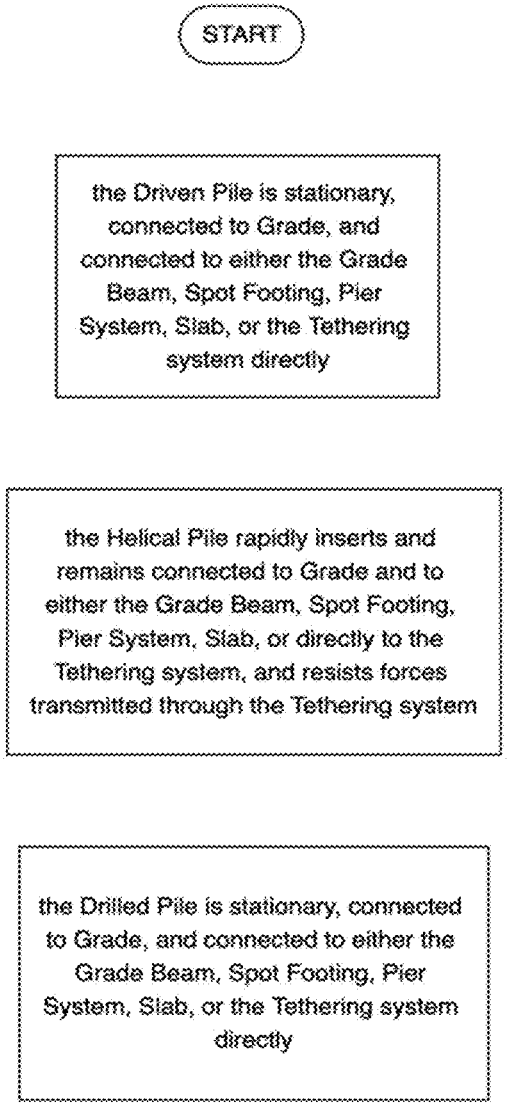

FIG. 186 is a method diagram which describes the shaft system according to an example embodiment of the present disclosure.

Figure 187:
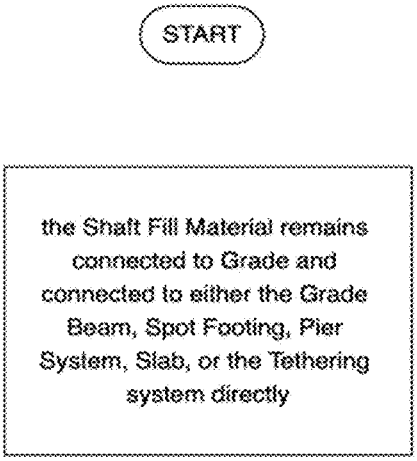

FIG. 187 is a method diagram which describes the drilled pile according to an example embodiment of the present disclosure.

Figure 188:
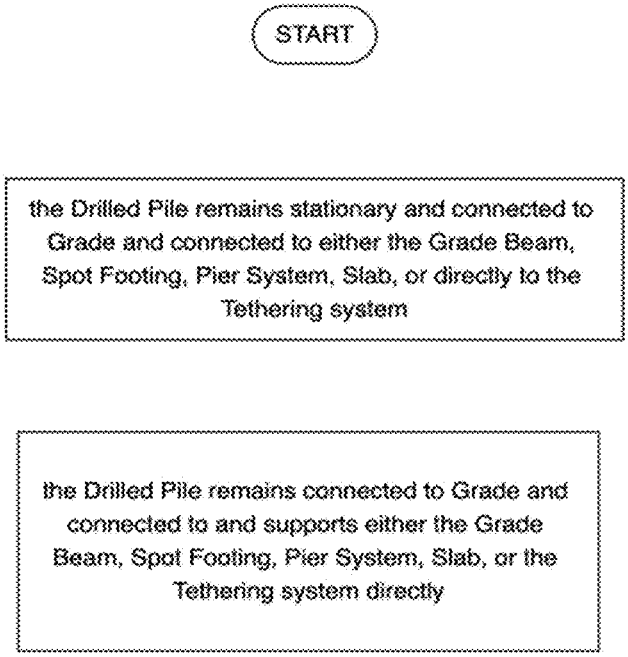

FIG. 188 is a method diagram which describes the shaft fill material according to an example embodiment of the present disclosure.

Figure 189:
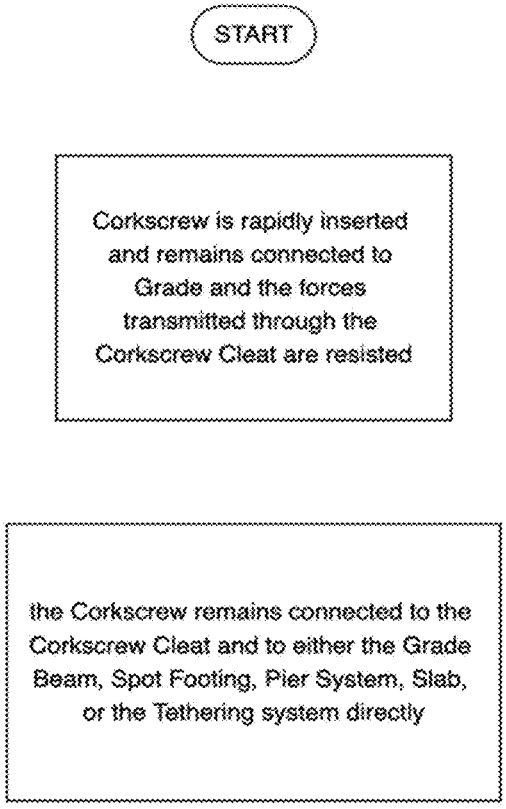

FIG. 189 is a method diagram which describes the helical pile according to an example embodiment of the present disclosure.

Figure 190:
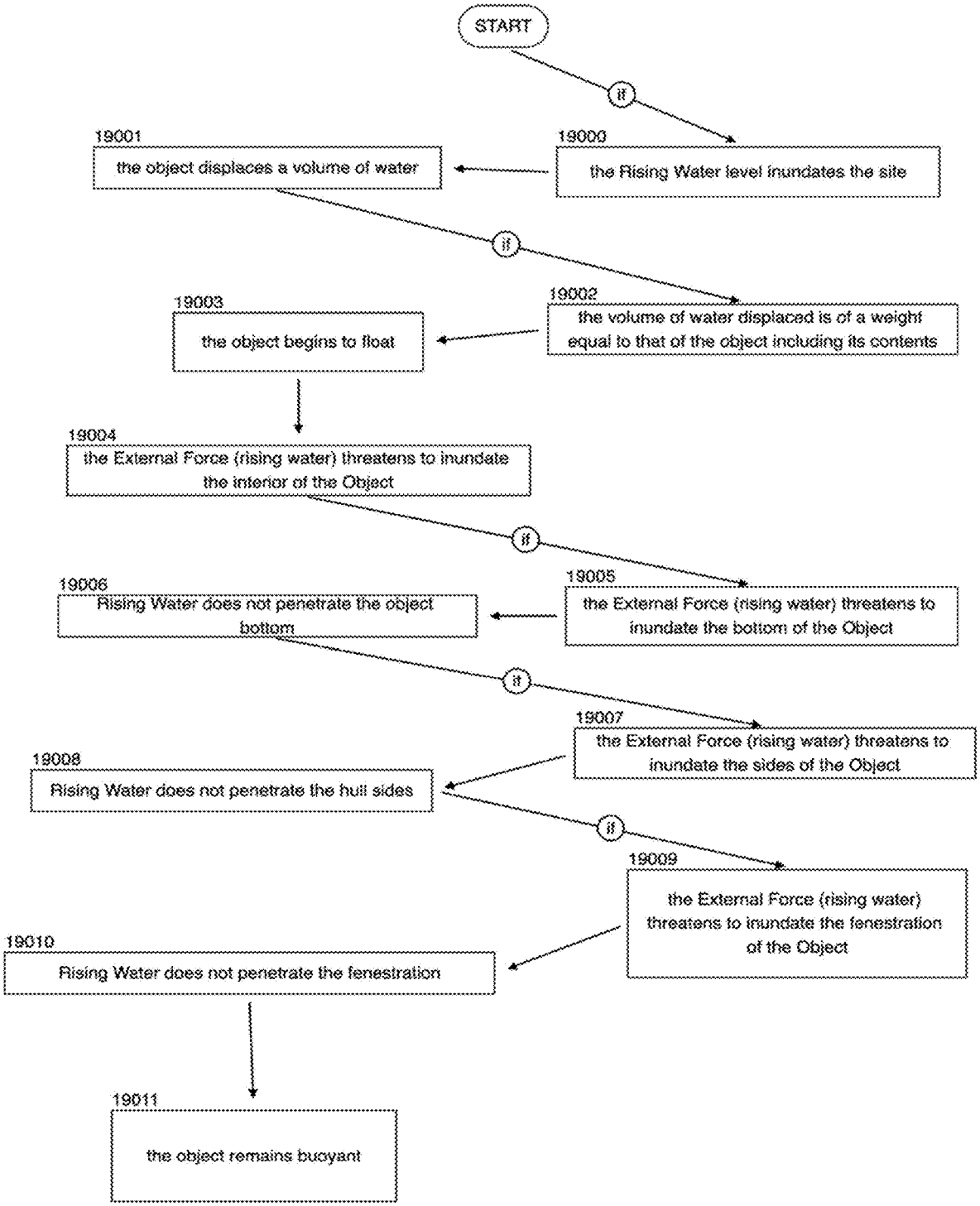

FIG. 190 is a method diagram which describes the buoyancy system according to an example embodiment of the present disclosure.

Figure 191:
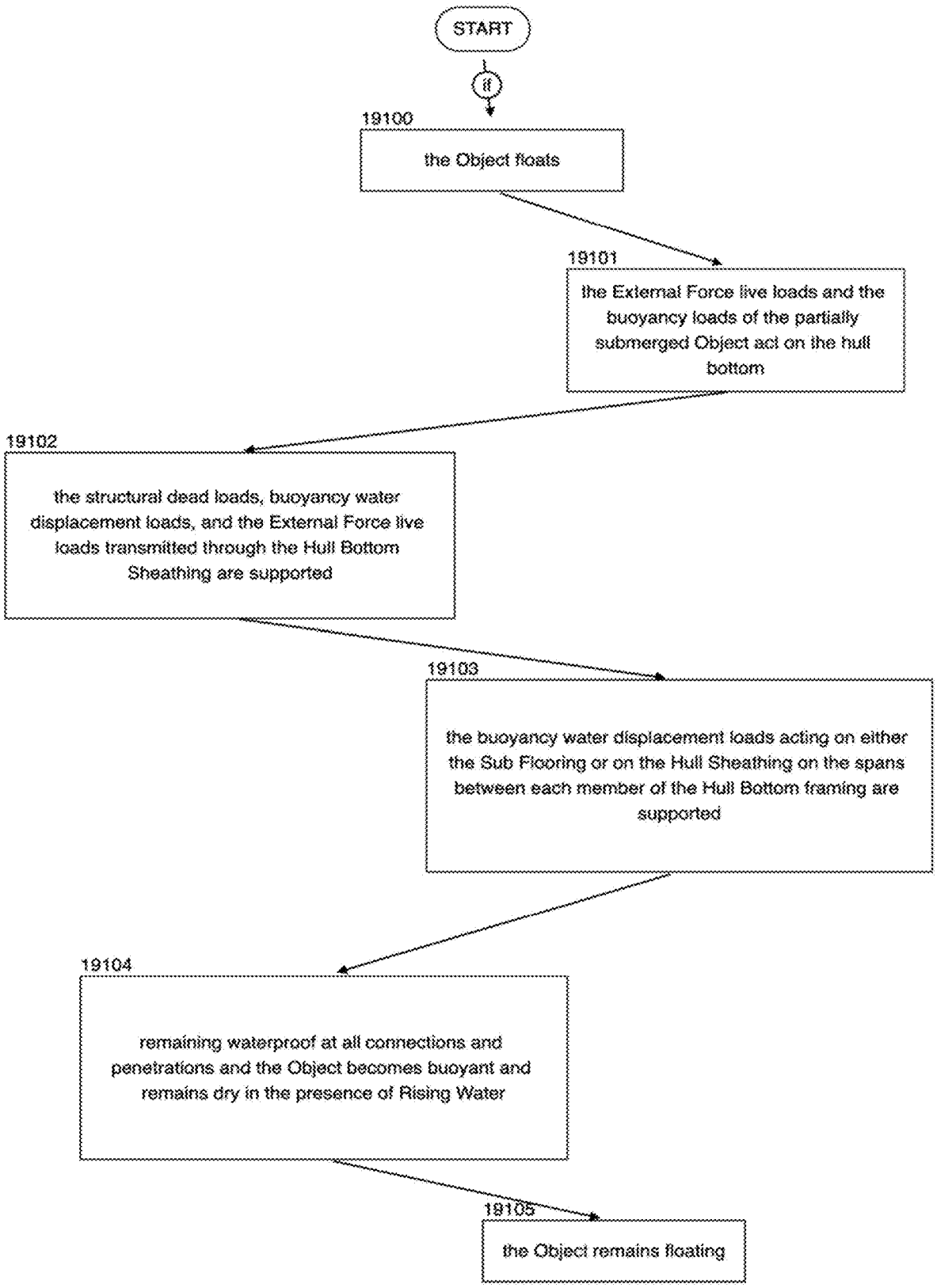

FIG. 191 is a method diagram which describes the hull bottom sealing system according to an example embodiment of the present disclosure.

Figure 192:
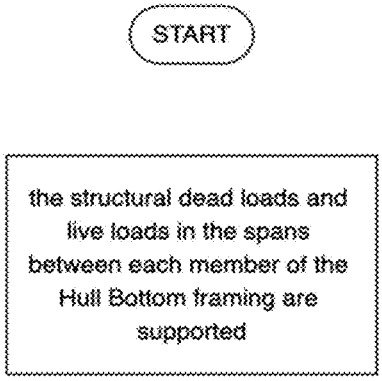

FIG. 192 is a method diagram which describes the hull bottom sheathing according to an example embodiment of the present disclosure.

Figure 193:
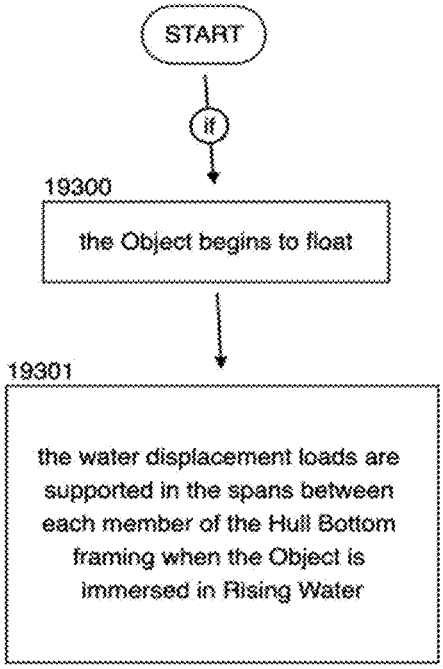

FIG. 193 is a method diagram which describes the hull bottom sheathing according to an example embodiment of the present disclosure.

Figure 194:
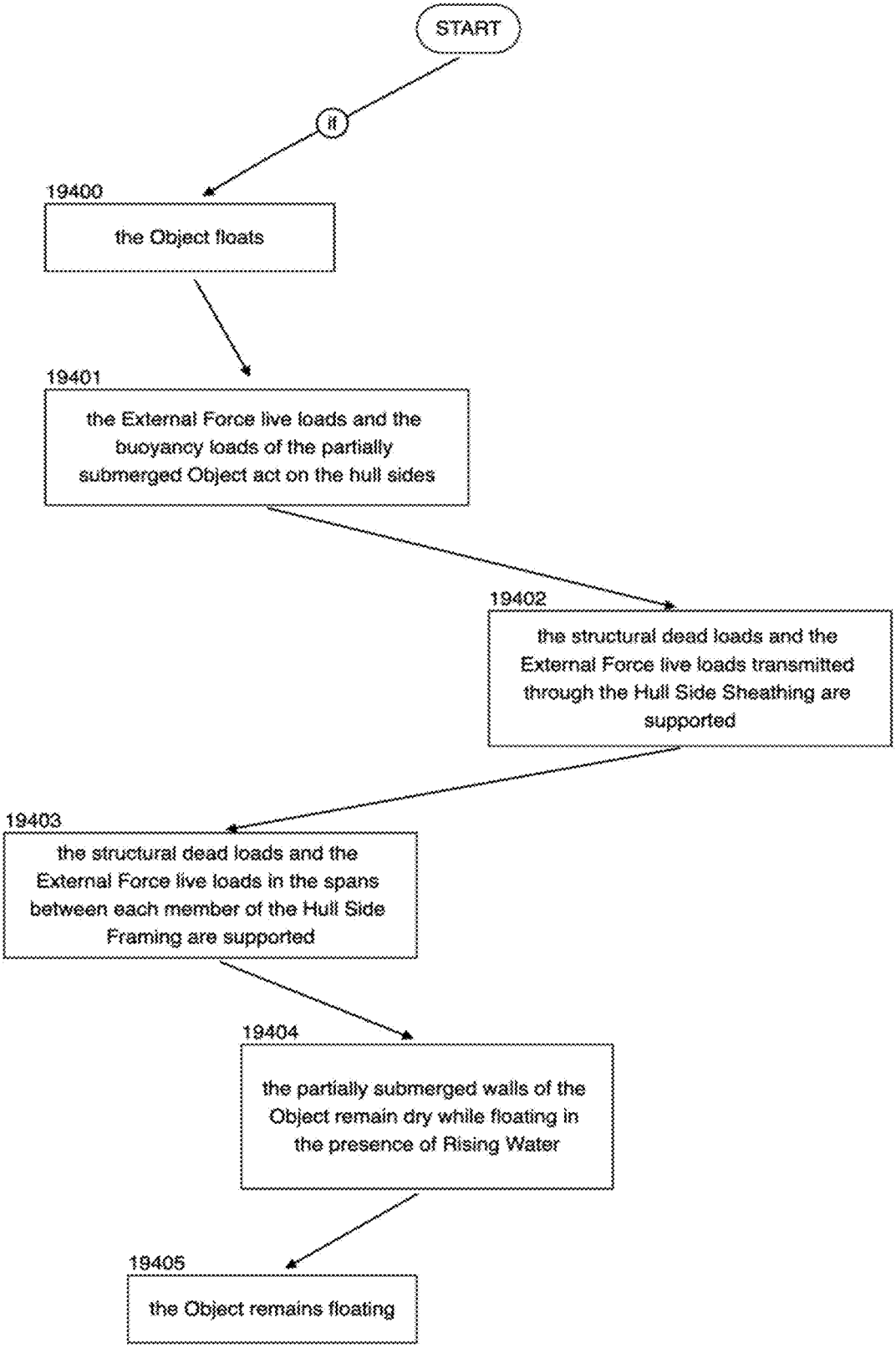

FIG. 194 is a method diagram which describes the hull side sealing system according to an example embodiment of the present disclosure.

Figure 195:
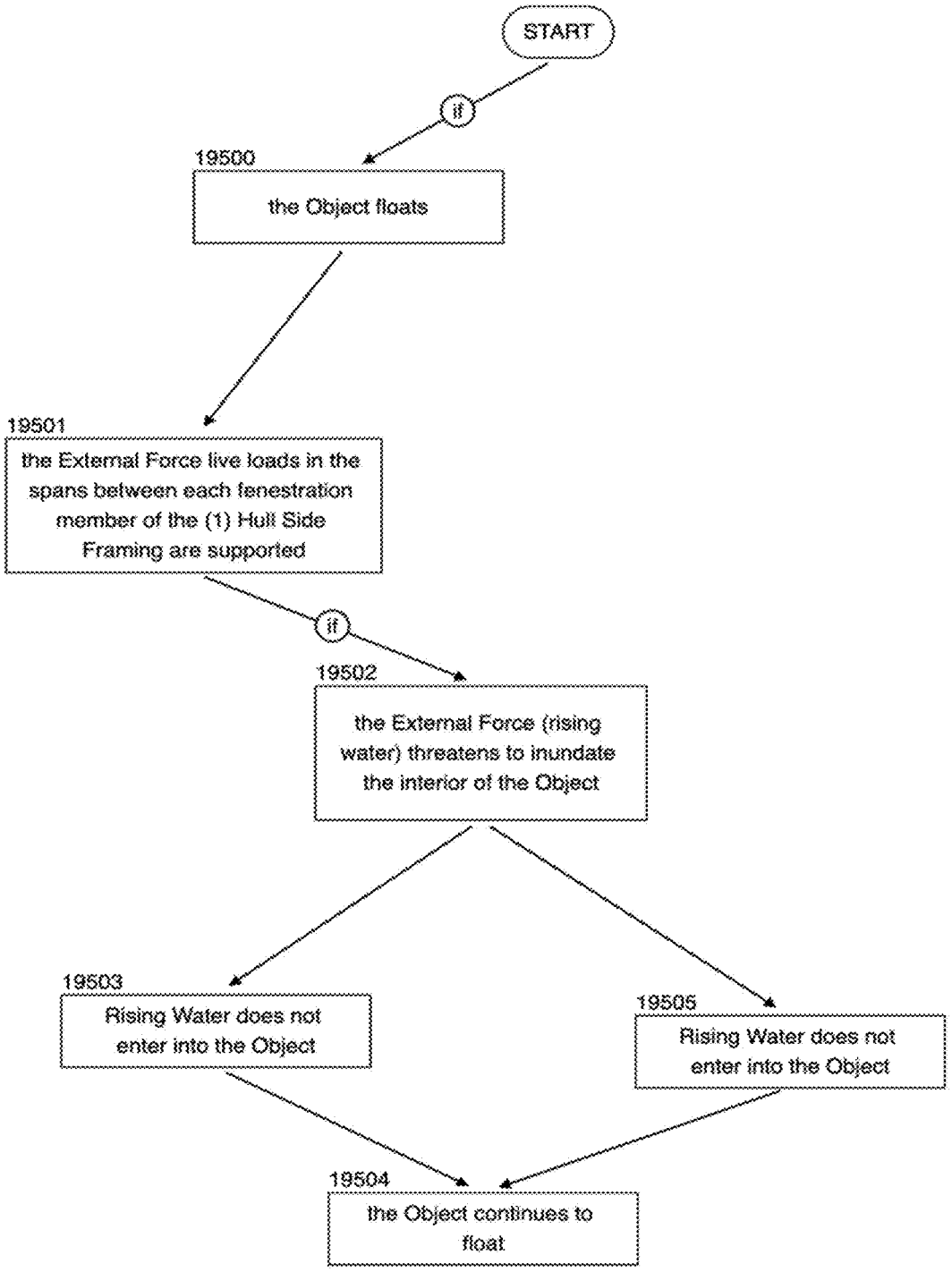

FIG. 195 is a method diagram which describes the fenestration buoyancy system according to an example embodiment of the present disclosure.

Figure 196:
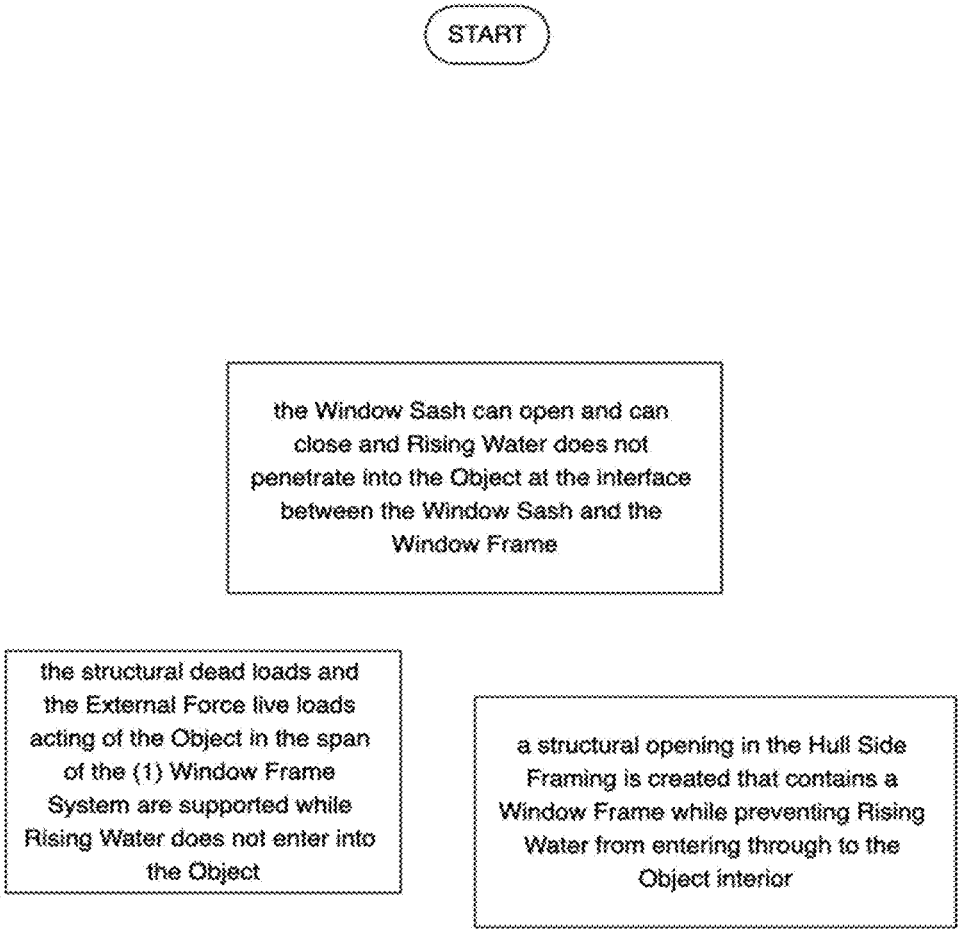

FIG. 196 is a method diagram which describes the fenestration buoyancy system according to an example embodiment of the present disclosure.

Figure 197:
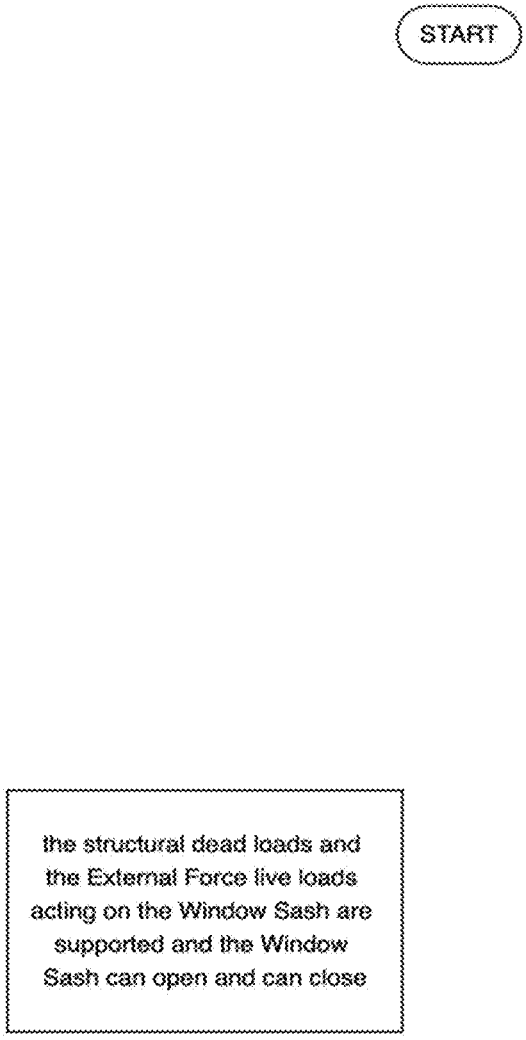

FIG. 197 is a method diagram which describes the window frame buoyancy system according to an example embodiment of the present disclosure.

Figure 198:
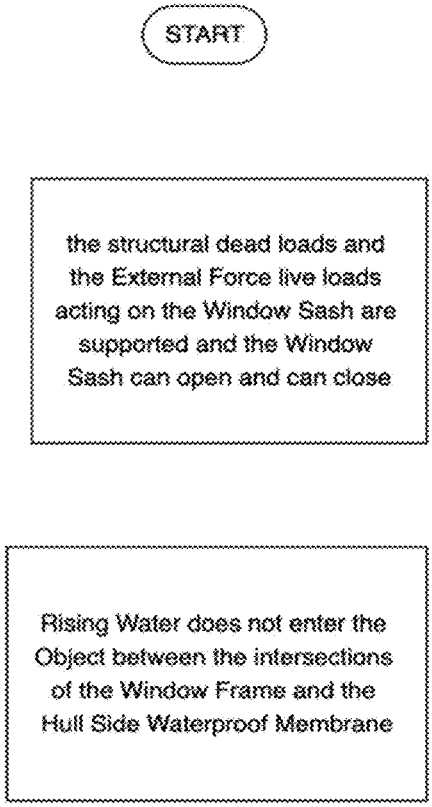

FIG. 198 is a method diagram which describes the window frame buoyancy system according to an example embodiment of the present disclosure.

Figure 199:
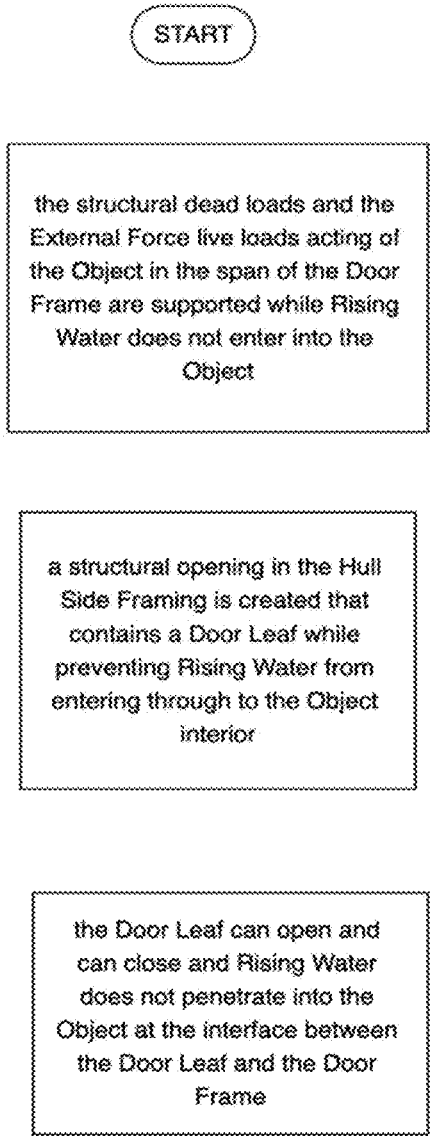

FIG. 199 is a method diagram which describes the fenestration buoyancy system according to an example embodiment of the present disclosure.

Figure 200:
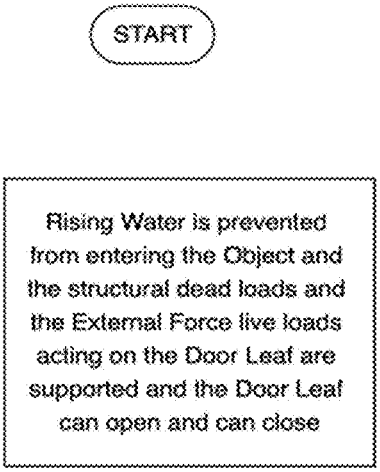

FIG. 200 is a method diagram which describes the door frame buoyancy system according to an example embodiment of the present disclosure.

Figure 201:
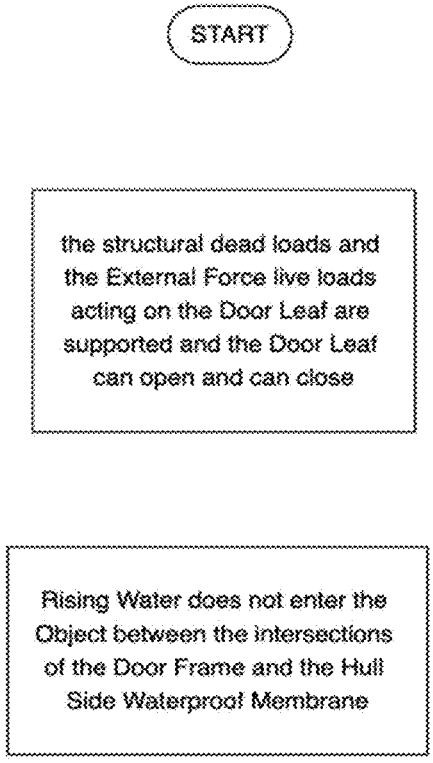

FIG. 201 is a method diagram which describes the door frame buoyancy system according to an example embodiment of the present disclosure.

Figure 202:
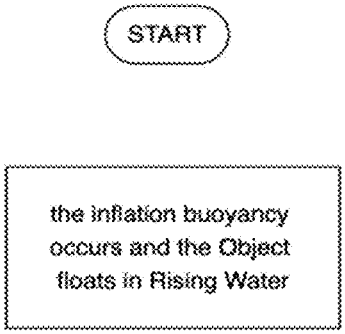

FIG. 202 is a method diagram which describes the buoyancy system according to an example embodiment of the present disclosure.

Figure 203:
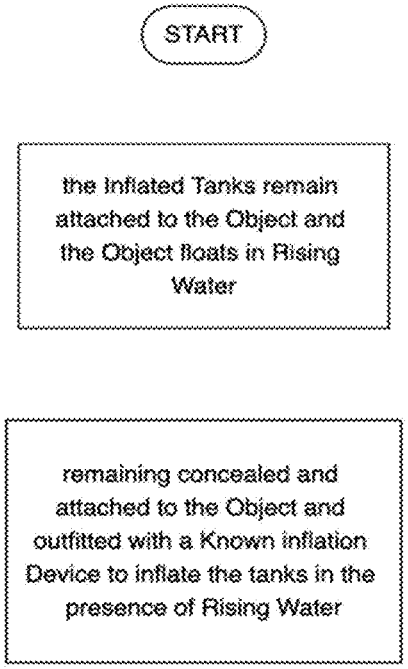

FIG. 203 is a method diagram which describes the deployable buoyancy according to an example embodiment of the present disclosure.

Figure 204:
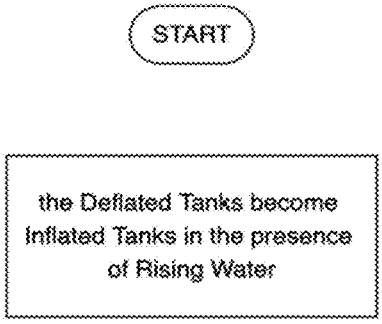

FIG. 204 is a method diagram which describes the deflated tanks according to an example embodiment of the present disclosure.

Figure 205:
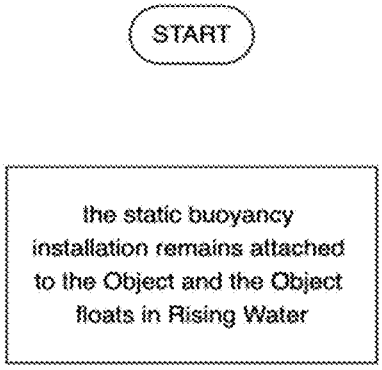

FIG. 205 is a method diagram which describes the buoyancy system according to an example embodiment of the present disclosure.

Figure 206:
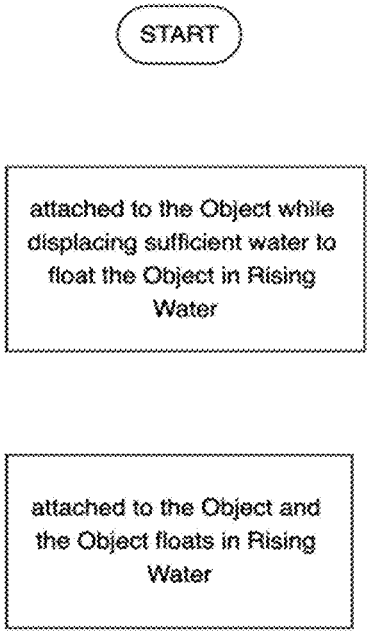

FIG. 206 is a method diagram which describes the static buoyancy installation according to an example embodiment of the present disclosure.

Figure 207:
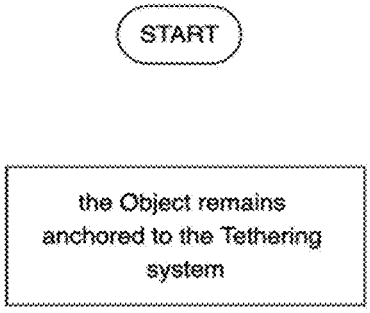

FIG. 207 is a method diagram which describes the buoyancy system according to an example embodiment of the present disclosure.

Figure 208:
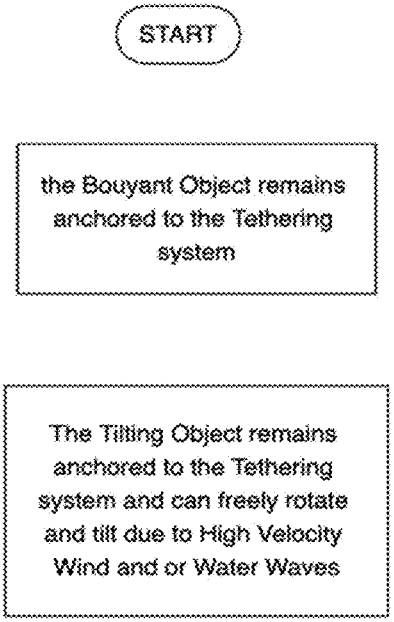

FIG. 208 is a method diagram which describes the buoyant object connector according to an example embodiment of the present disclosure.

Figure 209:
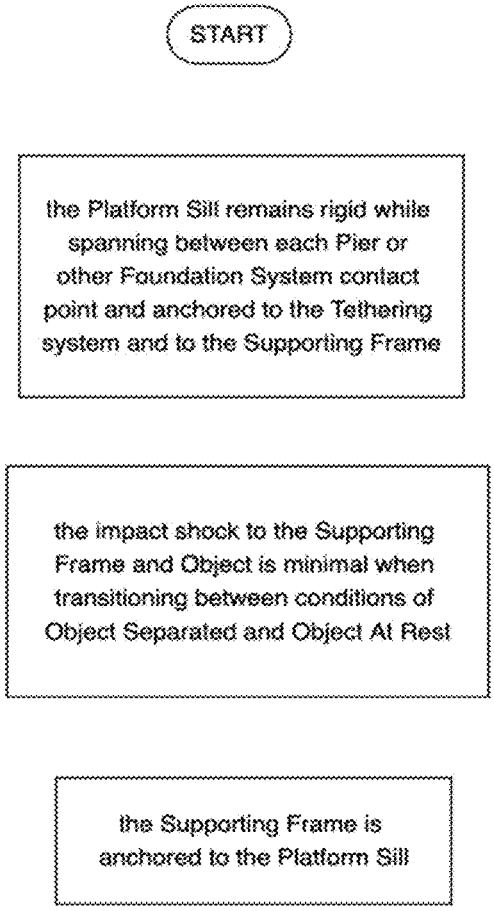

FIG. 209 is a method diagram which describes the object platform system according to an example embodiment of the present disclosure.

Figure 210:
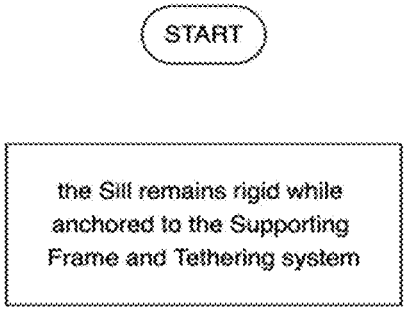

FIG. 210 is a method diagram which describes the platform sill according to an example embodiment of the present disclosure.

Figure 211:
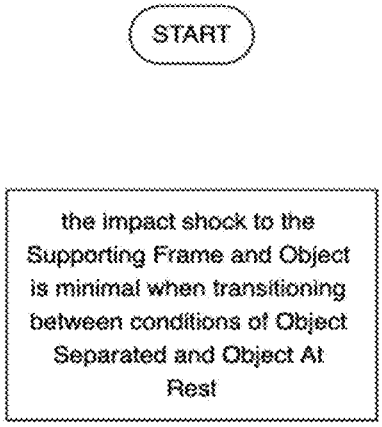

FIG. 211 is a method diagram which describes the impact dampening system according to an example embodiment of the present disclosure.

Figure 212:
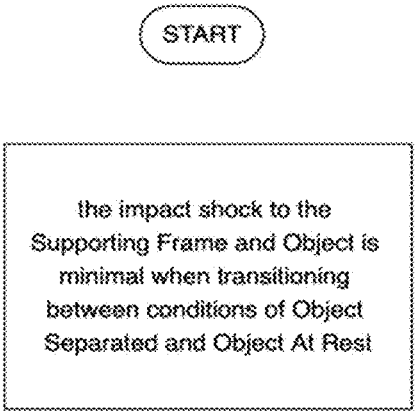

FIG. 212 is a method diagram which describes the impact dampening system according to an example embodiment of the present disclosure.

Figure 213:
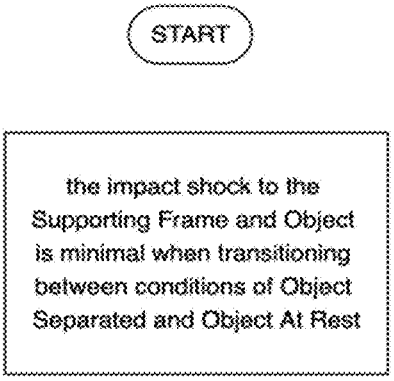

FIG. 213 is a method diagram which describes the impact dampening system according to an example embodiment of the present disclosure.

Figure 214:
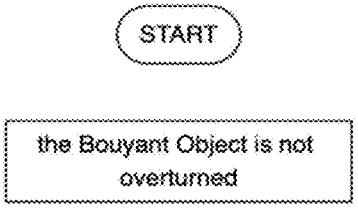

FIG. 214 is a method diagram which describes the object platform system according to an example embodiment of the present disclosure.

Figure 215:
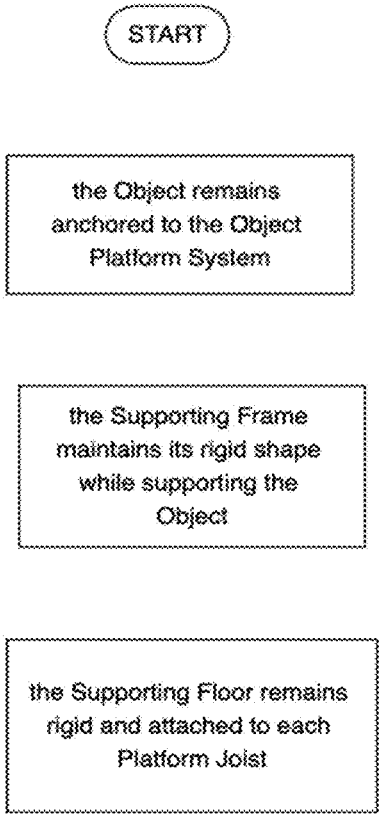

FIG. 215 is a method diagram which describes the object platform system according to an example embodiment of the present disclosure.

Figure 216:
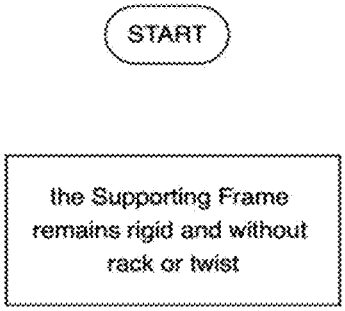

FIG. 216 is a method diagram which describes the supporting frame according to an example embodiment of the present disclosure.

Figure 217:
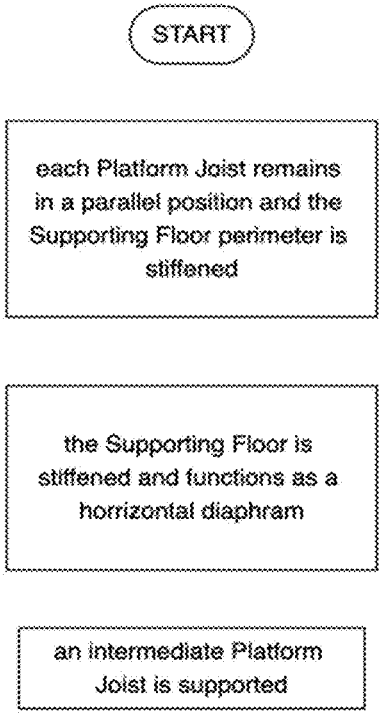

FIG. 217 is a method diagram which describes the supporting frame according to an example embodiment of the present disclosure.

Figure 218:
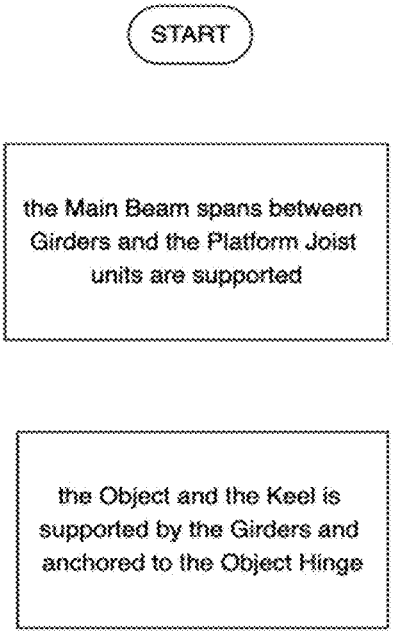

FIG. 218 is a method diagram which describes the supporting frame according to an example embodiment of the present disclosure.

Figure 219:
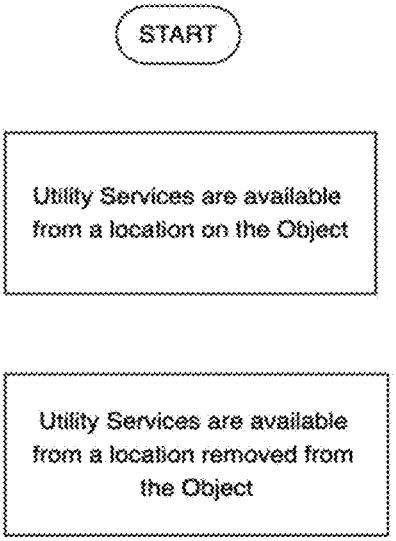

FIG. 219 is a method diagram which describes the utility service origination according to an example embodiment of the present disclosure.

Figure 220:
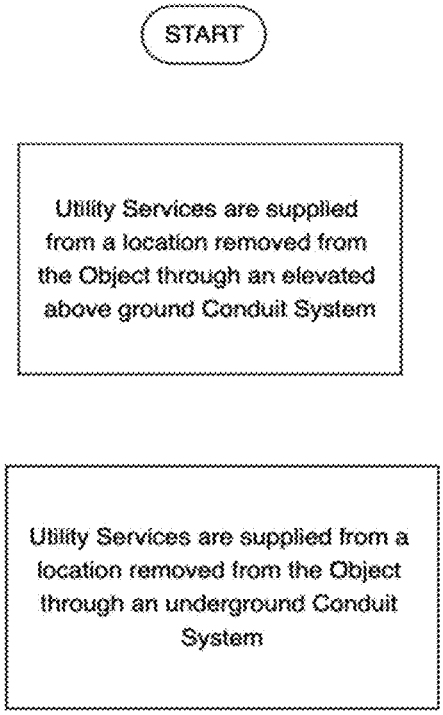

FIG. 220 is a method diagram which describes the off-site according to an example embodiment of the present disclosure.

Figure 221:
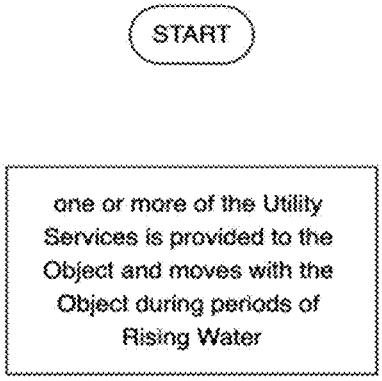

FIG. 221 is a method diagram which describes the on board delivery according to an example embodiment of the present disclosure.

Figure 222:
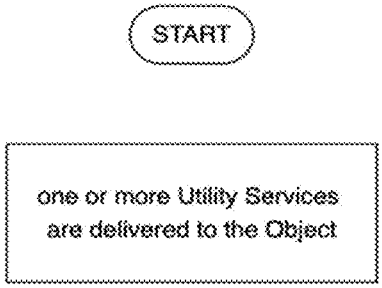

FIG. 222 is a method diagram which describes the utility service connection according to an example embodiment of the present disclosure.

Figure 223:
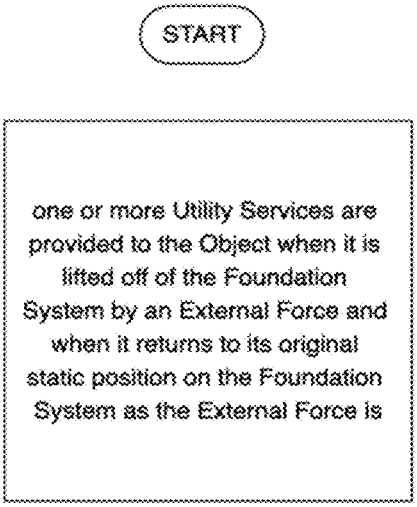

FIG. 223 is a method diagram which describes the conduit system according to an example embodiment of the present disclosure.

Figure 224:
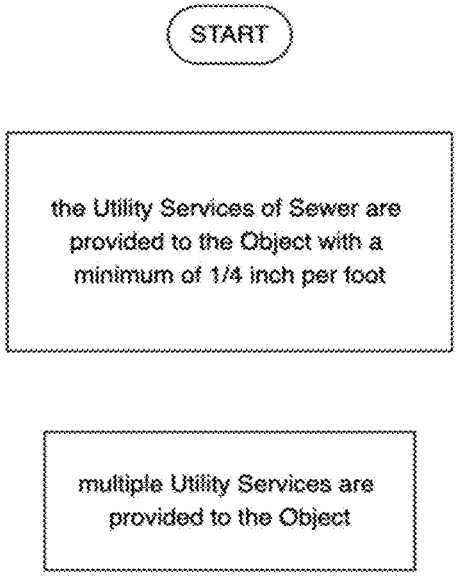

FIG. 224 is a method diagram which describes the coiled conduit according to an example embodiment of the present disclosure.

Figure 225:
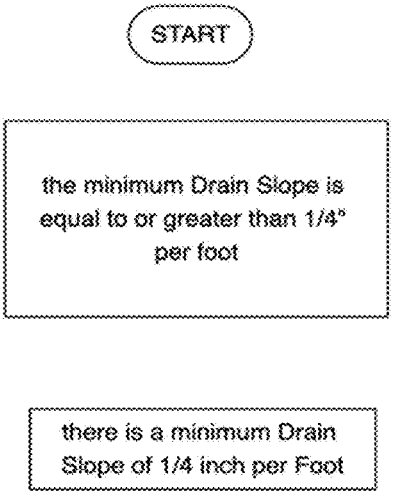

FIG. 225 is a method diagram which describes the coiled sewer conduit according to an example embodiment of the present disclosure.

Figure 226:
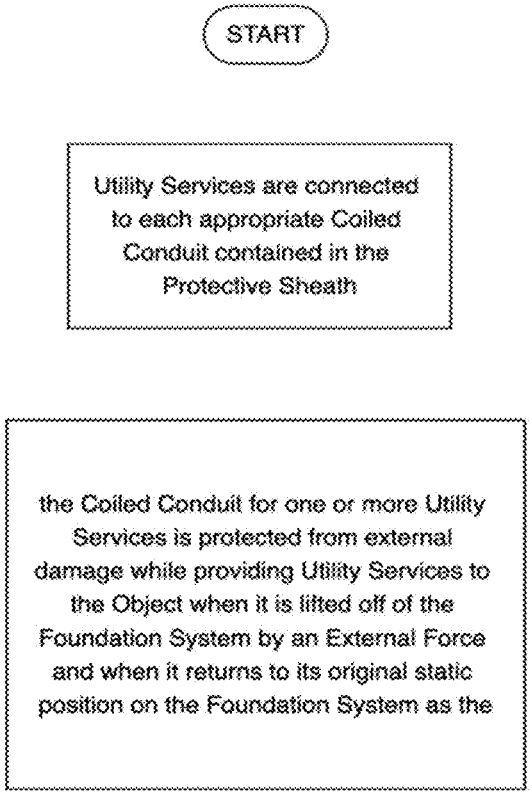

FIG. 226 is a method diagram which describes the coiled conduit according to an example embodiment of the present disclosure.

Figure 227:
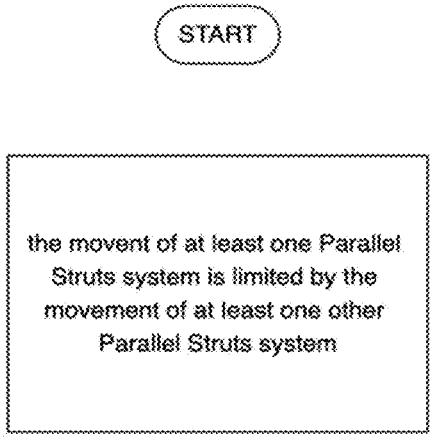

FIG. 227 is a method diagram which describes the outward acting elbow according to an example embodiment of the present disclosure.

Figure 228:
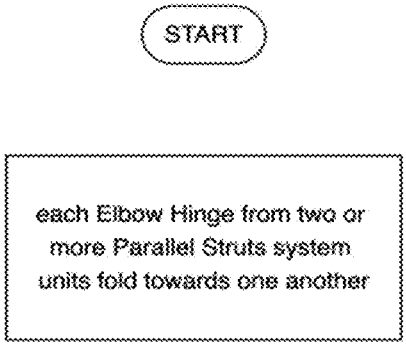

FIG. 228 is a method diagram which describes the opposing elbow system according to an example embodiment of the present disclosure.

Figure 229:
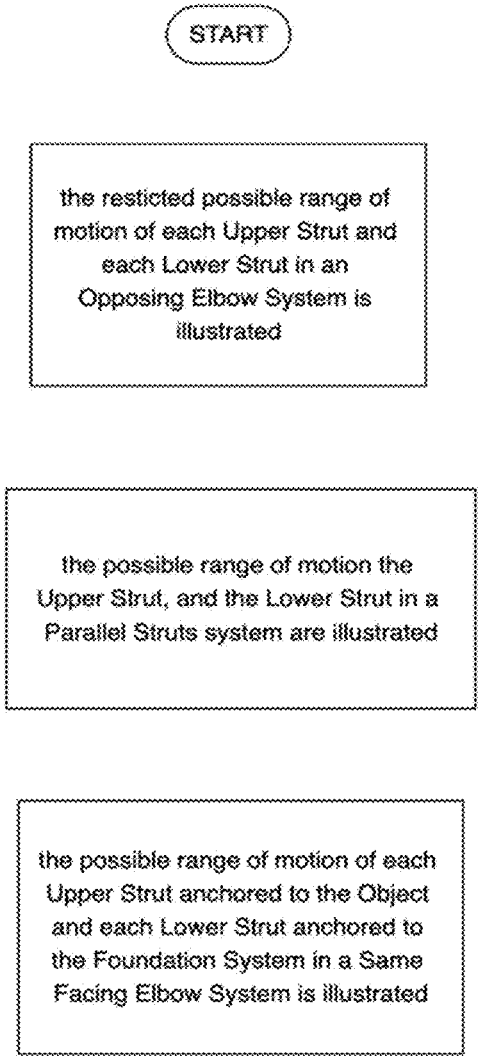

FIG. 229 is a method diagram which describes the folding strut movement arc system according to an example embodiment of the present disclosure.

Figure 230:
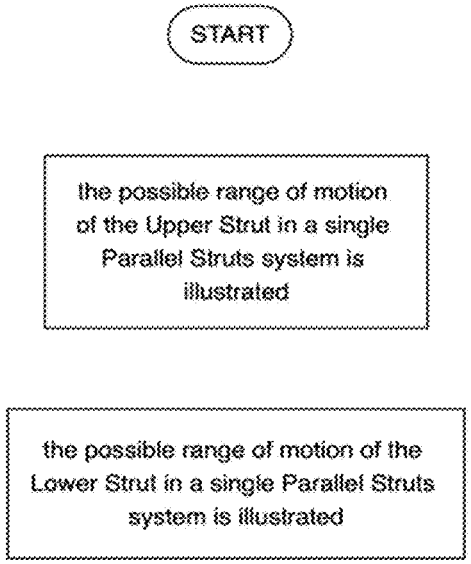

FIG. 230 is a method diagram which describes the single folding strut movement according to an example embodiment of the present disclosure.

Figure 231:
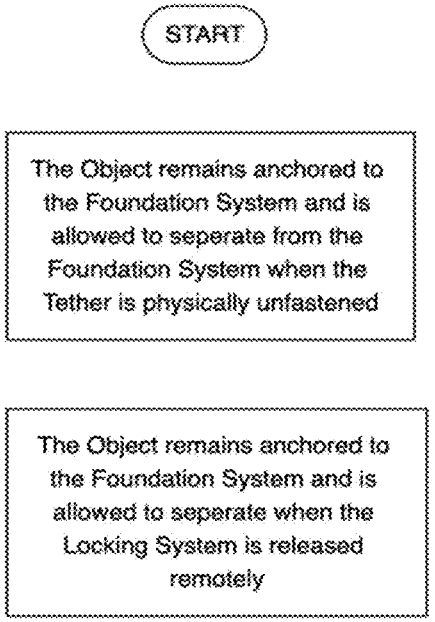

FIG. 231 is a method diagram which describes the locking system according to an example embodiment of the present disclosure.

Figure 232:
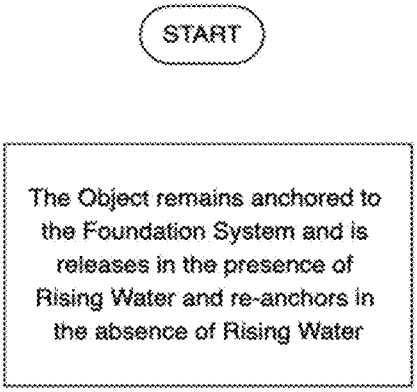

FIG. 232 is a method diagram which describes the locking system according to an example embodiment of the present disclosure.

Figure 233:
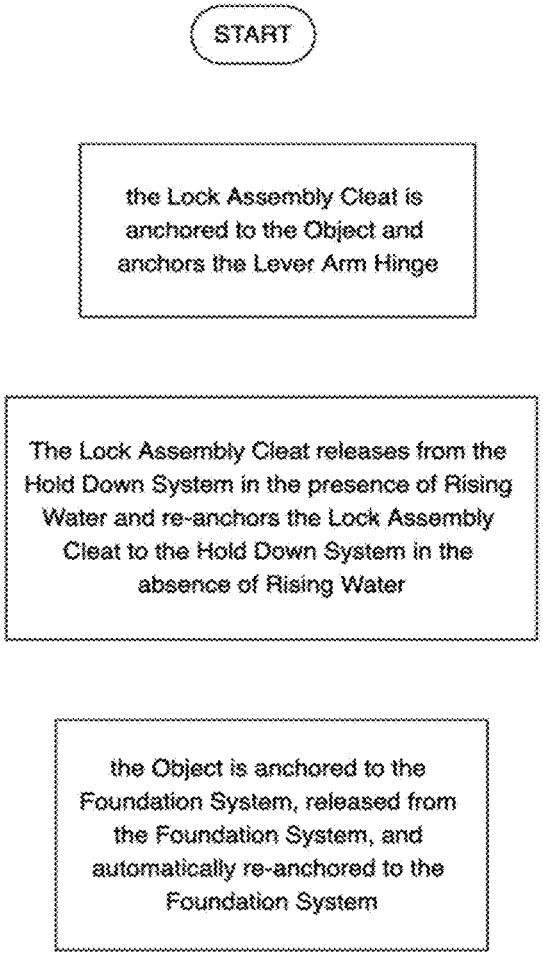

FIG. 233 is a method diagram which describes the rising water lock release activation system according to an example embodiment of the present disclosure.

Figure 234:
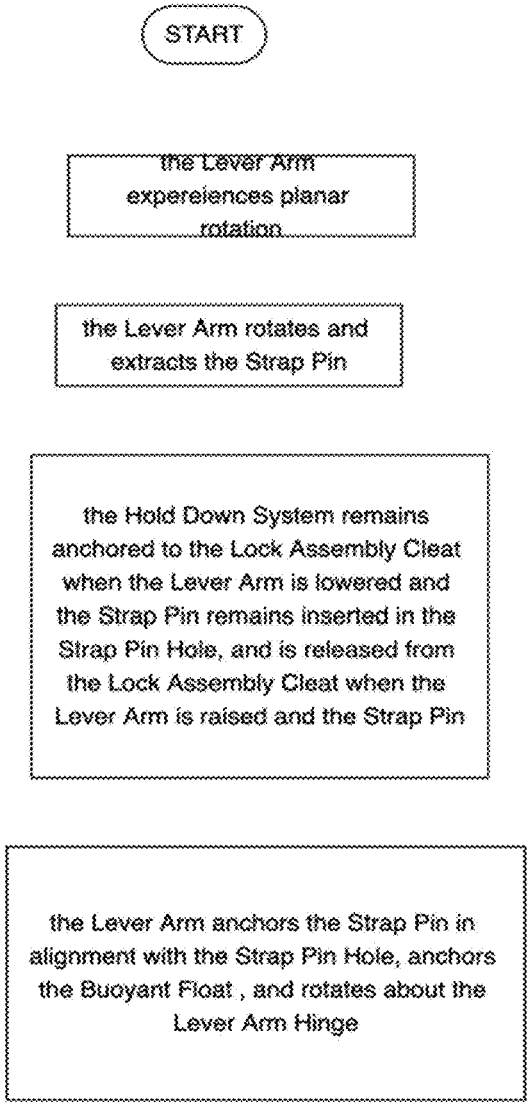

FIG. 234 is a method diagram which describes the float activated system according to an example embodiment of the present disclosure.

Figure 235:
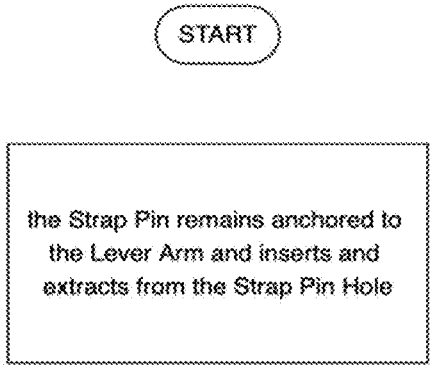

FIG. 235 is a method diagram which describes the lock system according to an example embodiment of the present disclosure.

Figure 236:
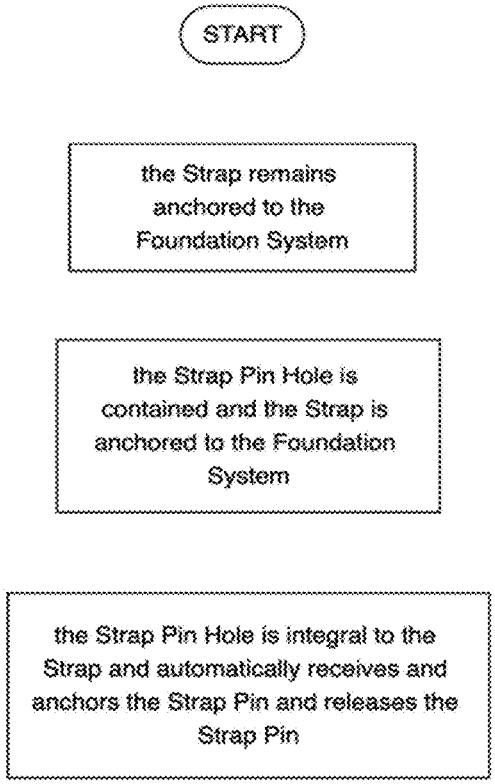

FIG. 236 is a method diagram which describes the hold down system according to an example embodiment of the present disclosure.

Figure 237:
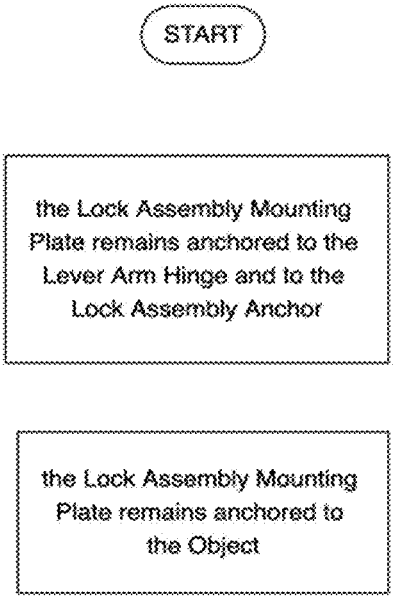

FIG. 237 is a method diagram which describes the lock assembly cleat according to an example embodiment of the present disclosure.

Figure 238:
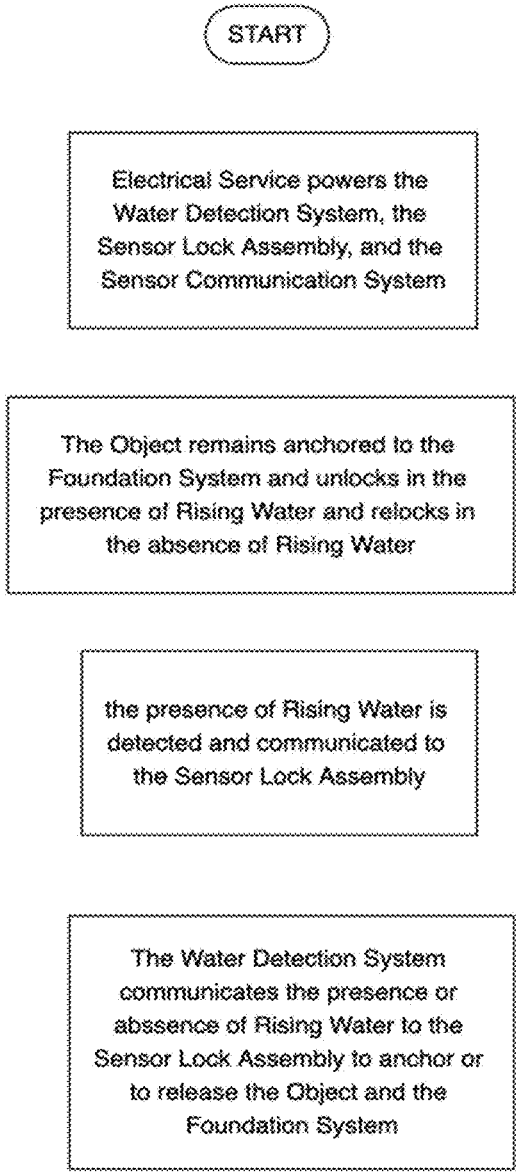

FIG. 238 is a method diagram which describes the rising water lock release activation system according to an example embodiment of the present disclosure.

DETAILED DESCRIPTION

Object separated 103 may be defined as an object 100 removed from the foundation system 200. Examples of the object separated 103 may include.

Tilting angle 10900 may be defined as the angle the object 100 is tilted relative to a level plane.

Tilting object 401 may be defined as an object 100 that is tilted relative to a level plane.

Object at rest 301 may be defined as an object 100 resting on the foundation system 200.

Water waves 501 may be defined as transverse and longitudinal deformations to the level surface of rising water 1202.

Examples of the rising water 1202 may include storm surge, tide and flash flood.

Examples of the high velocity wind 4000 may include hurricane winds and wind gusts.

Examples of the external force 500 may include wind, gravity, flooding, a high velocity wind 4000, water waves 501, human force 13400 and mechanical force 13300.

Object 100 may be defined as anything that is visible or tangible and is relatively stable in form, which may be in an object position 107, or of an object type 300. Examples of the object 100 may include house, mobile home, chicken coop, animal shelter, animal, human, storage building, motor vehicle, recreational vehicle, farm vehicle, boat, platform, walkway, roadway, machine and container.

Object position 107 may be defined as the location of the object 100 relative to the foundation system 200 and a level plane.

Examples of the communications may include telephone, cable and internet.

Electrical service 11203 may be defined as means for supplying uninterrupted electricity to the object 100.

Sewer 10804 may be defined as means for receiving sewer waste from the object 100.

Utility services may be defined as a means to provide utility services during the presence of rising water 1202, a means to provide gas 11201 service to the object 100, a means to provide potable water 11202 to the object 100, a means to provide sewer 10804 service to the object 100, a means to provide electrical service 11203 to the object, and a means to provide communications service to the object 100. Examples of the utility services may include sewer 10804, gas 11201, communications, potable water 11202 and electrical service 11203.

Examples of the safety disconnect may include plug and shut off valve.

Examples of the hard connection 14001 may include wired connection and pipe connection.

Examples of the gas 11201 may include piped gas service and refillable tanks.

Figure 1:
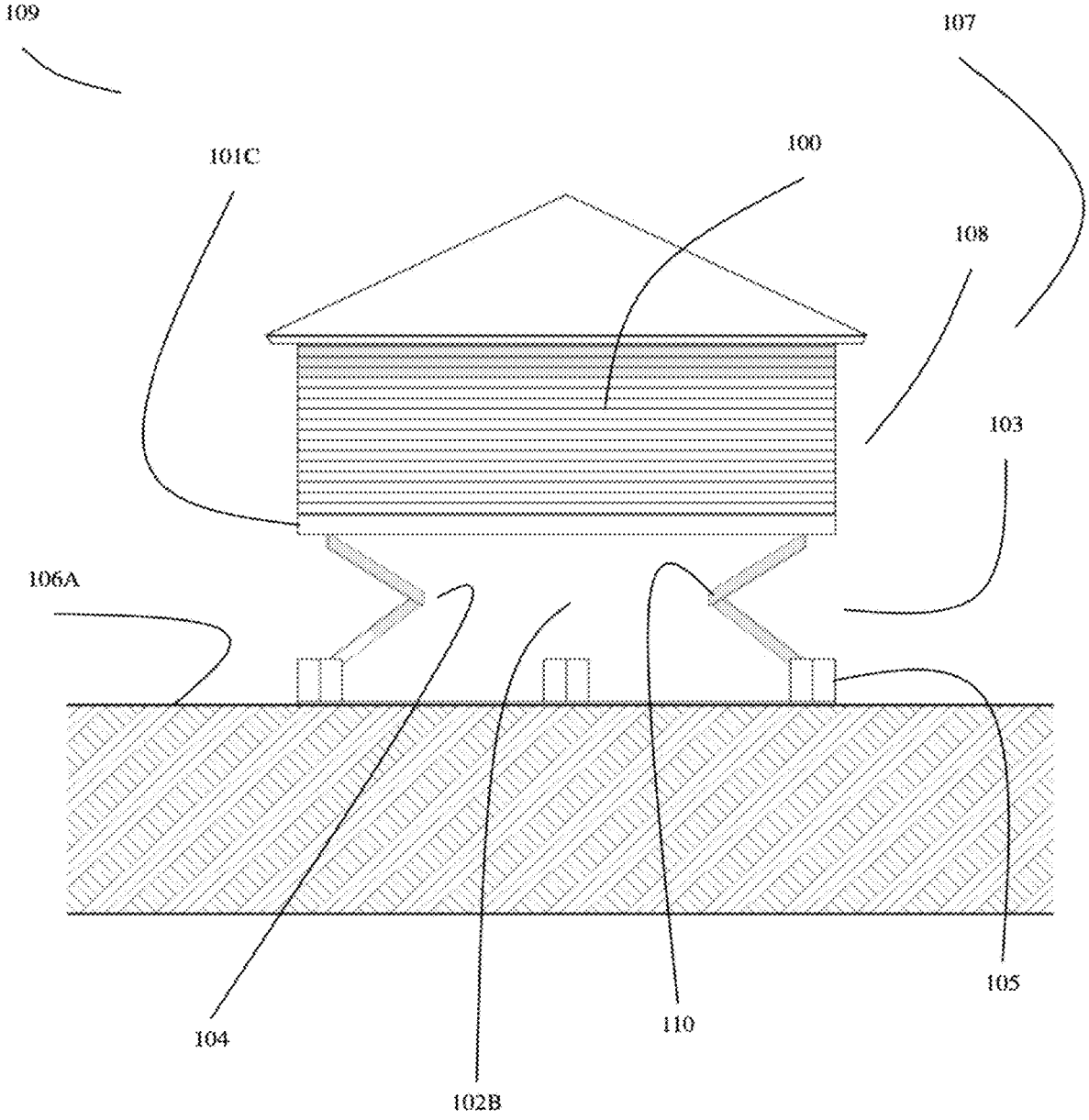
FIG. 1 illustrates an elevation view that shows a floating house that is tethered to its foundation with multiple primary parallel struts system units arranged at opposing angles and anchored a pier system, according to an example embodiment of the present disclosure.

This disclosure references the appended figures representing example embodiments. FIG. 1 illustrates an elevation view that shows a floating house that is tethered to its foundation with multiple primary parallel struts system 104 units arranged at opposing angles and anchored a pier system 105, according to an example embodiment of the present disclosure. Supporting frame 101C may be defined as a network of structural members that transfer the loads from the object platform system 1500 to the foundation system 200. Examples of supporting frame 101C may include a platform sill 1003 system and a platform joist 1001 system. In some example embodiments, the supporting frame 101C may be configured to maintain a rigid shape and support the object 100. In some example embodiments, the orientation system 102B may be configured to position the direction of action for multiple elbow hinge 700 units. In some example embodiments, the primary parallel struts system 104 may be configured to comprise an upper strut 702, a lower strut 703, an elbow hinge 700, an object hinge 2200, and a foundation hinge 1800, allow vertical movement between the object 100 and the foundation system 200, maintain a fixed distance between the foundation hinge 1800 and the elbow hinge 700, maintain a fixed distance between the object hinge 2200 and the elbow hinge 700 and maintain the upper strut 702 and the lower strut 703 parallel to each other. In some example embodiments, the primary parallel struts system 104 may be configured to tether the object 100 to the foundation system 200, allow the object 100 to separate from the foundation system 200 and guide the object 100 to return to its original position on the foundation system 200. In some example embodiments, the primary parallel struts system 104 may be positioned below the object 100 or above the foundation system 200. In some example embodiments, the primary parallel struts system 104 may be coupled with to the foundation system 200 or the object 100. In some example embodiments, the primary parallel struts system 104 may comprise upper strut 702, lower strut 703, strut 601, strut attachment system 1900, and strut alignment system 7400. In some example embodiments, the pier system 105 may be configured to support the object 100, elevate the object 100 above grade 106, remain connected to either the grade beam 201, spot footing 14100, or slab foundation 12000 and remain stationary. In some example embodiments, the pier system 105 may comprise pier location system 502, pier 14600 or pier anchoring system 4201. In some example embodiments, the grade 106A may be configured to support and anchor the foundation system 200 in place. Stabilization system 108 may be defined as the system which anchors the object 100 to the foundation system 200 while under select conditions to allow the object 100 to separate from the foundation system 200 while remaining anchored to the foundation system 200. In some example embodiments, the stabilization system 108 may be configured to anchor the object 100 to the foundation system 200, be anchored to the object 100, be anchored to the foundation system 200, guide the object 100 to return to its resting position on the foundation system 200, allow the object 100 to separate from the foundation system 200 and allow the object 100 while floating, to tilt and follow the asymmetrical movements of water waves 501. In some example embodiments, the stabilization system 108 may be configured to allow the object 100 to separate from the foundation system 200, to anchor the object 100 to the foundation system 200 and to guide the object 100 separated from the foundation system 200 to return to its original position before separation. In some example embodiments, the stabilization system 108 may be positioned between the object 100 and the foundation system 200. In some example embodiments, the stabilization system 108 may be coupled with the object 100 or the foundation system 200. In some example embodiments, the stabilization system 108 may interact in multiple ways: it may interact with high velocity wind 4000 while keeping the object 100 anchored to the foundation system 200, it also may interact with rising water 1202 while releasing the object 100 from the foundation system 200 and it may interact with adjusting the position of the object 100 to move with the undulating surface of water waves 501. In some example embodiments, the stabilization system 108 may comprise tethering system 9000, foundation system 200 or buoyancy system 1200. In some example embodiments, the flood hinge system 109 may comprise layout system, installation system or stabilization system 108. In some example embodiments, the secondary parallel struts system 110 may be configured to be configured such that its folding strut movement plane 3700 is positioned at a sufficient angle for its folding strut movement arc system 7101 to oppose the folding strut movement arc system 7101 of at least one primary parallel struts system 104 (example, the primary parallel struts system 104) to result in an opposing strut allowable movement 1700, comprise an upper strut 702, a lower strut 703, an elbow hinge 700, an object hinge 2200, and a foundation hinge 1800, allow vertical movement between the object 100 and the foundation system 200, maintain a fixed distance between the foundation hinge 1800 and the elbow hinge 700, maintain a fixed distance between the object hinge 2200 and the elbow hinge 700 and maintain the upper strut 702 and the lower strut 703 parallel to each other. In some example embodiments, the secondary parallel struts system 110 may be configured to tether the object 100 to the foundation system 200, allow the object 100 to separate from the foundation system 200 and guide the object 100 to return to its original position on the foundation system 200. In some example embodiments, the secondary parallel struts system 110 may be positioned its folding strut movement plane 3700 angled non-parallel and to opposed to the folding strut movement plane 3700 of one or more primary parallel struts system 104 assemblies, below the object 100 or above the foundation system 200. In some example embodiments, the secondary parallel struts system 110 may be configured to result in creating an opposing strut allowable movement 1700 for each object hinge 2200. In some example embodiments, the secondary parallel struts system 110 may comprise platform movement system 8000.

Figure 2:
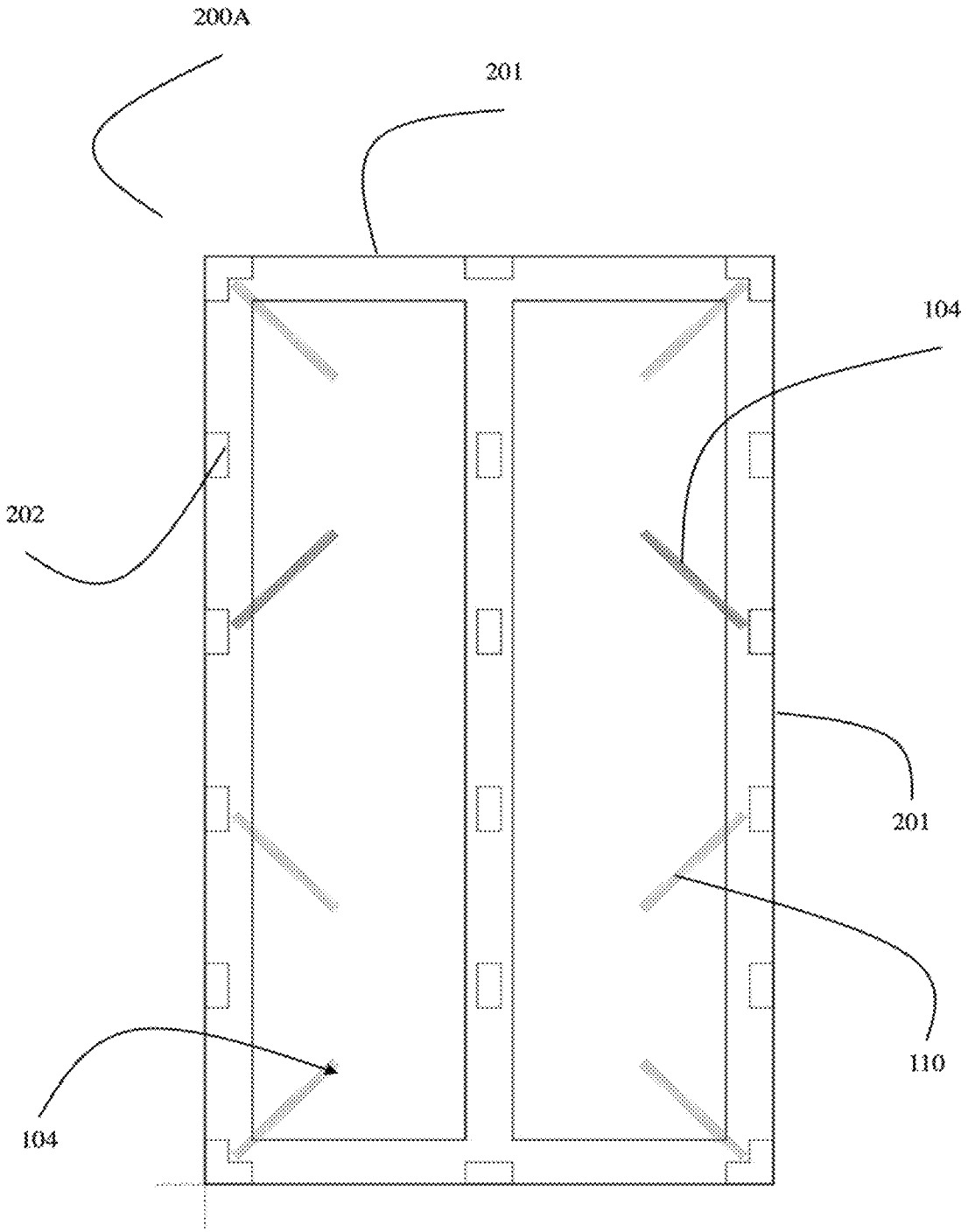
FIG. 2 illustrates a plan view that shows a foundation system consisting of a pier on gradebeam system and a series of primary parallel struts system assemblies anchored to a pier on gradebeam system, according to an example embodiment of the present disclosure.

FIG. 2 illustrates a plan view that shows a foundation system 200 consisting of a pier on gradebeam system 202 and a series of primary parallel struts system 104 assemblies anchored to a pier on gradebeam system 202, according to an example embodiment of the present disclosure. Examples of foundation system 200A may include Piers on Grade Beams, Piers on Pilings, Slab on grade, Footings and stem wall, Permanent wood foundation, Crawl Space Foundation, Basement Foundation, Piers on grade beams and Piers on spot footings. In some example embodiments, the foundation system 200A may be configured to be supported by grade 106, remain anchored to grade 106, support the object 100, support and resist the forces transmitted through the stabilization system 108 and remain connected to the stabilization system 108. In some example embodiments, the foundation system 200A may be configured to support the platform. In some example embodiments, the foundation system 200A may be positioned below the external force 500. In some example embodiments, the foundation system 200A may be coupled with to the stabilization system 108 or to the earth. In some example embodiments, the foundation system 200A is configured to be an anchor to the stabilization system 108. In some example embodiments, the grade beam 201 may be configured to support the object 100, remain anchored to grade 106 and remain in a place when the external force 500 acts upon the object 100. In some example embodiments, the pier on gradebeam system 202 may be configured to attach the pier 14600 on the grade beam 201.

Figure 3:
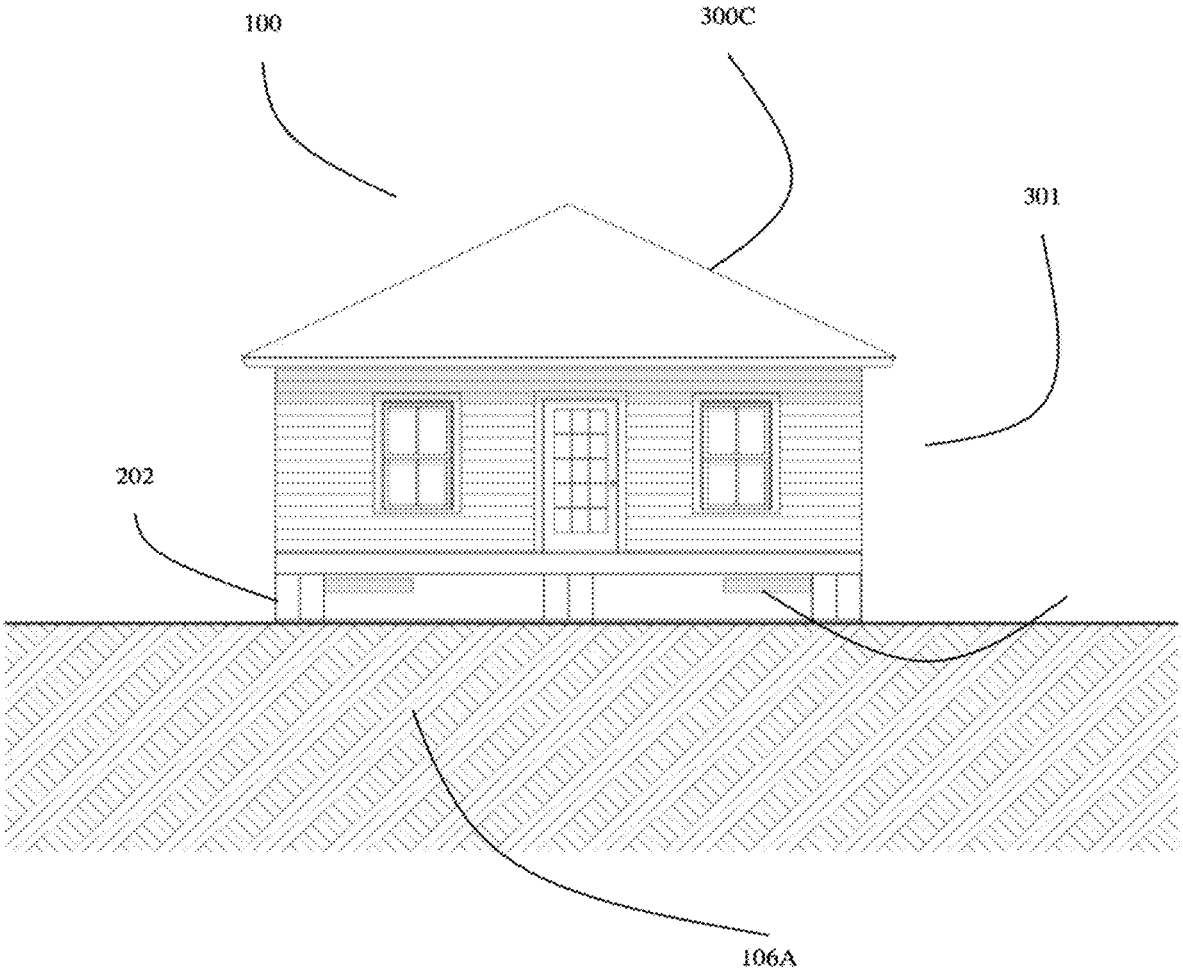
FIG. 3 illustrates an elevation view that shows a house at rest sitting on a pier on gradebeam system and tethered to the foundation system with multiple primary parallel struts system units, according to an example embodiment of the present disclosure.

FIG. 3 illustrates an elevation view that shows a house at rest sitting on a pier on gradebeam system 202 and tethered to the foundation system 200 with multiple primary parallel struts system 104 units, according to an example embodiment of the present disclosure. Object type 300C may be defined as a structure with a roof and walls that is used as a place for people to live, work, do activities, and to store things. Examples of object type 300C may include a house, a school, a garage, a store, a factory, an office and a storage structure. In some example embodiments, the object type 300C may be configured to be an object 100 and be susceptible to movement from an external force 500. In some example embodiments, the object type 300C may be configured to float in rising water 1202. In some example embodiments, the object type 300C may be coupled with the stabilization system 108 and may be coupled with the object platform system 1500. In some example embodiments, the object type 300C may be positioned above the foundation system 200. In some example embodiments, the object type 300C may interact in multiple ways: it may interact with the object platform system 1500, it also may interact with the object to platform anchor 1101 and it may interact with the stabilization system 108.

Figure 4:
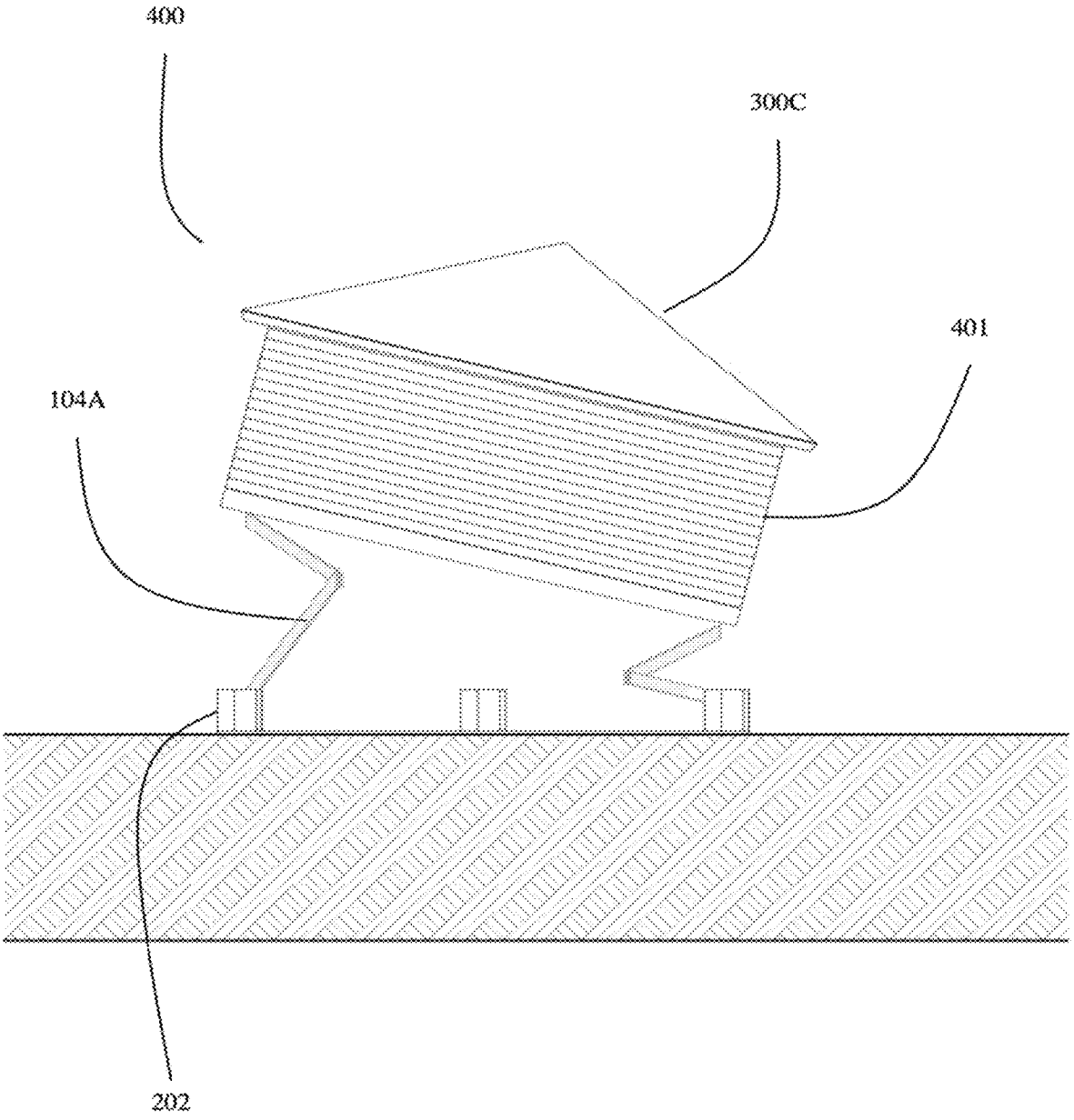
FIG. 4 illustrates an elevation view that shows a house anchored to the stabilization system of multiple primary parallel struts system units which allow an asymmetrical position caused by high velocity wind or water waves while separated from the pier on gradebeam system due to rising water, according to an example embodiment of the present disclosure.

FIG. 4 illustrates an elevation view that shows a house anchored to the stabilization system 108 of multiple primary parallel struts system 104 units which allow an asymmetrical position caused by high velocity wind 4000 or water waves 501 while separated from the pier on gradebeam system 202 due to rising water 1202, according to an example embodiment of the present disclosure. In some example embodiments, the primary parallel struts system 104A may be configured to comprise an upper strut 702, a lower strut 703, an elbow hinge 700, an object hinge 2200, and a foundation hinge 1800, allow vertical movement between the object 100 and the foundation system 200, maintain a fixed distance between the foundation hinge 1800 and the elbow hinge 700, maintain a fixed distance between the object hinge 2200 and the elbow hinge 700 and maintain the upper strut 702 and the lower strut 703 parallel to each other. In some example embodiments, the primary parallel struts system 104A may comprise multiple offset axle shaft 7200. Limited platform position 400 may be defined as the possible physical position of the object platform system 1500 restricted by the stabilization system 108 when in an object separated 103 position. In some example embodiments, the limited platform position 400 may be configured to illustrate the limited positions of the object platform system 1500.

Figure 5:
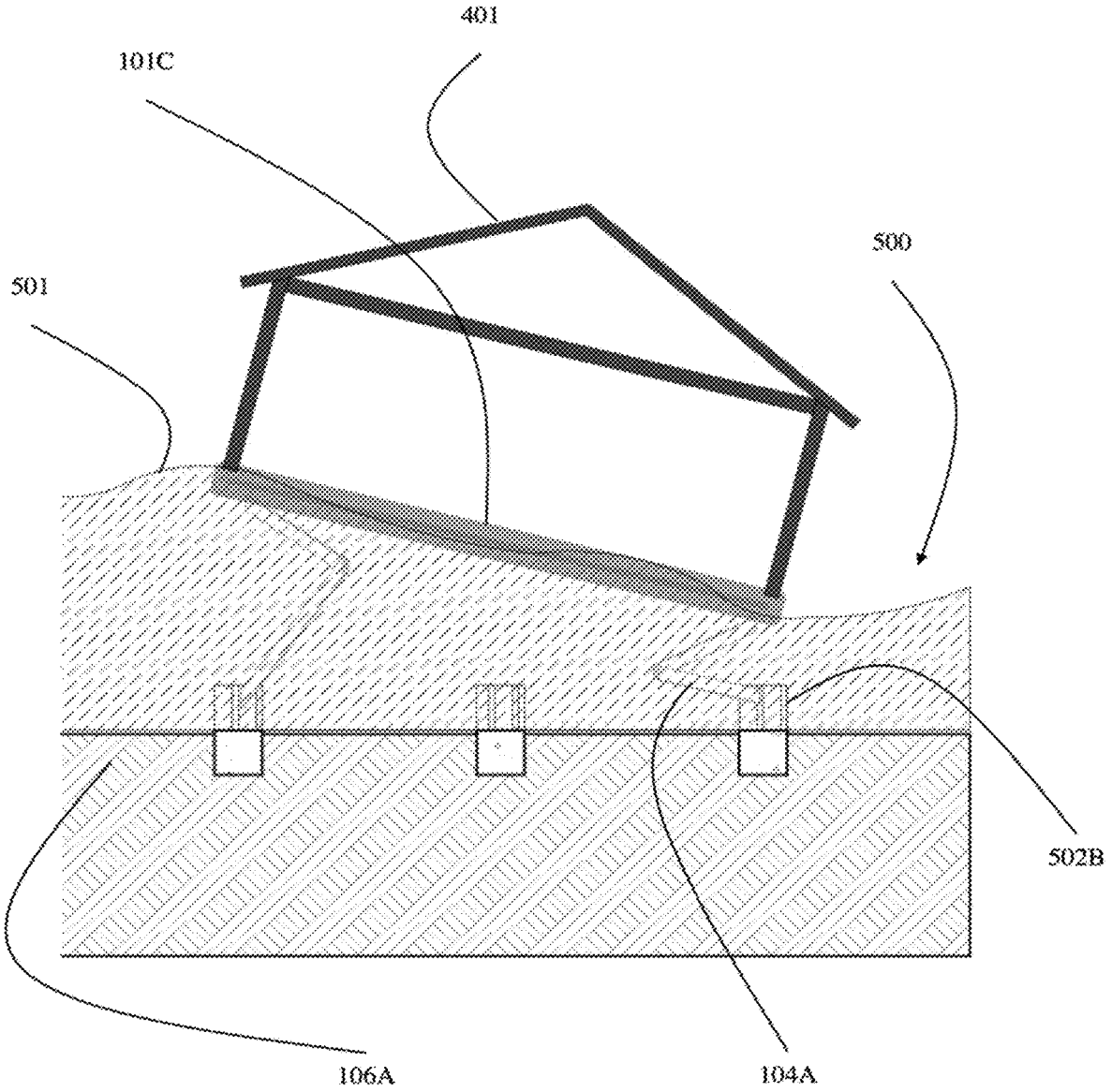
FIG. 5 illustrates a section view that shows a floating house object separated from the foundation system due to rising water and experiencing the additional external force of water waves causing the object platform system to move asymmetrically within a safe limited platform position while remaining anchored by multiple primary parallel struts system units anchored to a pier on gradebeam system, according to an example embodiment of the present disclosure.

FIG. 5 illustrates a section view that shows a floating house object 100 separated from the foundation system 200 due to rising water 1202 and experiencing the additional external force 500 of water waves 501 causing the object platform system 1500 to move asymmetrically within a safe limited platform position 400 while remaining anchored by multiple primary parallel struts system 104 units anchored to a pier on gradebeam system 202, according to an example embodiment of the present disclosure. In some example embodiments, the pier location system 502B may be configured to locate the pier 14600 on either the grade beam 201, spot footing 14100, or slab foundation 12000. In some example embodiments, the pier location system 502B may comprise pier on gradebeam system 202.

Figure 6:
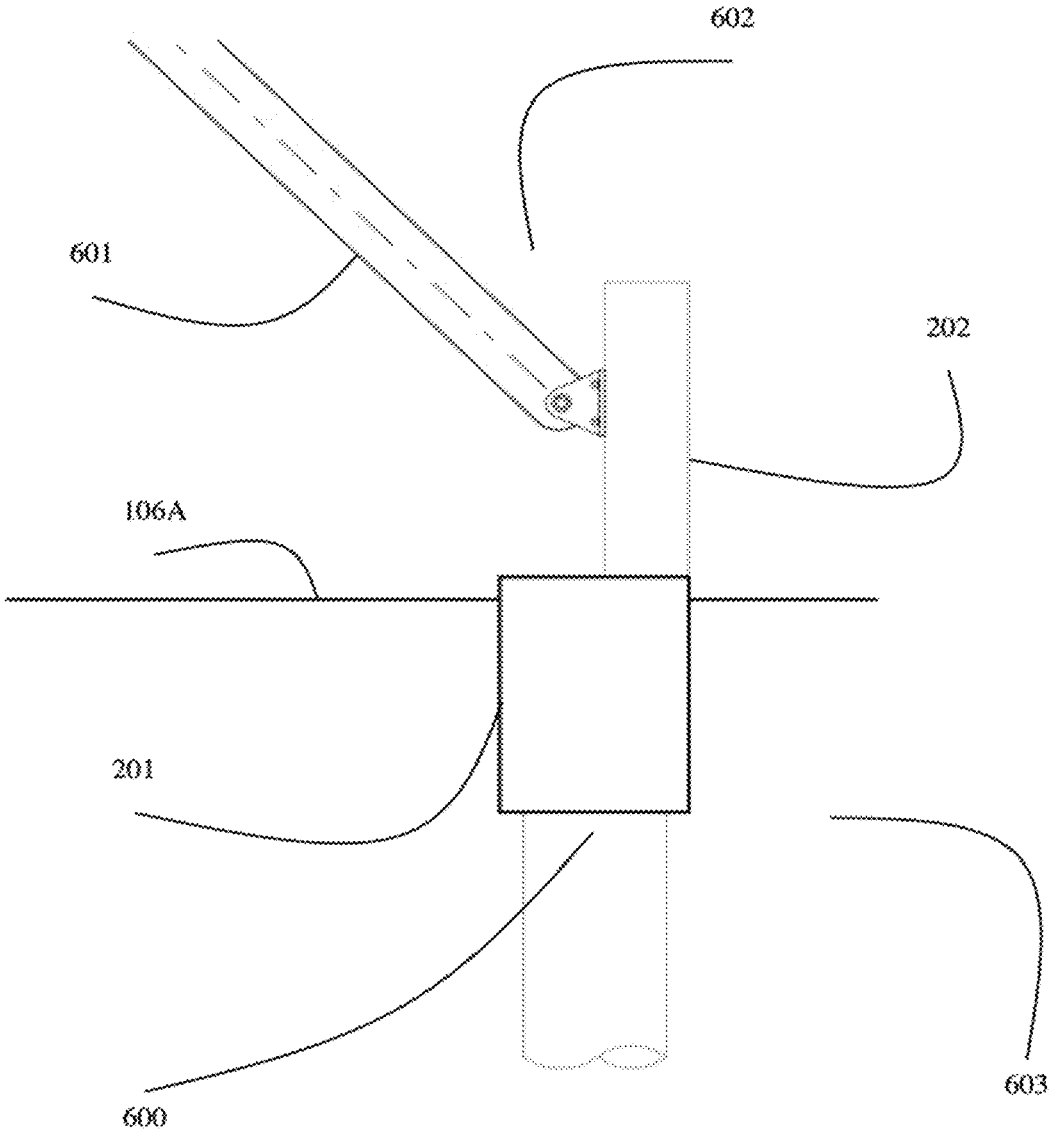
FIG. 6 illustrates an elevation view that shows the lower strut of a primary parallel struts system anchored to a pier on gradebeam system which is anchored to a supporting foundation of a shaft system, according to an example embodiment of the present disclosure.

FIG. 6 illustrates an elevation view that shows the lower strut 703 of a primary parallel struts system 104 anchored to a pier on gradebeam system 202 which is anchored to a supporting foundation 600 of a shaft system 12800, according to an example embodiment of the present disclosure. In some example embodiments, the supporting foundation 600 may be configured to connect to and support either the grade beam 201, spot footing 14100, or slab foundation 12000 and remain connected to grade 106. Strut 601 may be defined as a rigid structural member that can withstand the forces of compression, tension, and bending. In some example embodiments, the strut 601 may be configured to be anchored to the elbow hinge 700, be anchored to either the object hinge 2200 or to the foundation hinge 1800 and maintain a fixed length. In some example embodiments, if the strut 601 is absent then some other physical object capable of transferring the compressive, tensile, and bending forces while remaining connected to the elbow hinge 700 and either the foundation hinge 1800 or the object hinge 2200. In some example embodiments, the strut 601 may be configured to hinge adjacent to one or more of its companion strut 601 units to increase or reduce the vertical space when enabling the object 100 to transition between the object at rest 301 position and the object separated 103 position. In some example embodiments, the strut 601 may be positioned below the object 100 and above the foundation system 200. In some example embodiments, the strut 601 may be coupled with the elbow hinge 700 on one end and either the foundation hinge 1800 or the object hinge 2200 on the other. In some example embodiments, the strut 601 may contain the material dimensional wood lumber. In some example embodiments, the strut 601 may be shaped like rectangular tongue depressor or popsicle stick, flat, rectangular in section, and optionally rounded on each end. In some example embodiments, the strut 601 may interact with the foundation system 200 and the object 100 or the object platform system 1500. In some example embodiments, the single hinge system 602 may be configured to contain a single hinge leaf system 5801 and contain the hinge pin 800. In some example embodiments, the single hinge system 602 may comprise hinge pin 800 or hinge leaf system 5801. In some example embodiments, the foundation support system 603 may be configured to support the object 100, remain stationary, anchor and remain connected to the stabilization system 108, support the foundation system 200 and remain connected to grade 106. In some example embodiments, the foundation support system 603 may comprise grade beam 201, spot footing 14100, slab foundation 12000, pier system 105 or shaft system 12800.

Figure 7:
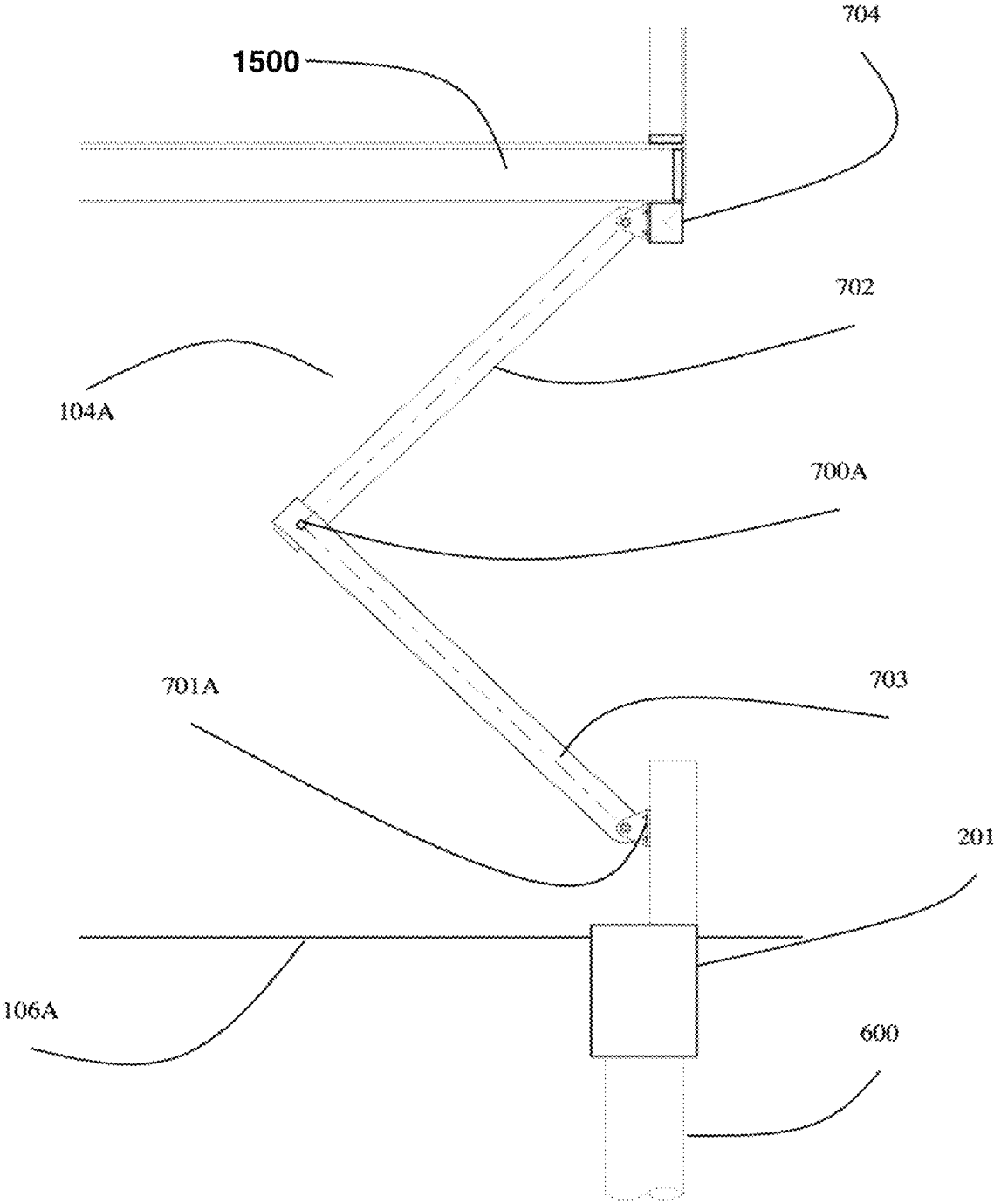
FIG. 7 illustrates a section view that shows of a floating house resting on an object platform system that is anchored to the sill which anchors the upper strut of a primary parallel struts system whose lower strut is anchored to the pier on gradebeam system with the cleat anchor mounting system, according to an example embodiment of the present disclosure.

FIG. 7 illustrates a section view that shows of a floating house resting on an object platform system 1500 that is anchored to the sill 704 which anchors the upper strut 702 of a primary parallel struts system 104 whose lower strut 703 is anchored to the pier on gradebeam system 202 with the cleat anchor mounting system 701, according to an example embodiment of the present disclosure. In some example embodiments, the elbow hinge 700A may be configured to allow rotational arc movement between the lower strut 703 relative to the upper strut 702. In some example embodiments, the elbow hinge 700A may comprise axle limiter or axle shaft 11700. Cleat anchor mounting system 701A may be defined as locating the cleat anchor system 801 on the vertical or side face of the object 100, the platform sill 1003, the sill 704, the pier system 105, or the shaft system 12800. In some example embodiments, the cleat anchor mounting system 701A may be configured to configure the anchor plate 803 for attachment to the object 100 and configure the anchor plate 803 for attachment to the foundation system 200. In some example embodiments, the upper strut 702 may be configured to maintain a fixed distance between the object hinge 2200 and the strut attachment system 1900. In some example embodiments, the lower strut 703 may be configured to maintain a fixed distance between the foundation hinge 1800 and the Elbow Hinge. In some example embodiments, the sill 704 may be configured to anchor to the stabilization system 108, support and transfer the supporting frame 101 dead and live loads in the spans between members of the pier system 105 or other foundation system 200 contact point, remain rigid and anchor the supporting frame 101.

Figure 8:
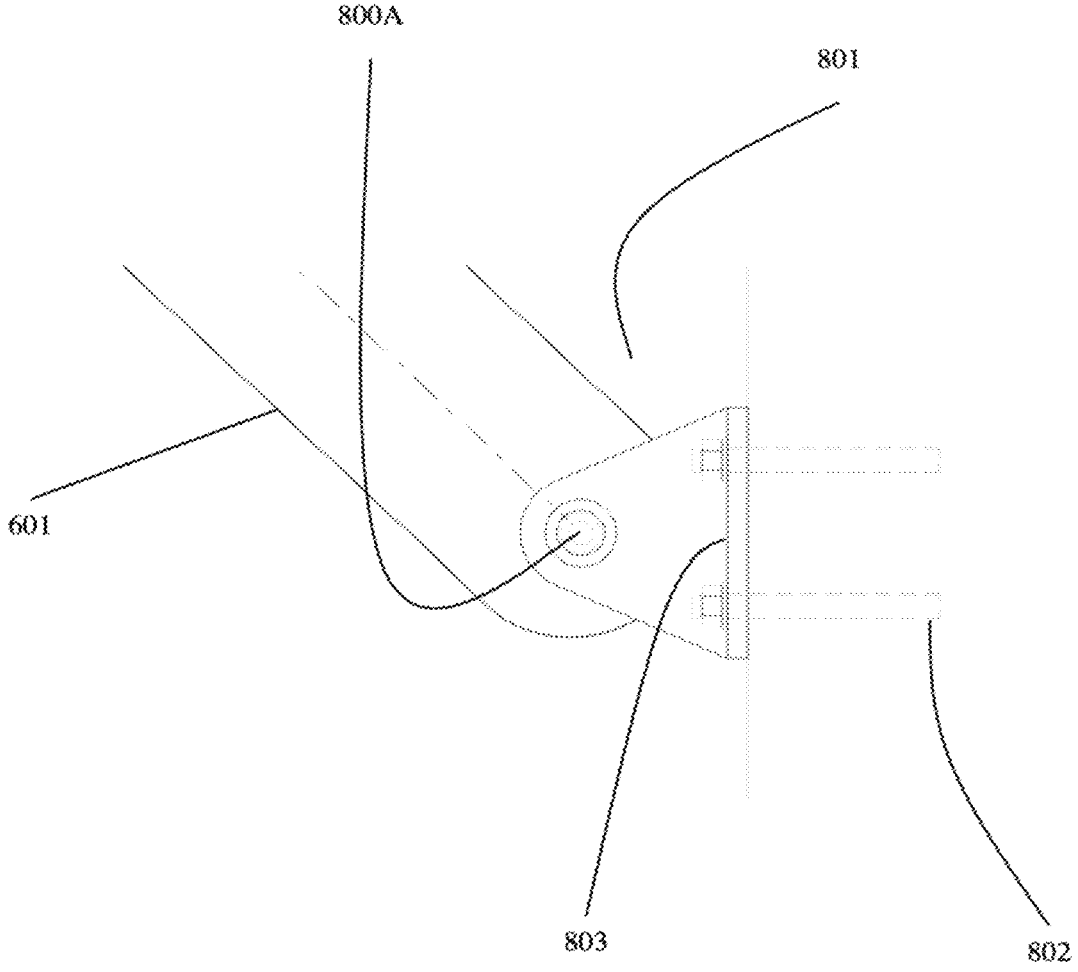
FIG. 8 illustrates an elevation view that shows how the cleat anchor system anchors the hinge block system using multiple anchor fastener units, according to an example embodiment of the present disclosure.

FIG. 8 illustrates an elevation view that shows how the cleat anchor system 801 anchors the hinge block system 2700 using multiple anchor fastener 802 units, according to an example embodiment of the present disclosure. In some example embodiments, the hinge pin 800A may be configured to allow the lower strut 703 to rotate on the elbow hinge 700, allow the lower strut 703 to rotate on foundation hinge 1800, allowing the upper strut 702 to rotate on the object hinge 2200 and allow the upper strut 702 to rotate on the elbow hinge 700. Cleat anchor system 801 may be defined as a device or assembly that anchors the foundation hinge 1800 to the foundation system 200 and the object hinge 2200 to the object 100 or object platform system 1500. In some example embodiments, the cleat anchor system 801 may be configured to anchor the strut cleat system 3100 to the object 100 and anchor the strut cleat system 3100 to the foundation system 200. In some example embodiments, the cleat anchor system 801 may be configured to anchor the foundation hinge 1800, anchor the object hinge 2200, anchor the object hinge 2200 to the object 100 or object platform system 1500 and anchor the foundation hinge 1800 to the foundation system 200. In some example embodiments, the cleat anchor system 801 may be coupled with the foundation system 200, the foundation hinge 1800, the object 100, the object platform system 1500 or the object hinge 2200. In some example embodiments, the cleat anchor system 801 may contain the material stainless steel. In some example embodiments, the cleat anchor system 801 may comprise cleat anchor mounting system 701, anchor fastener 802 or anchor plate 803. In some example embodiments, the anchor fastener 802 may be configured to fasten the anchor plate 803 to the foundation system 200 and anchor to the object 100. Anchor plate 803 may be defined as a device anchored to the strut hinge system 2600 that anchors to the foundation system 200 or to the object 100 or the object platform system 1500. In some example embodiments, the anchor plate 803 may be configured to anchor to the hinge block system 2700 and accept at least one anchor fastener 802. In some example embodiments, the anchor plate 803 may be coupled with the strut hinge system 2600, the foundation system 200, the object 100 or the object platform system 1500.

Figure 9:
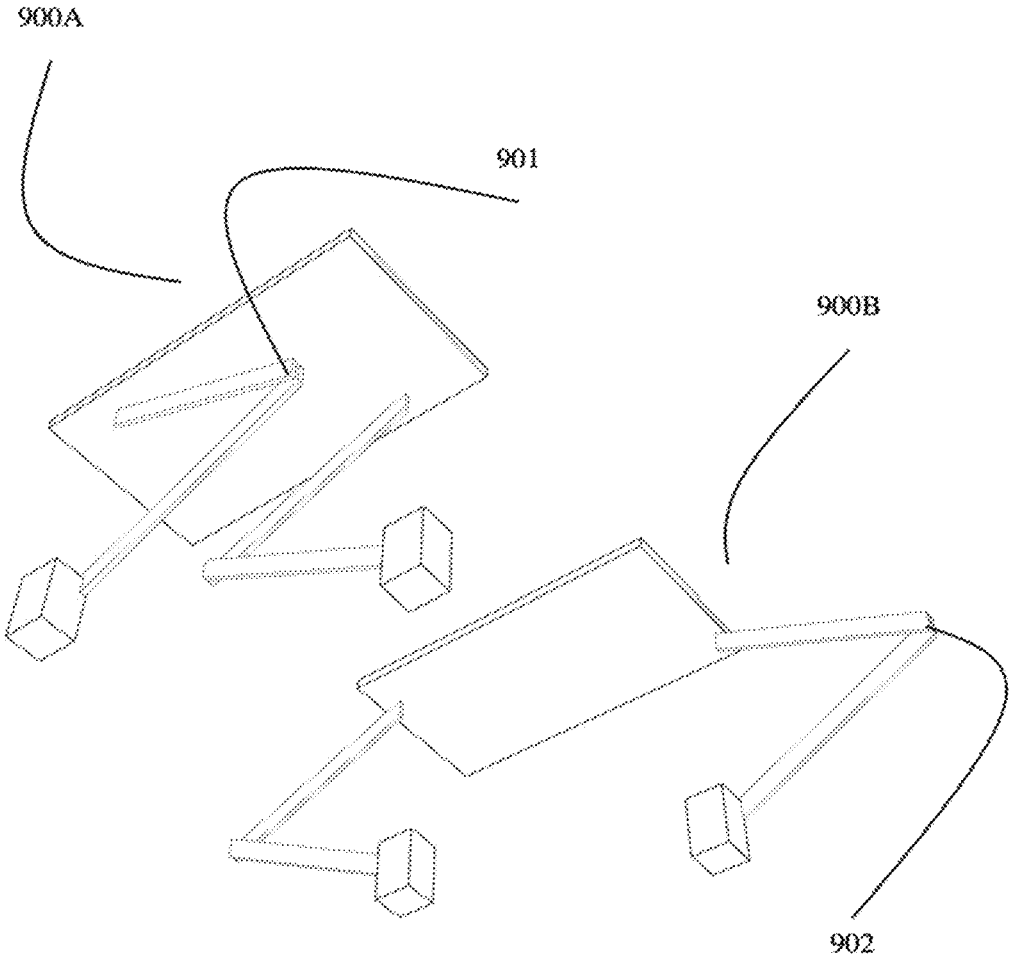
FIG. 9 illustrates a worms eye perspective view that shows two examples of multiple primary parallel struts system units set in opposing elbow system arrangements, one set with inward acting elbow orientation and the other set with outward acting elbow orientations, according to an example embodiment of the present disclosure.

FIG. 9 illustrates a worms eye perspective view that shows two examples of multiple primary parallel struts system 104 units set in opposing elbow system 900 arrangements, one set with inward acting elbow 901 orientation and the other set with outward acting elbow 902 orientations, according to an example embodiment of the present disclosure. opposing elbow system 900A may be defined as the arrangement of two or more primary parallel struts system 104 assemblies such that the elbow hinge 700 of one folds towards the others when approaching its resting position. In some example embodiments, the opposing elbow system 900A may be configured to be anchored to the foundation system 200, be anchored to the object 100 and position at least one primary parallel struts system 104 to restrict the motion of at least one other primary parallel struts system 104. In some example embodiments, the opposing elbow system 900A may be configured to position two or more primary parallel struts system 104 assemblies such that the single folding strut movement 7100 of one restricts the single folding strut movement 7100 or one or more of the others. In some example embodiments, the opposing elbow system 900A may be positioned according to the cleat positioning system 3701 locating the upper and lower hinge block system 2700 for each primary parallel struts system 104 in matching grid, radial, or other geometric arrangements. In some example embodiments, the opposing elbow system 900A may be coupled with the foundation system 200 and the object 100 or object platform system 1500. In some example embodiments, the opposing elbow system 900A may interact with the foundation system 200 and the object platform system 1500. In some example embodiments, the opposing elbow system 900A may comprise inward acting elbow 901. Opposing elbow system 900B may be defined as the arrangement of two or more primary parallel struts system 104 assemblies such that the elbow hinge 700 of one folds away from the others when approaching its resting position. In some example embodiments, the opposing elbow system 900B may be configured to position two or more primary parallel struts system 104 assemblies such that the single folding strut movement 7100 of one restricts the single folding strut movement 7100 or one or more of the others. In some example embodiments, the opposing elbow system 900B may be positioned according to the cleat positioning system 3701 locating the upper and lower hinge block system 2700 for each primary parallel struts system 104 in matching grid, radial, or other geometric arrangements. In some example embodiments, the opposing elbow system 900B may be coupled with the foundation system 200 and the object 100 or object platform system 1500. In some example embodiments, the opposing elbow system 900B may interact with the foundation system 200 and the object platform system 1500. In some example embodiments, the inward acting elbow 901 may be configured to include at least two primary parallel struts system 104 units and be positioned such that the elbow hinge 700 of one folds inward towards the other primary parallel struts system 104. In some example embodiments, the outward acting elbow 902 may be configured to include at least two primary parallel struts system 104 units and be positioned such that the elbow hinge 700 of one primary parallel struts system 104 folds outward and away from the elbow hinge 700 fold direction of at least one other primary parallel struts system 104. In some example embodiments, the outward acting elbow 902 may comprise opposing elbow system 900.

Figure 10:
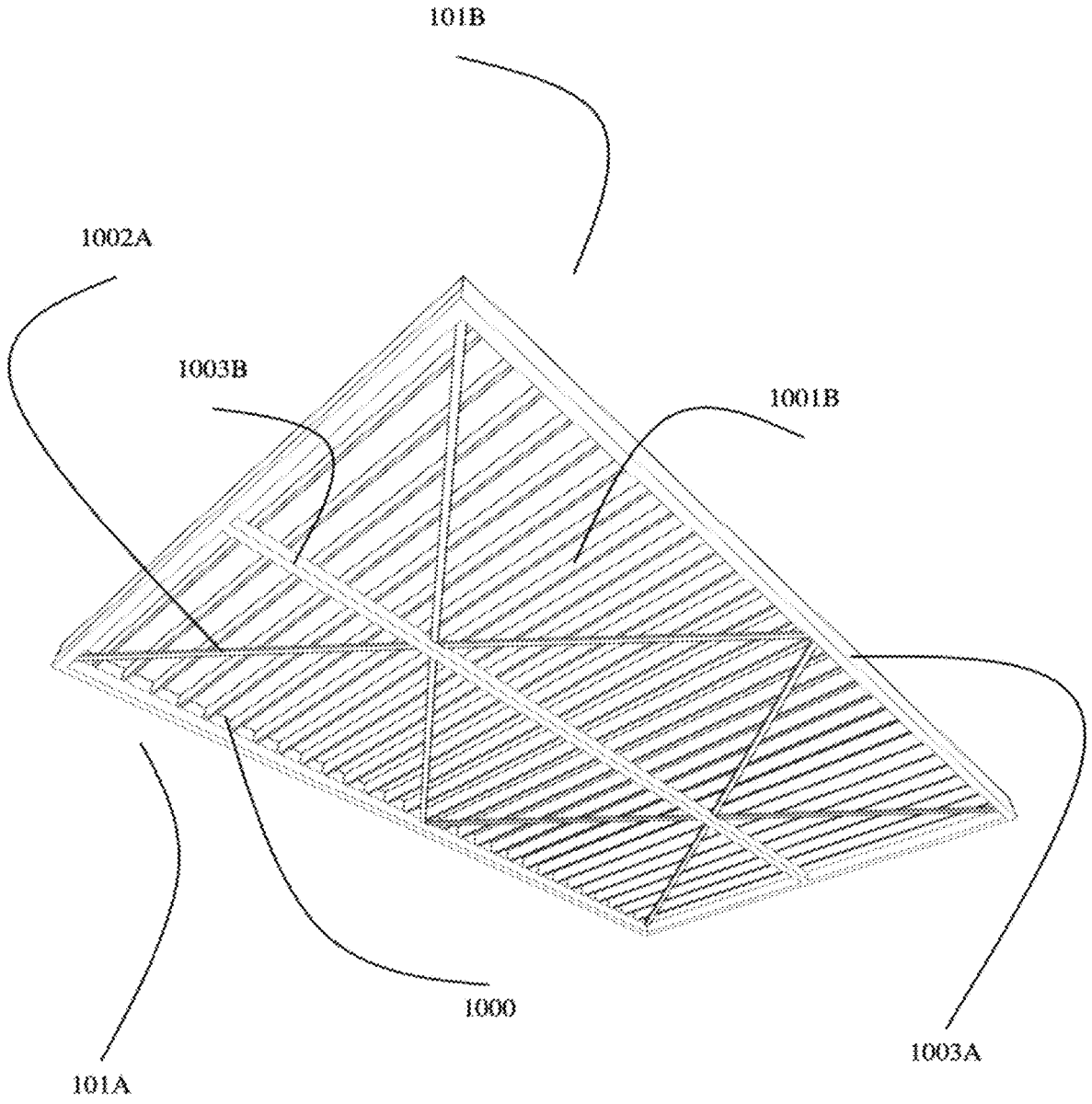
FIG. 10 illustrates a worms eye perspective view that shows the supporting frame system elements of multiple platform joist units terminating into rim joist units, all resting on and anchored to the platform sill and given lateral rigidity by the platform bracing system diagonal units, according to an example embodiment of the present disclosure.

FIG. 10 illustrates a worms eye perspective view that shows the supporting frame 101 system elements of multiple platform joist 1001 units terminating into rim joist 1000 units, all resting on and anchored to the platform sill 1003 and given lateral rigidity by the platform bracing system 1002 diagonal units, according to an example embodiment of the present disclosure. In some example embodiments, the rim joist 1000 may be configured to anchor each platform joist 1001 in a parallel position, position each platform joist 1001 in a parallel position and stiffen the supporting floor 1100 perimeter. Supporting frame 101A may be defined as one or more structural members added to a supporting frame 101 that adds rigidity and stiffness as well as prevents racking. In some example embodiments, the supporting frame 101A may be configured to maintain a rigid shape and support the object 100. In some example embodiments, the supporting frame 101A may comprise platform bracing system 1002. Supporting frame 101B may be defined as an assembly of multiple platform joist 1001 members used to span an open space, often between rim joist 1000 and rim joist 1000 or between rim joist 1000 and header. Examples of supporting frame 101B may include floor joist, joist, purlin and beam. In some example embodiments, the supporting frame 101B may be configured to support the gravity loads of the object 100 and its contents and support the water displacement loads pushing upwards on the object 100 in conditions of rising water 1202. In some example embodiments, the supporting frame 101B may interact in multiple ways: it may interact with anchoring the supporting floor 1100, it also may interact with anchoring the hull bottom sheathing 4301, it also may interact with anchoring the platform sill 1003 and it may interact with contain the static buoyancy installation 5000. In some example embodiments, the supporting frame 101B may comprise rim joist 1000, header or platform joist 1001. In some example embodiments, the platform joist 1001B may be configured to provide stiffness to the supporting floor 1100 allowing it to function as a horizontal diaphragm, support the object 100 in rising water 1202, remain rigid and support the object 100 in the condition of the platform at resting position 7901. Platform bracing system 1002A may be defined as used to provide both lateral and longitudinal stability of the supporting frame 101 while distributing the vertical bending effects between each platform joist 1001, and to ensure that lateral effects such as high velocity wind 4000 loading and stresses from floating on undulating water waves 501 are resisted. In some example embodiments, the platform bracing system 1002A may be configured to resist and prevent racking or twisting movement in the supporting frame 101. In some example embodiments, the platform sill 1003A may be configured to span between each pier 14600 or other contact point between the object 100 and the foundation system 200, stiffen and support loads acting on the supporting floor 1100, transfer the supporting frame 101 dead and live loads to the foundation system 200, anchor to the stabilization system 108, anchor to the supporting frame 101 and remain rigid. In some example embodiments, the platform sill 1003A may comprise sill 704.

Figure 11:
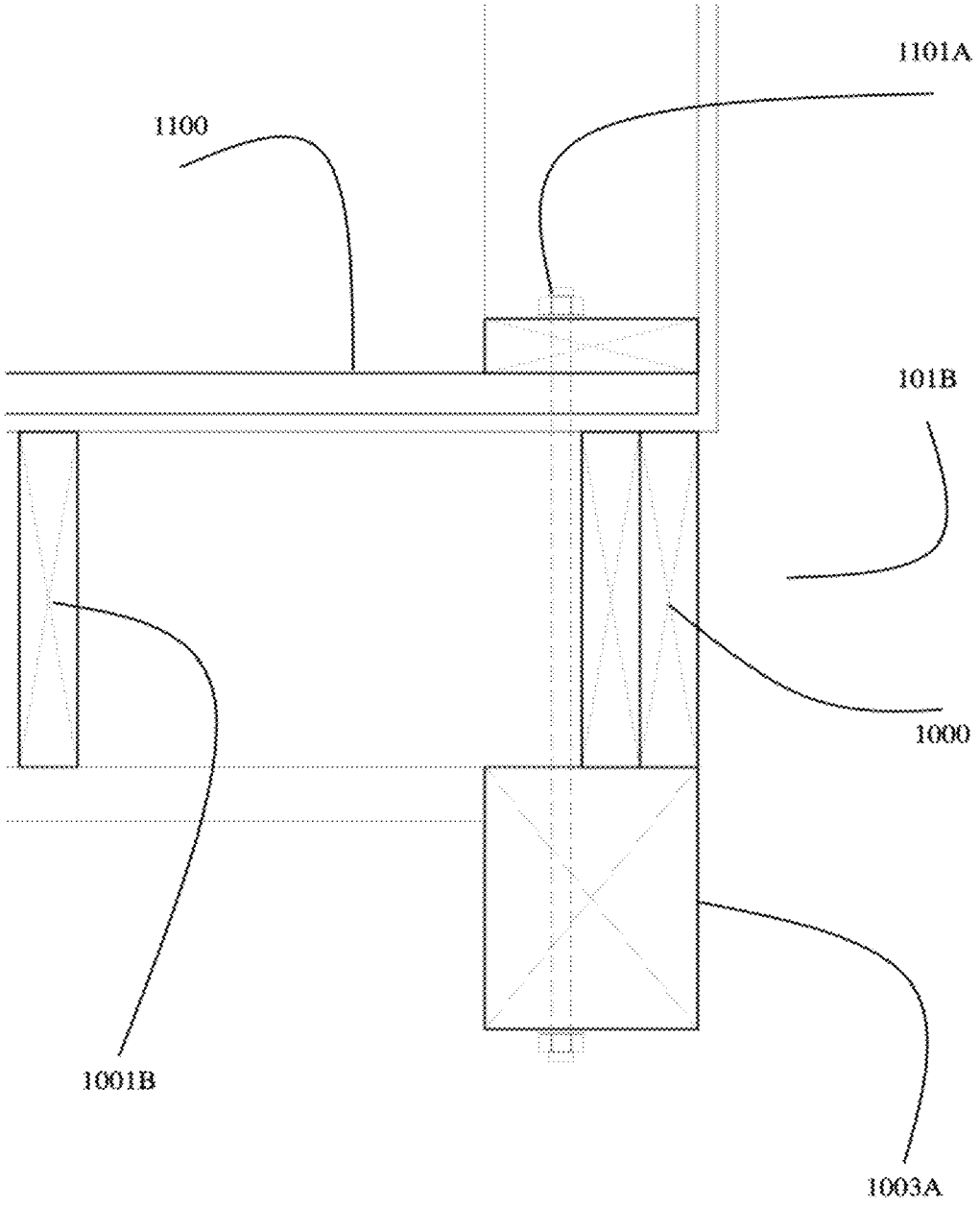
FIG. 11 illustrates a section view that shows one method of connecting the platform sill to the supporting frame using an object to platform anchor, according to an example embodiment of the present disclosure.

FIG. 11 illustrates a section view that shows one method of connecting the platform sill 1003 to the supporting frame 101 using an object to platform anchor 1101, according to an example embodiment of the present disclosure. Supporting floor 1100 may be defined as that part of a supporting frame 101 that forms its lower enclosing surface which supports the object 100. In some example embodiments, the supporting floor 1100 may be configured to support the structural loads caused by buoyant uplift acting between each platform joist 1001, remain rigid, support the structural dead loads and live loads of the object 100 in the spans between each platform joist 1001 and remain attached to each platform joist 1001. Object to platform anchor 1101A may be defined as a connection between the object 100 and the object platform system 1500 that is a permanent part of the structure. In some example embodiments, the object to platform anchor 1101A may be configured to anchor the object 100 to the object platform system 1500.

Figure 12:
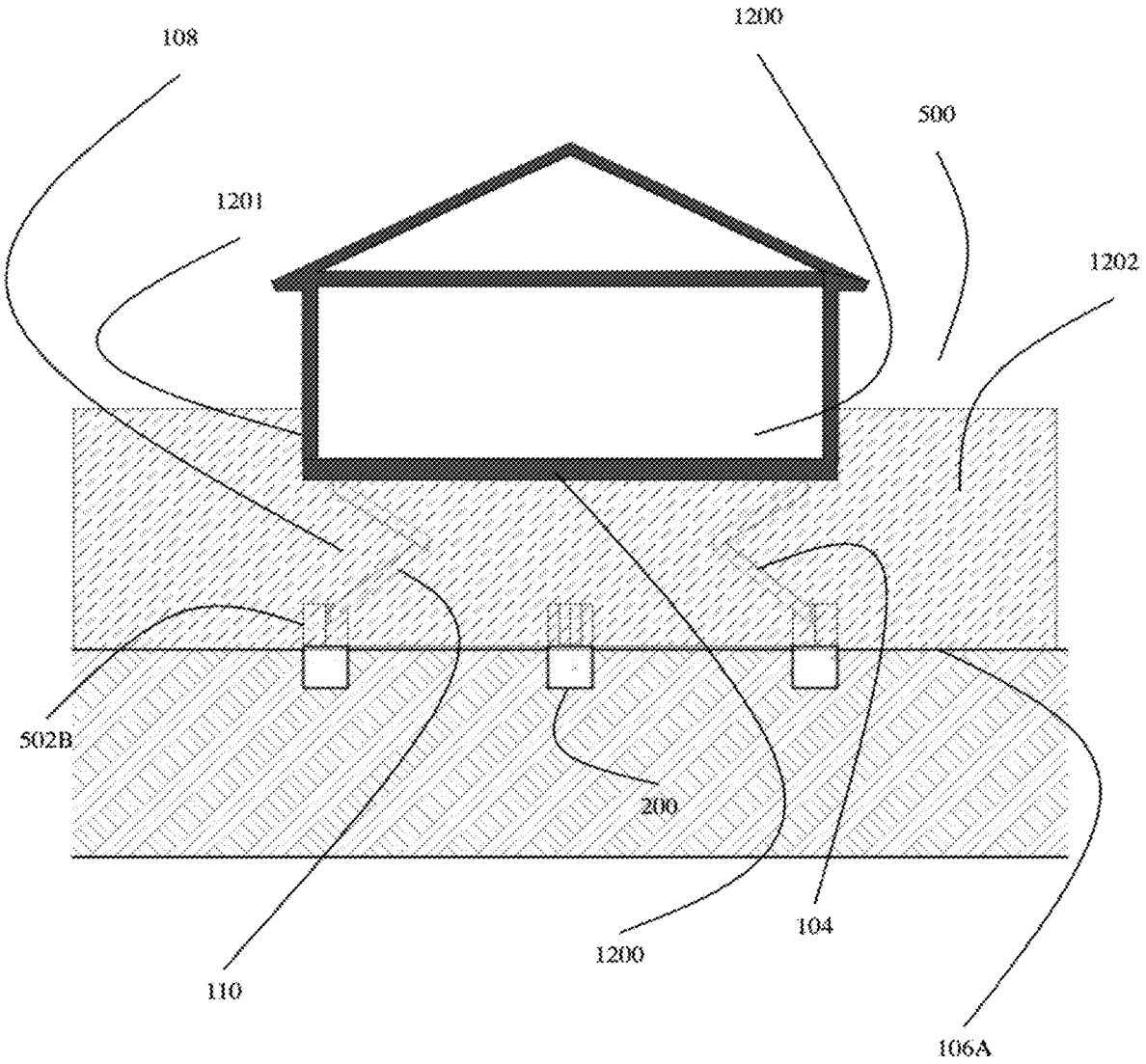
FIG. 12 illustrates a section view that shows a house as the object outfitted to serve as the buoyancy system to float the house in rising water from the external force of flooding while tethered to the foundation system by multiple hinged system units of folding struts, according to an example embodiment of the present disclosure.

FIG. 12 illustrates a section view that shows a house as the object 100 outfitted to serve as the buoyancy system 1200 to float the house in rising water 1202 from the external force 500 of flooding while tethered to the foundation system 200 by multiple hinged system units of folding struts, according to an example embodiment of the present disclosure. In some example embodiments, the buoyancy system 1200 may be configured to float the object 100 in rising water 1202. In some example embodiments, the buoyancy system 1200 may be configured to be internal to the structure and able to prevent leakage. In some example embodiments, the buoyancy system 1200 may comprise hull bottom sealing system 6302, hull side sealing system 1201 or fenestration buoyancy system 4400. In some example embodiments, the hull side sealing system 1201 may comprise hull side sheathing 6301, hull side waterproof membrane 6201 or hull side framing 6300. In some example embodiments, the foundation system 200 may be configured to be supported by grade 106, remain anchored to grade 106, support the object 100, support and resist the forces transmitted through the stabilization system 108 and remain connected to the stabilization system 108. In some example embodiments, the foundation system 200 may comprise foundation support system 603.

Figure 13:
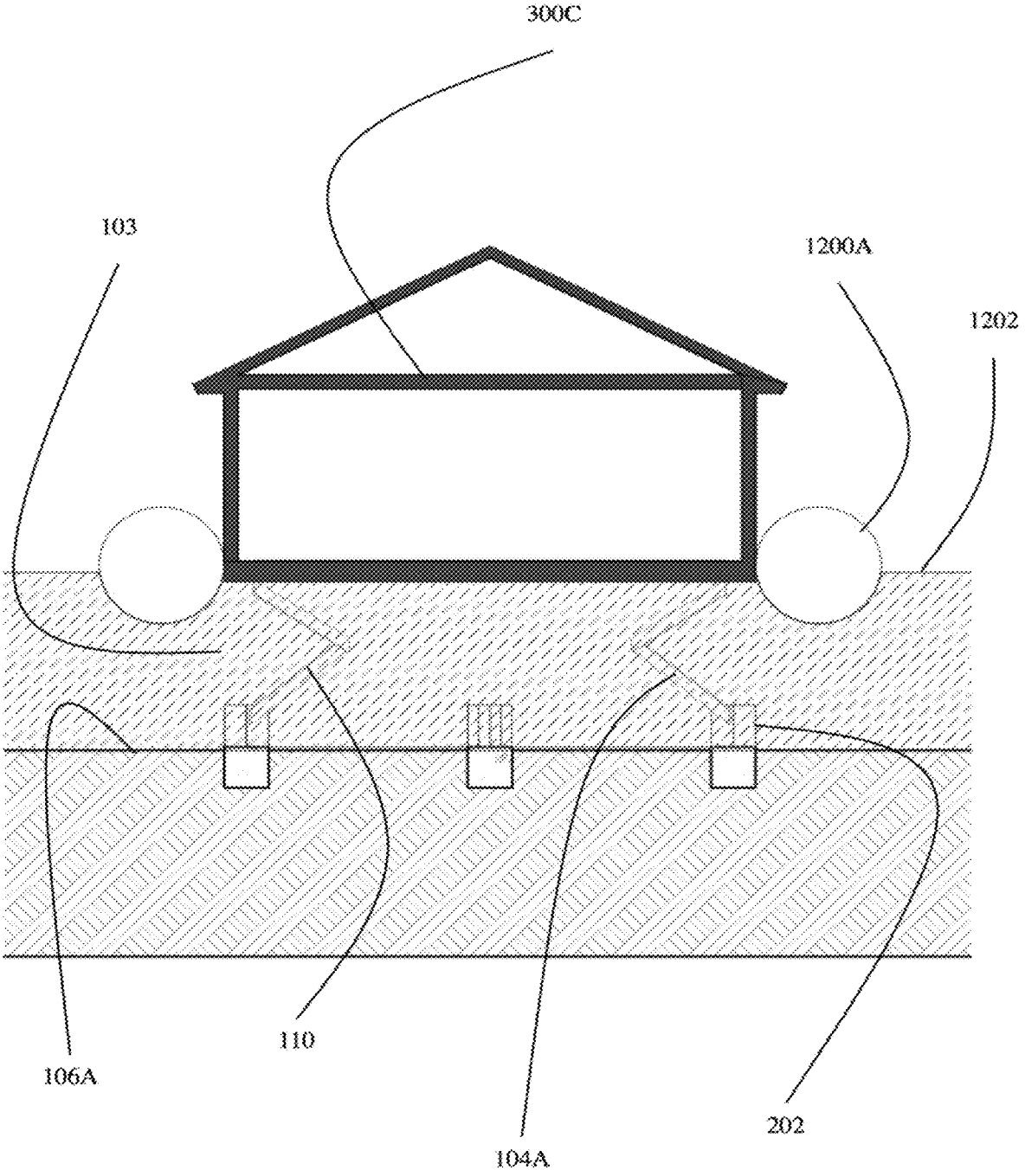
FIG. 13 illustrates a section view that shows a floating house as the object supported by an external buoyancy system and safely tethered to a pier on gradebeam system, according to an example embodiment of the present disclosure.

FIG. 13 illustrates a section view that shows a floating house as the object 100 supported by an external buoyancy system 1200 and safely tethered to a pier on gradebeam system 202, according to an example embodiment of the present disclosure. In some example embodiments, the buoyancy system 1200A may be configured to float the object 100 in rising water 1202. In some example embodiments, the buoyancy system 1200A may be configured to be external and attached to the structure. In some example embodiments, the buoyancy system 1200A may comprise deployable buoyancy 5200.

Figure 14:
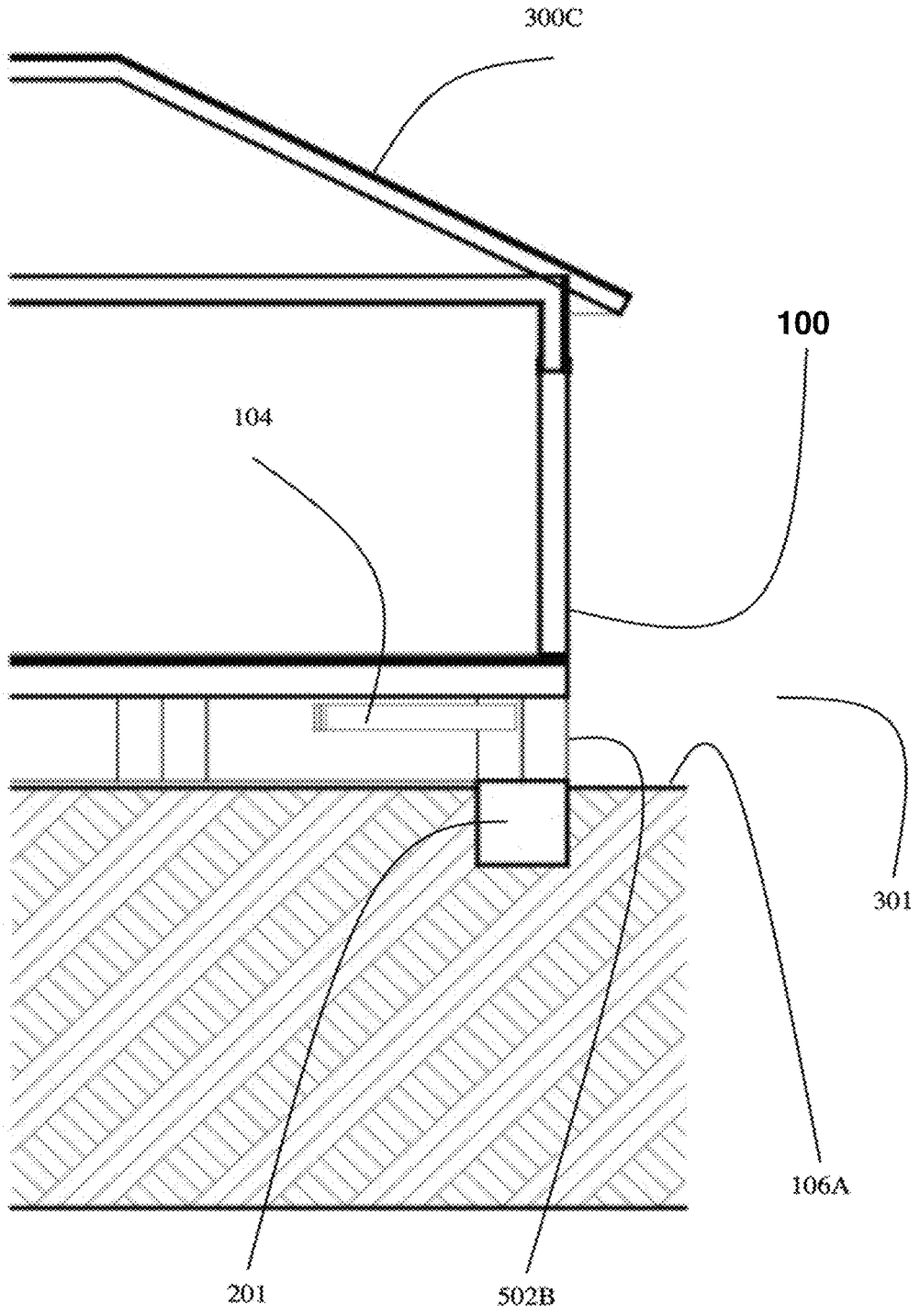
FIG. 14 illustrates a section view that shows a house in an object at rest position constructed with its bottom and sides waterproofed so that the air space inside will serve as a hull buoyancy system, according to an example embodiment of the present disclosure.

FIG. 14 illustrates a section view that shows a house in an object at rest 301 position constructed with its bottom and sides waterproofed so that the air space inside will serve as a hull buoyancy system, according to an example embodiment of the present disclosure.

Figure 15:
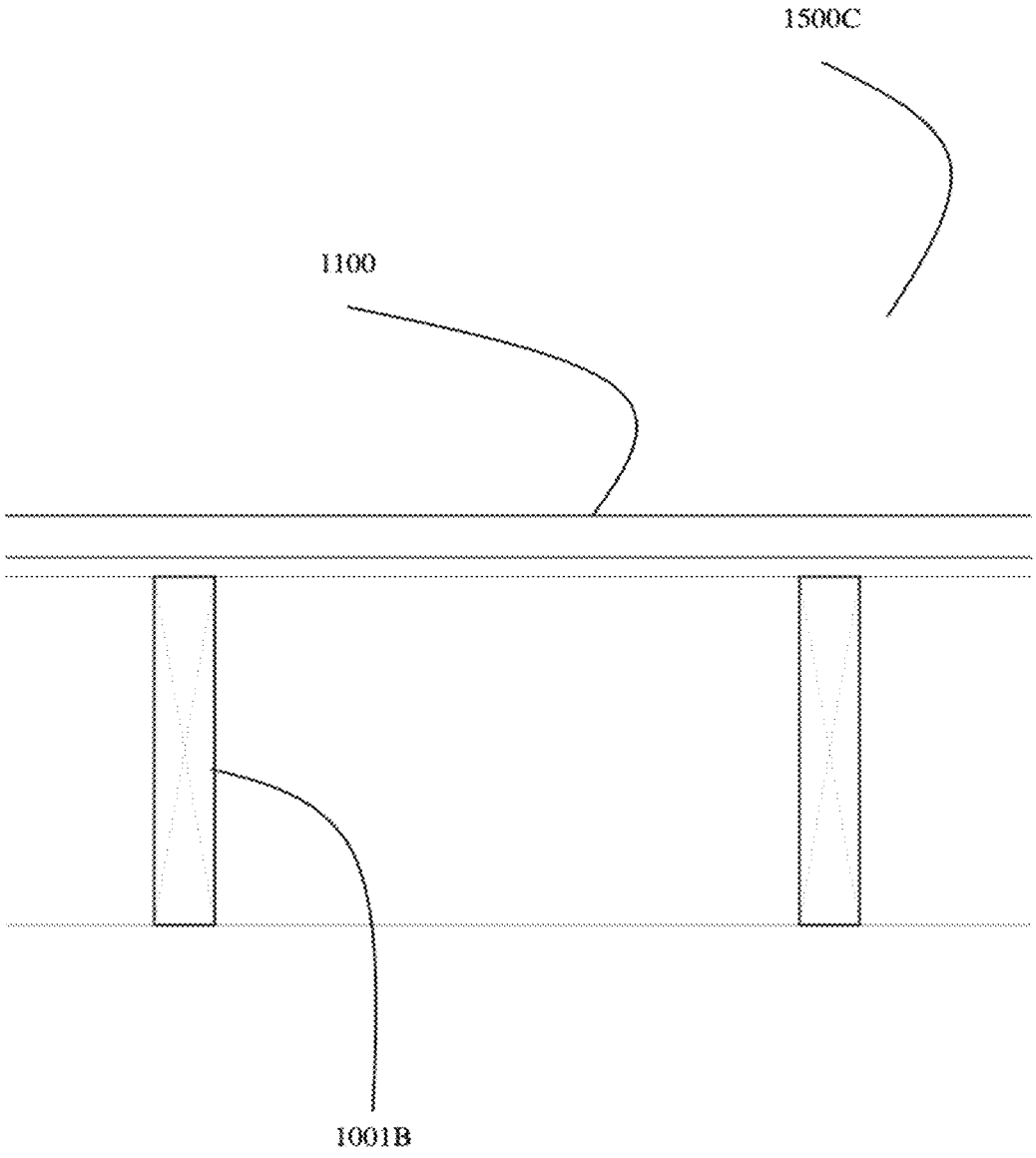
FIG. 15 illustrates a section view that shows the object platform system components of a supporting floor resting on a series of platform joist units, according to an example embodiment of the present disclosure.

FIG. 15 illustrates a section view that shows the object platform system 1500 components of a supporting floor 1100 resting on a series of platform joist 1001 units, according to an example embodiment of the present disclosure. Object platform system 1500C may be defined as a system or device that supports an object 100. In some example embodiments, the object platform system 1500C may be configured to be able to support the object 100. In some example embodiments, the object platform system 1500C may be configured to support the object 100. In some example embodiments, if the object platform system 1500C is absent then the object 100 serves as its own platform. In some example embodiments, the object platform system 1500C may be positioned above the foundation system 200 or below the object 100. In some example embodiments, the object platform system 1500C may interact in multiple ways: it may interact with the stabilization system 108, it also may interact with rising water 1202, it also may interact with the object 100, it also may interact with the platform to sill anchor 4203 and it may interact with object to platform anchor 1101. In some example embodiments, the object platform system 1500C may be coupled with the stabilization system 108, the object 100, the object to platform anchor 1101 or the platform to sill anchor 4203. In some example embodiments, the object platform system 1500C may comprise supporting frame 101, supporting floor 1100 or object to platform anchor 1101.

Figure 16:
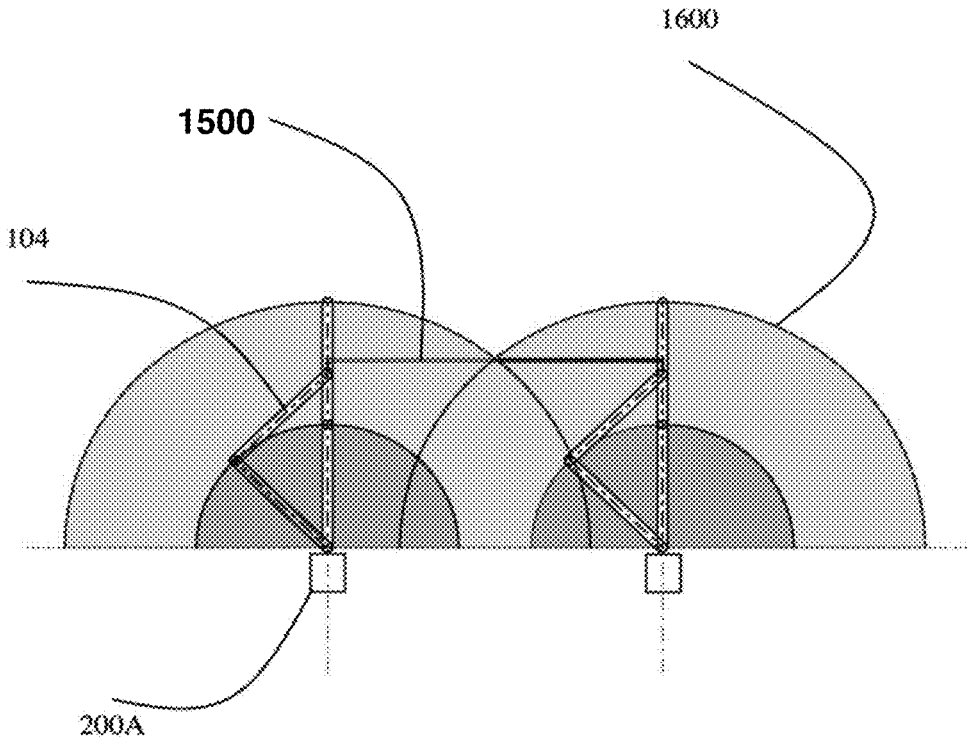
FIG. 16 illustrates an elevation view that shows a diagram illustrating the possible range of movement possible that the object platform system can experience when anchored to two primary parallel struts system units arranged in a same facing elbow system, according to an example embodiment of the present disclosure.

FIG. 16 illustrates an elevation view that shows a diagram illustrating the possible range of movement possible that the object platform system 1500 can experience when anchored to two primary parallel struts system 104 units arranged in a same facing elbow system 9800, according to an example embodiment of the present disclosure. Multiple same facing movement arc system 1600 may be defined as the possible range of movement of the object platform system 1500 at each point of connection to each strut hinge system 2600 when two or more strut hinge system 2600 assemblies are arranged as a same facing elbow system 9800. In some example embodiments, the multiple same facing movement arc system 1600 may be configured to illustrate the possible range of motion of each lower strut 703 anchored to the foundation system 200 in a same facing elbow system 9800 and illustrate the possible range of motion of each upper strut 702 anchored to the object 100 in a same facing elbow system 9800.

Figure 17:
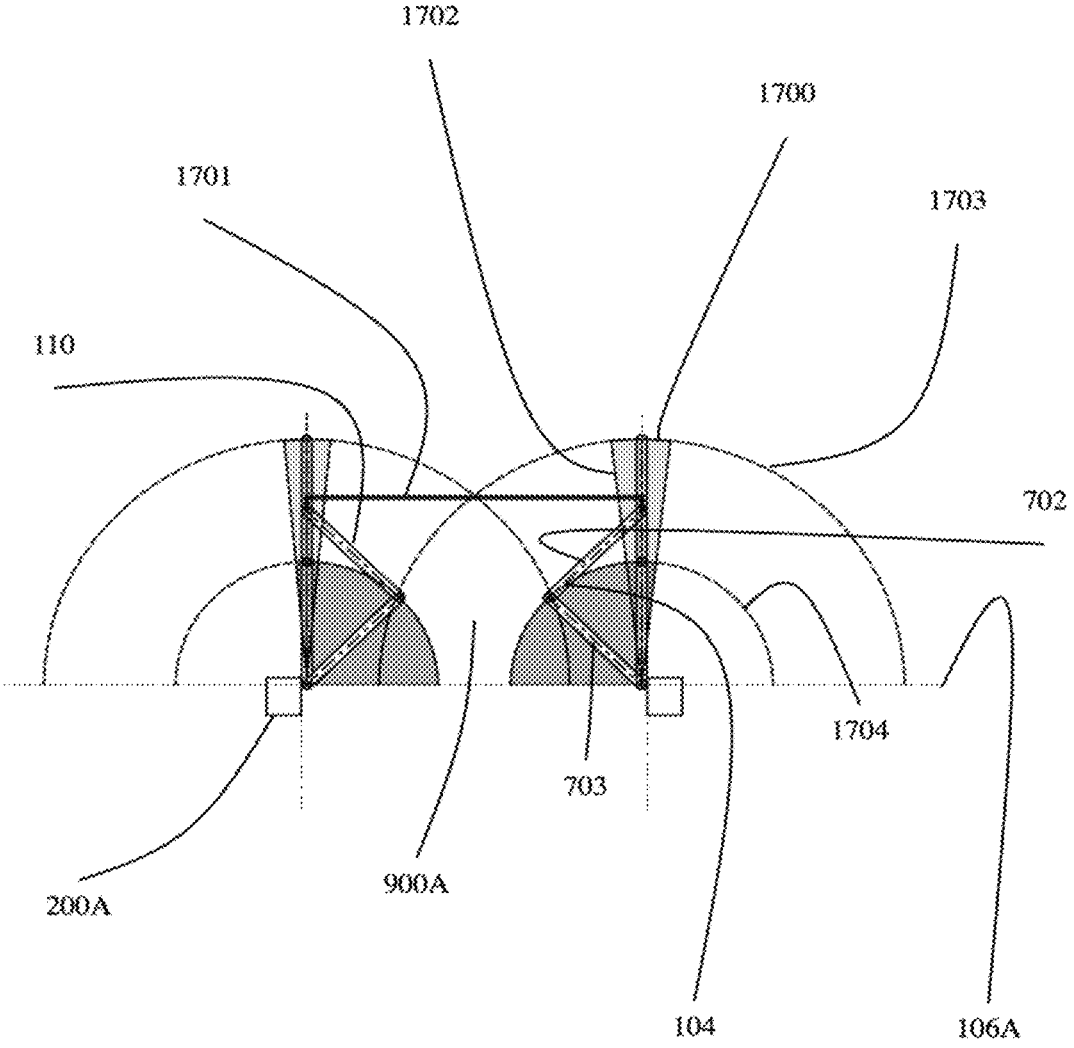
FIG. 17 illustrates an elevation view that shows a diagram illustrating the limited platform movement cone range of movement allowed for the object platform system when anchored to two or more primary parallel struts system units arranged in an opposing elbow system, according to an example embodiment of the present disclosure.

FIG. 17 illustrates an elevation view that shows a diagram illustrating the limited platform movement cone 1702 range of movement allowed for the object platform system 1500 when anchored to two or more primary parallel struts system 104 units arranged in an opposing elbow system 900, according to an example embodiment of the present disclosure. Opposing strut allowable movement 1700 may be defined as the possible range of movement of the object platform system 1500 at each point of connection to each strut hinge system 2600 when two or more strut hinge system 2600 assemblies are arranged as an opposing elbow system 900. In some example embodiments, the opposing strut allowable movement 1700 may be configured to illustrate the restricted possible range of motion of each upper strut 702 in an opposing elbow system 900 and illustrate the restricted possible range of motion of each lower strut 703 in an opposing elbow system 900. In some example embodiments, the opposing strut allowable movement 1700 may be configured to illustrate the resultant allowable range of motion for folding strut assemblies arranged at opposing angles to each other. In some example embodiments, the supporting platform 1701 may be configured to remain connected to the stabilization system 108, remain stationary and remain connected to grade 106. Limited platform movement cone 1702 may be defined as a diagram illustrating the possible range of movement and tilt of the object platform system 1500 at each point of connection to a strut hinge system 2600 relative to the foundation system 200 when two or more primary parallel struts system 104 assemblies are arranged in an opposing elbow system 900. In some example embodiments, the limited platform movement cone 1702 may be configured to illustrate the limited conal range of motion of the object hinge 2200 in an opposing elbow system 900. In some example embodiments, the upper strut movement arc 1703 may be configured to illustrate the possible range of motion of the upper strut 702 in a single primary parallel struts system 104. In some example embodiments, the lower strut movement arc 1704 may be configured to illustrate the possible range of motion of the lower strut 703 in a single primary parallel struts system 104.

Figure 18:
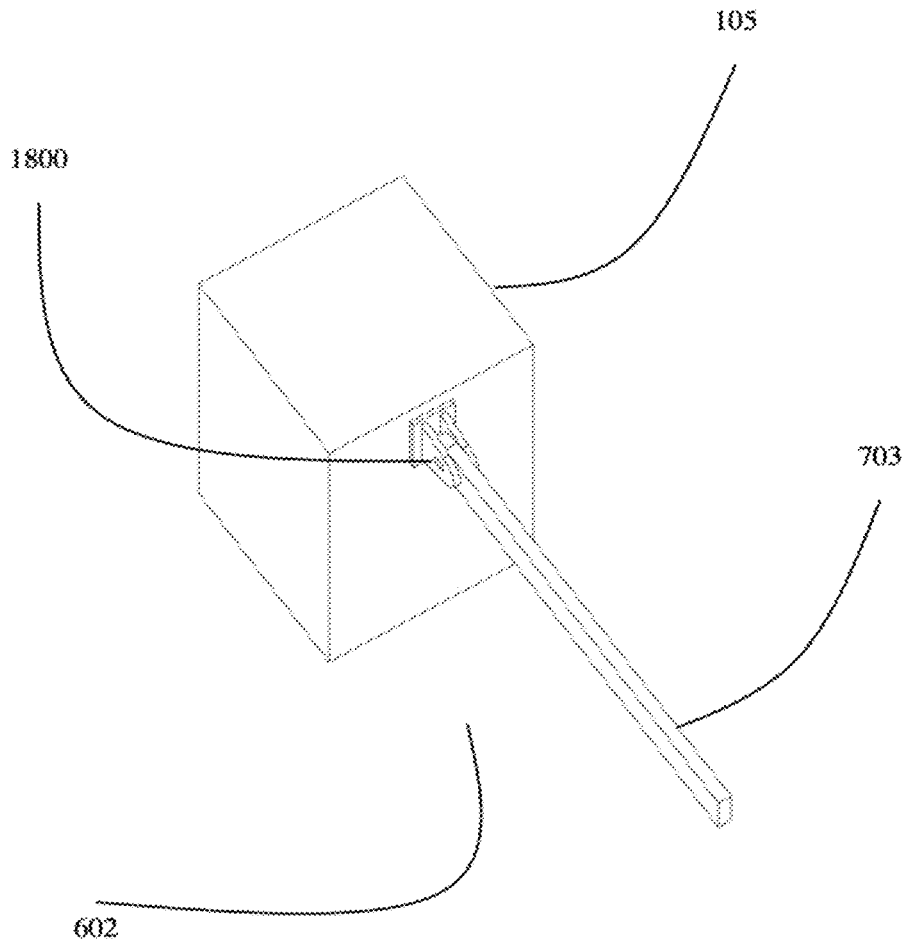
FIG. 18 illustrates a perspective view that shows the lower strut of a single hinge system of a primary parallel struts system anchored to a foundation hinge on a pier system, according to an example embodiment of the present disclosure.

FIG. 18 illustrates a perspective view that shows the lower strut 703 of a single hinge system 602 of a primary parallel struts system 104 anchored to a foundation hinge 1800 on a pier system 105, according to an example embodiment of the present disclosure. In some example embodiments, the foundation hinge 1800 may be configured to attach to the foundation system 200 and allow rotational arc movement of the lower strut 703 attached to the hinge block system 2700 that is attached to the foundation system 200.

Figure 19:
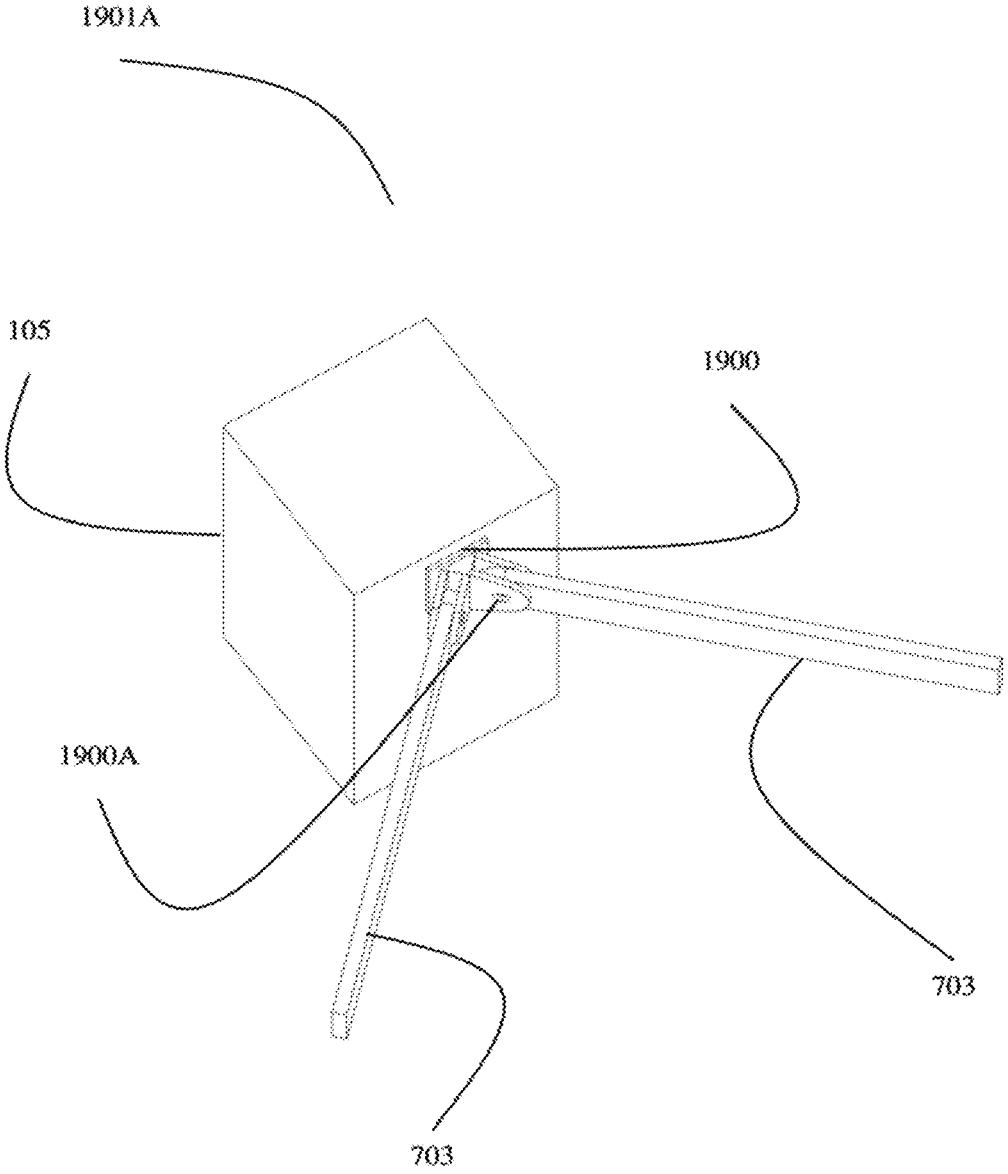
FIG. 19 illustrates a perspective view that shows a pier system anchoring a clustered hinge system with two lower strut units of two primary parallel struts system assemblies anchored by the strut attachment system components of strut hinge and strut cleat, according to an example embodiment of the present disclosure.

FIG. 19 illustrates a perspective view that shows a pier system 105 anchoring a clustered hinge system 1901 with two lower strut 703 units of two primary parallel struts system 104 assemblies anchored by the strut attachment system 1900 components of strut hinge and strut cleat, according to an example embodiment of the present disclosure. Strut attachment system 1900 may be defined as a device or assembly that anchors one or more strut 601 units to its corresponding foundation hinge 1800, elbow hinge 700, or object hinge 2200. Examples of the strut attachment system 1900 may include fastener and block. In some example embodiments, the strut attachment system 1900 may be configured to anchor each strut 601 to the strut cleat system 3100 and anchor each strut to a strut hinge system 2600. In some example embodiments, the strut attachment system 1900 may be configured to anchor the strut 601 to the object hinge 2200, to anchor the strut 601 to the elbow hinge 700 and to anchor the strut 601 to the foundation hinge 1800. In some example embodiments, the strut attachment system 1900 may be positioned at the end of the strut 601. In some example embodiments, the strut attachment system 1900 may be coupled with the lower strut 703, the upper strut 702, the object 100, the object platform system 1500, the platform sill 1003, the foundation system 200, the pier system 105, the slab foundation 12000 or the shaft system 12800. In some example embodiments, the strut attachment system 1900 may comprise strut cleat system 3100. Strut attachment system 1900A may be defined as a movable joint or mechanism on which a strut 601 swings as it opens and closes or which connects two or more linked strut 601 units. Examples of strut attachment system 1900A may include joint, flexible device, knee, elbow and pivot. In some example embodiments, the strut attachment system 1900A may be configured to allow one or more strut 601 units to rotate around a transverse axis about the hinge pin 800 and connects two or more strut 601 units to each other. In some example embodiments, the strut attachment system 1900A may be positioned at each end of the strut 601. In some example embodiments, the strut attachment system 1900A may be coupled with the strut 601 or the strut cleat system 3100. In some example embodiments, the strut attachment system 1900A may interact in multiple ways: it may interact with the strut 601 and it also may interact with the strut cleat system 3100. In some example embodiments, the strut attachment system 1900A may comprise strut hinge system 2600. In some example embodiments, the clustered hinge system 1901A may be configured to contain a cluster of multiple hinge leaf system 5801 units and contain a cluster of multiple hinge pin 800 units, one for each hinge leaf system 5801.

Figure 20:
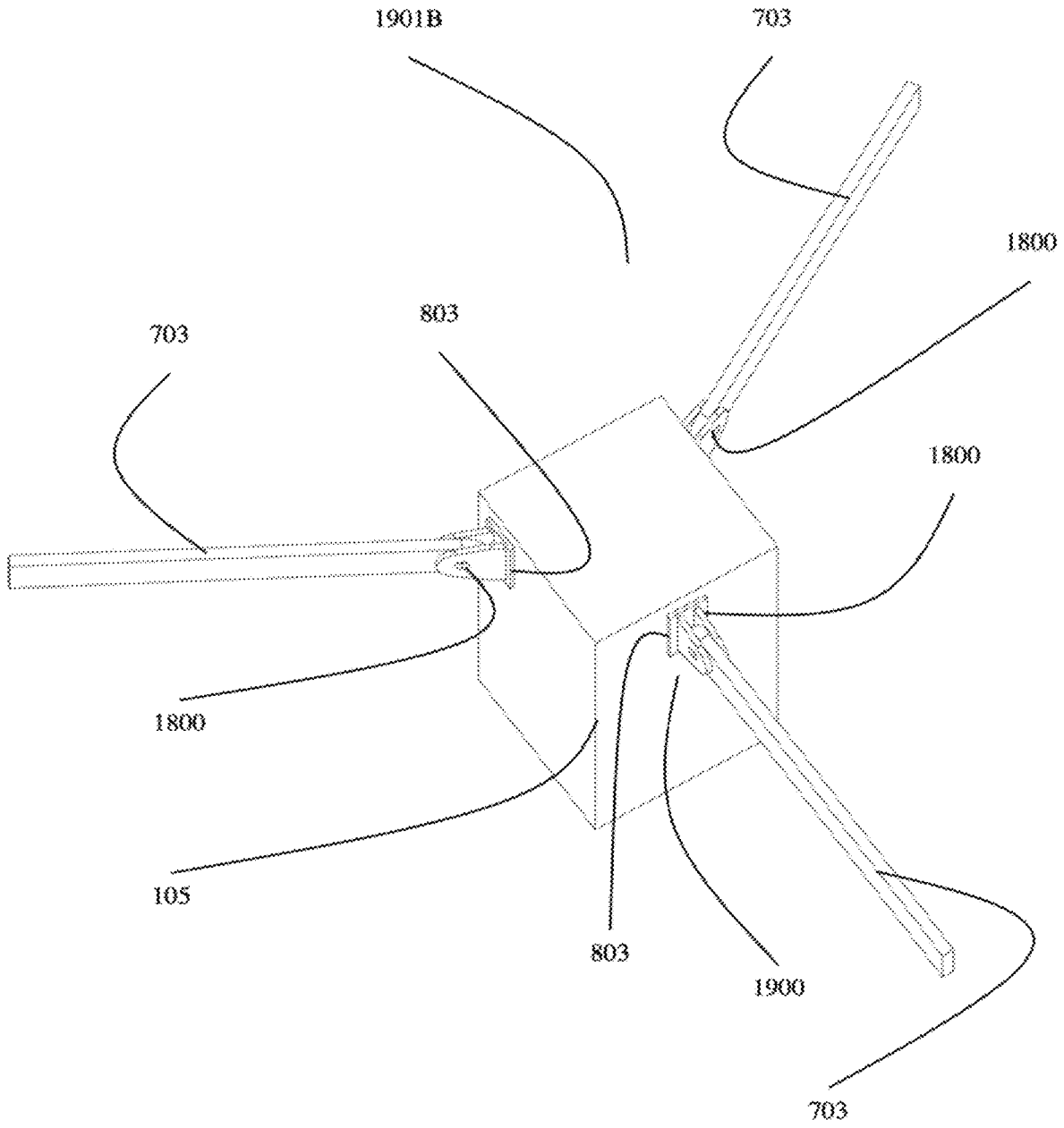
FIG. 20 illustrates a perspective view that shows three lower strut units of three primary parallel struts system assemblies anchored to one version of a triple hinge block in a clustered hinge system, according to an example embodiment of the present disclosure.

FIG. 20 illustrates a perspective view that shows three lower strut 703 units of three primary parallel struts system 104 assemblies anchored to one version of a triple hinge block in a clustered hinge system 1901, according to an example embodiment of the present disclosure. In some example embodiments, the clustered hinge system 1901B may be configured to contain a cluster of multiple hinge leaf system 5801 units and contain a cluster of multiple hinge pin 800 units, one for each hinge leaf system 5801.

Figure 21:
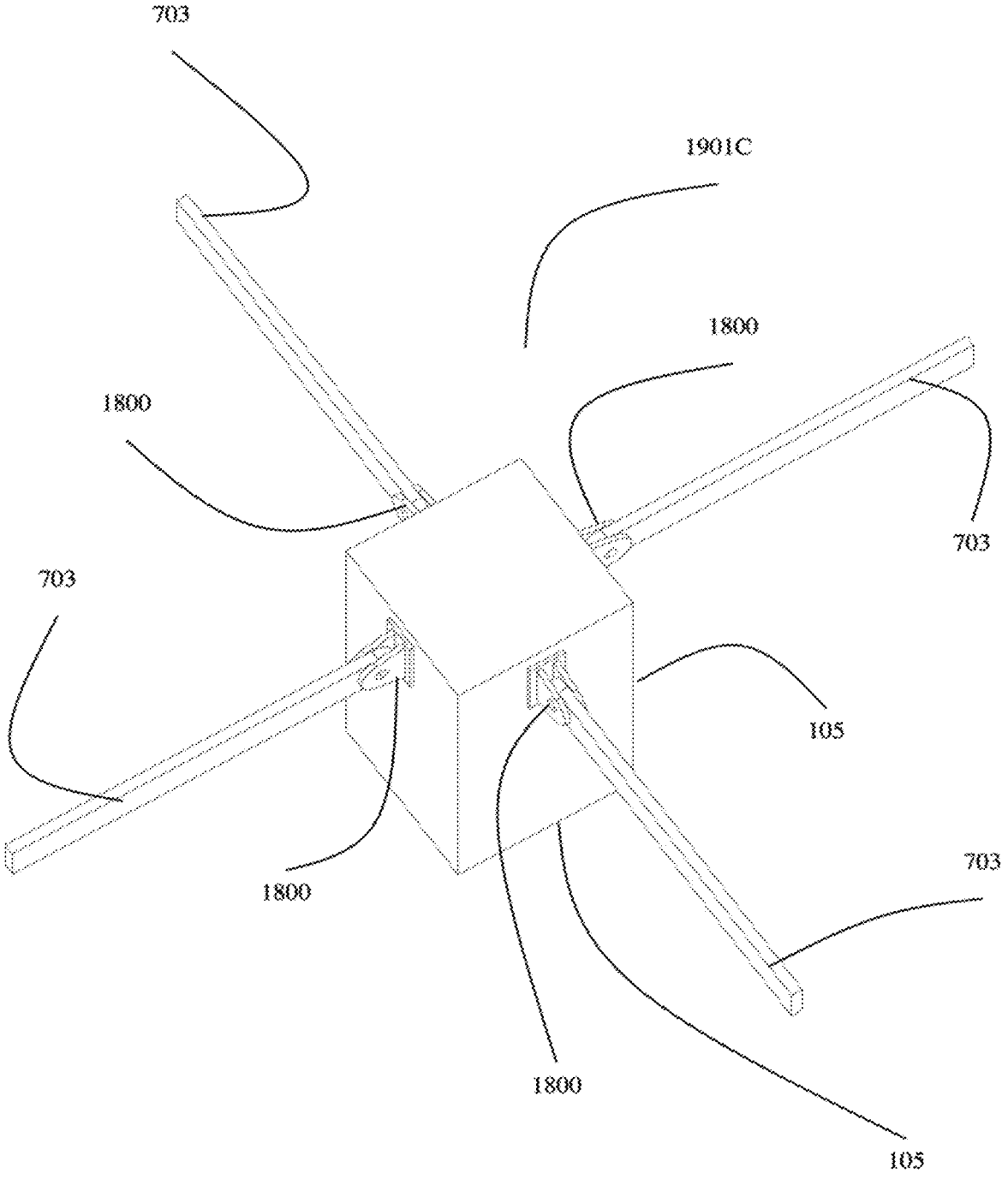
FIG. 21 illustrates a perspective view that shows one version of a quadruple hinge block in a side mount clustered hinge system anchored to a pier system of four lower strut units of four primary parallel struts system assemblies, according to an example embodiment of the present disclosure.

FIG. 21 illustrates a perspective view that shows one version of a quadruple hinge block in a side mount clustered hinge system 1901 anchored to a pier system 105 of four lower strut 703 units of four primary parallel struts system 104 assemblies, according to an example embodiment of the present disclosure. In some example embodiments, the clustered hinge system 1901C may be configured to contain a cluster of multiple hinge leaf system 5801 units and contain a cluster of multiple hinge pin 800 units, one for each hinge leaf system 5801.

Figure 22:
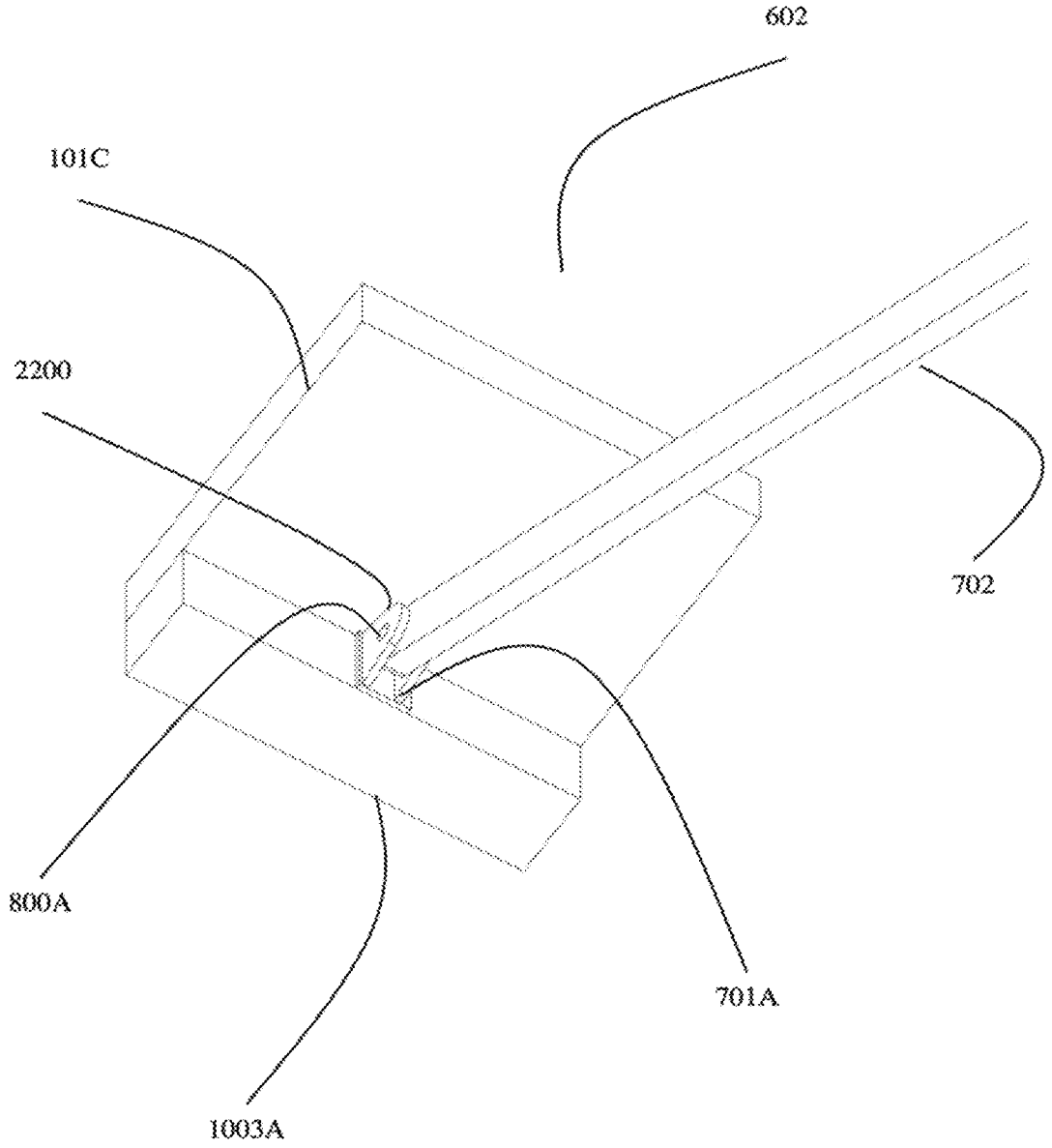
FIG. 22 illustrates a worms eye perspective view that shows a single hinge system with an upper strut anchored by a hinge pin to a side mount cleat anchor mounting system that is attached to a platform sill anchoring a supporting frame, according to an example embodiment of the present disclosure.

FIG. 22 illustrates a worms eye perspective view that shows a single hinge system 602 with an upper strut 702 anchored by a hinge pin 800 to a side mount cleat anchor mounting system 701 that is attached to a platform sill 1003 anchoring a supporting frame 101, according to an example embodiment of the present disclosure. In some example embodiments, the object hinge 2200 may be configured to attach to the object 100 and allow rotational arc movement of the upper strut 702 attached to the hinge block system 2700 that is attached to the object 100.

Figure 23:
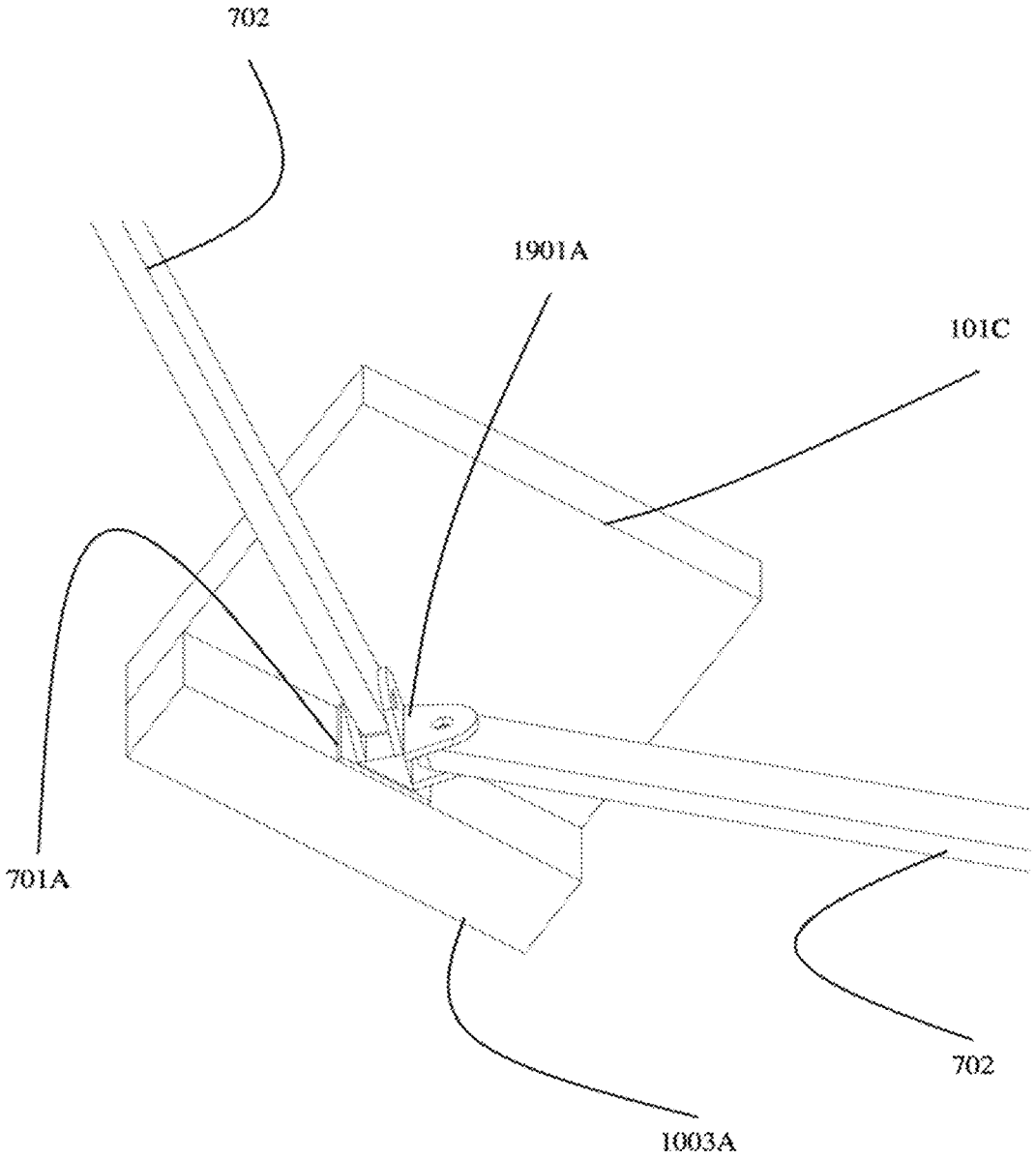
FIG. 23 illustrates a perspective view that shows a clustered hinge system with two upper strut units anchored to a side mount cleat anchor mounting system attached to a platform sill attached to a supporting frame, according to an example embodiment of the present disclosure.

FIG. 23 illustrates a perspective view that shows a clustered hinge system 1901 with two upper strut 702 units anchored to a side mount cleat anchor mounting system 701 attached to a platform sill 1003 attached to a supporting frame 101, according to an example embodiment of the present disclosure.

Figure 24:
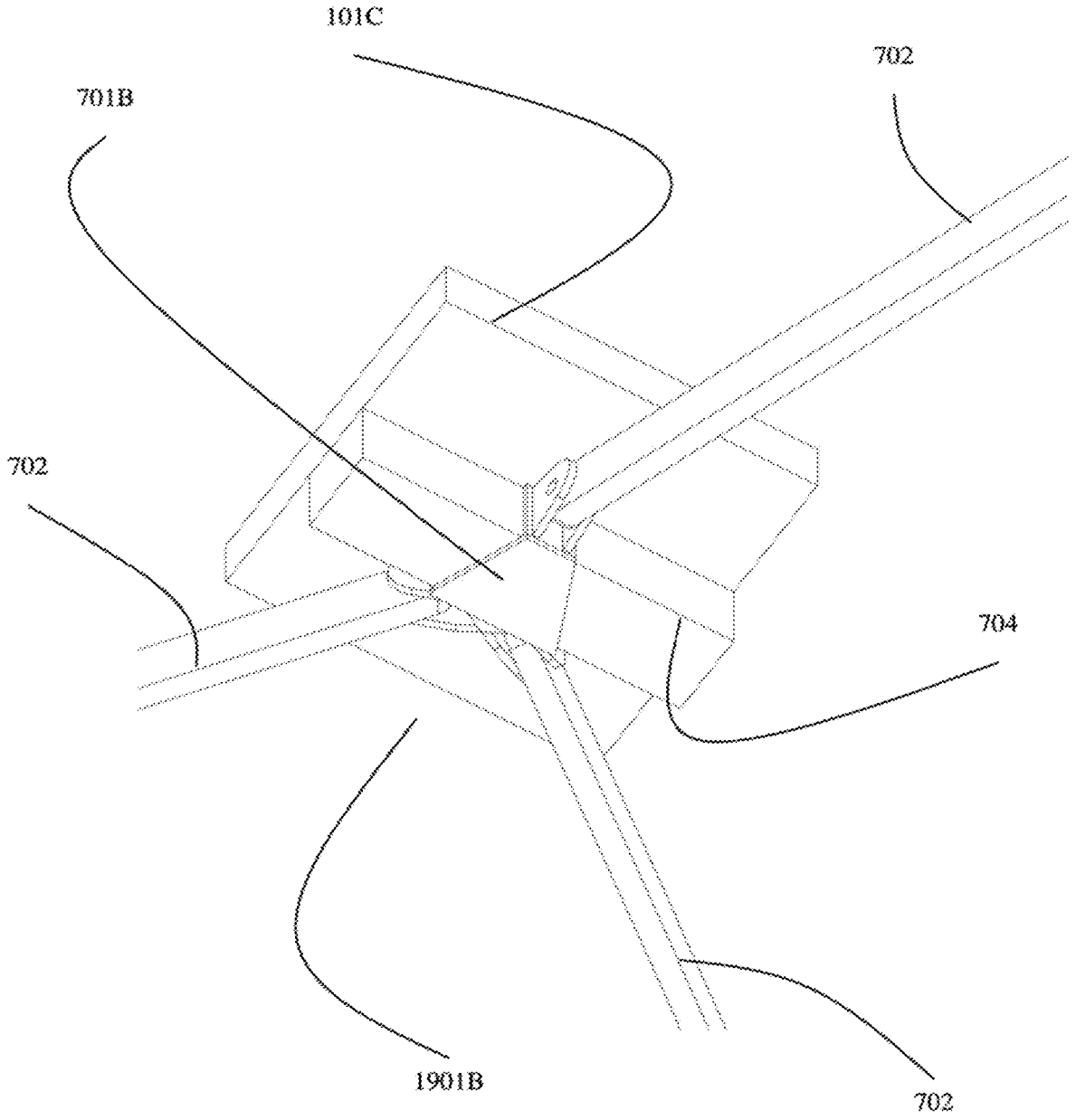
FIG. 24 illustrates a perspective view that shows a triple hinge block clustered hinge system acting as object hinge anchoring three upper strut units to a sill supporting a supporting frame using a bottom mount cleat anchor mounting system, according to an example embodiment of the present disclosure.

FIG. 24 illustrates a perspective view that shows a triple hinge block clustered hinge system 1901 acting as object hinge 2200 anchoring three upper strut 702 units to a sill 704 supporting a supporting frame 101 using a bottom mount cleat anchor mounting system 701, according to an example embodiment of the present disclosure. Cleat anchor mounting system 701B may be defined as locating the cleat anchor system 801 on the horizontal bottom face of the object 100, the platform sill 1003, or the sill 704. In some example embodiments, the cleat anchor mounting system 701B may be configured to configure the anchor plate 803 for attachment to the object 100 and configure the anchor plate 803 for attachment to the foundation system 200.

Figure 25:
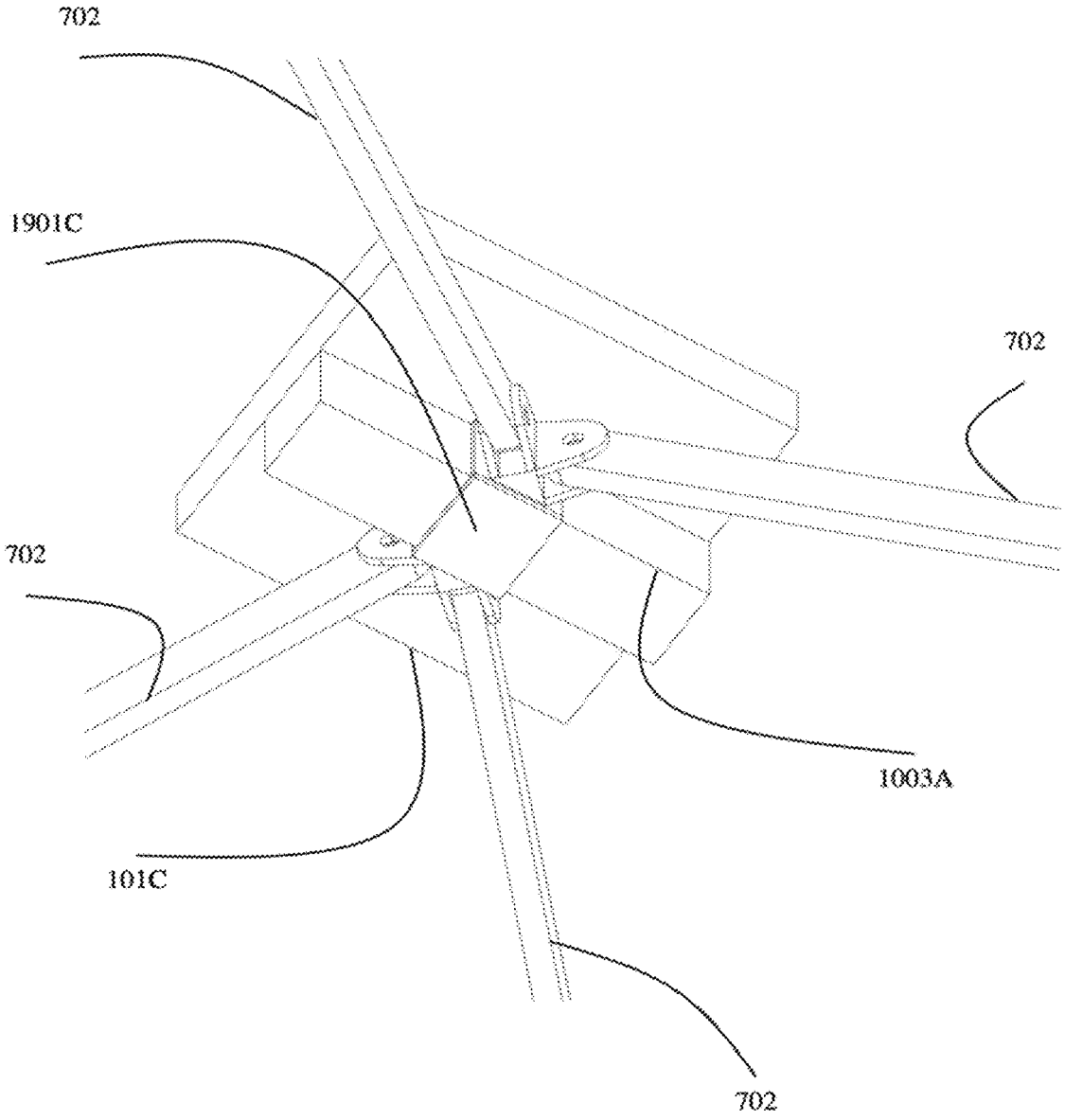
FIG. 25 illustrates a worms eye perspective view that shows a quadruple hinge block clustered hinge system anchoring four upper strut units to a sill supporting a supporting frame using a bottom mount cleat anchor mounting system, according to an example embodiment of the present disclosure.

FIG. 25 illustrates a worms eye perspective view that shows a quadruple hinge block clustered hinge system 1901 anchoring four upper strut 702 units to a sill 704 supporting a supporting frame 101 using a bottom mount cleat anchor mounting system 701, according to an example embodiment of the present disclosure.

Figure 26:
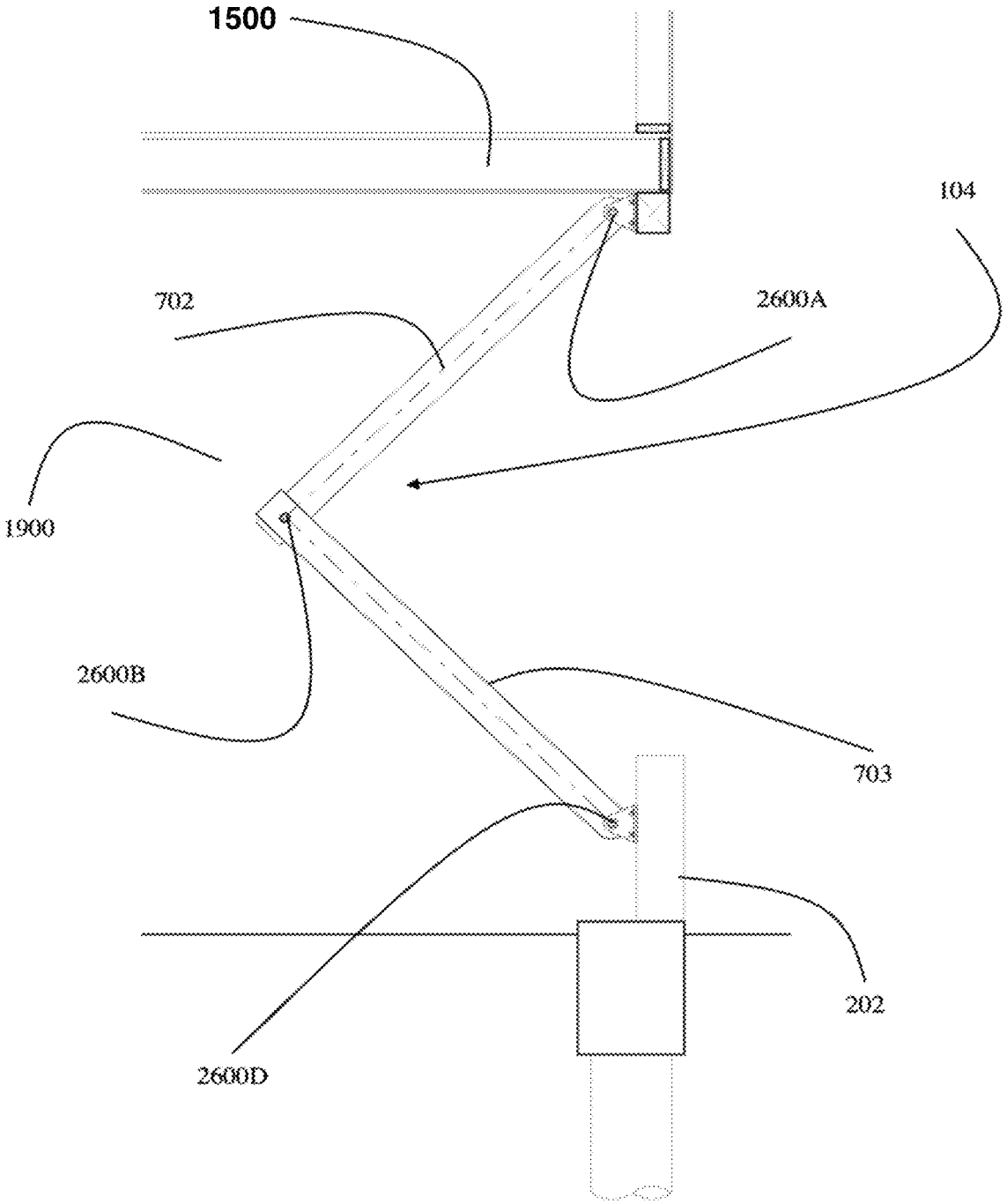
FIG. 26 illustrates an elevation view that shows the three hinge system that converts two strut units into a primary parallel struts system that is connected to a floating house resting on an object platform system that is anchored to the sill which anchors the upper strut of the primary parallel struts system whose lower strut is anchored to the pier on gradebeam system with the cleat anchor mounting system, according to an example embodiment of the present disclosure.

FIG. 26 illustrates an elevation view that shows the three hinge system that converts two strut 601 units into a primary parallel struts system 104 that is connected to a floating house resting on an object platform system 1500 that is anchored to the sill 704 which anchors the upper strut 702 of the primary parallel struts system 104 whose lower strut 703 is anchored to the pier on gradebeam system 202 with the cleat anchor mounting system 701, according to an example embodiment of the present disclosure. In some example embodiments, the strut hinge system 2600A may be configured to allow rotational arc movement of the strut end attached to the elbow hinge 700 and allow rotational arc movement of the strut 601 end attached to the strut cleat system 3100. In some example embodiments, the strut hinge system 2600A may comprise object hinge 2200. In some example embodiments, the strut hinge system 2600D may comprise foundation hinge 1800. In some example embodiments, the strut hinge system 2600B may comprise elbow hinge 700.

Figure 27:
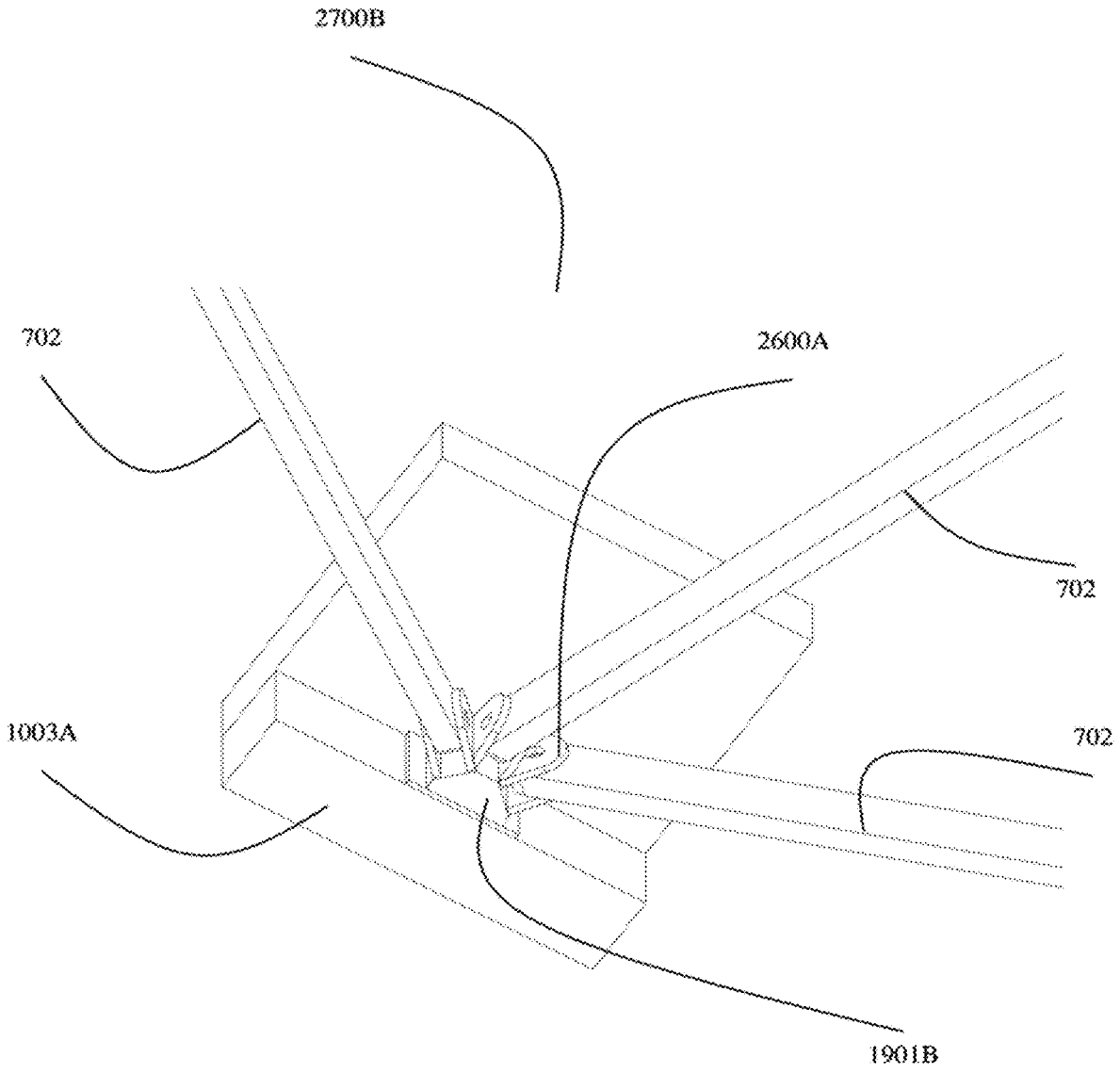
FIG. 27 illustrates a worms eye perspective view that shows a triple hinge block clustered hinge system anchoring three upper strut units to a platform sill using a side mount cleat anchor mounting system, according to an example embodiment of the present disclosure.

FIG. 27 illustrates a worms eye perspective view that shows a triple hinge block clustered hinge system 1901 anchoring three upper strut 702 units to a platform sill 1003 using a side mount cleat anchor mounting system 701, according to an example embodiment of the present disclosure. In some example embodiments, the hinge block system 2700B may be configured to contain the hinge pin 800 and the hinge leaf system 5801. In some example embodiments, the hinge block system 2700B may comprise clustered hinge system 1901.

Figure 28:
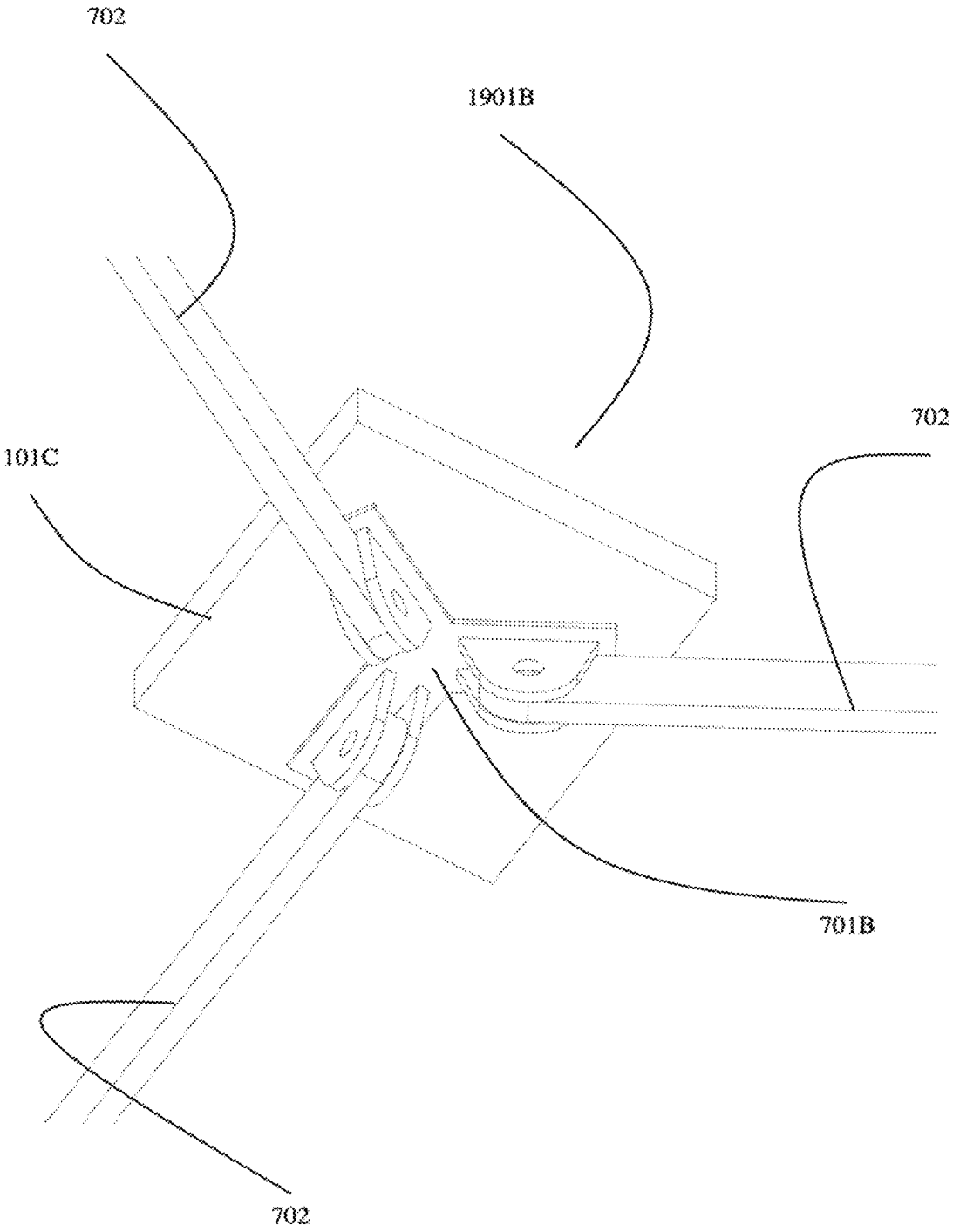
FIG. 28 illustrates a worms eye perspective view that shows a triple hinge block clustered hinge system anchoring three upper strut units to a supporting frame using a bottom mount cleat anchor mounting system, according to an example embodiment of the present disclosure.

FIG. 28 illustrates a worms eye perspective view that shows a triple hinge block clustered hinge system 1901 anchoring three upper strut 702 units to a supporting frame 101 using a bottom mount cleat anchor mounting system 701, according to an example embodiment of the present disclosure.

Figure 29:
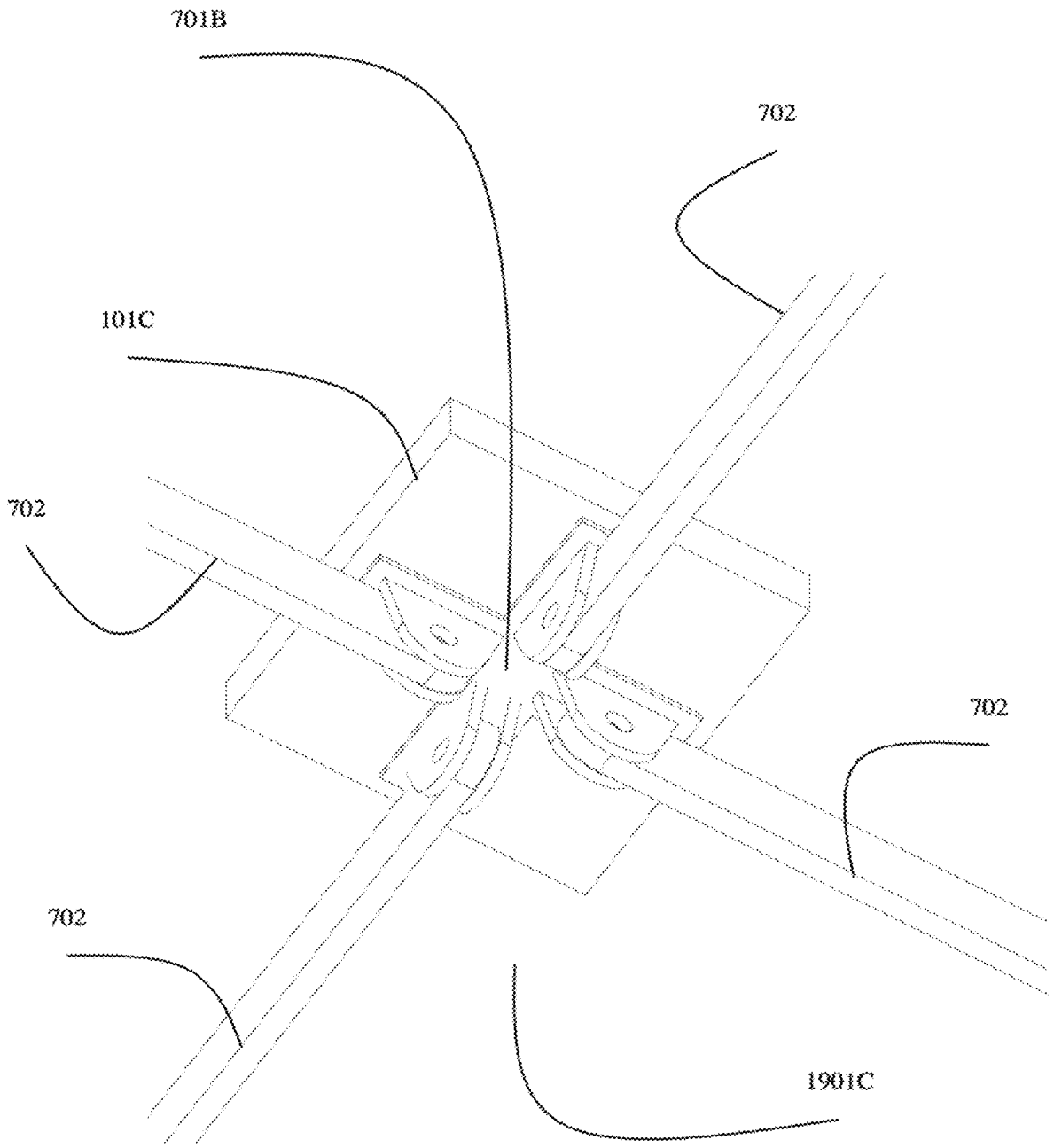
FIG. 29 illustrates a worms eye perspective view that shows a quadruple hinge block clustered hinge system anchoring three upper strut units to a supporting frame using a bottom mount cleat anchor mounting system, according to an example embodiment of the present disclosure.

FIG. 29 illustrates a worms eye perspective view that shows a quadruple hinge block clustered hinge system 1901 anchoring three upper strut 702 units to a supporting frame 101 using a bottom mount cleat anchor mounting system 701, according to an example embodiment of the present disclosure.

Figure 30:
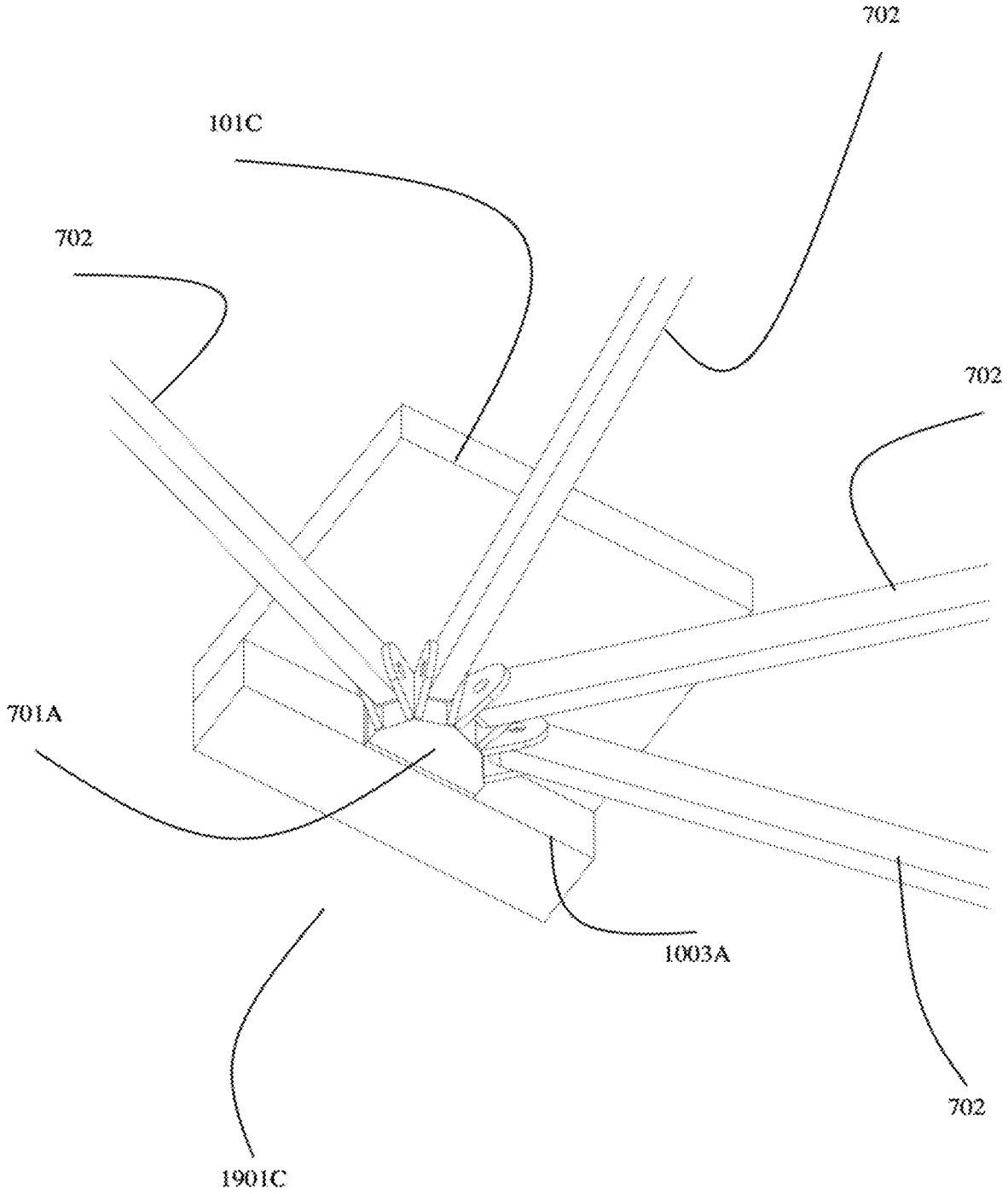
FIG. 30 illustrates a Worms Eye Perspective view that shows a quadruple hinge block clustered hinge system anchoring four upper strut units to a platform sill using a side mount cleat anchor mounting system, according to an example embodiment of the present disclosure.

FIG. 30 illustrates a worms eye perspective view that shows a quadruple hinge block clustered hinge system 1901 anchoring four upper strut 702 units to a platform sill 1003 using a side mount cleat anchor mounting system 701, according to an example embodiment of the present disclosure.

Figure 31:
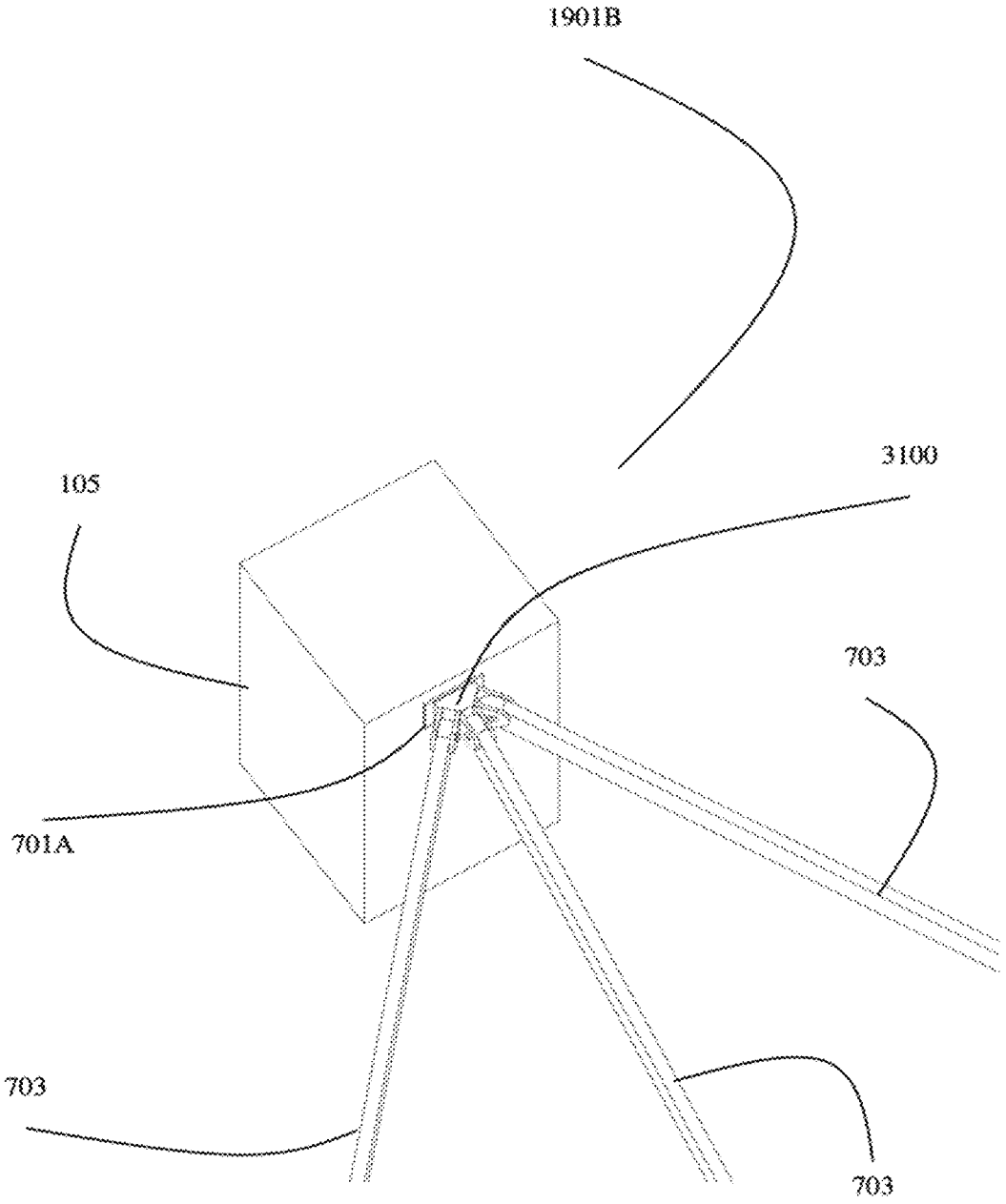
FIG. 31 illustrates a perspective view that shows a triple hinge block clustered hinge system anchoring three lower strut units to a pier system using a side mount cleat anchor mounting system, according to an example embodiment of the present disclosure.

FIG. 31 illustrates a perspective view that shows a triple hinge block clustered hinge system 1901 anchoring three lower strut 703 units to a pier system 105 using a side mount cleat anchor mounting system 701, according to an example embodiment of the present disclosure. Strut cleat system 3100 may be defined as a device or assembly that anchors one or more strut 601 units to its corresponding foundation hinge 1800, Elbow Hinge, or Object Hinge. In some example embodiments, the strut cleat system 3100 may be configured to anchor the strut 601 to the strut anchor system 6000 and anchor the strut to the cleat anchor system 801. In some example embodiments, the strut cleat system 3100 may comprise cleat anchor system 801 or strut anchor system 6000.

Figure 32:
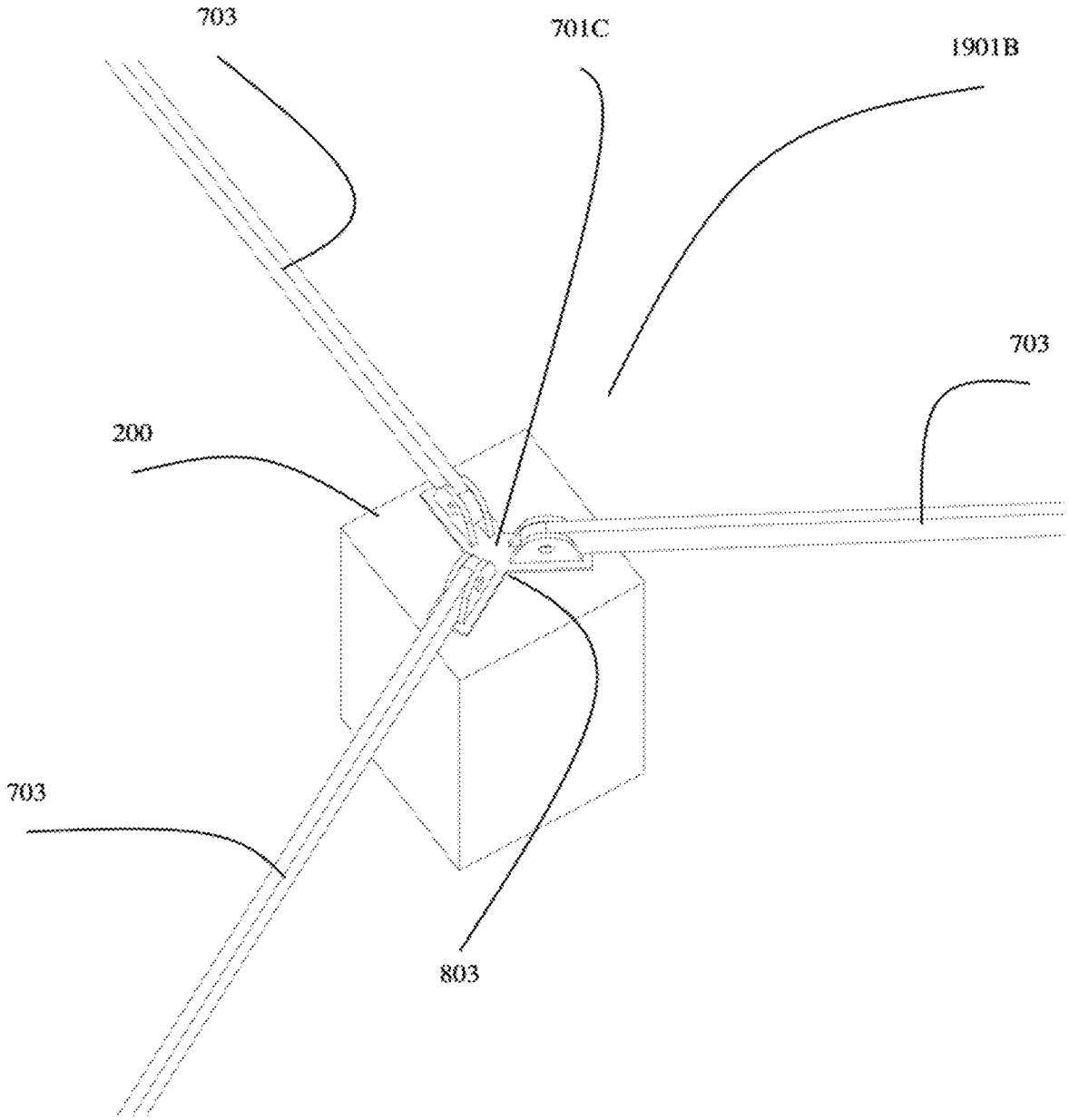
FIG. 32 illustrates a perspective view that shows a triple hinge block clustered hinge system anchoring three lower strut units to a pier system using a top mount cleat anchor mounting system anchor plate, according to an example embodiment of the present disclosure.

FIG. 32 illustrates a perspective view that shows a triple hinge block clustered hinge system 1901 anchoring three lower strut 703 units to a pier system 105 using a top mount cleat anchor mounting system 701 anchor plate 803, according to an example embodiment of the present disclosure. Cleat anchor mounting system 701C may be defined as locating the cleat anchor system 801 on the horizontal top face of the pier on gradebeam system 202, the grade beam 201, or the shaft system 12800. In some example embodiments, the cleat anchor mounting system 701C may be configured to configure the anchor plate 803 for attachment to the object 100 and configure the anchor plate 803 for attachment to the foundation system 200.

Figure 33:
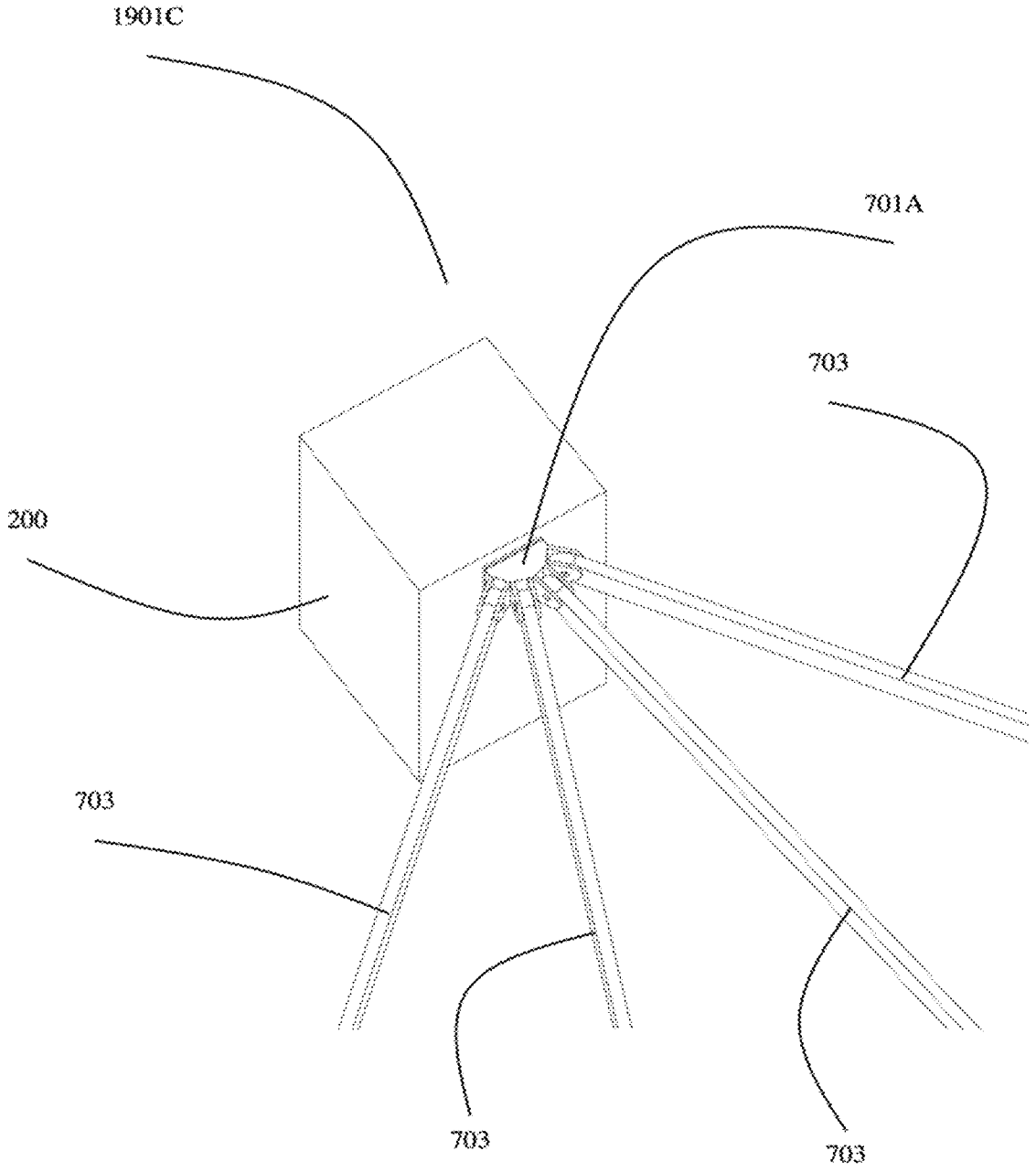
FIG. 33 illustrates a perspective view that shows a quadruple hinge block clustered hinge system anchoring four lower strut units to a pier system using a side mount cleat anchor mounting system, according to an example embodiment of the present disclosure.

FIG. 33 illustrates a perspective view that shows a quadruple hinge block clustered hinge system 1901 anchoring four lower strut 703 units to a pier system 105 using a side mount cleat anchor mounting system 701, according to an example embodiment of the present disclosure.

Figure 34:
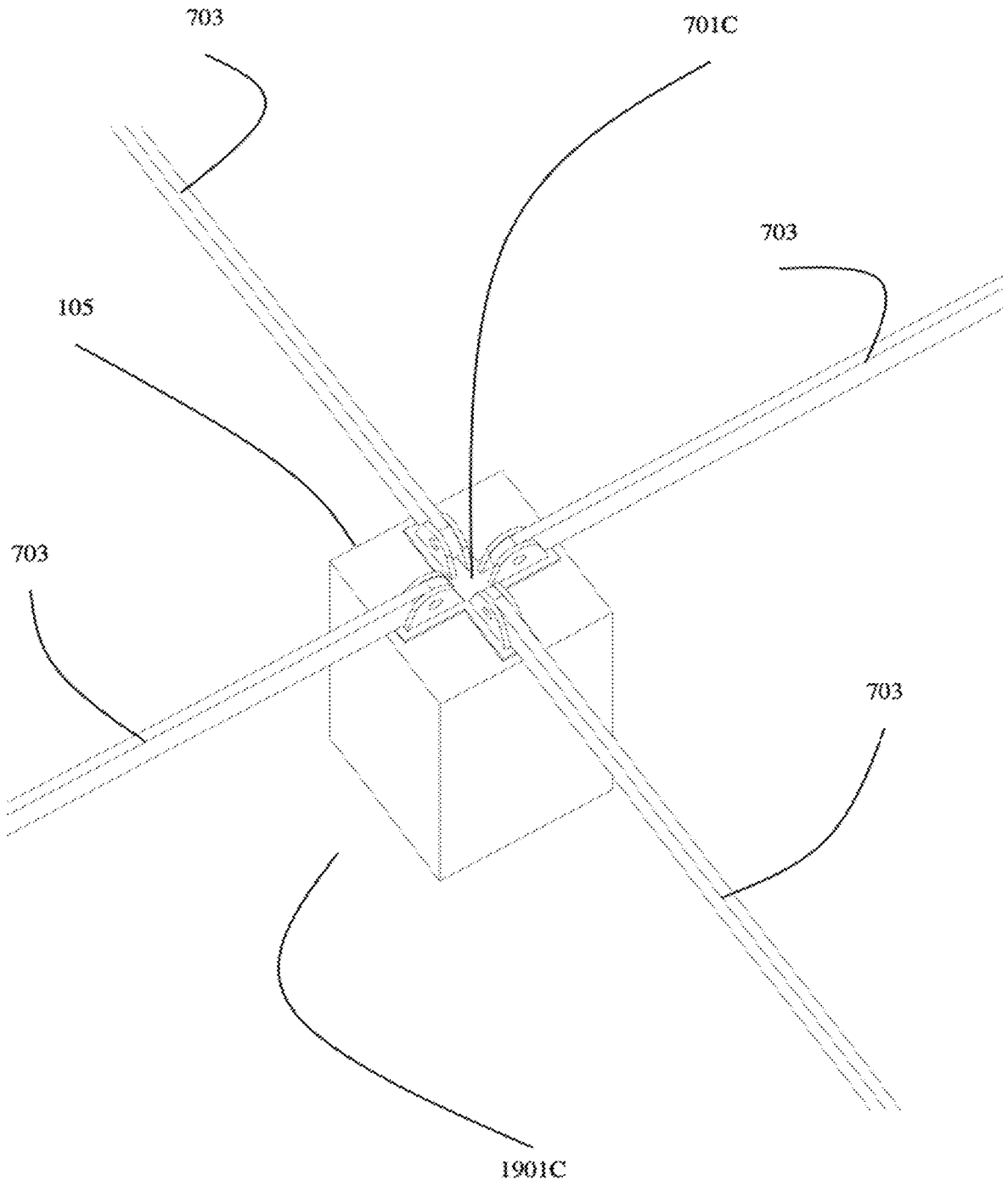
FIG. 34 illustrates a perspective view that shows a quadruple hinge block clustered hinge system anchoring four lower strut units to a pier system using a top mount cleat anchor mounting system, according to an example embodiment of the present disclosure.

FIG. 34 illustrates a perspective view that shows a quadruple hinge block clustered hinge system 1901 anchoring four lower strut 703 units to a pier system 105 using a top mount cleat anchor mounting system 701, according to an example embodiment of the present disclosure.

Figure 35:
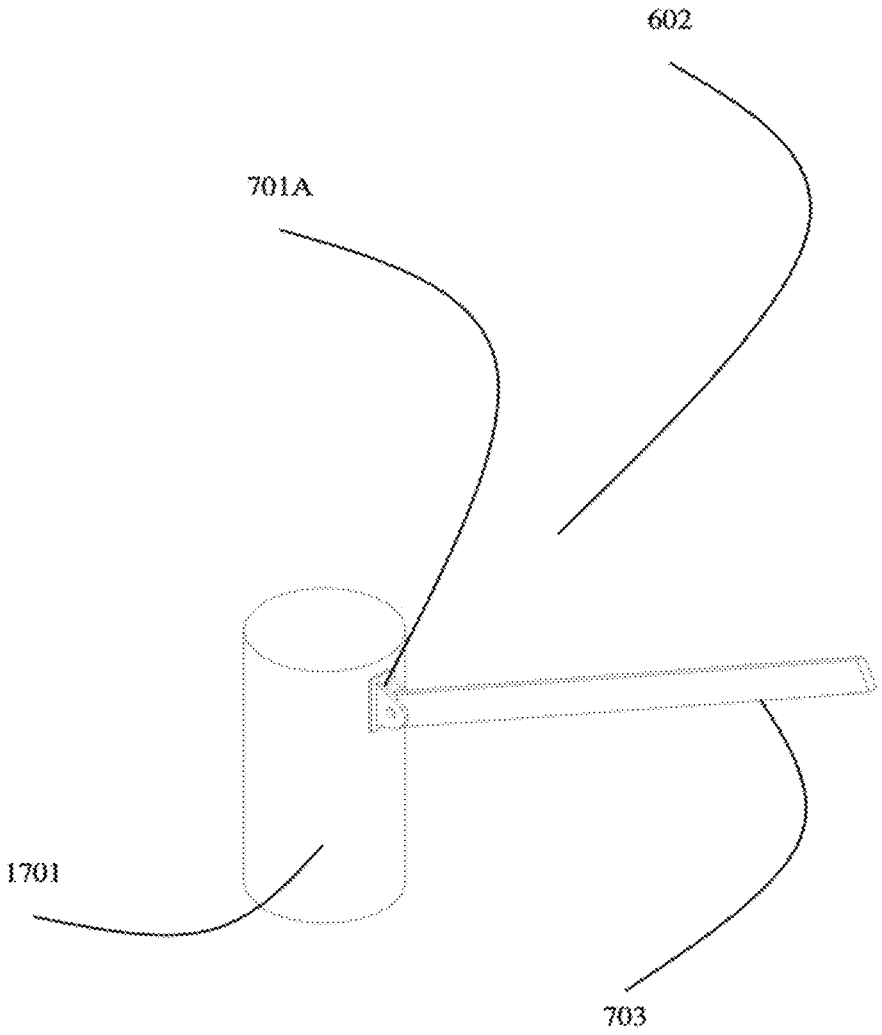
FIG. 35 illustrates a perspective view that shows a single hinge system using a shaft system to anchor a side mount cleat anchor mounting system to anchor a single lower strut unit, according to an example embodiment of the present disclosure.

FIG. 35 illustrates a perspective view that shows a single hinge system 602 using a shaft system 12800 to anchor a side mount cleat anchor mounting system 701 to anchor a single lower strut 703 unit, according to an example embodiment of the present disclosure.

Figure 36:
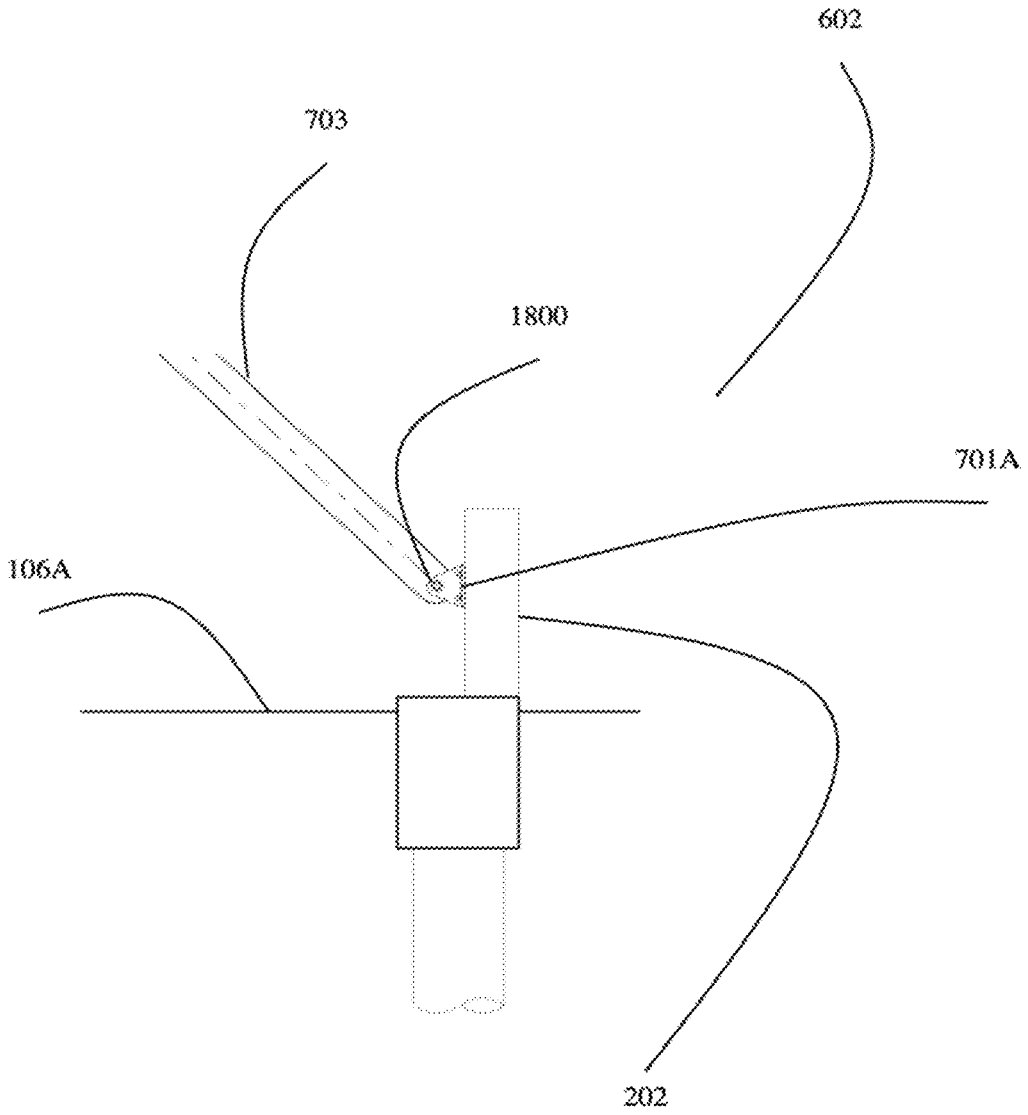
FIG. 36 illustrates an elevation view that shows a single hinge system anchoring a single lower strut unit to a foundation hinge anchored to a pier on gradebeam system using a side mount cleat anchor mounting system, according to an example embodiment of the present disclosure.

FIG. 36 illustrates an elevation view that shows a single hinge system 602 anchoring a single lower strut 703 unit to a foundation hinge 1800 anchored to a pier on gradebeam system 202 using a side mount cleat anchor mounting system 701, according to an example embodiment of the present disclosure.

Figure 37:
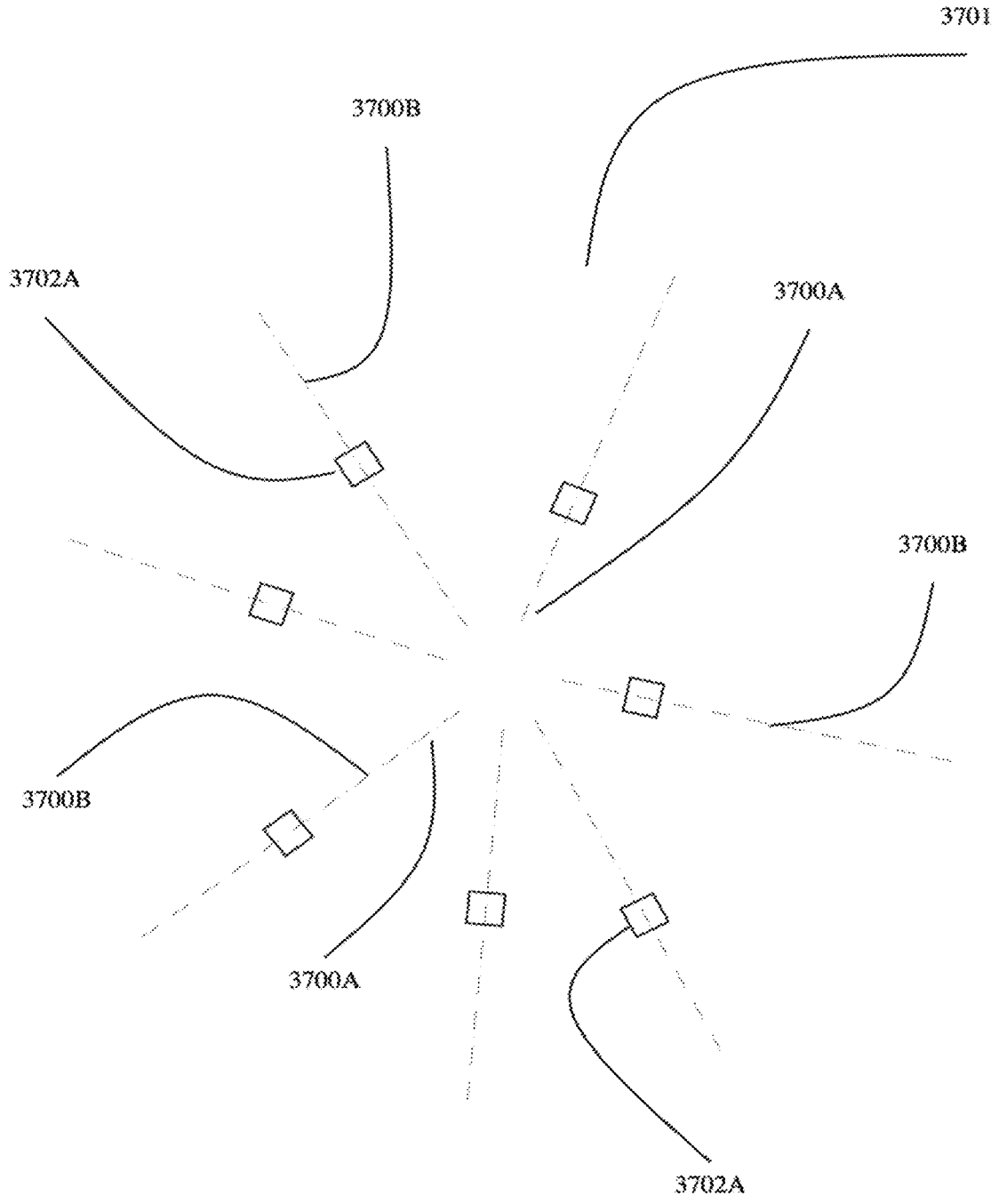
FIG. 37 illustrates a plan view that shows a diagram illustrating multiple cleat system units configured to position each folding strut movement plane in a radial pattern, according to an example embodiment of the present disclosure.

FIG. 37 illustrates a plan view that shows a diagram illustrating multiple cleat system 3702 units configured to position each folding strut movement plane 3700 in a radial pattern, according to an example embodiment of the present disclosure. Folding strut movement plane 3700B may be defined as a diagram illustrating the possible planar range of movement of the object platform system 1500 at the point of connection to a strut hinge system 2600 relative to the foundation system 200 when attached to a single primary parallel struts system 104 assembly. In some example embodiments, the folding strut movement plane 3700B may be configured to illustrate the restricted possible planar movement for multiple primary parallel struts system 104 assemblies anchored to the same object 100, illustrate the possible range of planar motion of the lower strut 703 in a primary parallel struts system 104 and illustrate the possible range of planar motion of the upper strut 702 in a primary parallel struts system 104. In some example embodiments, the cleat positioning system 3701 may be configured to geometrically locate on the ground plane the X axis and Y axis of each strut cleat system 3100 for multiple primary parallel struts system 104 assemblies acting together to tether a single object 100 or object platform system 1500. In some example embodiments, the cleat positioning system 3701 may be configured to a method for locating each cleat anchor system 801 assembly for multiple primary parallel struts system 104 units acting together to tether a single object 100 or object platform system 1500 by arranging them around a central point. In some example embodiments, the cleat system 3702A may be configured to anchor the fixed length tether 9001 to the foundation system 200 and anchor the object 100 to the fixed length tether 9001. Folding strut movement plane 3700A may be defined as a diagram illustrating the possible planar range of movement of the object platform system 1500 at each point of connection to a strut hinge system 2600 relative to the foundation system 200 when the folding strut movement plane 3700 of two or more primary parallel struts system 104 assemblies are set not parallel by at an angle.

Figure 38:
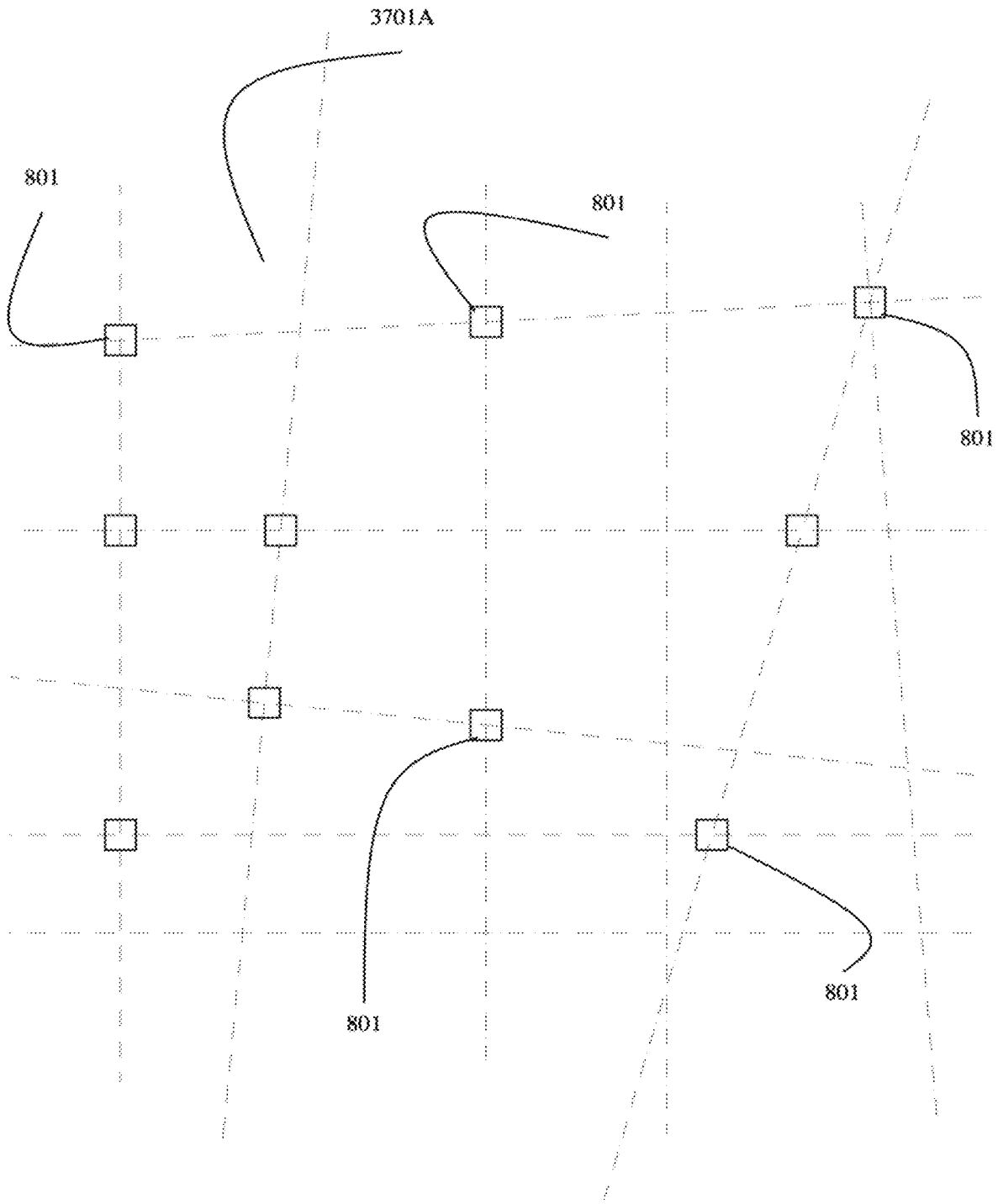
FIG. 38 illustrates a plan view that shows a cleat positioning system diagram of multiple cleat anchor system units arranged in a grid pattern, according to an example embodiment of the present disclosure.

FIG. 38 illustrates a plan view that shows a cleat positioning system 3701 diagram of multiple cleat anchor system 801 units arranged in a grid pattern, according to an example embodiment of the present disclosure. Cleat positioning system 3701A may be defined as a method used to locate each cleat anchor system 801 for multiple primary parallel struts system 104 assemblies acting together to tether a single object 100 or object platform system 1500 that employs a network of lines that cross each other to form a series of squares or rectangles. In some example embodiments, the cleat positioning system 3701A may be configured to geometrically locate on the ground plane the X axis and Y axis of each strut cleat system 3100 for multiple primary parallel struts system 104 assemblies acting together to tether a single object 100 or object platform system 1500. In some example embodiments, the cleat positioning system 3701A may be configured to an arrangement of multiple stabilization system 108 assemblies secured in an axial arrangement pattern. In some example embodiments, the cleat positioning system 3701A may be positioned under the object 100.

Figure 39:
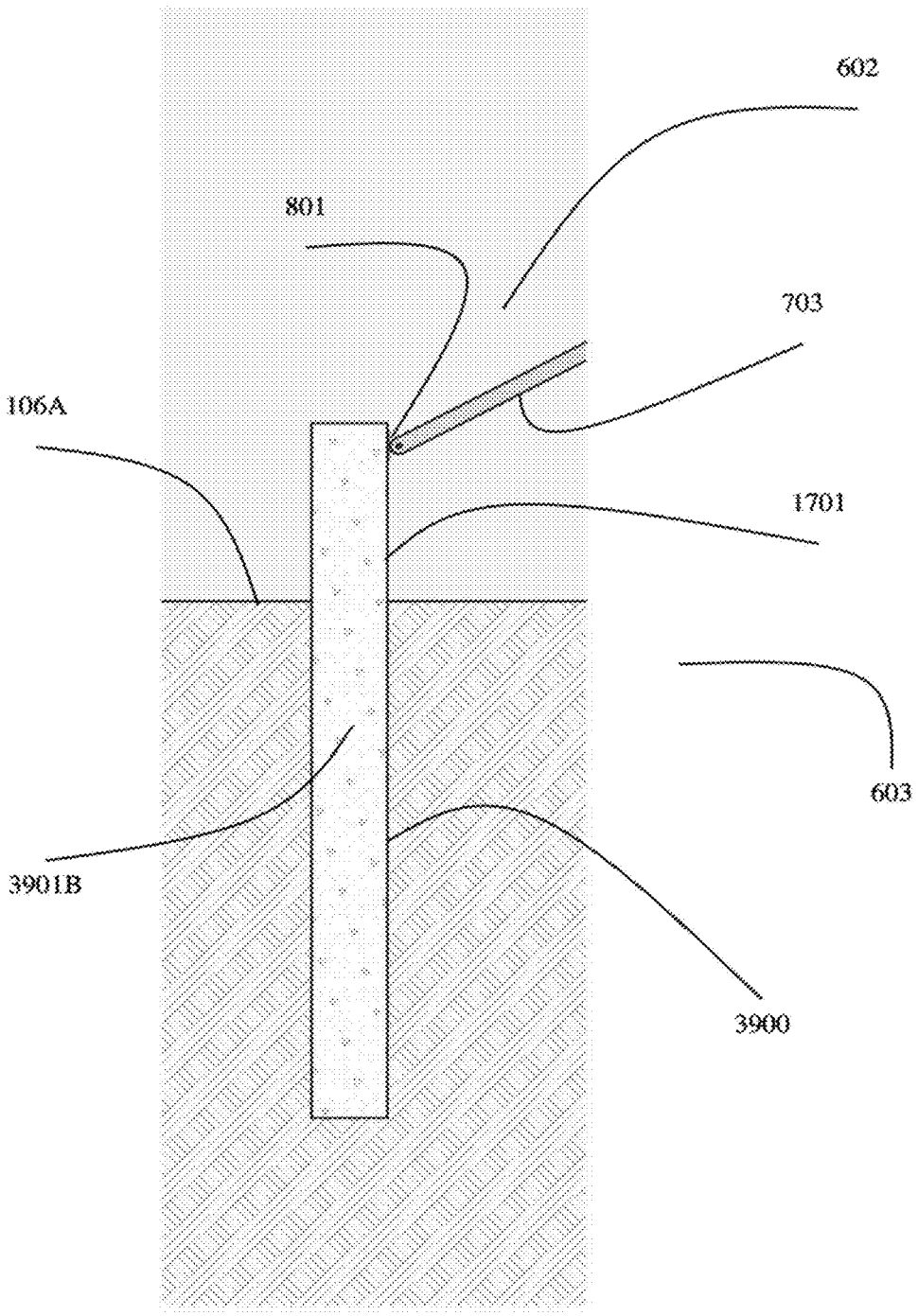
FIG. 39 illustrates a section view that shows a drilled pile anchored in earth grade with reinforced concrete as a shaft fill material anchoring a single lower strut unit to a supporting platform shaft system using a side mount cleat anchor mounting system, according to an example embodiment of the present disclosure.

FIG. 39 illustrates a section view that shows a drilled pile 3900 anchored in earth grade 106 with reinforced concrete as a shaft fill material 3901 anchoring a single lower strut 703 unit to a supporting platform 1701 shaft system 12800 using a side mount cleat anchor mounting system 701, according to an example embodiment of the present disclosure. In some example embodiments, the drilled pile 3900 may be configured to be connected to and support either the grade beam 201, spot footing 14100, pier system 105, slab foundation 12000, or directly to the stabilization system 108, be drilled into grade 106, support and resist the forces transmitted through the stabilization system 108, remain connected to grade 106 and remain stationary. In some example embodiments, the drilled pile 3900 may comprise shaft fill material 3901. In some example embodiments, the shaft fill material 3901B may be configured to remain connected to either the grade beam 201, spot footing 14100, pier system 105, slab foundation 12000, or directly to the stabilization system 108, remain stationary, transfer gravity, uplift, and other movement loads into grade 106 and fill the void in grade 106 caused by drilling the drilled pile 3900. In some example embodiments, the shaft fill material 3901B may comprise concrete or steel reinforcing.

Figure 40:
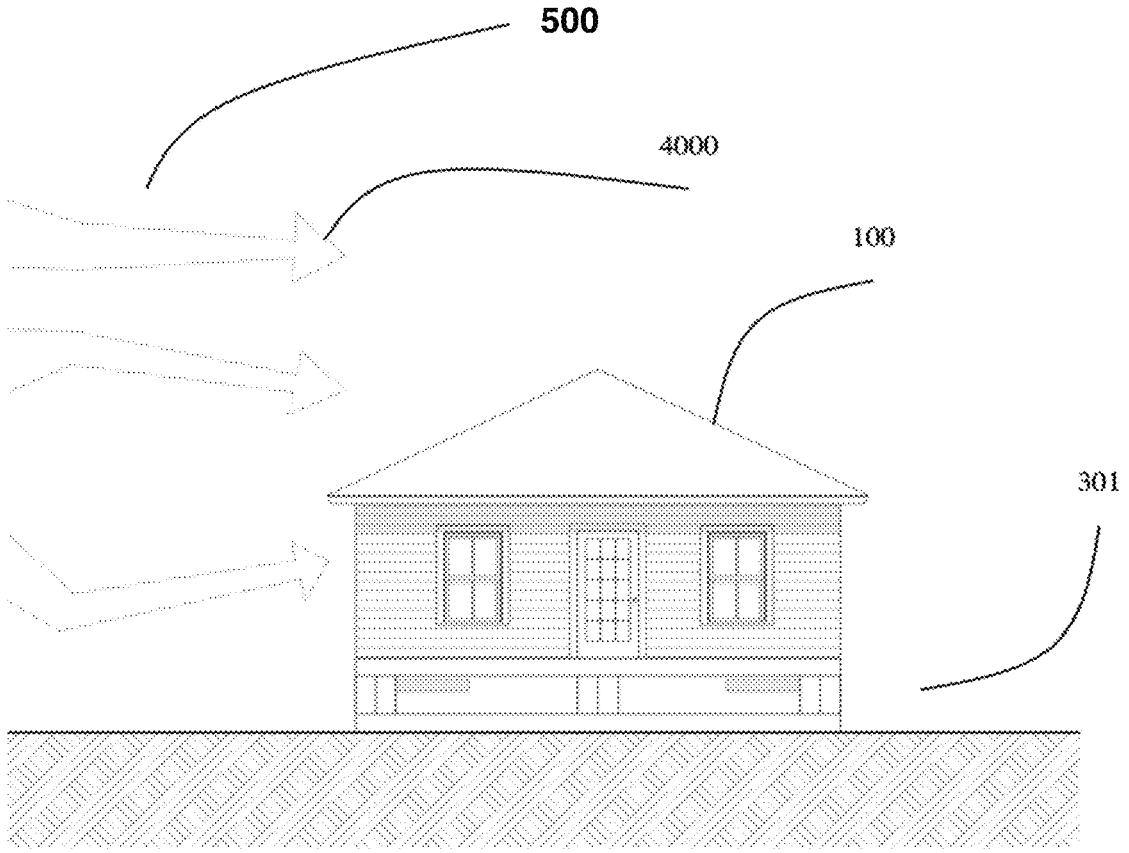
FIG. 40 illustrates an elevation view that shows a house representing the object in an object at rest position experiencing the external force of high velocity wind, according to an example embodiment of the present disclosure.

FIG. 40 illustrates an elevation view that shows a house representing the object 100 in an object at rest 301 position experiencing the external force 500 of high velocity wind 4000, according to an example embodiment of the present disclosure.

Figure 41:
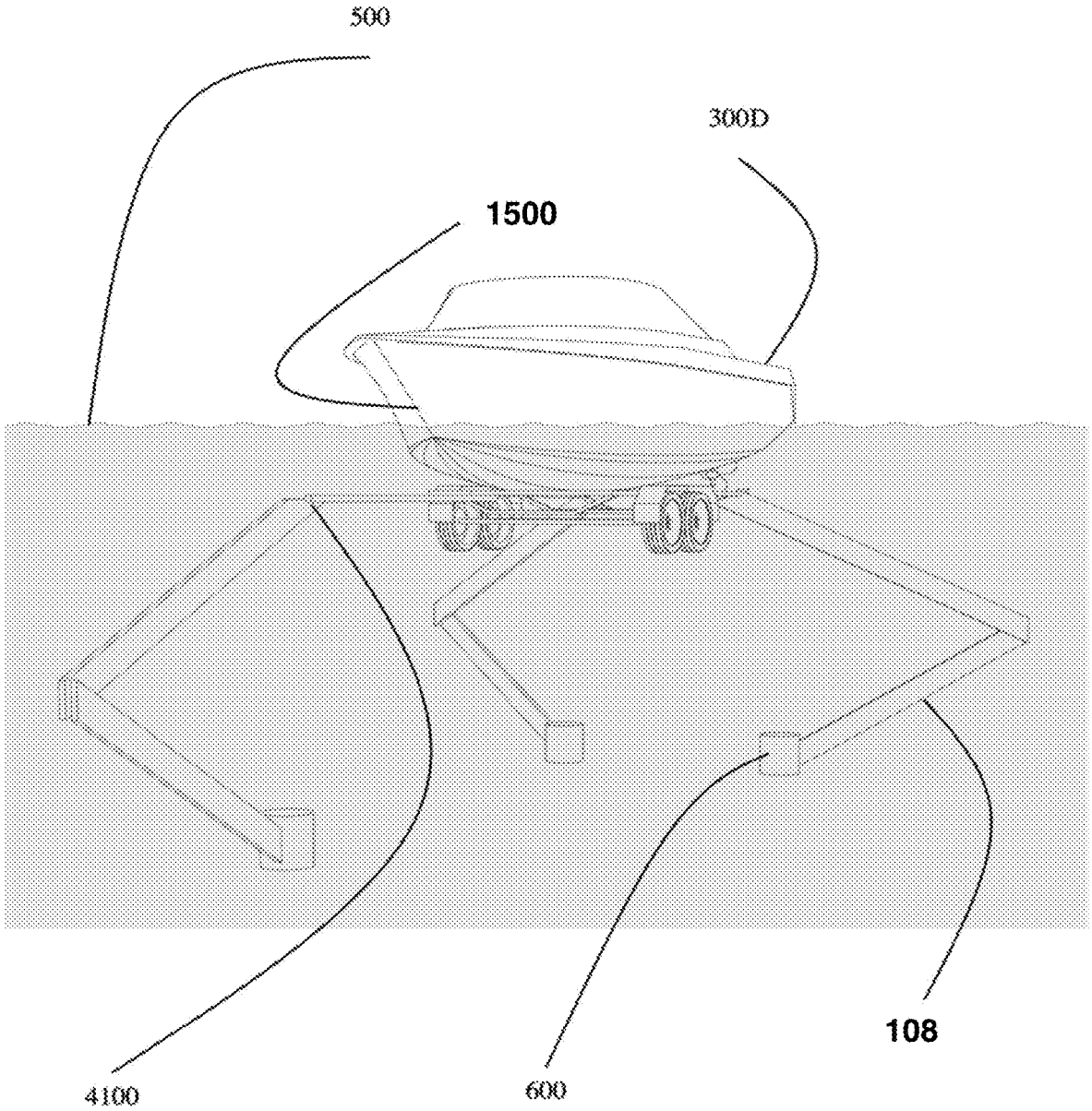
FIG. 41 illustrates an elevation view that shows a boat serving as its own object platform system floating during an external force of Flooding while remaining tethered to multiple hinged system folding strut units that are anchored to shafts of a supporting foundation, according to an example embodiment of the present disclosure.

FIG. 41 illustrates an elevation view that shows a boat serving as its own object platform system 1500 floating during an external force 500 of Flooding while remaining tethered to multiple hinged system folding strut units that are anchored to shafts of a supporting foundation 600, according to an example embodiment of the present disclosure. Object type 300D may be defined as a small vessel propelled on water by oars, sails, or an engine. In some example embodiments, the object type 300D may be configured to be an object 100 and be susceptible to movement from an external force 500. In some example embodiments, the object type 300D may be positioned above the foundation system 200. In some example embodiments, the object type 300D may be coupled with the stabilization system 108 and In some example embodiments attached to a trailer for roadway transport and storage and may be coupled with the object platform system 1500. In some example embodiments, the object type 300D may be configured to float in rising water 1202. Object anchor 4100 may be defined as a device or assembly that anchors the buoyant object to the stabilization system 108. Examples of the object anchor 4100 may include a fastener, a clip and a clasp. In some example embodiments, the object anchor 4100 may be configured to anchor the stabilization system 108 to the buoyant object. In some example embodiments, the object anchor 4100 may be configured to be removed from the buoyant object, be anchored to the buoyant object, be anchored to the stabilization system 108 and be integral to the buoyant object assembly.

Figure 42:
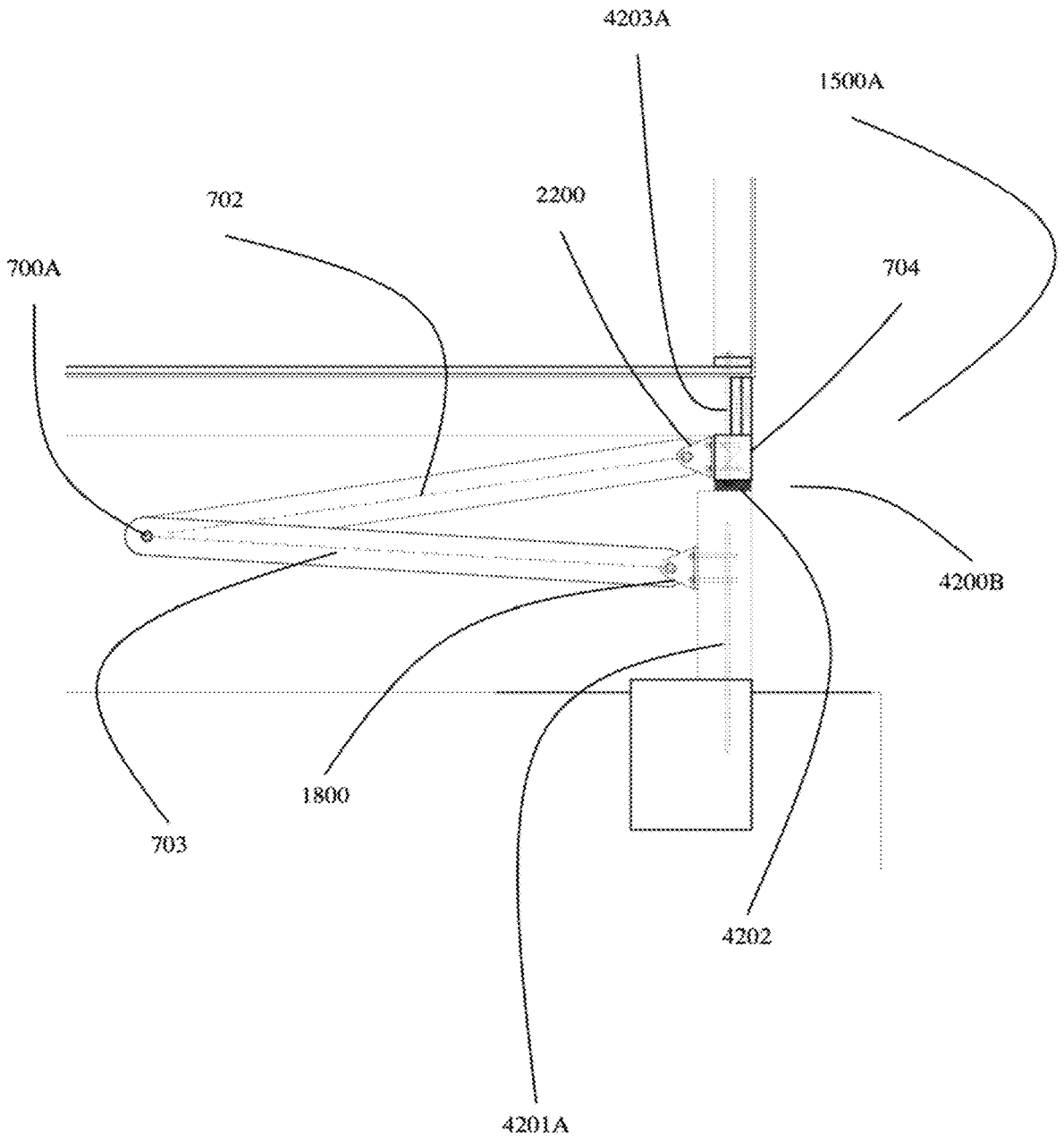
FIG. 42 illustrates an elevation view that shows a platform foundation interface that uses a shock resistant material for the impact dampening system to absorb the inertia impact shock of the object while transitioning from an object separated to an object at rest position on a pier on gradebeam system where the pier system is attached to the grade beam using a pier anchoring system, according to an example embodiment of the present disclosure.

FIG. 42 illustrates an elevation view that shows a platform foundation interface that uses a shock resistant material 4202 for the impact dampening system 4200 to absorb the inertia impact shock of the object 100 while transitioning from an object separated 103 to an object at rest 301 position on a pier on gradebeam system 202 where the pier system 105 is attached to the grade beam 201 using a pier anchoring system 4201, according to an example embodiment of the present disclosure. Impact dampening system 4200B may be defined as a shock-absorbing material. In some example embodiments, the impact dampening system 4200B may be configured to minimize the impact shock to the supporting frame 101 and object 100 when transitioning between conditions of object separated 103 and object at rest 301. In some example embodiments, the impact dampening system 4200B may be positioned between the object 100 and the foundation system 200. In some example embodiments, the impact dampening system 4200B may comprise shock resistant material 4202. Object platform system 1500A may be defined as including the zone between the object 100 and the foundation system 200 where the object platform system 1500 connects to the stabilization system 108 and rests on the foundation system 200 when in the object at rest 301 position. In some example embodiments, the object platform system 1500A may be configured to be able to support the object 100. In some example embodiments, the object platform system 1500A may be configured to anchor the object platform system 1500 to the stabilization system 108. In some example embodiments, the object platform system 1500A may be positioned above the foundation system 200, above the stabilization system 108 or below the object 100. In some example embodiments, the object platform system 1500A may be coupled with the stabilization system 108 or the object 100. In some example embodiments, the object platform system 1500A may comprise platform sill 1003, platform to sill anchor 4203 or impact dampening system 4200. In some example embodiments, the pier anchoring system 4201A may be configured to anchor the pier 14600 to either the grade beam 201, spot footing 14100, or slab foundation 12000. Shock resistant material 4202 may be defined as having the capacity to absorb the energy of impact between the object 100 and the foundation system 200 when the object 100 is transitioning its position between object at rest 301 and object separated 103. In some example embodiments, the shock resistant material 4202 may be configured to absorb the energy of an impact and minimize the impact shock to the supporting frame 101 and object 100 when transitioning between conditions of object separated 103 and object at rest 301. In some example embodiments, if the shock resistant material 4202 is absent then the object 100 and the foundation system 200 will absorb the energy of impact between the object 100 and the foundation system 200 when the object 100 is transitioning its position between object at rest 301 and object separated 103. In some example embodiments, the platform to sill anchor 4203A may be configured to anchor the supporting frame 101 to the platform sill 1003.

Figure 43:
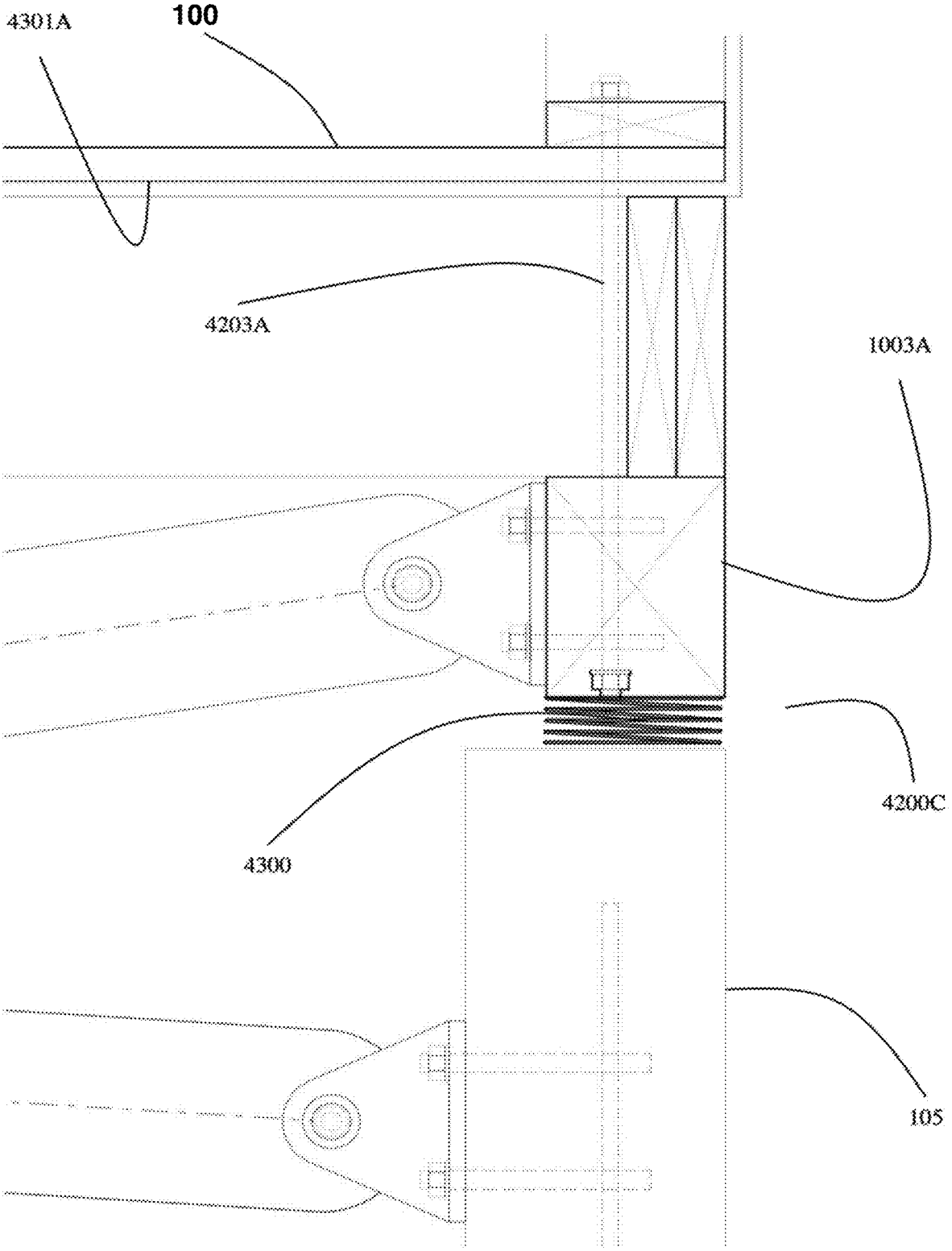
FIG. 43 illustrates a section view that shows a platform foundation interface that uses a coil sprig for the impact dampening system to absorb the inertia impact shock of the object while transitioning from an object separated to an object at rest position on a pier system, according to an example embodiment of the present disclosure.

FIG. 43 illustrates a section view that shows a platform foundation interface that uses a coil sprig 4300 for the impact dampening system 4200 to absorb the inertia impact shock of the object 100 while transitioning from an object separated 103 to an object at rest 301 position on a pier system 105, according to an example embodiment of the present disclosure. Impact dampening system 4200C may be defined as a resilient device, typically a helical metal coil, that can be pressed or pulled but returns to its former shape when released, having the capacity to absorb the energy of impact between the object 100 and the foundation system 200 when the object 100 is transitioning its position between object at rest 301 and object separated 103. In some example embodiments, the impact dampening system 4200C may be configured to minimize the impact shock to the supporting frame 101 and object 100 when transitioning between conditions of object separated 103 and object at rest 301. In some example embodiments, if the impact dampening system 4200C is absent then the object 100 and the foundation system 200 will absorb the energy of impact between the object 100 and the foundation system 200 when the object 100 is transitioning its position between object at rest 301 and object separated 103. In some example embodiments, the impact dampening system 4200C may be positioned between the object 100 and the foundation system 200. In some example embodiments, the impact dampening system 4200C may comprise coil sprig 4300. Coil sprig 4300 may be defined as a resilient device, typically a helical metal coil, that can be pressed or pulled but returns to its former shape when released, having the capacity to absorb the energy of impact between the object 100 and the foundation system 200 when the object 100 is transitioning its position between object at rest 301 and object separated 103. In some example embodiments, the coil sprig 4300 may be configured to minimize the impact shock to the supporting frame 101 and object 100 when transitioning between conditions of object separated 103 and object at rest 301. In some example embodiments, if the coil sprig 4300 is absent then the object 100 and the foundation system 200 will absorb the energy of impact between the object 100 and the foundation system 200 when the object 100 is transitioning its position between object at rest 301 and object separated 103. In some example embodiments, the hull bottom sheathing 4301A may be configured to support the buoyancy water displacement loads acting on either the sub flooring 5100 or on the hull sheathing and structurally span between members of the hull bottom framing 5101. In some example embodiments, the hull bottom sheathing 4301A may comprise sub flooring 5100.

Figure 44:
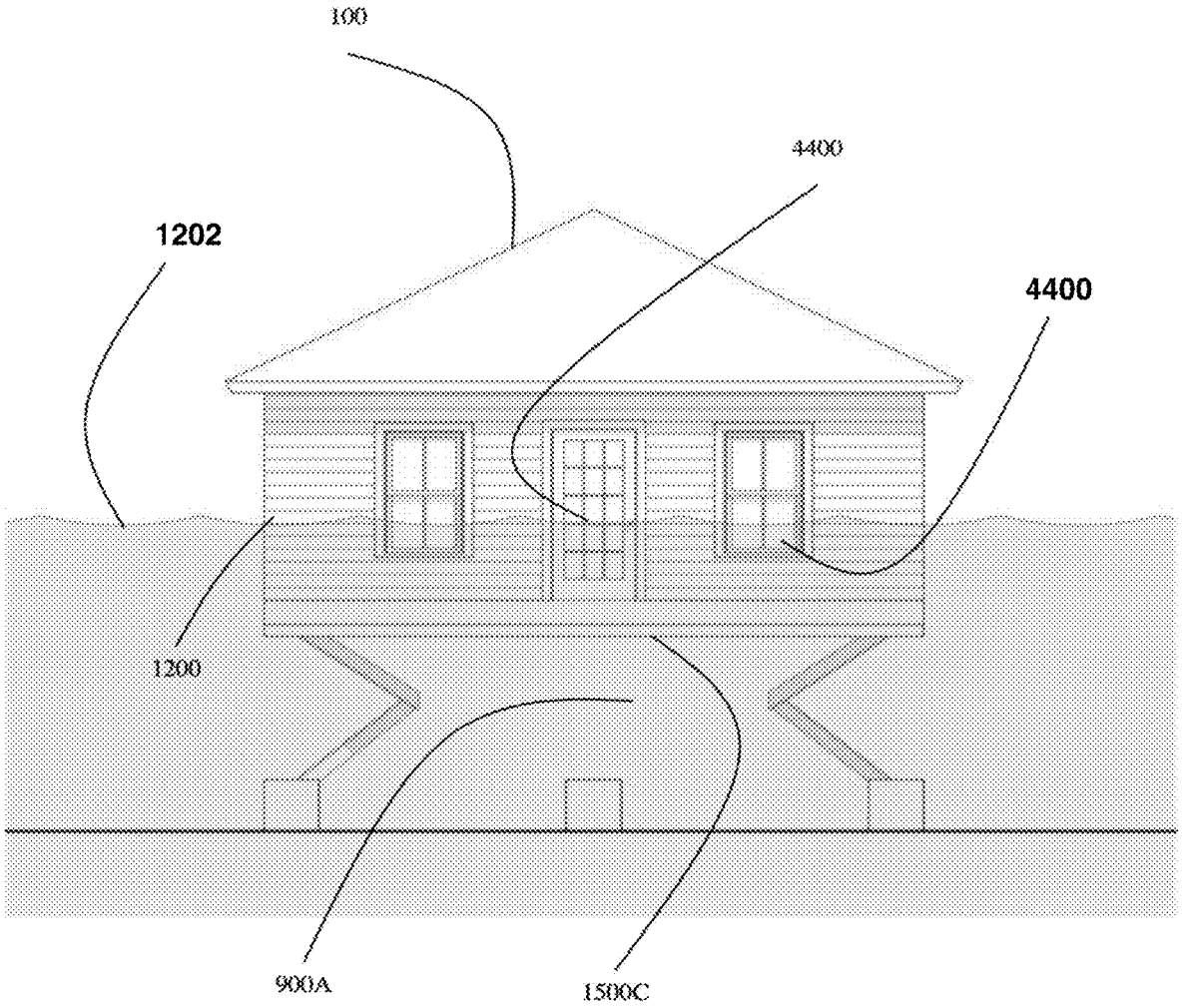
FIG. 44 illustrates a front elevation view that shows a floating house experiencing a storm surge of rising water where the house is configured to provide its own hull buoyancy system and fenestration buoyancy system where both windows and doors have been waterproofed, according to an example embodiment of the present disclosure.

FIG. 44 illustrates a front elevation view that shows a floating house experiencing a storm surge of rising water 1202 where the house is configured to provide its own hull buoyancy system and fenestration buoyancy system 4400 where both windows and doors have been waterproofed, according to an example embodiment of the present disclosure. In some example embodiments, the fenestration buoyancy system 4400 may be configured to configure openings in the partially submerged object 100 to be waterproof and repel the entry of rising water 1202, resist the buoyancy water displacement loads acting on partially submerged windows and doors, allow physical access into the object 100 interior, allow light to enter the object 100 interior and prevent rising water 1202 from entering the object 100. In some example embodiments, the fenestration buoyancy system 4400 may comprise window buoyancy system or door buoyancy system.

Figure 45:
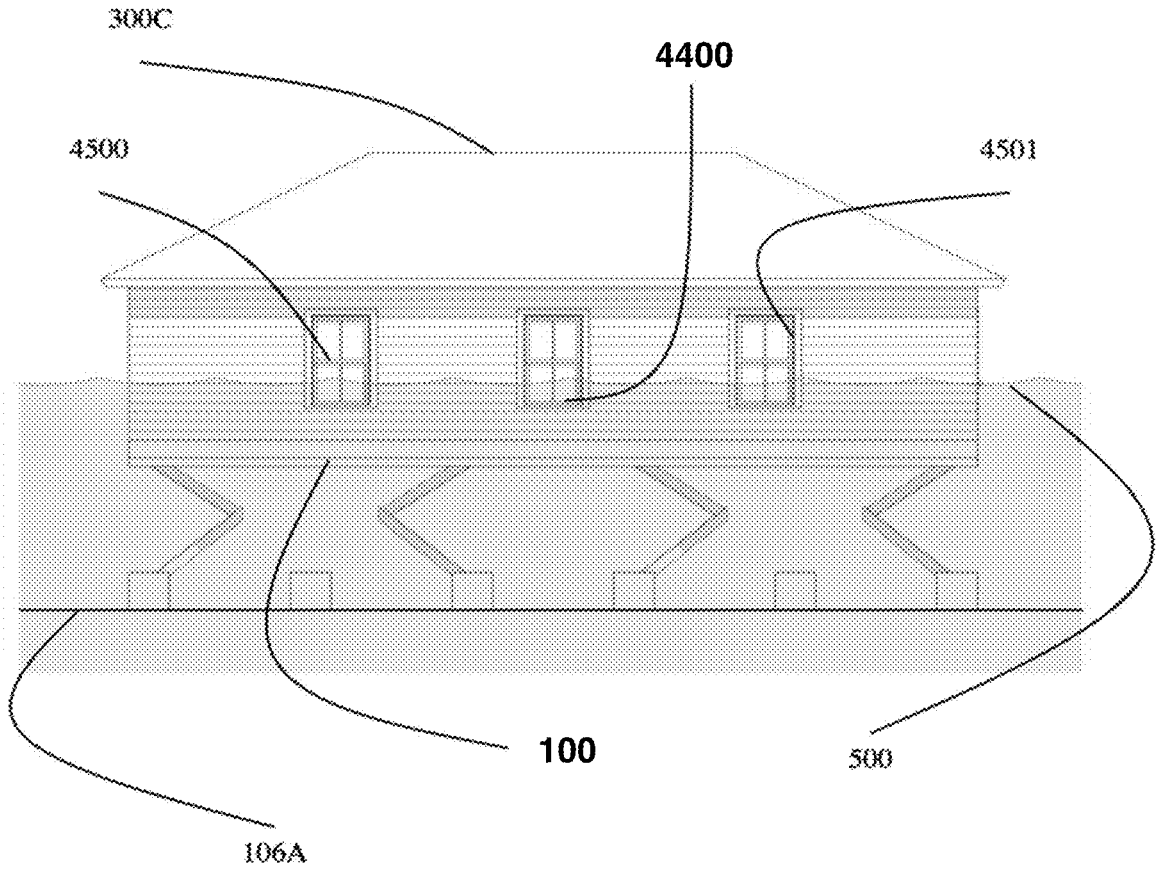
FIG. 45 illustrates a side elevation view that shows a floating house experiencing a flooding of rising water where the house is configured to provide its own hull buoyancy system and fenestration buoyancy system where both windows and doors have been waterproofed, according to an example embodiment of the present disclosure.

FIG. 45 illustrates a side elevation view that shows a floating house experiencing a flooding of rising water 1202 where the house is configured to provide its own hull buoyancy system and fenestration buoyancy system 4400 where both windows and doors have been waterproofed, according to an example embodiment of the present disclosure. In some example embodiments, the window sash system 4500 may be configured to support the structural dead loads and the external force 500 live loads acting of the object 100 in the span of the window frame system 4501, prevent rising water 1202 from entering the object 100, allow light into the object 100 and fit inside of the window frame buoyancy system 6700. In some example embodiments, the window frame system 4501 may be configured to support the structural dead loads and the external force 500 live loads acting on the window sash system 4500, allow the window sash system 4500 to open and allow the window sash system 4500 to close.

Figure 46:
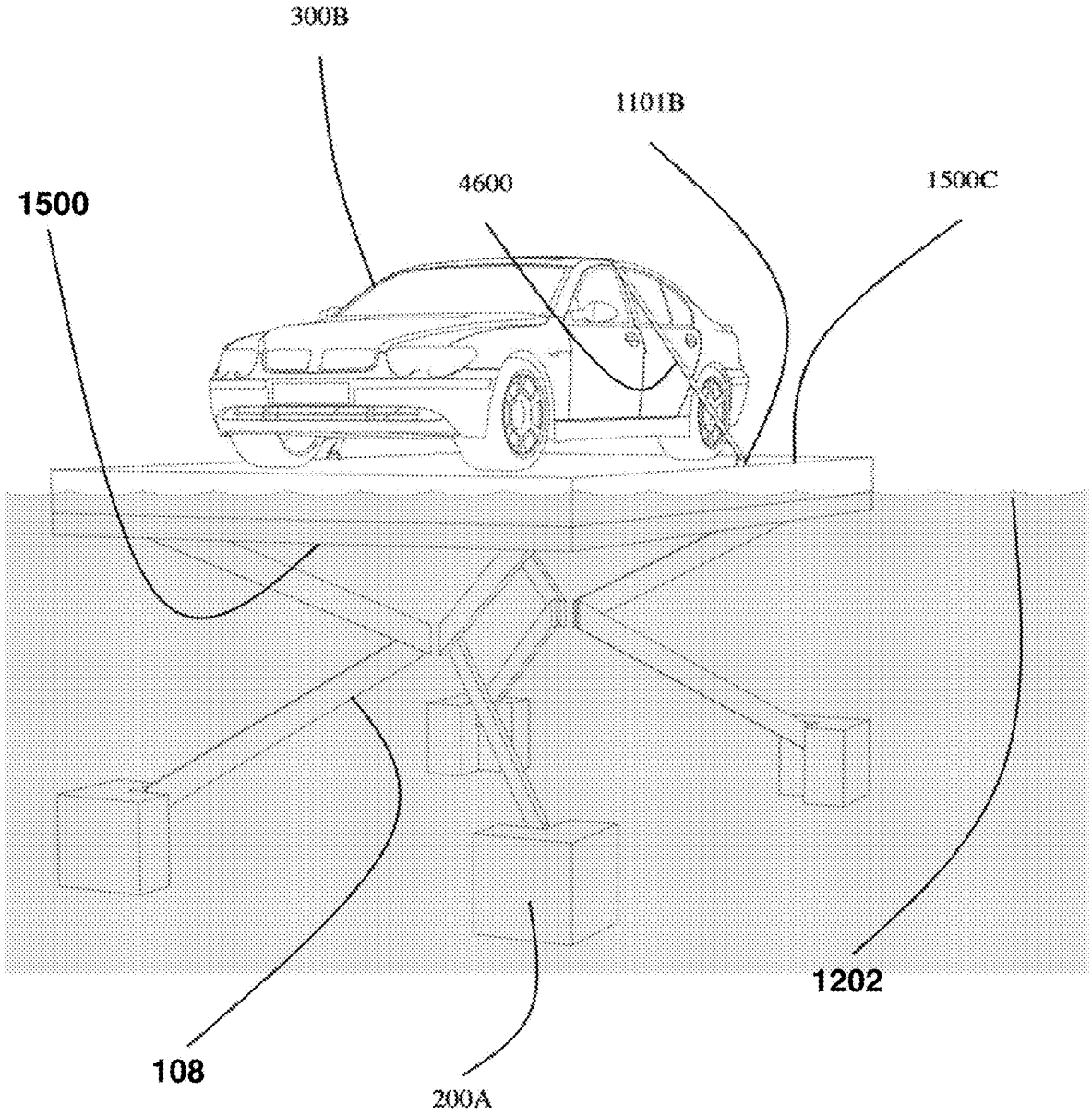
FIG. 46 illustrates an elevation view that shows a floating object platform system that is configured with its own hull buoyancy system and supporting a vehicle safely above inundation from a storm surge of rising water while safely tethered using multiple hinged system folding strut units, according to an example embodiment of the present disclosure.

FIG. 46 illustrates an elevation view that shows a floating object platform system 1500 that is configured with its own hull buoyancy system and supporting a vehicle safely above inundation from a storm surge of rising water 1202 while safely tethered using multiple hinged system folding strut units, according to an example embodiment of the present disclosure. Object type 300B may be defined as a thing used for transporting people or goods, especially on land. Examples of object type 300B may include an automobile, a Bus, a mobile home, a recreational vehicle, a farm vehicle, a motorbike, a golf cart, a cart and a truck. In some example embodiments, the object type 300B may be configured to be an object 100 and be susceptible to movement from an external force 500. In some example embodiments, the object type 300B may be configured to float in rising water 1202. In some example embodiments, the object type 300B may be positioned above the foundation system 200. In some example embodiments, the object type 300B may be coupled with the stabilization system 108 or the object platform system 1500. Object to platform anchor 1101B may be defined as a connection between the object 100 and the object platform system 1500 that is a removable part of the assembly. In some example embodiments, the object to platform anchor 1101B may be configured to anchor the object 100 to the object platform system 1500. In some example embodiments, the physical release system 4600 may be configured to anchor the object 100 to the foundation system 200, release the object 100 from the foundation system 200 when the locking system 8309 is physically unfastened from either the object 100 or the foundation system 200 and anchor the object 100 to the tether.

Figure 47:
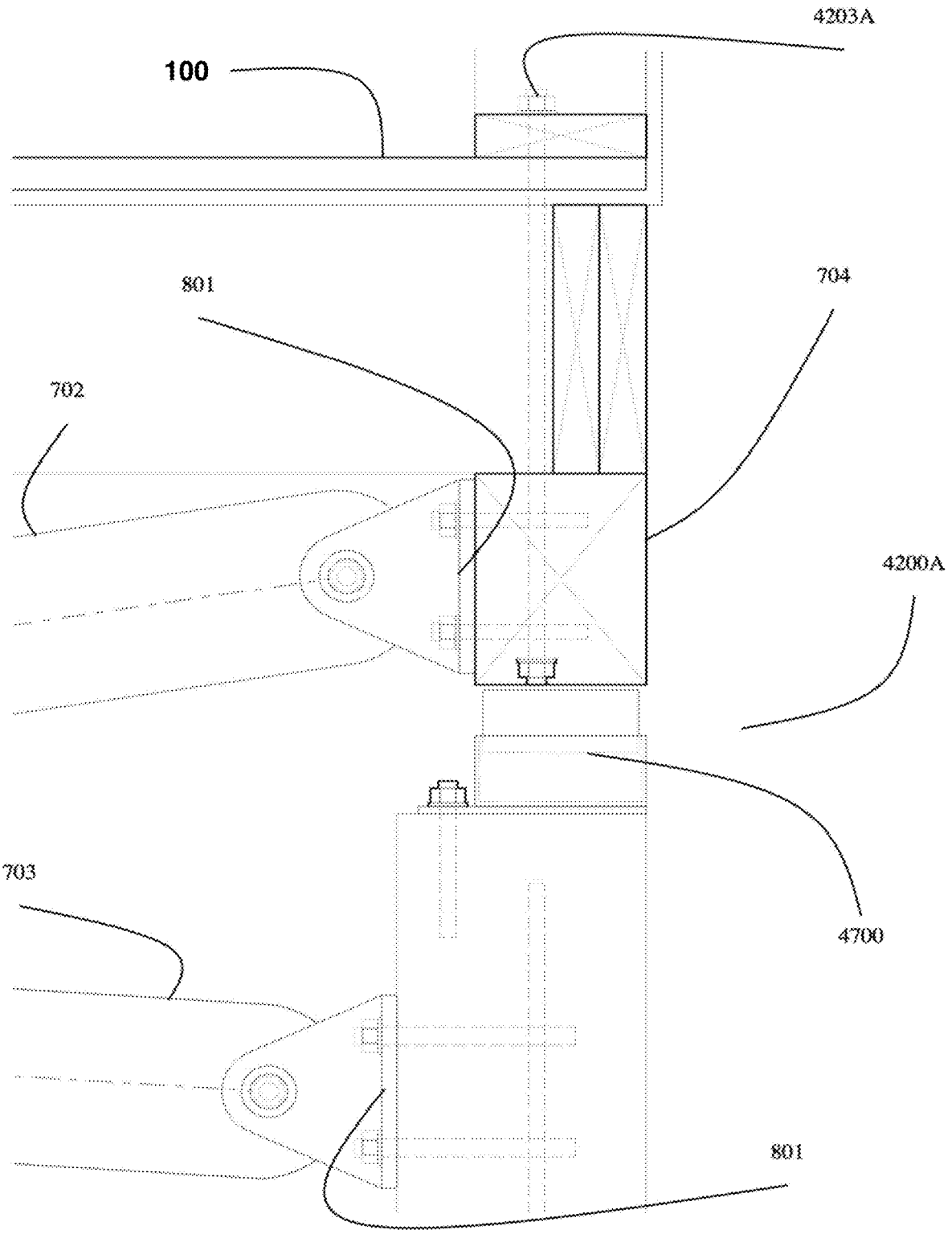
FIG. 47 illustrates an elevation view that shows a platform foundation interface that uses a shock absorber for the impact dampening system to absorb the inertia impact shock of the object while transitioning from an object separated to an object at rest position on a pier system, according to an example embodiment of the present disclosure.

FIG. 47 illustrates an elevation view that shows a platform foundation interface that uses a shock absorber 4700 for the impact dampening system 4200 to absorb the inertia impact shock of the object 100 while transitioning from an object separated 103 to an object at rest 301 position on a pier system 105, according to an example embodiment of the present disclosure. In some example embodiments, the impact dampening system 4200A may be configured to minimize the impact shock to the supporting frame 101 and object 100 when transitioning between conditions of object separated 103 and object at rest 301. In some example embodiments, the impact dampening system 4200A may be positioned between the object 100 and the foundation system 200. In some example embodiments, the impact dampening system 4200A may comprise shock absorber 4700. Shock absorber 4700 may be defined as a telescoping assembly configured to valve oil and gasses to absorb excess energy released after impact from one or more springs having the capacity to absorb the energy of collision between the object 100 and the foundation system 200 when the object 100 is transitioning its position between object at rest 301 and object separated 103. In some example embodiments, the shock absorber 4700 may be configured to minimize the impact shock to the supporting frame 101 and object 100 when transitioning between conditions of object separated 103 and object at rest 301. In some example embodiments, if the shock absorber 4700 is absent then the object 100 and the foundation system 200 will absorb the energy of impact between the object 100 and the foundation system 200 when the object 100 is transitioning its position between object at rest 301 and object separated 103.

Figure 48:
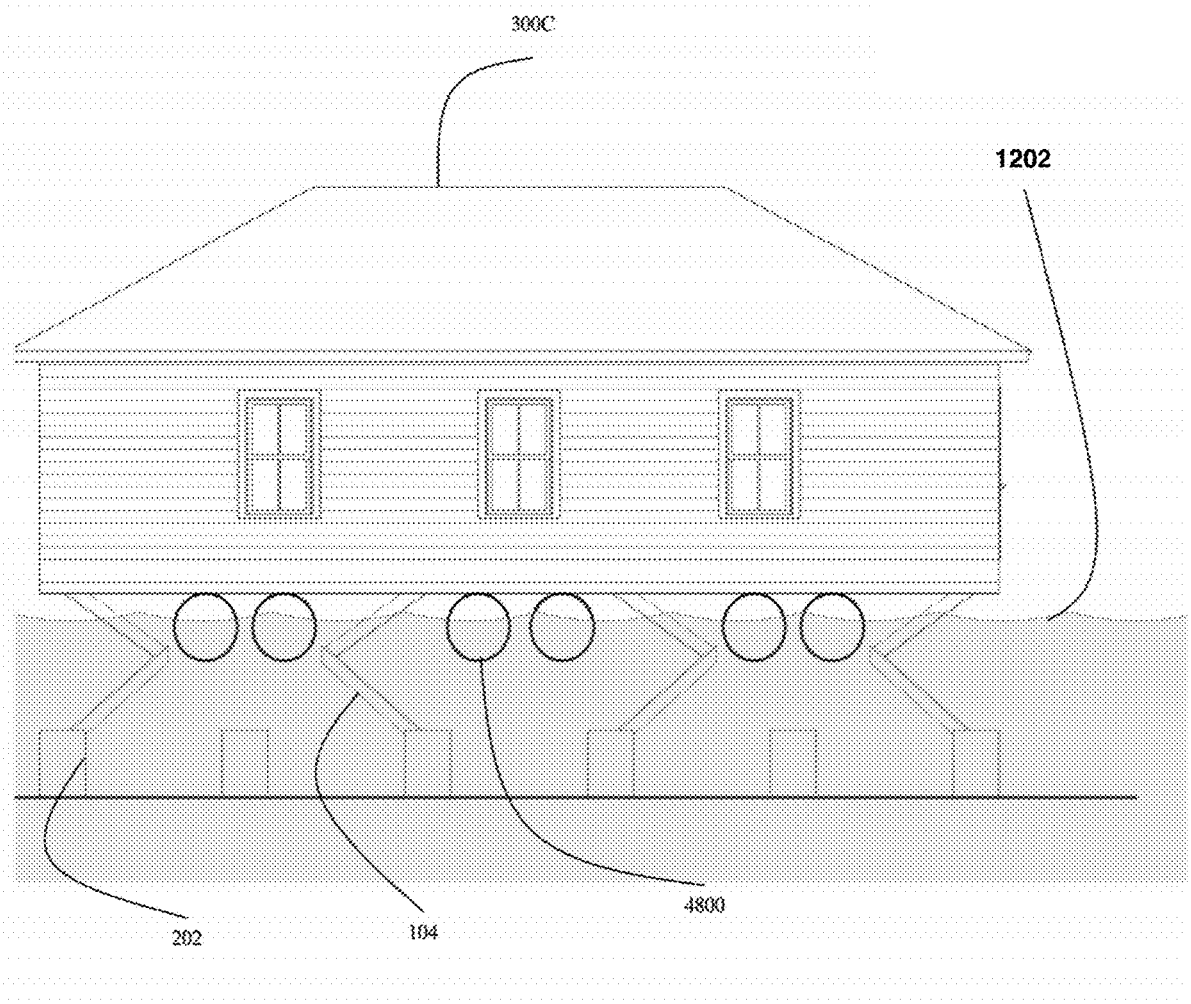
FIG. 48 illustrates a side elevation view that shows a floating house as the object supported by an external buoyancy system of fixed tanks during high water and safely tethered to a pier on gradebeam system by multiple primary parallel struts system units, according to an example embodiment of the present disclosure.

FIG. 48 illustrates a side elevation view that shows a floating house as the object 100 supported by an external buoyancy system 1200 of fixed tanks during high water 4800 and safely tethered to a pier on gradebeam system 202 by multiple primary parallel struts system 104 units, according to an example embodiment of the present disclosure. In some example embodiments, the fixed tanks during high water 4800 may be configured to displace sufficient water to float the object 100 in rising water 1202 and remain attached to the object 100.

Figure 49:
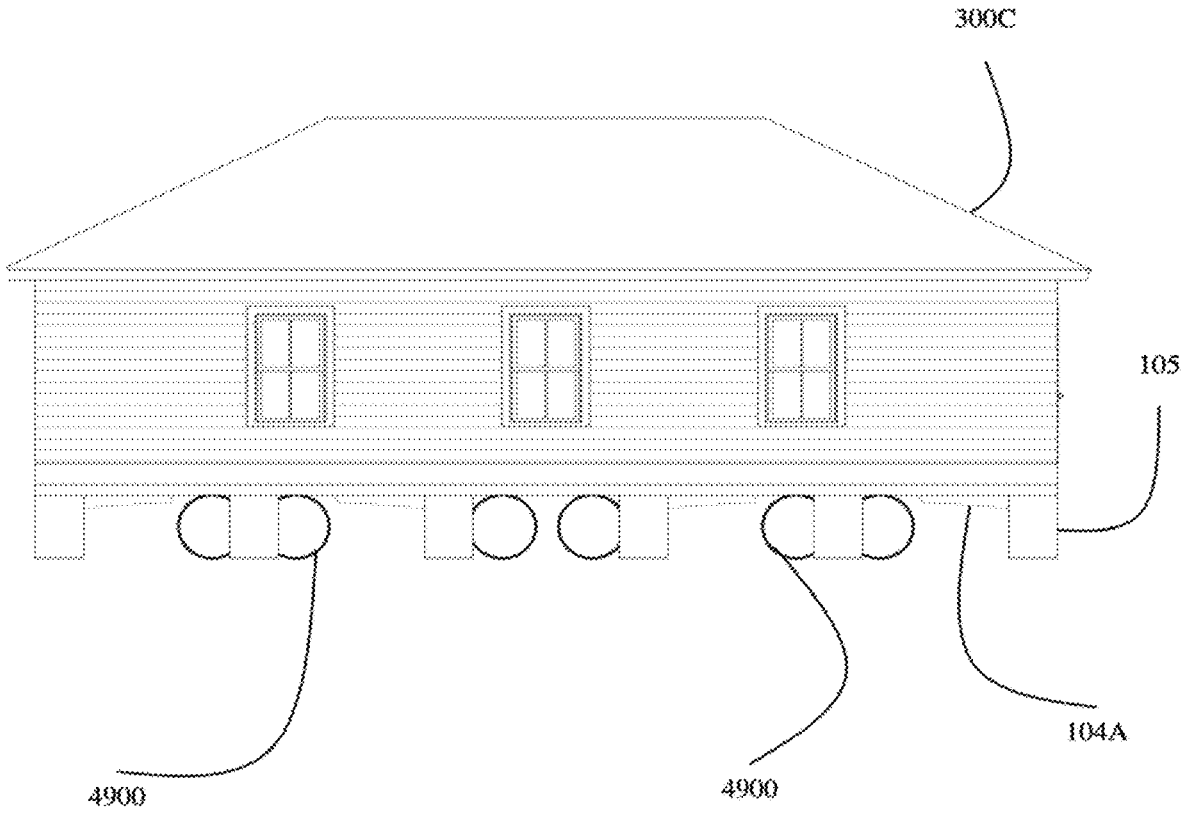
FIG. 49 illustrates a side elevation view that shows a house as the object in an object at rest position that is outfitted a buoyancy system of fixed tanks secured below the object platform system where each tank is located in between and do not interfere with the operation of multiple primary parallel struts system units which safely tether the house to a pier on gradebeam system, according to an example embodiment of the present disclosure.

FIG. 49 illustrates a side elevation view that shows a house as the object 100 in an object at rest 301 position that is outfitted a buoyancy system 1200 of fixed tanks secured below the object platform system 1500 where each tank is located in between and do not interfere with the operation of multiple primary parallel struts system 104 units which safely tether the house to a pier on gradebeam system 202, according to an example embodiment of the present disclosure. In some example embodiments, the fixed tanks in dry conditions 4900 may be configured to fit inside the crawl space, displace sufficient water to float the object 100 in rising water 1202 and remain attached to the object 100.

Figure 50:
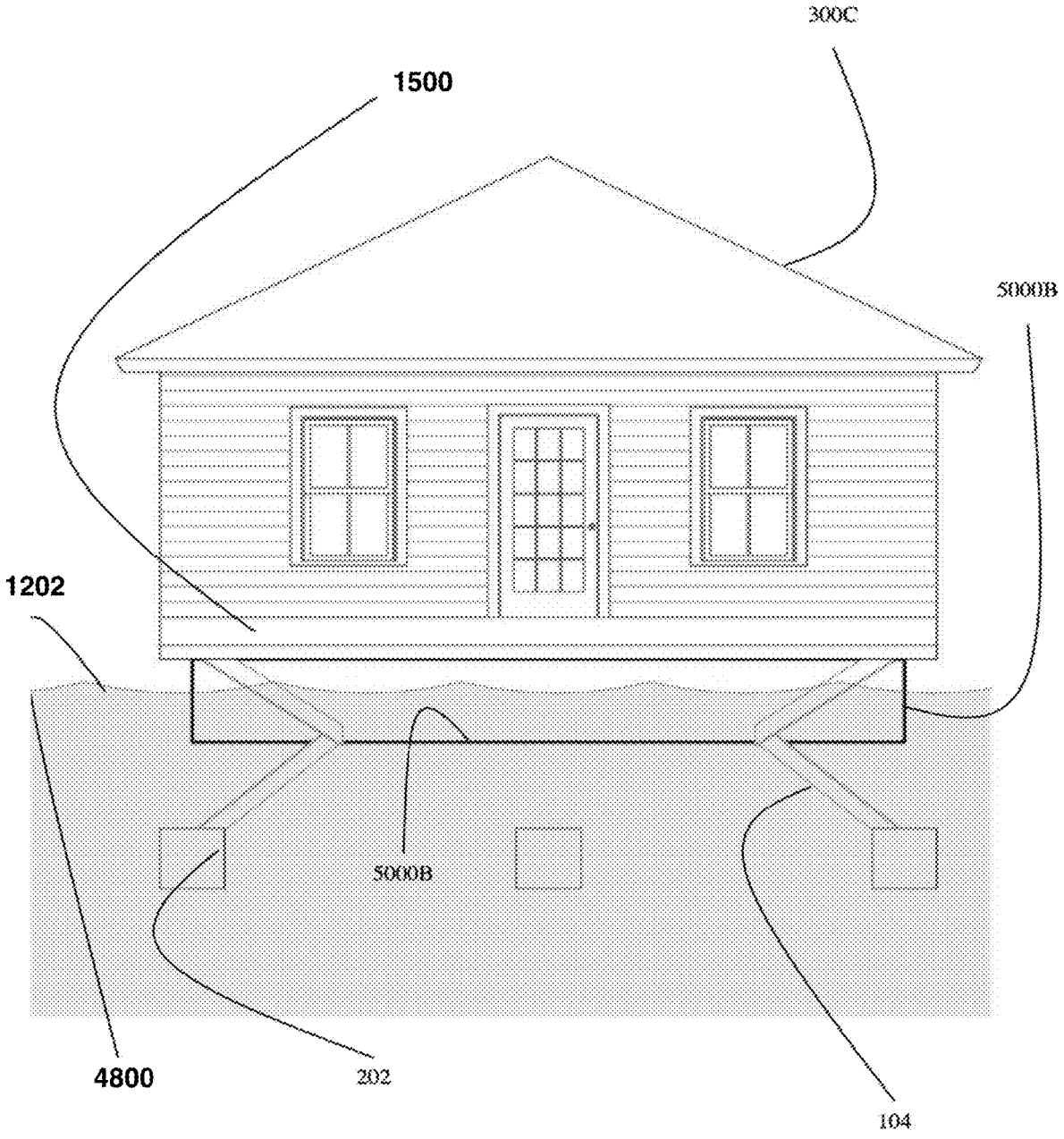
FIG. 50 illustrates a front elevation view that shows a floating house as the object in an object separated position that is outfitted with a buoyancy system of fixed tanks secured below the object platform system where each tank is located in between and does not interfere with the operation of multiple primary parallel struts system units which safely tether the house to a pier on gradebeam system, according to an example embodiment of the present disclosure.

FIG. 50 illustrates a front elevation view that shows a floating house as the object 100 in an object separated 103 position that is outfitted with a buoyancy system 1200 of fixed tanks secured below the object platform system 1500 where each tank is located in between and does not interfere with the operation of multiple primary parallel struts system 104 units which safely tether the house to a pier on gradebeam system 202, according to an example embodiment of the present disclosure. In some example embodiments, the static buoyancy installation 5000B may be configured to remain buoyant, displace sufficient water to float the object 100 in rising water 1202 and remain attached to the object 100. In some example embodiments, the static buoyancy installation 5000B may comprise fixed tanks during high water 4800 or fixed tanks in dry conditions 4900.

Figure 51:
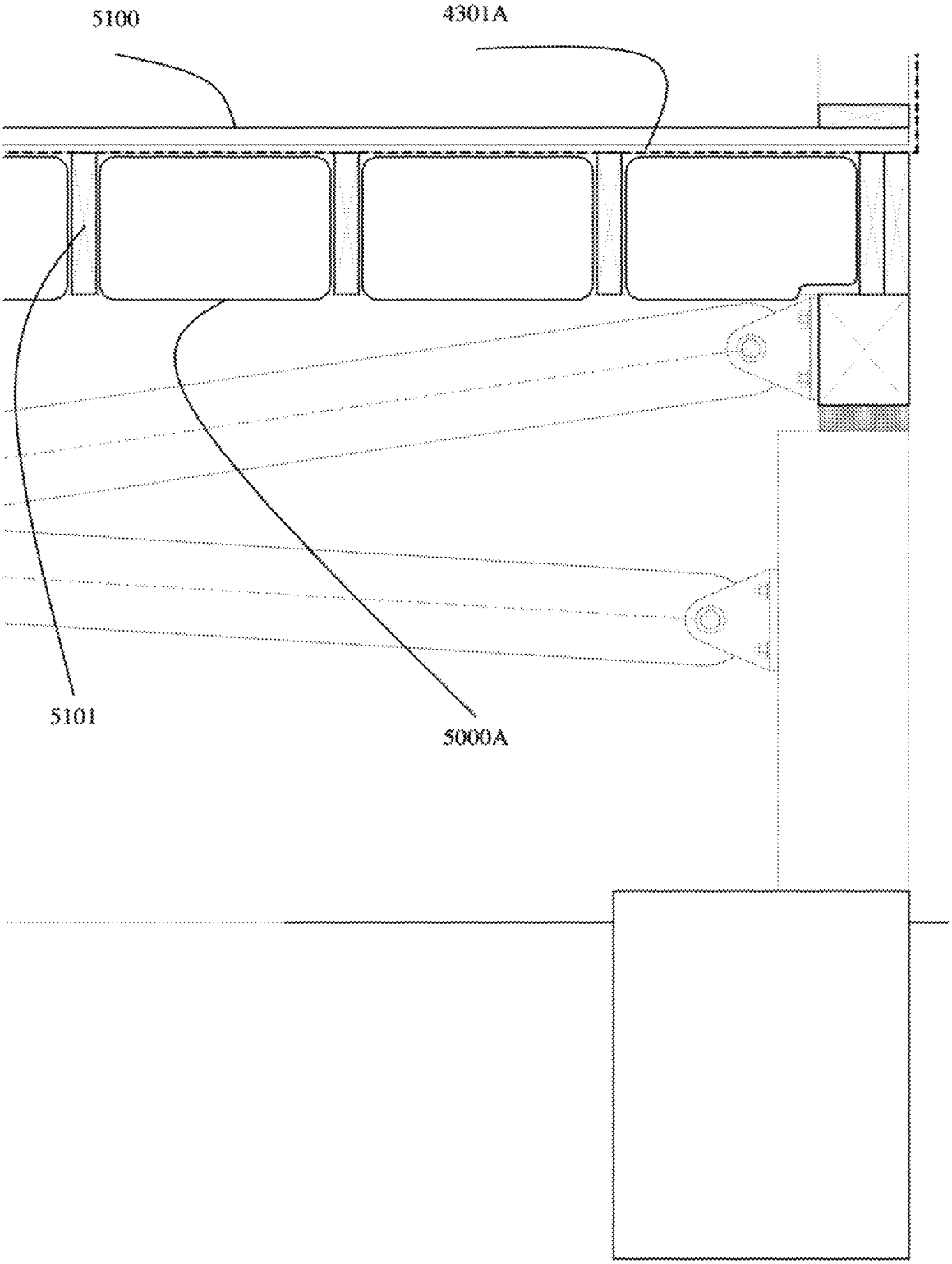
FIG. 51 illustrates a section view that shows one method of outfitting a supporting platform with a static buoyancy installation of a waterproof buoyant material placed and secured in between the platform joist members, according to an example embodiment of the present disclosure.

FIG. 51 illustrates a section view that shows one method of outfitting a supporting platform 1701 with a static buoyancy installation 5000 of a waterproof buoyant material placed and secured in between the platform joist 1001 members, according to an example embodiment of the present disclosure. In some example embodiments, the static buoyancy installation 5000A may be configured to remain buoyant, displace sufficient water to float the object 100 in rising water 1202 and remain attached to the object 100. In some example embodiments, the sub flooring 5100 may be configured to support the structural dead loads and live loads in the spans between each member of the hull bottom framing 5101. In some example embodiments, the hull bottom framing 5101 may be configured to support the hull bottom sheathing 4301 and support the structural dead loads, buoyancy water displacement loads, and the external force 500 live loads transmitted through the hull bottom sheathing 4301.

Figure 52:
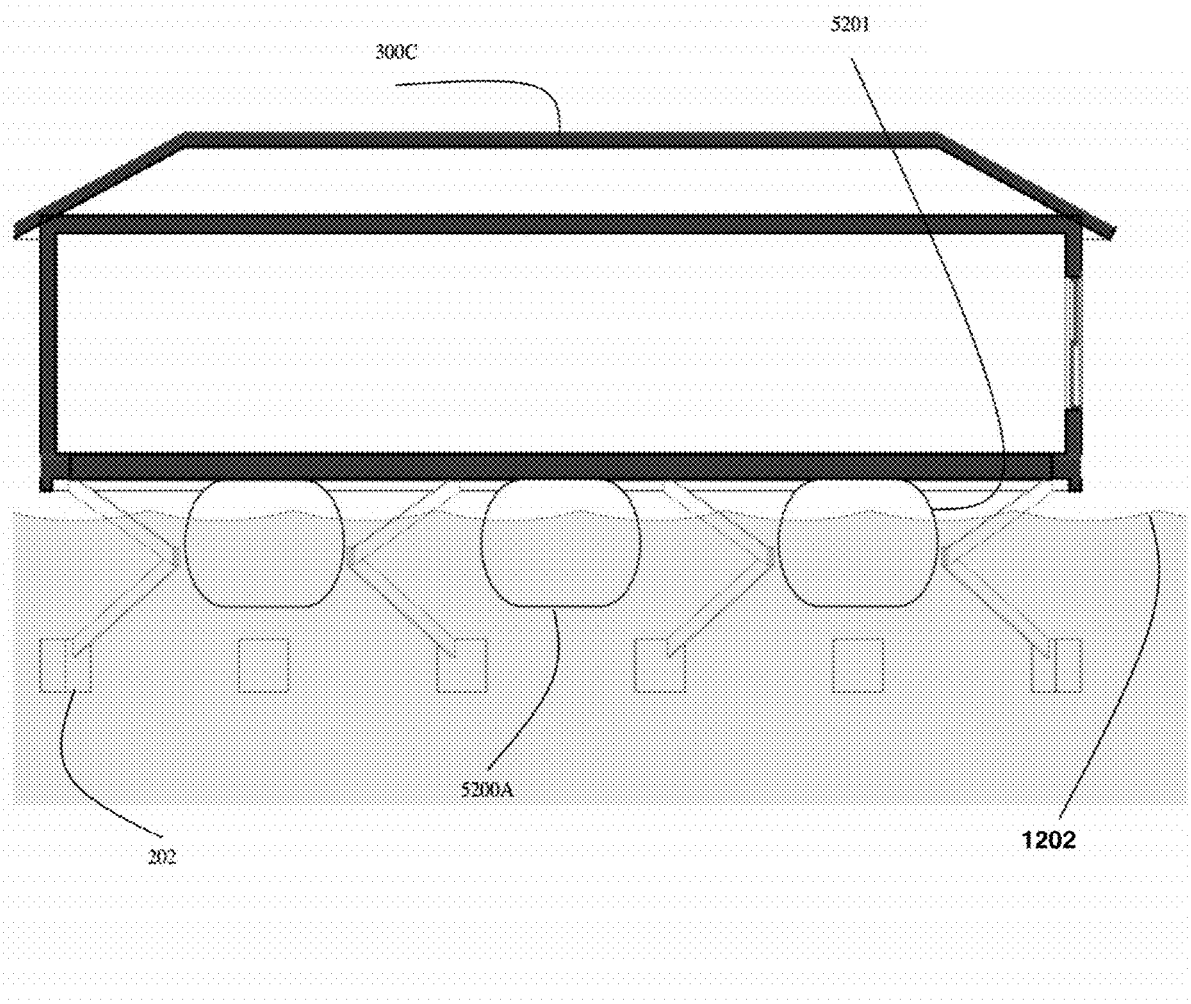
FIG. 52 illustrates a section view that shows a floating house as the object experiencing a flash flood and supported by an external buoyancy system of deployable buoyancy tanks that are water-activated to inflate and attached and secured to the house that is safely tethered to a pier on gradebeam system by multiple primary parallel struts system units, according to an example embodiment of the present disclosure.

FIG. 52 illustrates a section view that shows a floating house as the object 100 experiencing a flash flood and supported by an external buoyancy system 1200 of deployable buoyancy 5200 tanks that are water-activated to inflate and attached and secured to the house that is safely tethered to a pier on gradebeam system 202 by multiple primary parallel struts system 104 units, according to an example embodiment of the present disclosure. In some example embodiments, the deployable buoyancy 5200A may be configured to remain attached to the object 100, inflate and become buoyant in the presence of rising water 1202 and displace sufficient water to float the object 100 in rising water 1202. In some example embodiments, the deployable buoyancy 5200A may comprise deflated tanks 5300 or inflated tanks 5201. In some example embodiments, the inflated tanks 5201 may be configured to displace sufficient water to float the object 100 in rising water 1202 and remain attached to the object 100 in the presence of rising water 1202.

Figure 53:
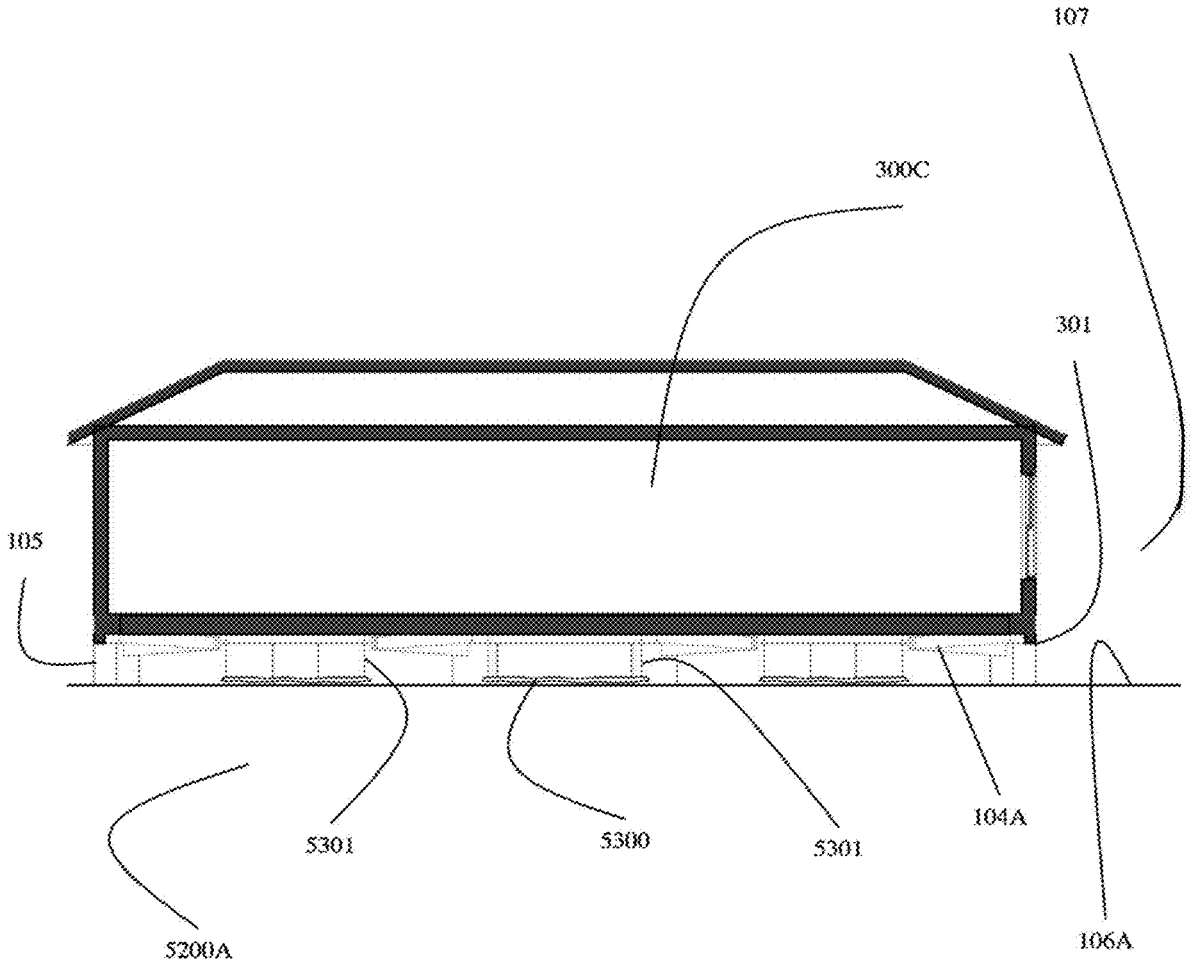
FIG. 53 illustrates a section view that shows a house as the object in an object at rest position that is outfitted with an external buoyancy system of deflated deployable buoyancy tanks water-activated to inflate and located in between and out of the way of the operation of multiple primary parallel struts system units tethered to a pier on gradebeam system by multiple primary parallel struts system units, according to an example embodiment of the present disclosure.

FIG. 53 illustrates a section view that shows a house as the object 100 in an object at rest 301 position that is outfitted with an external buoyancy system 1200 of deflated deployable buoyancy 5200 tanks water-activated to inflate and located in between and out of the way of the operation of multiple primary parallel struts system 104 units tethered to a pier on gradebeam system 202 by multiple primary parallel struts system 104 units, according to an example embodiment of the present disclosure. In some example embodiments, the deflated tanks 5300 may be configured to collapse and flatten for concealment when not inflated, be outfitted with a device to inflate the tanks in the presence of rising water 1202, inflate in the presence of rising water 1202 and remain attached to the object 100. In some example embodiments, the deflated tanks 5300 may comprise inflation device 5301. In some example embodiments, the inflation device 5301 may be configured to detect the presence of rising water 1202 and inflate the deflated tanks 5300 in the presence of rising water 1202.

Figure 54:
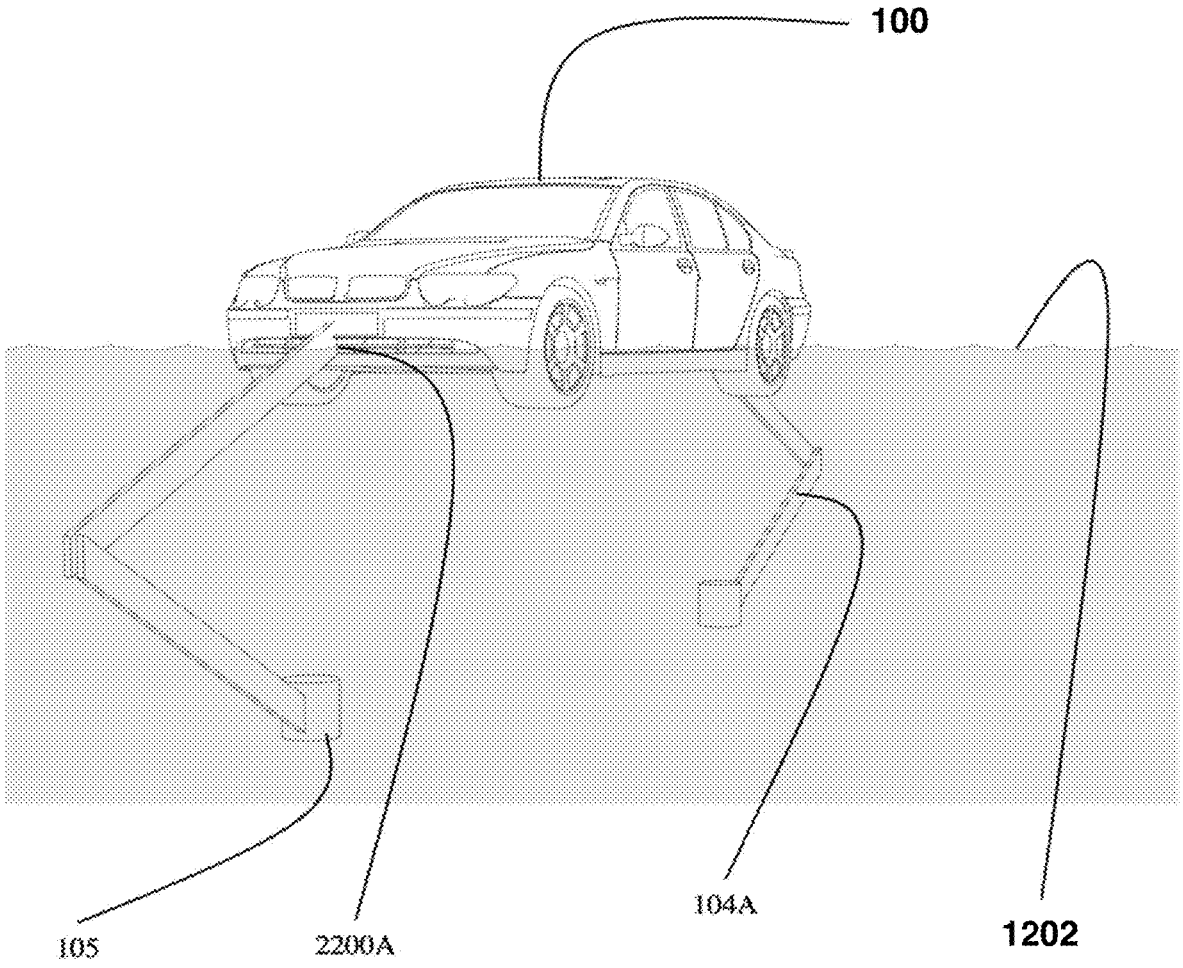
FIG. 54 illustrates a perspective view that shows a car outfitted as a buoyant object and floating in water while safely tethered to the foundation system with multiple primary parallel struts system units, according to an example embodiment of the present disclosure.

FIG. 54 illustrates a perspective view that shows a car outfitted as a buoyant object and floating in water while safely tethered to the foundation system 200 with multiple primary parallel struts system 104 units, according to an example embodiment of the present disclosure. Object hinge 2200A may be defined as a device that anchors the object 100 to the stabilization system 108 that is removable when anchoring the object 100 to the foundation system 200 is not used. In some example embodiments, the object hinge 2200A may be configured to attach to the object 100 and allow rotational arc movement of the upper strut 702 attached to the hinge block system 2700 that is attached to the object 100.

Figure 55:
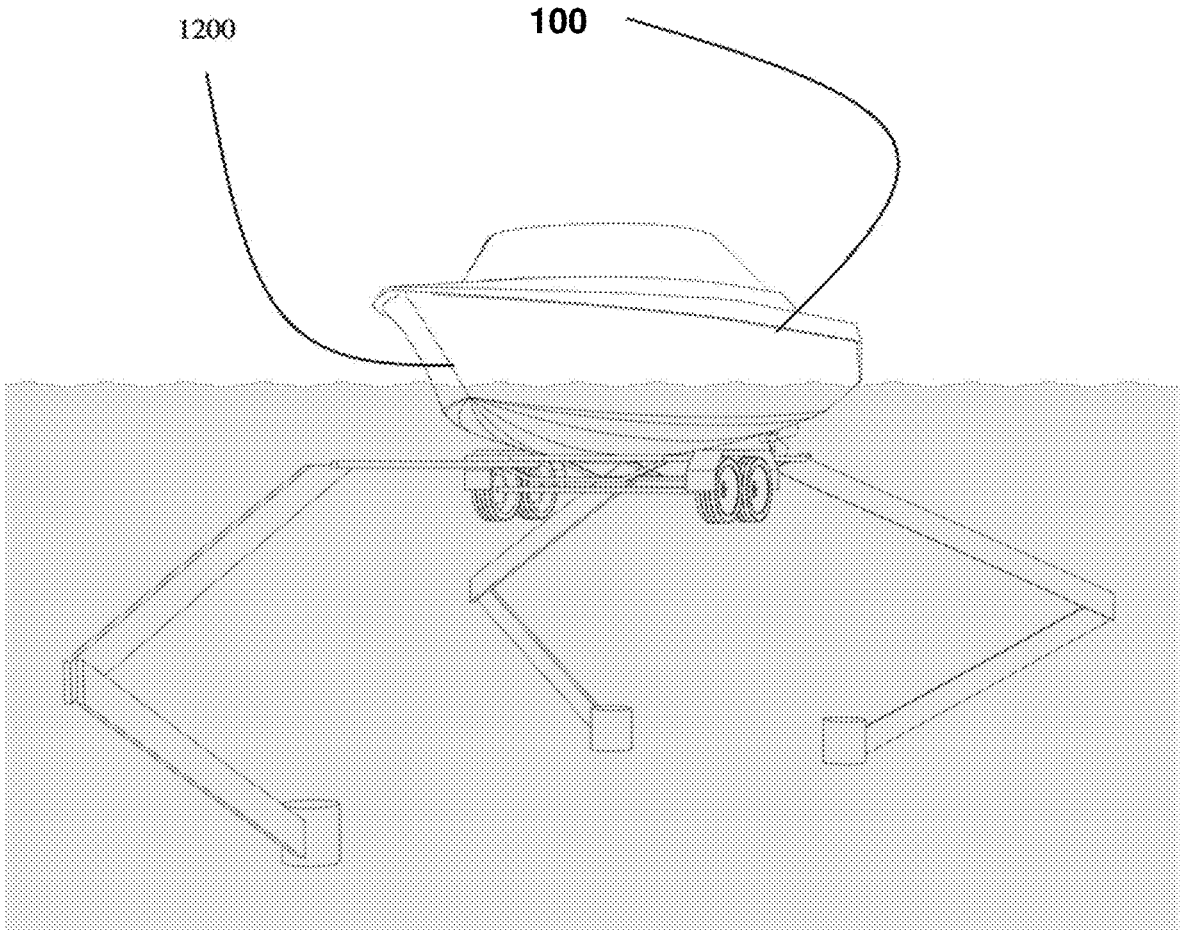
FIG. 55 illustrates a perspective view that shows a trailer secured to a boat as a buoyant object and floating in water while safely tethered to the foundation system with multiple primary parallel struts system units, according to an example embodiment of the present disclosure.

FIG. 55 illustrates a perspective view that shows a trailer secured to a boat as a buoyant object and floating in water while safely tethered to the foundation system 200 with multiple primary parallel struts system 104 units, according to an example embodiment of the present disclosure.

Figure 56:
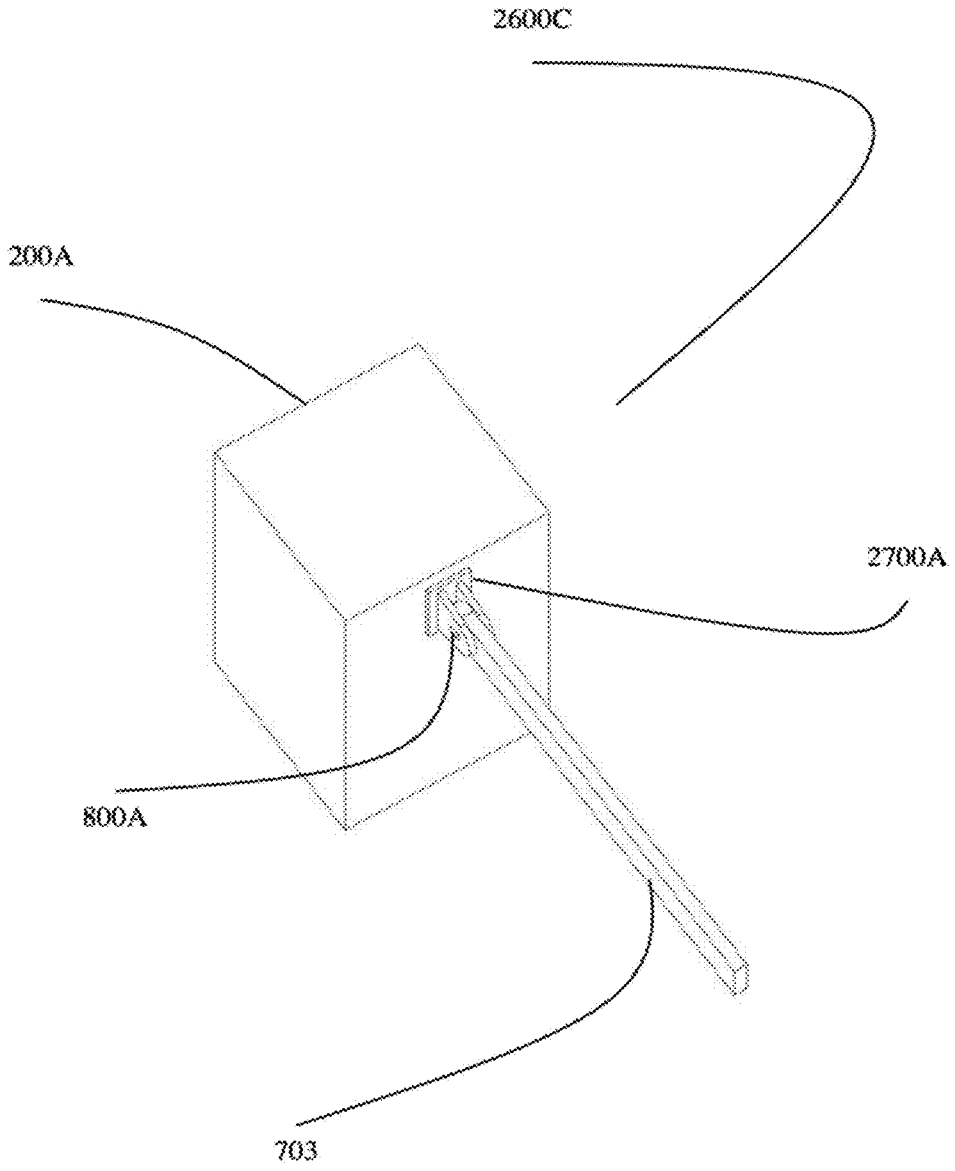
FIG. 56 illustrates a perspective view that shows a hinge block of a strut hinge system attaching a single strut to a hinge block system anchored to a foundation system, according to an example embodiment of the present disclosure.

FIG. 56 illustrates a perspective view that shows a hinge block of a strut hinge system 2600 attaching a single strut to a hinge block system 2700 anchored to a foundation system, according to an example embodiment of the present disclosure. In some example embodiments, the hinge block system 2700A may be configured to contain the hinge pin 800 and the hinge leaf system 5801. In some example embodiments, the hinge block system 2700A may comprise single hinge system 602. In some example embodiments, the strut hinge system 2600C may be configured to allow rotational arc movement of the strut end attached to the elbow hinge 700 and allow rotational arc movement of the strut 601 end attached to the strut cleat system 3100. In some example embodiments, the strut hinge system 2600C may comprise hinge block system 2700.

Figure 57:
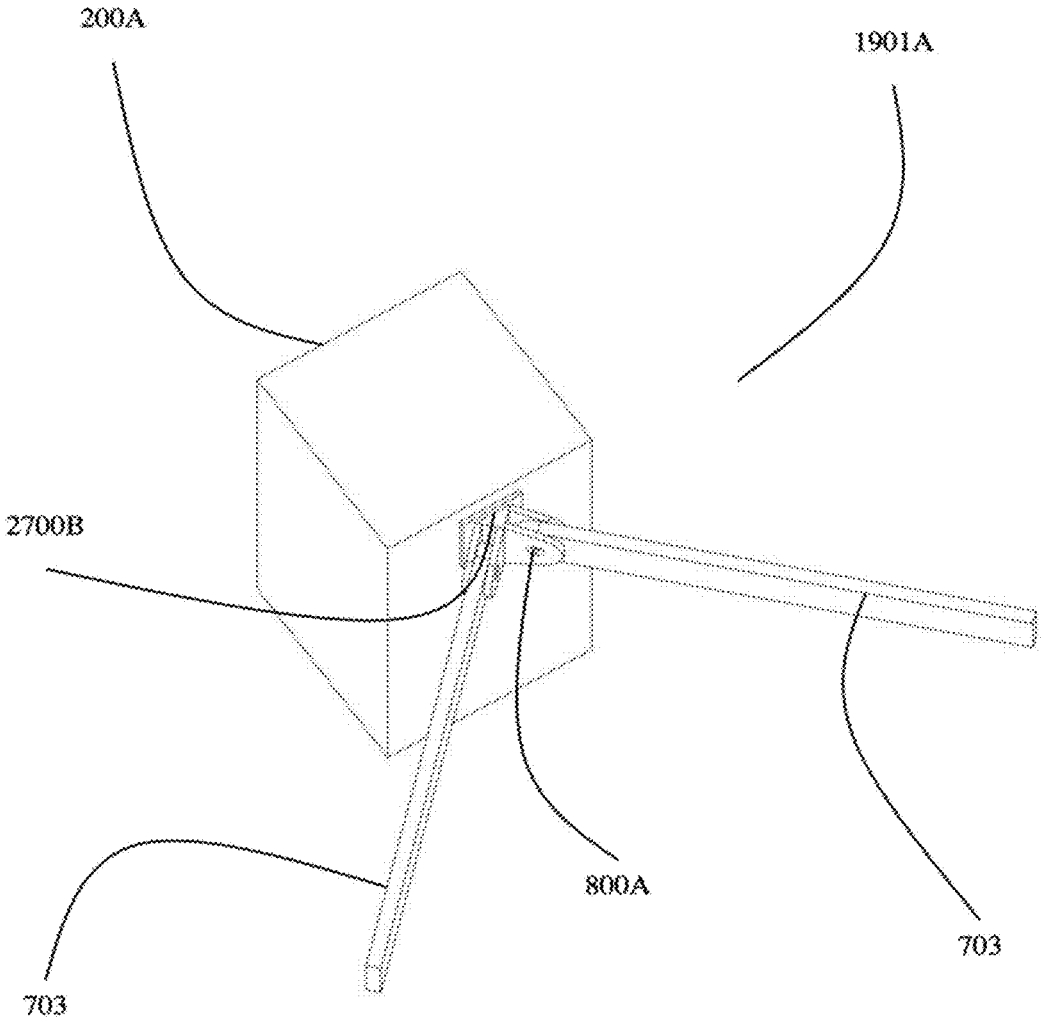
FIG. 57 illustrates a perspective view that shows a clustered hinge system double hinge block anchoring two lower strut units to a foundation system, according to an example embodiment of the present disclosure.

FIG. 57 illustrates a perspective view that shows a clustered hinge system 1901 double hinge block anchoring two lower strut 703 units to a foundation system, according to an example embodiment of the present disclosure.

Figure 58:
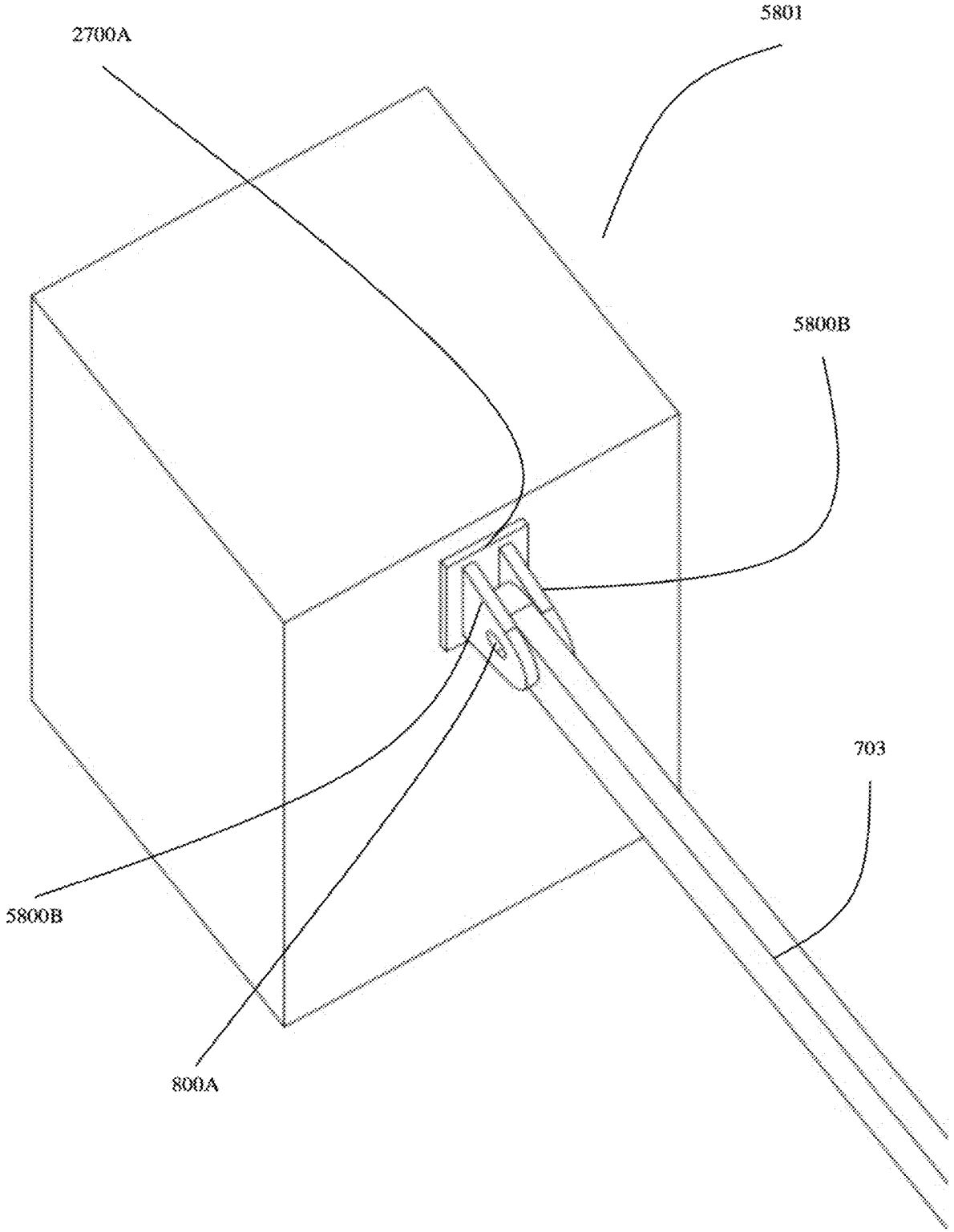
FIG. 58 illustrates a perspective view that shows a hinge leaf system using hinge block system configured to anchor a single hinge using a hinge pin to anchor a lower strut, according to an example embodiment of the present disclosure.

FIG. 58 illustrates a perspective view that shows a hinge leaf system 5801 using hinge block system 2700 configured to anchor a single hinge using a hinge pin 800 to anchor a lower strut 703, according to an example embodiment of the present disclosure. In some example embodiments, the leaf 5800B may be configured to allow rotation of the strut 601 and secure the hinge pin 800. In some example embodiments, the hinge leaf system 5801 may be configured to allow the strut 601 to rotate axially and contain the hinge pin 800. In some example embodiments, the hinge leaf system 5801 may comprise leaf 5800.

Figure 59:
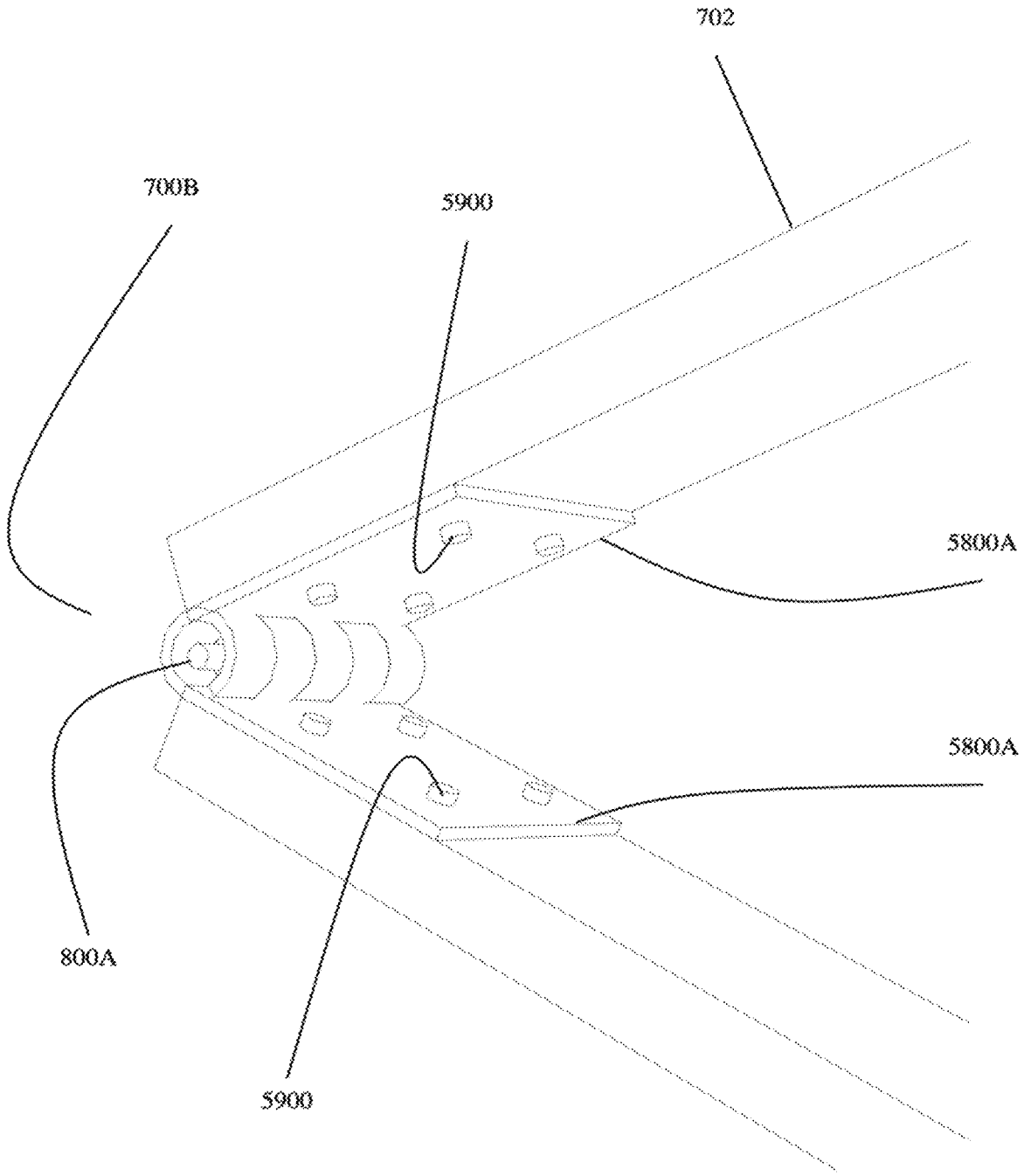
FIG. 59 illustrates a perspective view that shows an elbow hinge utilizing a butt hinge with a fixed hinge pin, according to an example embodiment of the present disclosure.

FIG. 59 illustrates a perspective view that shows an elbow hinge 700 utilizing a butt hinge 6001 with a fixed hinge pin 800, according to an example embodiment of the present disclosure. In some example embodiments, the leaf 5800A may be configured to allow rotation of the strut 601 and secure the hinge pin 800. In some example embodiments, the elbow hinge 700B may be configured to allow rotational arc movement between the lower strut 703 relative to the upper strut 702. In some example embodiments, the elbow hinge 700B may comprise butt hinge 6001 or butt movement limiter. In some example embodiments, the strut to elbow fastener 5900 may be configured to anchor the strut 601 to the elbow hinge 700.

Figure 60:
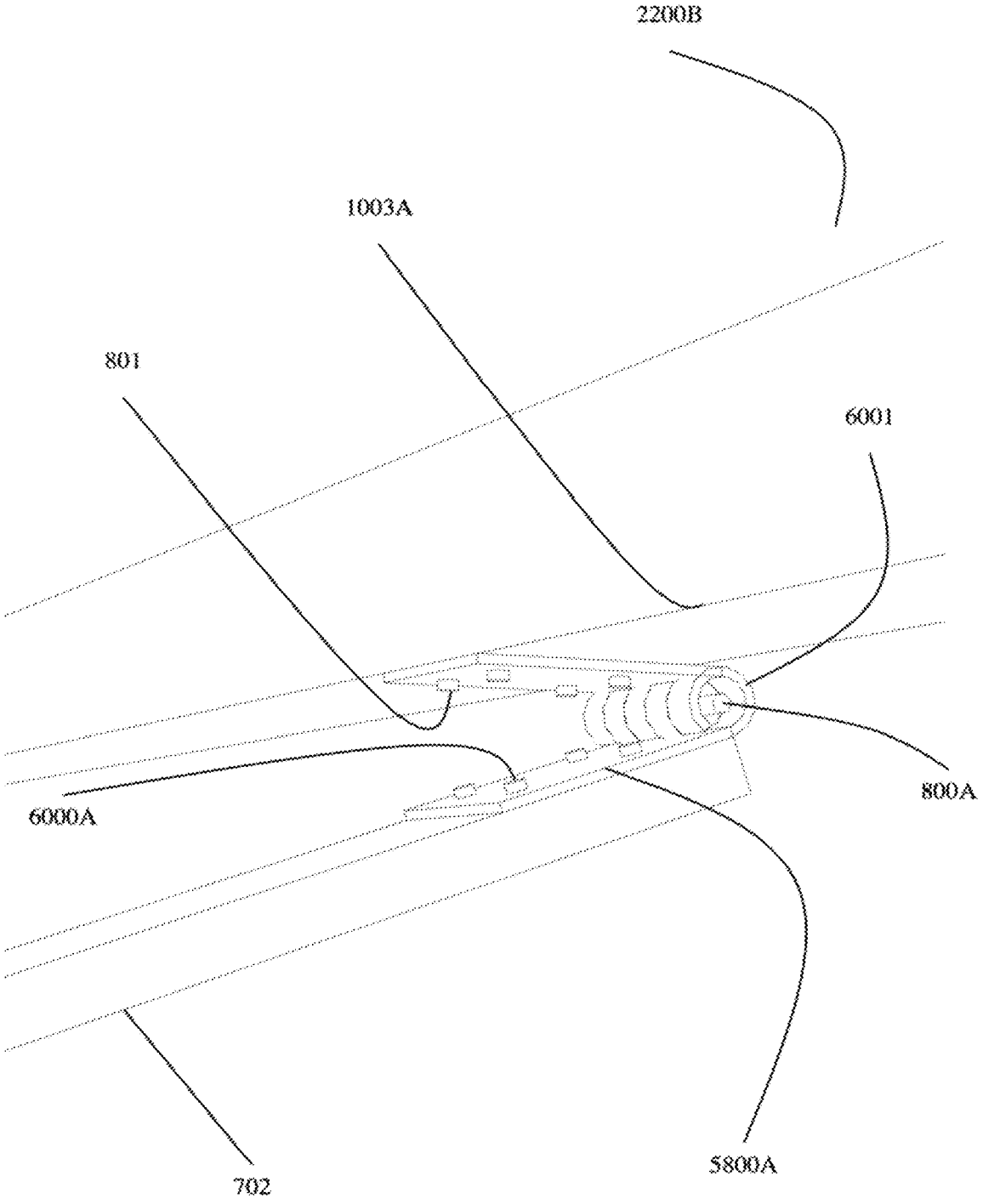
FIG. 60 illustrates a perspective view that shows an object hinge version using a butt hinge anchored to the platform sill and a strut anchor system to secure the upper strut, according to an example embodiment of the present disclosure.

FIG. 60 illustrates a perspective view that shows an object hinge 2200 version using a butt hinge 6001 anchored to the platform sill 1003 and a strut anchor system 6000 to secure the upper strut 702, according to an example embodiment of the present disclosure. In some example embodiments, the strut anchor system 6000A may be configured to anchor the strut 601 to the hinge block system 2700 and anchor the strut 601 to the elbow hinge 700. In some example embodiments, the strut anchor system 6000A may comprise strut to cleat fastener 11800. In some example embodiments, the object hinge 2200B may be configured to attach to the object 100 and allow rotational arc movement of the upper strut 702 attached to the hinge block system 2700 that is attached to the object 100. In some example embodiments, the butt hinge 6001 may be configured to comprise at least two hinge leaf 5800 units that are secured by and rotate about a common hinge pin 800, fasten to the upper strut 702 and to the lower strut 703 and allow rotation of the upper strut 702 relative to the lower strut 703.

Figure 61:
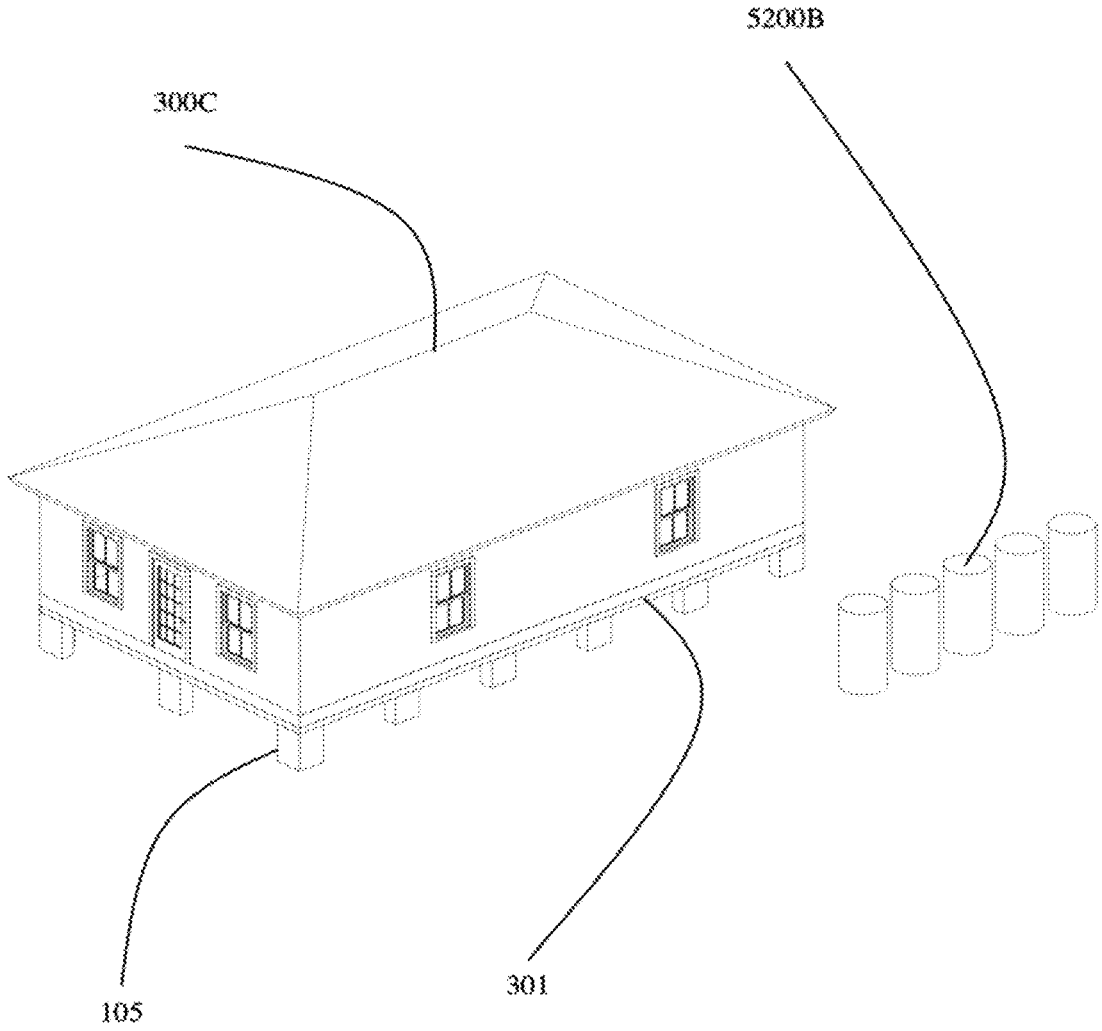
FIG. 61 illustrates a perspective view that shows detached deployable buoyancy tanks stored nearby a house resting on a pier on gradebeam system, according to an example embodiment of the present disclosure.

FIG. 61 illustrates a perspective view that shows detached deployable buoyancy 5200 tanks stored nearby a house resting on a pier on gradebeam system 202, according to an example embodiment of the present disclosure. In some example embodiments, the deployable buoyancy 5200B may be configured to remain attached to the object 100, inflate and become buoyant in the presence of rising water 1202 and displace sufficient water to float the object 100 in rising water 1202.

Figure 62:
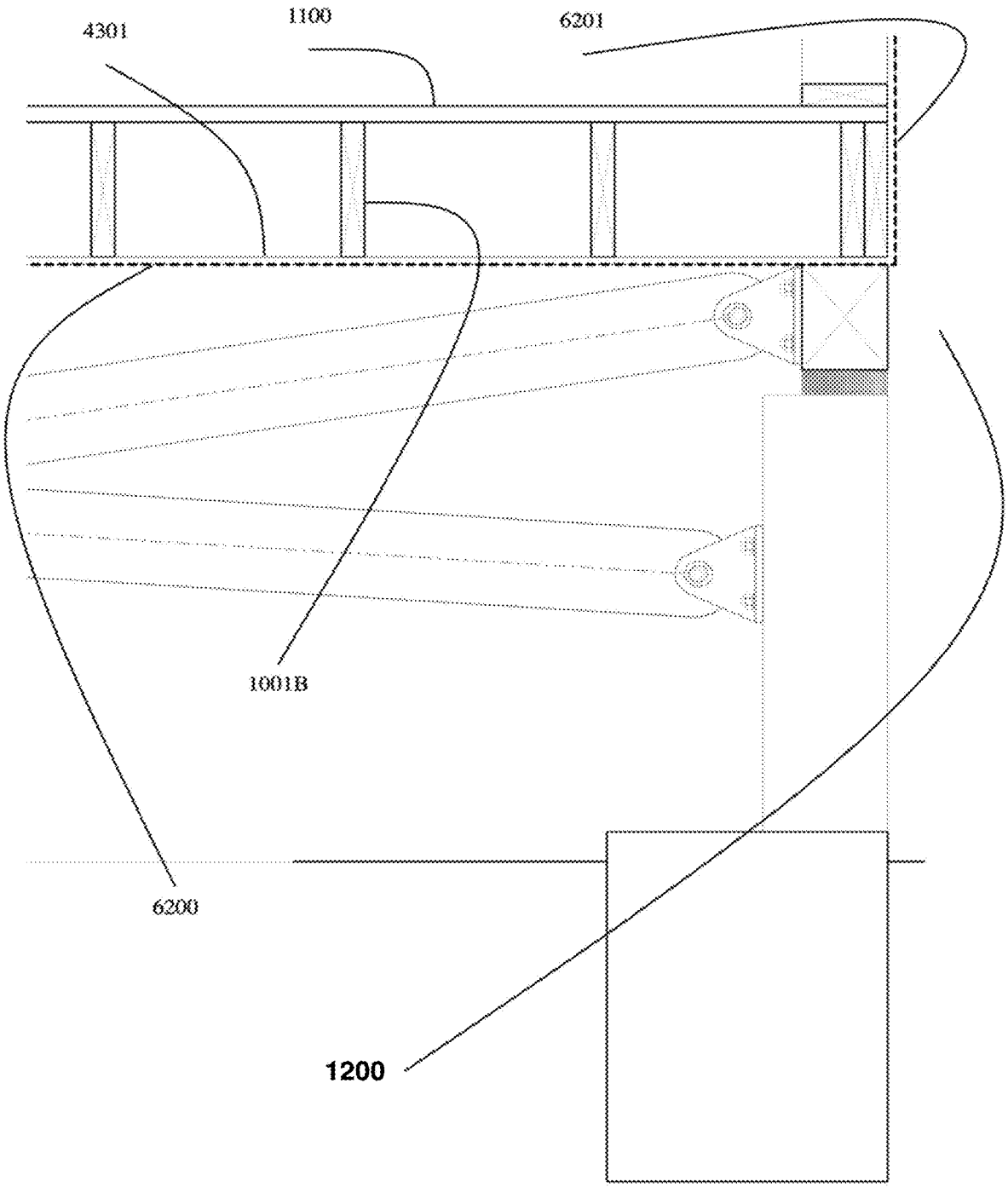
FIG. 62 illustrates a section view that shows a hull buoyancy system to configure a building to serve as its own buoyancy system using a hull bottom waterproof membrane set against hull bottom sheathing attached to the underside of the platform joist system along with a hull side waterproof membrane set against the hull side sheathing and contiguous with the hull bottom waterproof membrane, according to an example embodiment of the present disclosure.

FIG. 62 illustrates a section view that shows a hull buoyancy system to configure a building to serve as its own buoyancy system 1200 using a hull bottom waterproof membrane 6200 set against hull bottom sheathing 4301 attached to the underside of the platform joist 1001 system along with a hull side waterproof membrane 6201 set against the hull side sheathing 6301 and contiguous with the hull bottom waterproof membrane 6200, according to an example embodiment of the present disclosure. In some example embodiments, the hull bottom waterproof membrane 6200 may be configured to configure the partially submerged object 100 to be waterproof, remain waterproof at all connections and penetrations, remain waterproof at the intersection with the hull side waterproof membrane 6201 and prevent rising water 1202 from penetrating the partially submerged object 100. In some example embodiments, the hull side waterproof membrane 6201 may be configured to configure the partially submerged walls to be waterproof, remain waterproof at the intersection overlap with the hull bottom waterproof membrane 6200 and prevent rising water 1202 from penetrating the partially submerged walls of the object 100. In some example embodiments, the hull bottom sheathing 4301 may be configured to support the buoyancy water displacement loads acting on either the sub flooring 5100 or on the hull sheathing and structurally span between members of the hull bottom framing 5101. In some example embodiments, the hull bottom sheathing 4301 may comprise hull sheathing.

Figure 63:
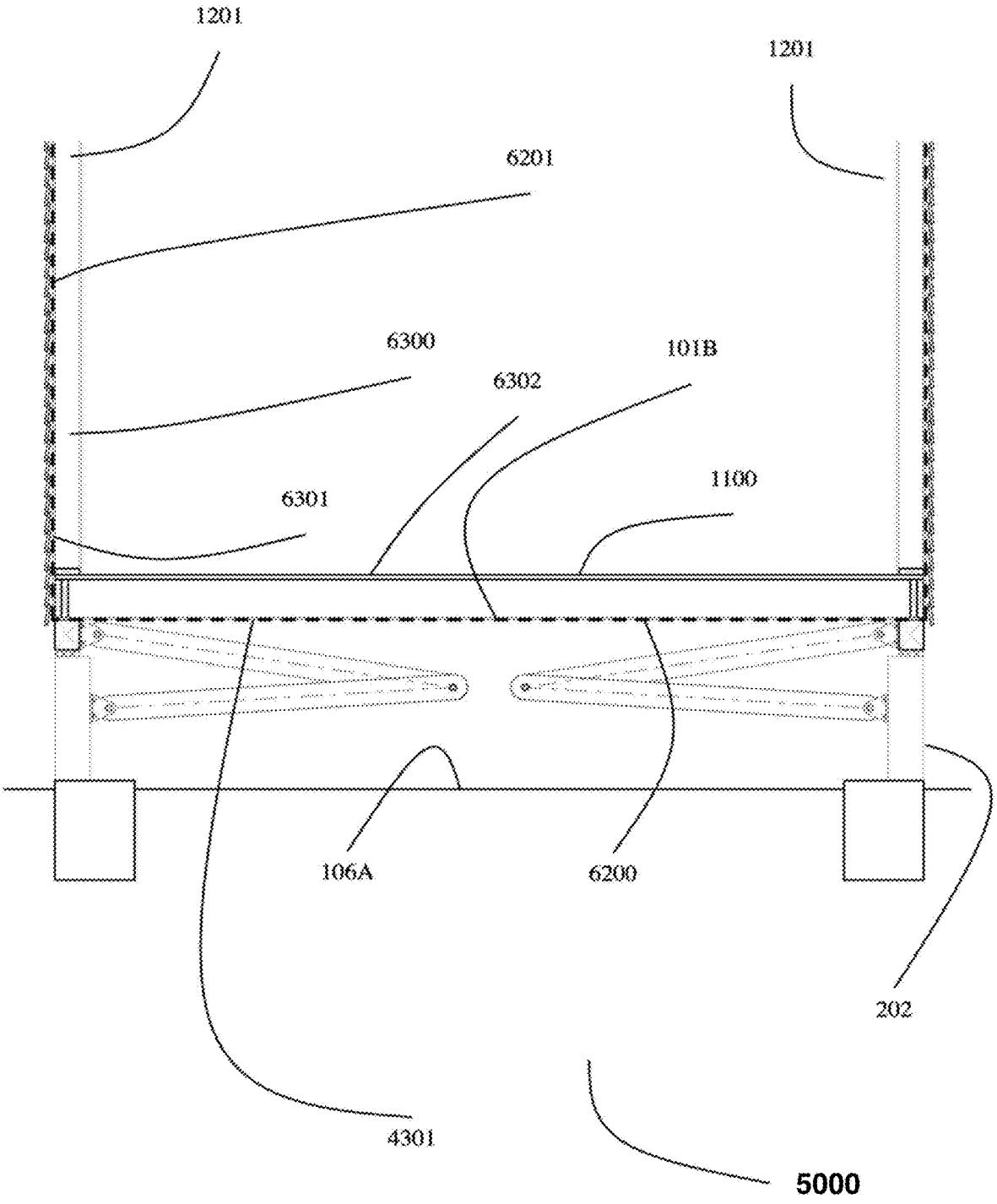
FIG. 63 illustrates a section view that shows a hull buoyancy system to configure a building to serve as its own buoyancy system using a hull bottom waterproof membrane set against hull bottom sheathing attached to the underside of the platform joist system along with a hull side waterproof membrane set against the hull side sheathing and contiguous with the hull bottom waterproof membrane, according to an example embodiment of the present disclosure.

FIG. 63 illustrates a section view that shows a hull buoyancy system to configure a building to serve as its own buoyancy system 1200 using a hull bottom waterproof membrane 6200 set against hull bottom sheathing 4301 attached to the underside of the platform joist 1001 system along with a hull side waterproof membrane 6201 set against the hull side sheathing 6301 and contiguous with the hull bottom waterproof membrane 6200, according to an example embodiment of the present disclosure. In some example embodiments, the hull side framing 6300 may be configured to support the object 100 ceiling and roof loads, support the structural dead loads, buoyancy water displacement loads, and the external force 500 live loads transmitted through the hull side sheathing 6301 and support the hull side sheathing 6301. In some example embodiments, the hull side sheathing 6301 may be configured to structurally span between members of the hull side framing 6300, support the hull side waterproof membrane 6201, remain attached to the hull side framing 6300, support the structural dead loads, buoyancy water displacement loads, and external force 500 live loads acting on the spans between each member of the hull side framing 6300 and transfer any external force 500 acting on the hull side sheathing 6301 to the hull side framing 6300. In some example embodiments, the hull bottom sealing system 6302 may comprise hull bottom waterproof membrane 6200, hull bottom sheathing 4301 or hull bottom framing 5101.

Figure 64:
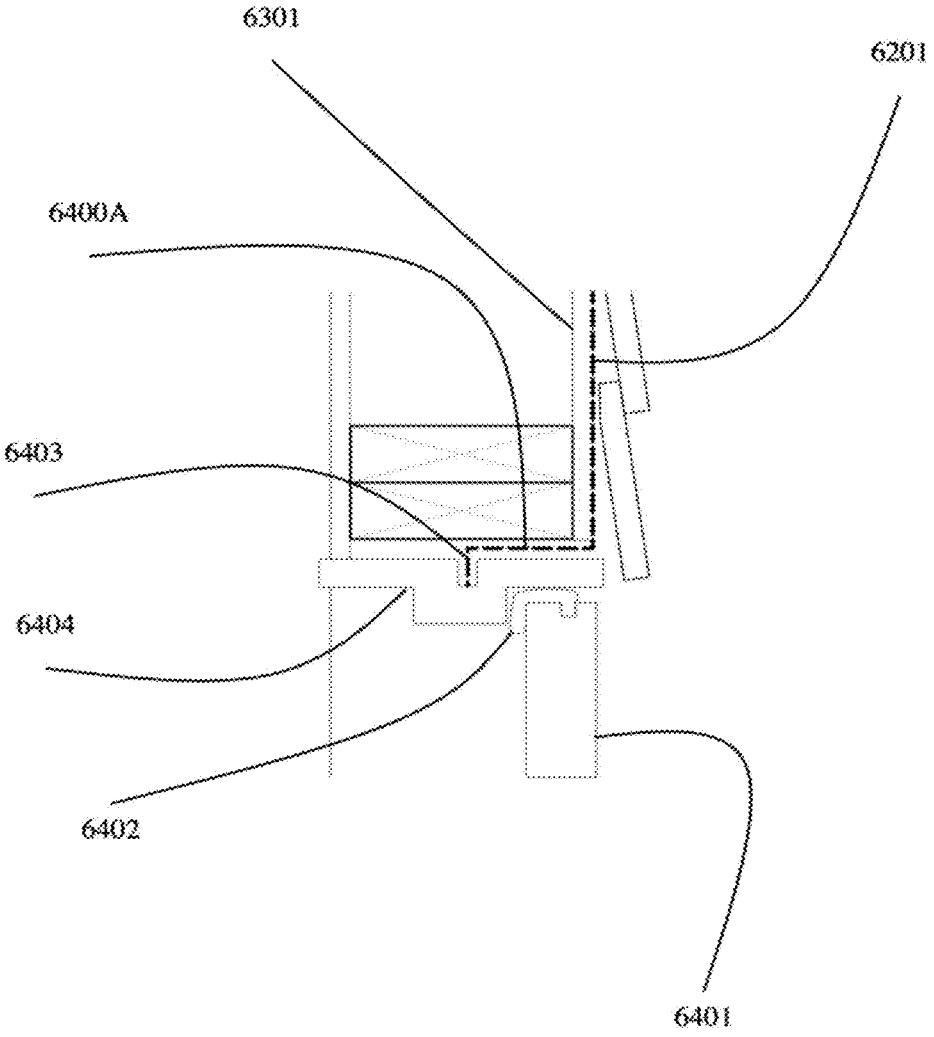
FIG. 64 illustrates a section view that shows one method to configure a house to serve as its own buoyant object by applying a hull side waterproof membrane that is extended uninterrupted into the door jamb and securely attached to the waterproof door frame system which contains a door seal system to waterproof an outward swinging door leaf system which presses tighter against this door seal system when partially submerged in rising water, according to an example embodiment of the present disclosure.

FIG. 64 illustrates a section view that shows one method to configure a house to serve as its own buoyant object by applying a hull side waterproof membrane 6201 that is extended uninterrupted into the door jamb and securely attached to the waterproof door frame system 6404 which contains a door seal system 6402 to waterproof an outward swinging door leaf system 6401 which presses tighter against this door seal system 6402 when partially submerged in rising water 1202, according to an example embodiment of the present disclosure. In some example embodiments, the door frame buoyancy system 6400A may be configured to configure the doors in a partially submerged object 100 to be waterproof and convert the object 100 into a buoyant object, prevent rising water 1202 from entering the object 100, contain the door leaf system 6401 and create a structural opening in the hull side framing 6300. In some example embodiments, the door leaf system 6401 may be configured to support the structural dead loads and the external force 500 live loads acting of the object 100 in the span of the door frame system 6404, prevent rising water 1202 from entering the object 100, allow physical access into the object 100 and fit into the door frame buoyancy system 6400. In some example embodiments, the door seal system 6402 may be configured to allow the door leaf system 6401 to close, allow the door leaf system 6401 to open and prevent rising water 1202 from penetrating into the object 100 at the interface between the door leaf system 6401 and the door frame system 6404. In some example embodiments, the door frame waterproof membrane system 6403 may be configured to prevent rising water 1202 from entering the object 100 from between the intersections of the door frame system 6404 and the hull side waterproof membrane 6201 and remain waterproof at all intersections of the door frame system 6404 with the hull side waterproof membrane 6201. In some example embodiments, the door frame system 6404 may be configured to support the structural dead loads and the external force 500 live loads acting on the door leaf system 6401, allow the door leaf system 6401 to open and allow the door leaf system 6401 to close.

Figure 65:
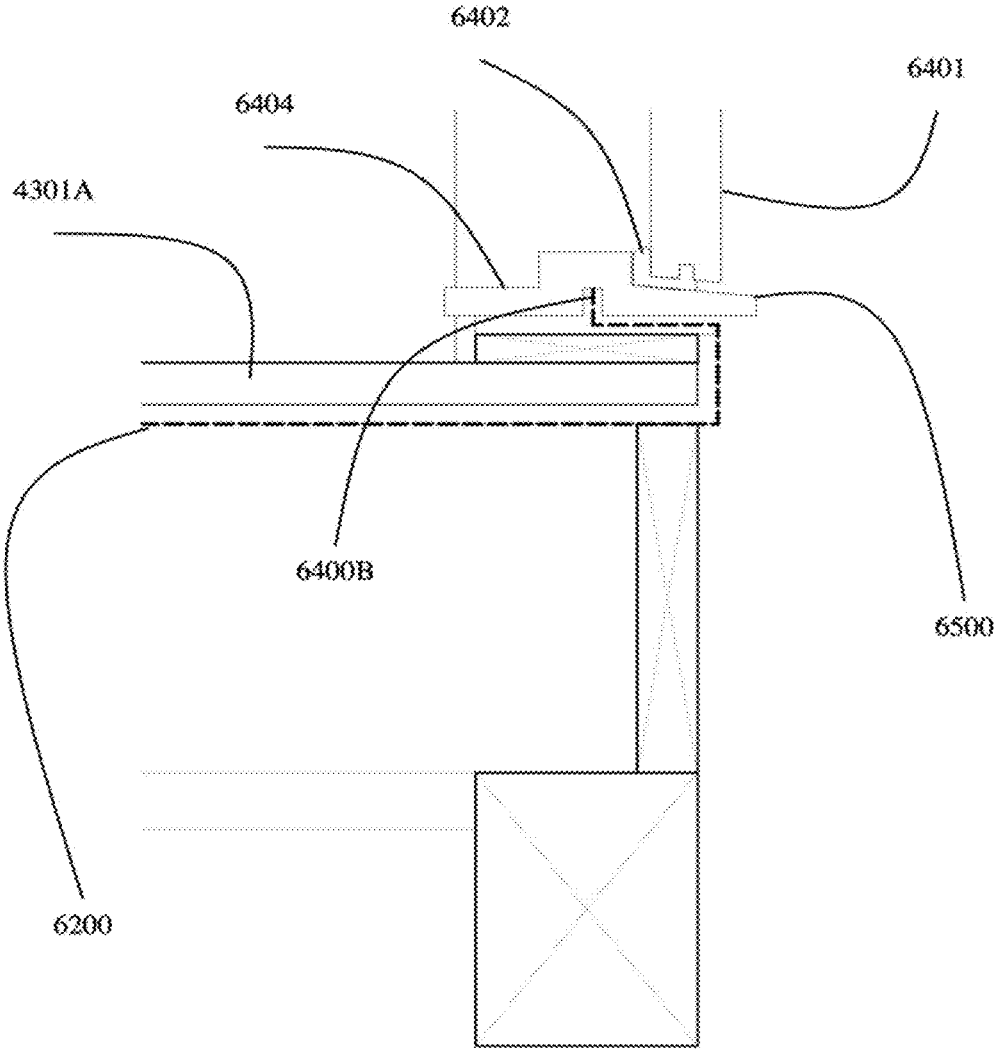
FIG. 65 illustrates a section view that shows one method to configure a house to serve as its own buoyant object by applying a hull bottom waterproof membrane that is extended uninterrupted below the waterproof door sill system opening and securely terminated into the door frame system or door sill system which contains a continuous door seal system to waterproof an outward swinging door leaf system which presses tighter against this door seal system when partially submerged in rising water, according to an example embodiment of the present disclosure.

FIG. 65 illustrates a section view that shows one method to configure a house to serve as its own buoyant object by applying a hull bottom waterproof membrane 6200 that is extended uninterrupted below the waterproof door sill system 6500 opening and securely terminated into the door frame system 6404 or door sill system 6500 which contains a continuous door seal system 6402 to waterproof an outward swinging door leaf system 6401 which presses tighter against this door seal system 6402 when partially submerged in rising water 1202, according to an example embodiment of the present disclosure. In some example embodiments, the door frame buoyancy system 6400B may be configured to configure the doors in a partially submerged object 100 to be waterproof and convert the object 100 into a buoyant object, prevent rising water 1202 from entering the object 100, contain the door leaf system 6401 and create a structural opening in the hull side framing 6300. In some example embodiments, the door frame buoyancy system 6400B may comprise door sill system 6500. In some example embodiments, the door sill system 6500 may be configured to support the structural dead loads and the external force 500 live loads acting on the door leaf system 6401, contain the bottom of the door leaf system 6401, allow the door leaf system 6401 to open and allow the door leaf system 6401 to close.

Figure 66:
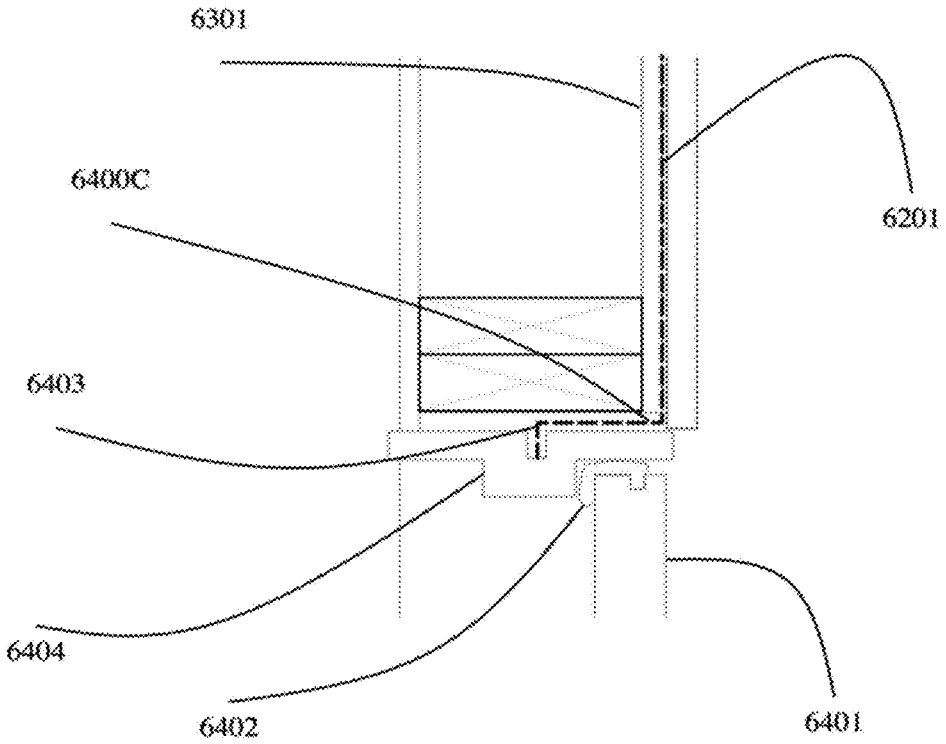
FIG. 66 illustrates a section view that shows one method to configure a house to serve as its own buoyant object by applying a hull side waterproof membrane that is extended uninterrupted into the door jamb opening and securely attached to the waterproof door frame system which contains a door seal system to waterproof an outward swinging door leaf system which presses tighter against this door seal system when partially submerged in rising water, according to an example embodiment of the present disclosure.

FIG. 66 illustrates a section view that shows one method to configure a house to serve as its own buoyant object by applying a hull side waterproof membrane 6201 that is extended uninterrupted into the door jamb opening and securely attached to the waterproof door frame system 6404 which contains a door seal system 6402 to waterproof an outward swinging door leaf system 6401 which presses tighter against this door seal system 6402 when partially submerged in rising water 1202, according to an example embodiment of the present disclosure. In some example embodiments, the door frame buoyancy system 6400C may be configured to configure the doors in a partially submerged object 100 to be waterproof and convert the object 100 into a buoyant object, prevent rising water 1202 from entering the object 100, contain the door leaf system 6401 and create a structural opening in the hull side framing 6300. In some example embodiments, the door frame buoyancy system 6400C may comprise door frame waterproof membrane system 6403 or door frame system 6404.

Figure 67:
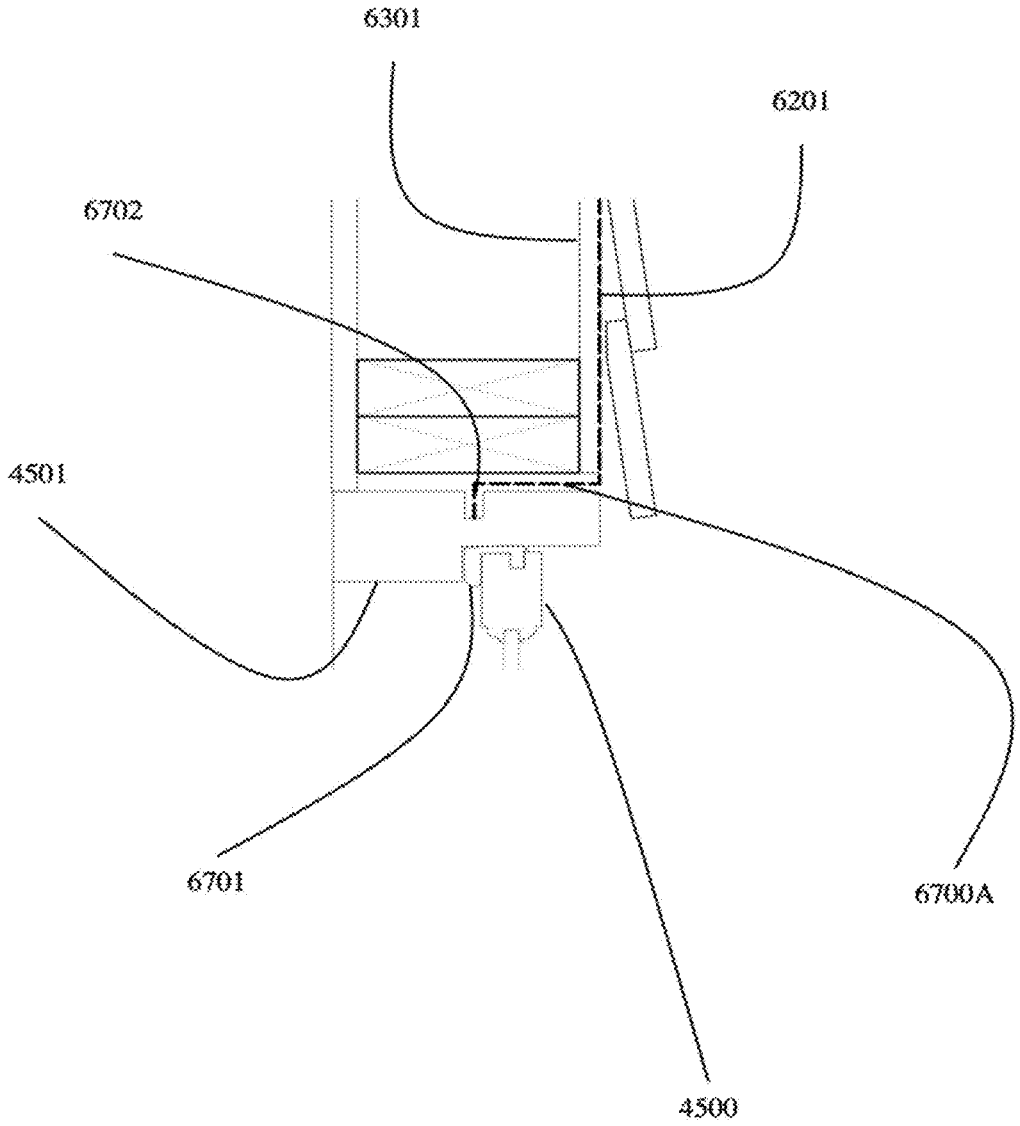
FIG. 67 illustrates a section view that shows one method to configure a house to serve as its own buoyant object by applying a hull side waterproof membrane that is extended uninterrupted into the window wall opening and securely attached to the waterproof window frame system, which contains a window sealing system to waterproof the window sash system which presses tighter against this window sealing system when partially submerged in rising water, according to an example embodiment of the present disclosure.

FIG. 67 illustrates a section view that shows one method to configure a house to serve as its own buoyant object by applying a hull side waterproof membrane 6201 that is extended uninterrupted into the window wall opening and securely attached to the waterproof window frame system 4501 which contains a window sealing system 6701 to waterproof the window sash system 4500 which presses tighter against this window sealing system 6701 when partially submerged in rising water 1202, according to an example embodiment of the present disclosure. In some example embodiments, the window frame buoyancy system 6700A may be configured to configure the windows in a partially submerged object 100 to be waterproof and convert the object 100 into a buoyant object, prevent rising water 1202 from entering the object 100, create a structural opening in the hull side framing 6300 and contain the window frame system 4501. In some example embodiments, the window sealing system 6701 may be configured to allow the window sash system 4500 to close, allow the window sash system 4500 to open and prevent rising water 1202 from penetrating into the object 100 at the interface between the window sash system 4500 and the window frame system 4501. In some example embodiments, the window frame waterproof membrane system 6702 may be configured to prevent rising water 1202 from entering the object 100 from between the intersections of the window frame system 4501 and the hull side waterproof membrane 6201 and remain waterproof at all intersections of the window frame system 4501 with the hull side waterproof membrane 6201.

Figure 68:
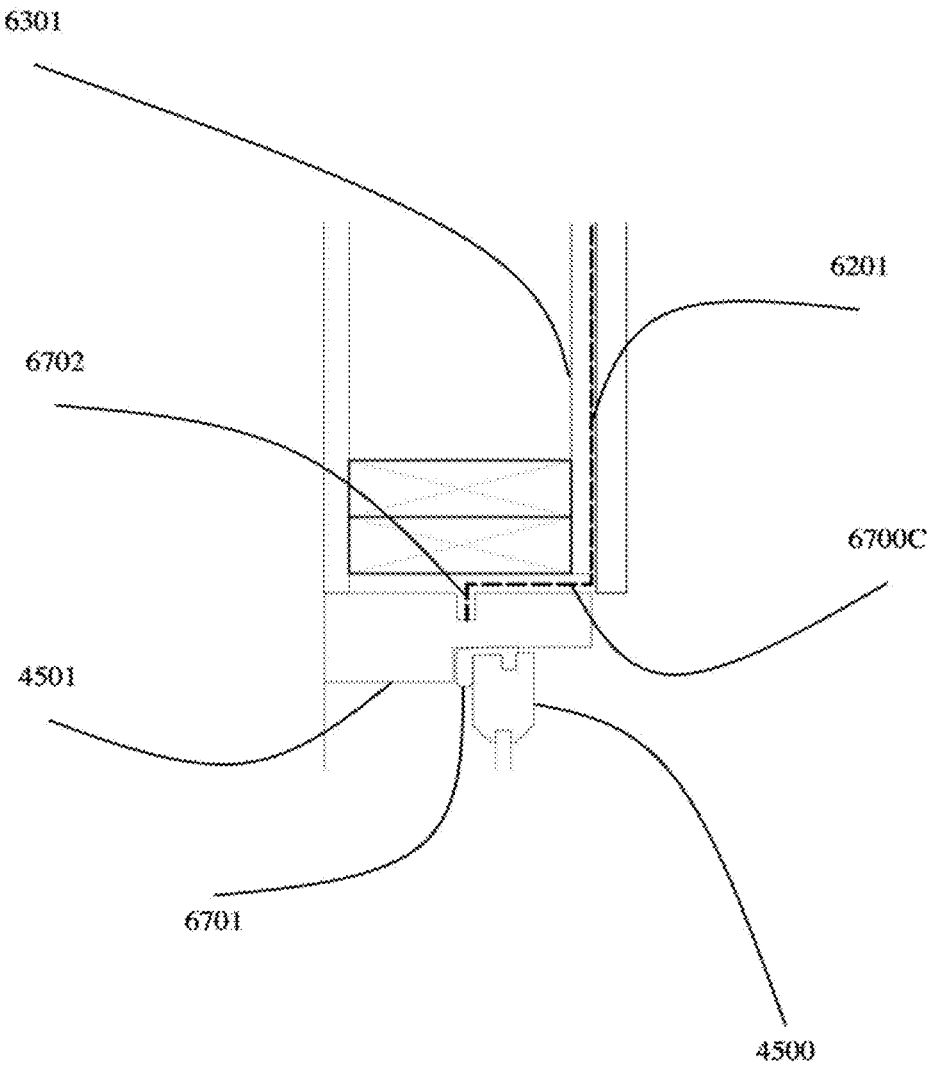
FIG. 68 illustrates a section view that shows one method to configure a house to serve as its own buoyant object by applying a hull side waterproof membrane that is extended uninterrupted into the window jamb wall opening and securely attached to the waterproof window frame system, which contains a window sealing system to waterproof the window sash system which presses tighter against this window sealing system when partially submerged in rising water, according to an example embodiment of the present disclosure.

FIG. 68 illustrates a section view that shows one method to configure a house to serve as its own buoyant object by applying a hull side waterproof membrane 6201 that is extended uninterrupted into the window jamb wall opening and securely attached to the waterproof window frame system 4501 which contains a window sealing system 6701 to waterproof the window sash system 4500 which presses tighter against this window sealing system 6701 when partially submerged in rising water 1202, according to an example embodiment of the present disclosure. In some example embodiments, the window frame buoyancy system 6700C may be configured to configure the windows in a partially submerged object 100 to be waterproof and convert the object 100 into a buoyant object, prevent rising water 1202 from entering the object 100, create a structural opening in the hull side framing 6300 and contain the window frame system 4501. In some example embodiments, the window frame buoyancy system 6700C may comprise window frame system 4501 or window frame waterproof membrane system 6702.

Figure 69:
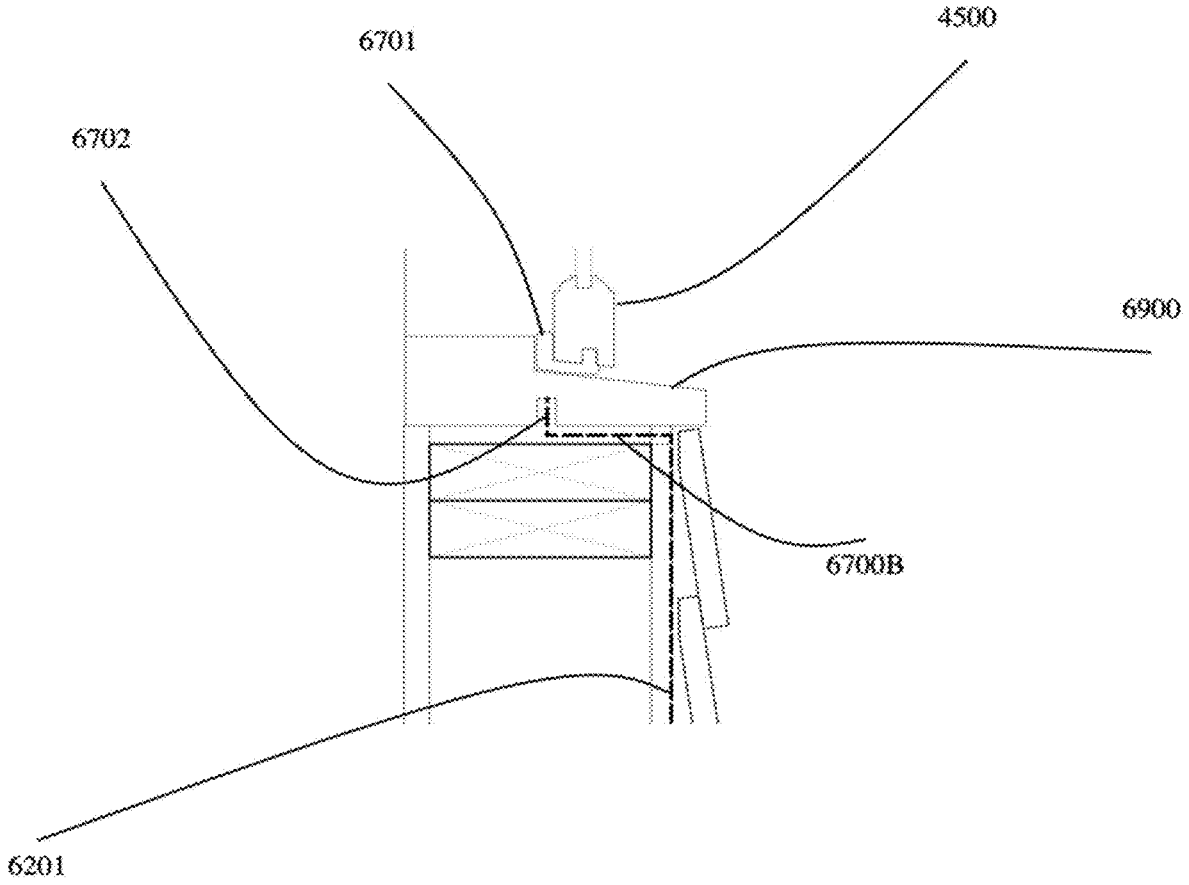
FIG. 69 illustrates a section view that shows one method to configure a house to serve as its own buoyant object by applying a hull side waterproof membrane that is extended uninterrupted into the window sill wall opening and securely attached to the waterproof window sill system which contains a window sealing system to waterproof the window sash system which presses tighter against this window sealing system when partially submerged in rising water, according to an example embodiment of the present disclosure.

FIG. 69 illustrates a section view that shows one method to configure a house to serve as its own buoyant object by applying a hull side waterproof membrane 6201 that is extended uninterrupted into the window sill wall opening and securely attached to the waterproof window sill system 6900 which contains a window sealing system 6701 to waterproof the window sash system 4500 which presses tighter against this window sealing system 6701 when partially submerged in rising water 1202, according to an example embodiment of the present disclosure. In some example embodiments, the window sill system 6900 may be configured to support the structural dead loads and the external force 500 live loads acting on the window sash system 4500, contain the bottom of the window sash system 4500, allow the window sash system 4500 to open and allow the window sash system 4500 to close. In some example embodiments, the window frame buoyancy system 6700B may be configured to configure the windows in a partially submerged object 100 to be waterproof and convert the object 100 into a buoyant object, prevent rising water 1202 from entering the object 100, create a structural opening in the hull side framing 6300 and contain the window frame system 4501. In some example embodiments, the window frame buoyancy system 6700B may comprise window sill system 6900.

Figure 70:
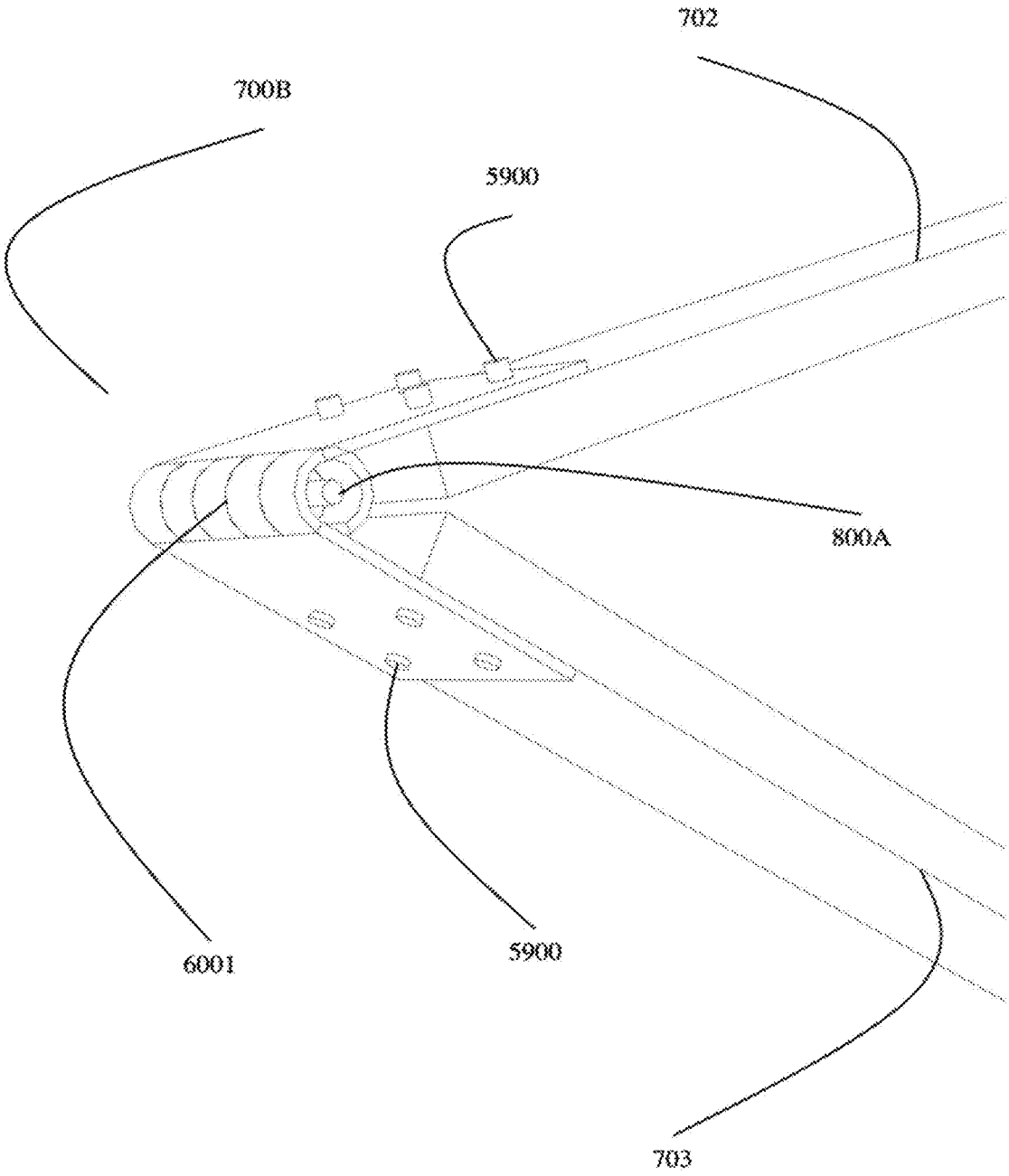
FIG. 70 illustrates a perspective view that shows a butt hinge serving as the elbow hinge with strut to elbow fastener units securing the upper strut and the lower strut in a primary parallel struts system which allows for the use of a strut with a structural section profile that is stronger in resisting lateral forces, according to an example embodiment of the present disclosure.

FIG. 70 illustrates a perspective view that shows a butt hinge 6001 serving as the elbow hinge 700 with strut to elbow fastener 5900 units securing the upper strut 702 and the lower strut 703 in a primary parallel struts system 104 which allows for the use of a strut 601 with a structural section profile that is stronger in resisting lateral forces, according to an example embodiment of the present disclosure.

Figure 71:
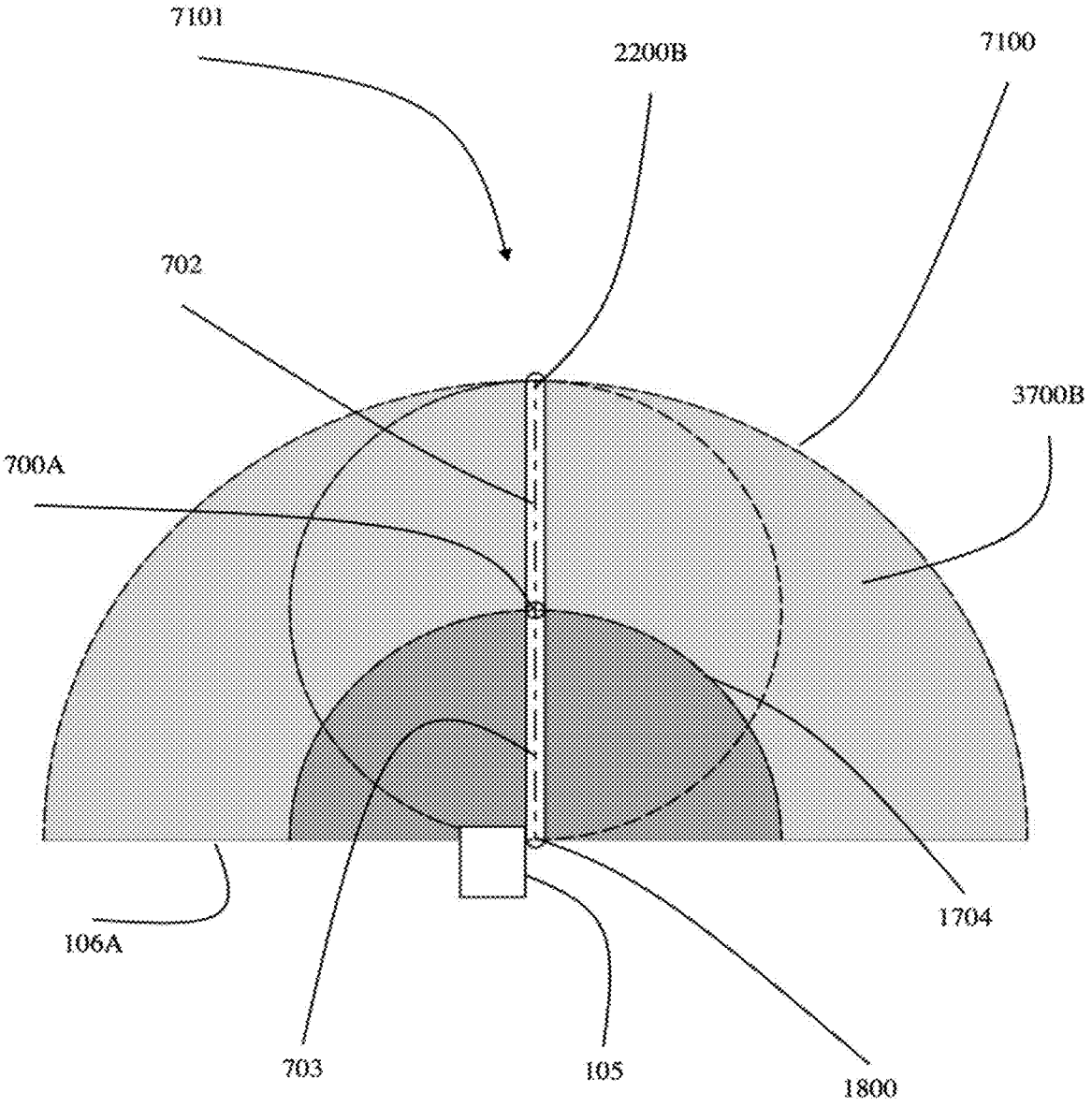
FIG. 71 illustrates an elevation view that shows a diagram illustrating the folding strut movement arc system of limited half-circle movement arc of the lower strut attached to the foundation hinge anchored to the pier system and the larger half-circle area of possible movement of the object hinge anchored to the upper strut when the upper strut is attached to the lower strut at the elbow hinge, according to an example embodiment of the present disclosure.

FIG. 71 illustrates an elevation view that shows a diagram illustrating the folding strut movement arc system 7101 of limited half-circle movement arc of the lower strut 703 attached to the foundation hinge 1800 anchored to the pier system 105 and the larger half-circle area of possible movement of the object hinge 2200 anchored to the upper strut 702 when the upper strut 702 is attached to the lower strut 703 at the elbow hinge 700, according to an example embodiment of the present disclosure. Single folding strut movement 7100 may be defined as the possible range of movement of a single strut hinge system 2600 relative to the foundation system 200. In some example embodiments, the single folding strut movement 7100 may be configured to illustrate the possible range of motion of the upper strut 702 in a single primary parallel struts system 104 and illustrate the possible range of motion of the lower strut 703 in a single primary parallel struts system 104. In some example embodiments, the single folding strut movement 7100 may comprise upper strut movement arc 1703 or lower strut movement arc 1704. Folding strut movement arc system 7101 may be defined as a diagram illustrating the possible range of movement at each point of connection to the object platform system 1500 for a strut hinge system 2600 relative to the foundation system 200. In some example embodiments, the folding strut movement arc system 7101 may be configured to illustrate the possible range of motion of any additional reserve struts 10000 in a primary parallel struts system 104, illustrate the possible range of motion of the upper strut 702 in a primary parallel struts system 104 and illustrate the range of motion of the lower strut 703 in a primary parallel struts system 104. In some example embodiments, the folding strut movement arc system 7101 may comprise opposing strut allowable movement 1700, single folding strut movement 7100 or multiple same facing movement arc system 1600.

Figure 72:
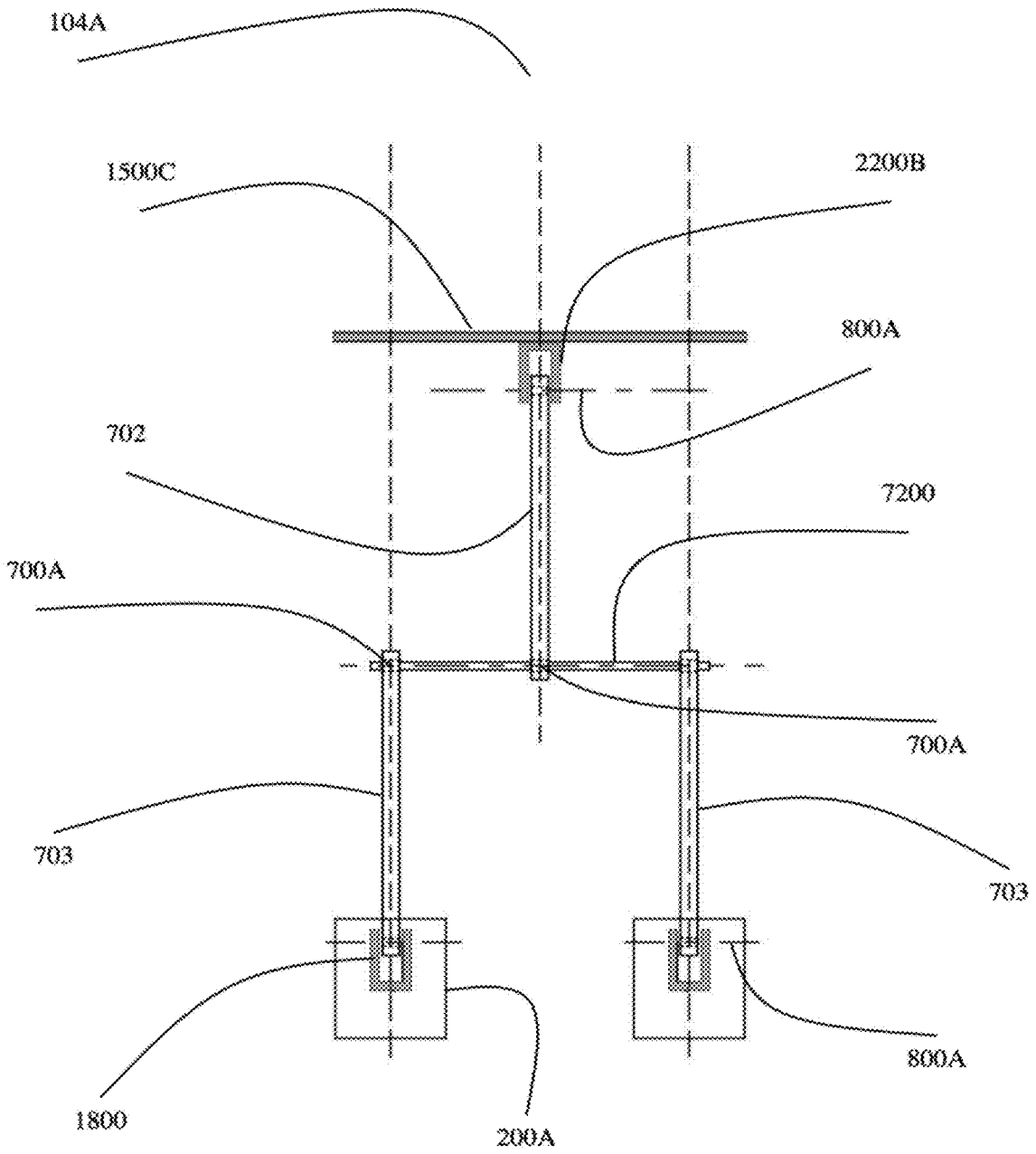
FIG. 72 illustrates an elevation view that shows one alternative configuration of a primary parallel struts system using multiple offset strut units for the lower strut function with a single strut unit. The configuration can also be reversed using a single strut for the lower strut function and two or more strut units for the upper strut function, according to an example embodiment of the present disclosure.

FIG. 72 illustrates an elevation view that shows one alternative configuration of a primary parallel struts system 104 using multiple offset strut 601 units for the lower strut 703 function with a single strut 601 unit. The configuration can also be reversed using a single strut 601 for the lower strut 703 function and two or more strut 601 units for the upper strut 702 function, according to an example embodiment of the present disclosure. In some example embodiments, the multiple offset axle shaft 7200 may be configured to allow multiple upper strut 702 or lower strut 703 units to share the same rotational axis of the elbow hinge 700 and anchor each elbow hinge 700.

Figure 73:
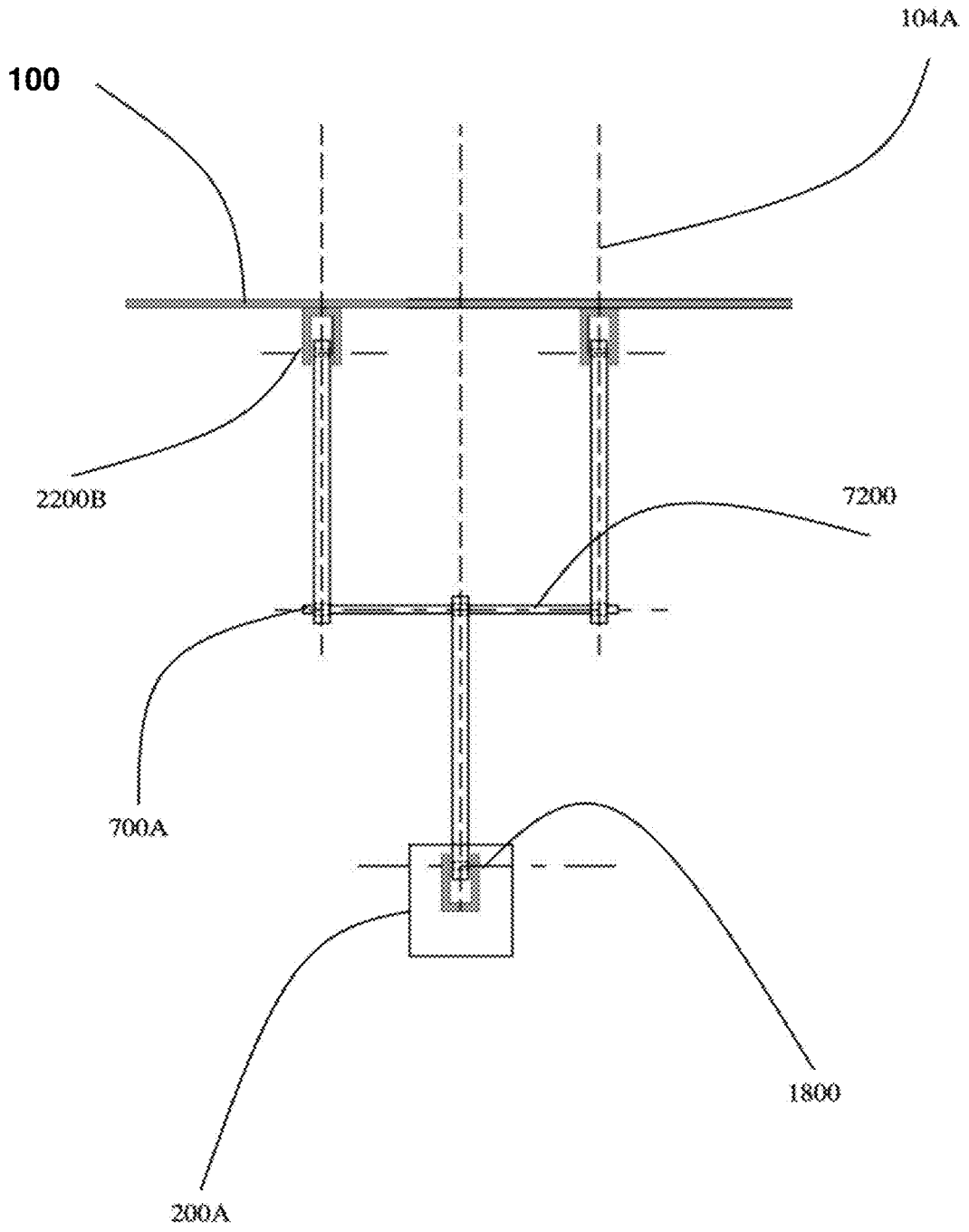
FIG. 73 illustrates an elevation view that shows one alternative configuration of a primary parallel struts system using multiple offset strut units for the upper strut function with a single strut unit serving the lower strut function, according to an example embodiment of the present disclosure.

FIG. 73 illustrates an elevation view that shows one alternative configuration of a primary parallel struts system 104 using multiple offset strut 601 units for the upper strut 702 function with a single strut 601 unit serving the lower strut 703 function, according to an example embodiment of the present disclosure.

Figure 74:
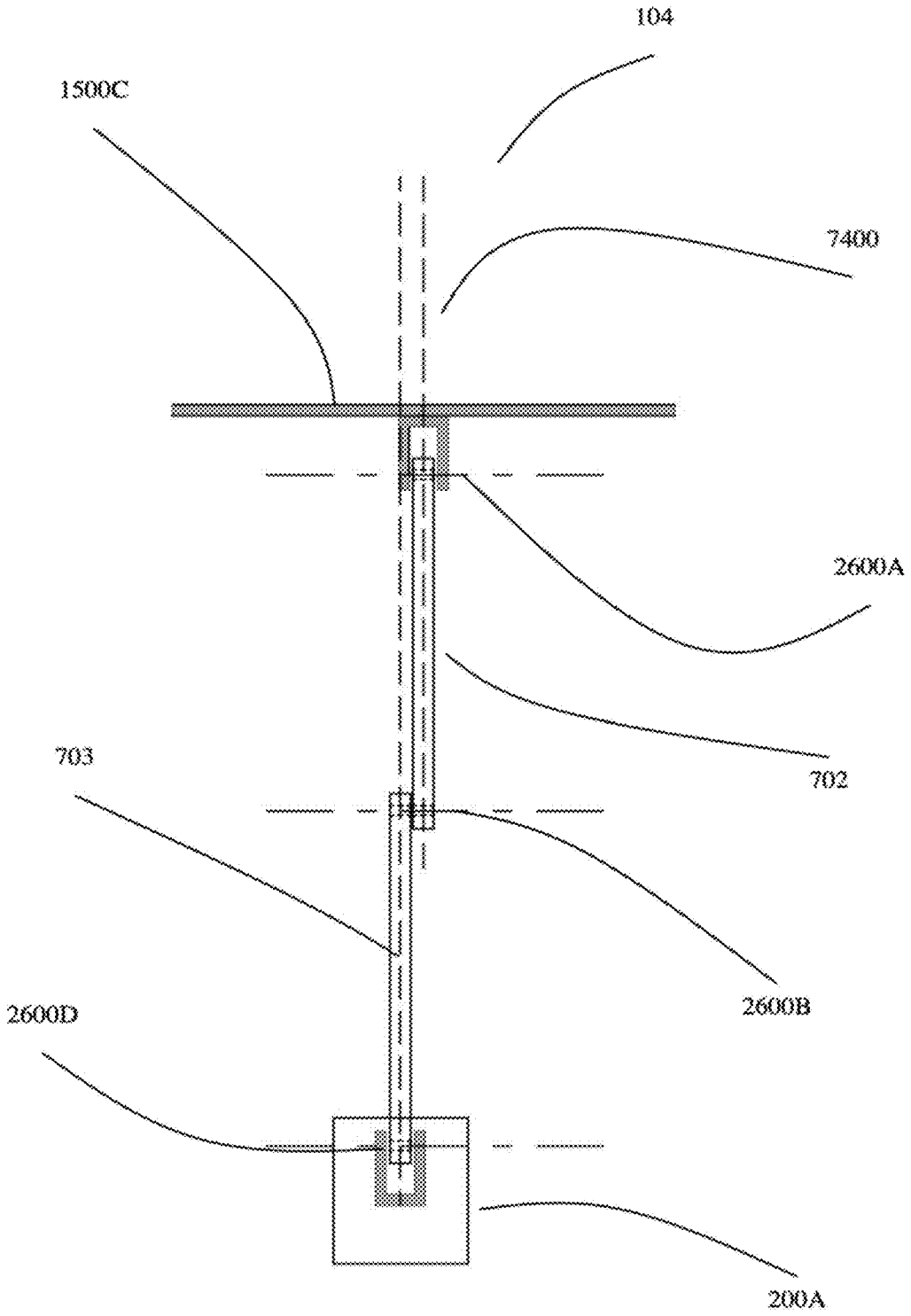
FIG. 74 illustrates an elevation view that shows the strut alignment system of two parallel strut units as a stabilization system anchoring the object platform system to the foundation system, according to an example embodiment of the present disclosure.

FIG. 74 illustrates an elevation view that shows the strut alignment system 7400 of two parallel strut 601 units as a stabilization system 108 anchoring the object platform system 1500 to the foundation system 200, according to an example embodiment of the present disclosure. Strut alignment system 7400 may be defined as an arrangement of at least one upper strut 702 and at least one lower strut 703 that are connected to each other at an elbow hinge 700 such that their movement occurs in a joint around a transverse axis allowing the outside ends of each strut 601 to move within the same or a parallel folding strut movement plane 3700. In some example embodiments, the strut alignment system 7400 may be configured to align the strut 601 anchored to the object hinge 2200 in a parallel position to the strut 601 anchored to the foundation system 200 and align the positions of the upper strut 702 and the lower strut 703.

Figure 75:
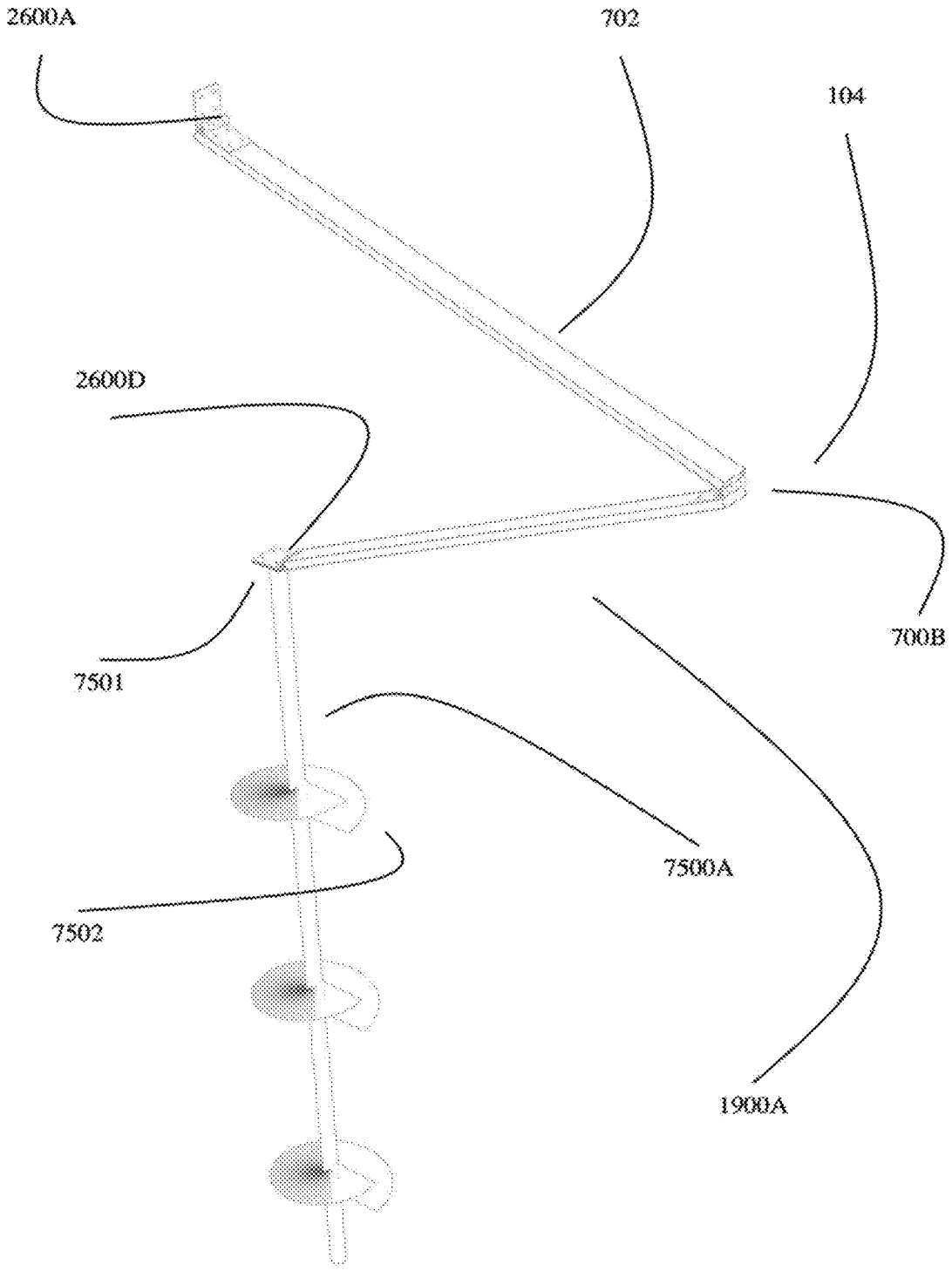
FIG. 75 illustrates a perspective view that shows one application of a primary parallel struts system using butt hinge units to anchor to the object platform system and to grade using a helical pile. This application can serve to retrofit existing structures as well as for new construction, according to an example embodiment of the present disclosure.

FIG. 75 illustrates a perspective view that shows one application of a primary parallel struts system 104 using butt hinge 6001 units to anchor to the object platform system 1500 and to grade 106 using a helical pile 7500. This application can serve to retrofit existing structures as well as for new construction, according to an example embodiment of the present disclosure. In some example embodiments, the helical pile 7500A may be configured to remain stationary, remain connected to and support either the grade beam 201, spot footing 14100, pier system 105, slab foundation 12000, or directly to the stabilization system 108, rapidly insert into grade 106, support and resist the forces transmitted through the stabilization system 108 and remain connected to grade 106. In some example embodiments, the helical pile 7500A may comprise corkscrew 7502 or corkscrew cleat 7501. In some example embodiments, the corkscrew cleat 7501 may be configured to remain connected to either the grade beam 201, spot footing 14100, pier system 105, slab foundation 12000, or directly to the stabilization system 108 and remain connected to the corkscrew 7502. In some example embodiments, the corkscrew 7502 may be configured to remain connected to the corkscrew cleat 7501, support and resist the forces transmitted through the corkscrew cleat 7501, rapidly insert into grade 106 and remain connected to grade 106.

Figure 76:
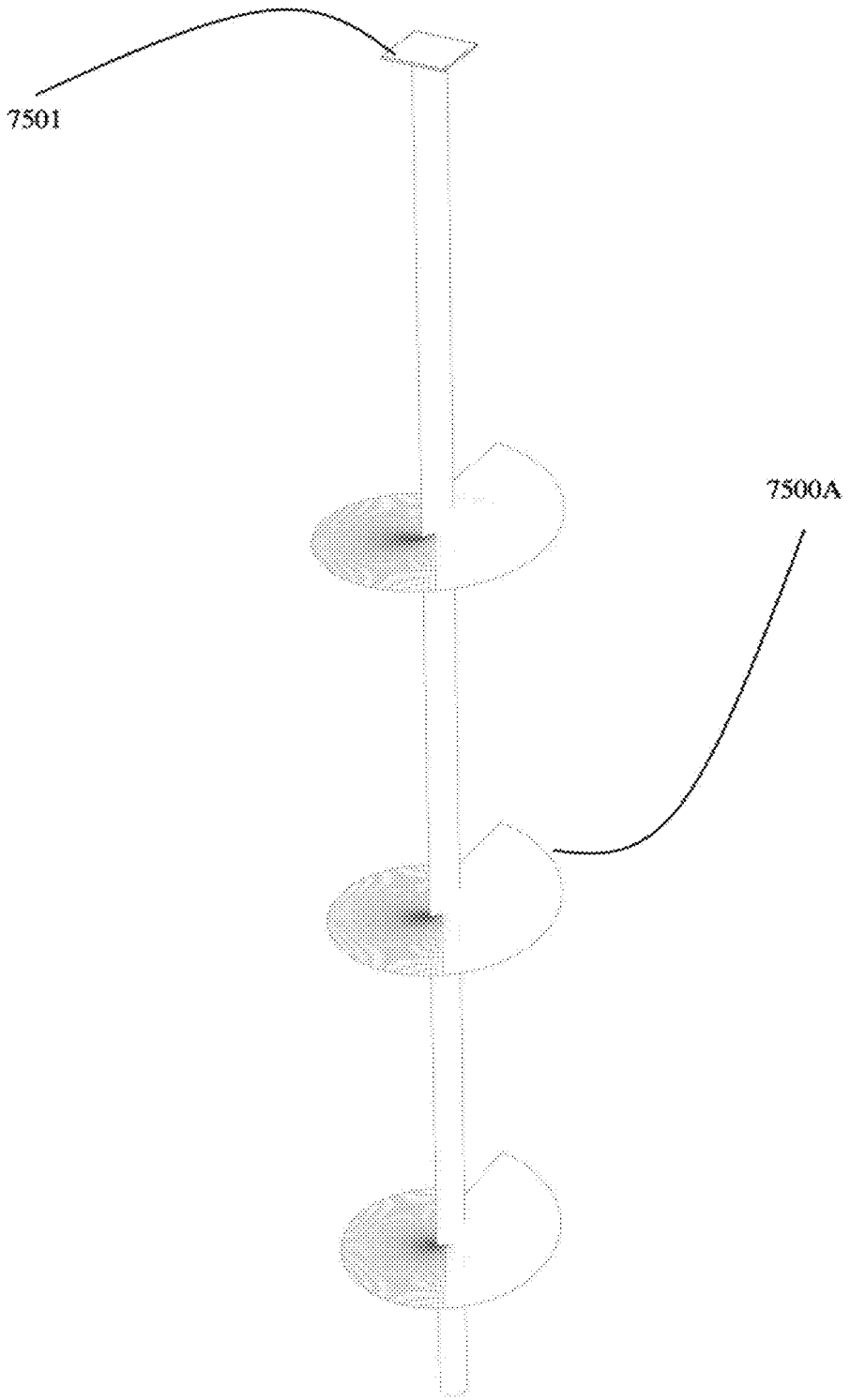
FIG. 76 illustrates a perspective view that shows a helical pile topped off with a corkscrew cleat that is used to anchor the foundation hinge, according to an example embodiment of the present disclosure.

FIG. 76 illustrates a perspective view that shows a helical pile 7500 topped off with a corkscrew cleat 7501 that is used to anchor the foundation hinge 1800, according to an example embodiment of the present disclosure.

Figure 77:
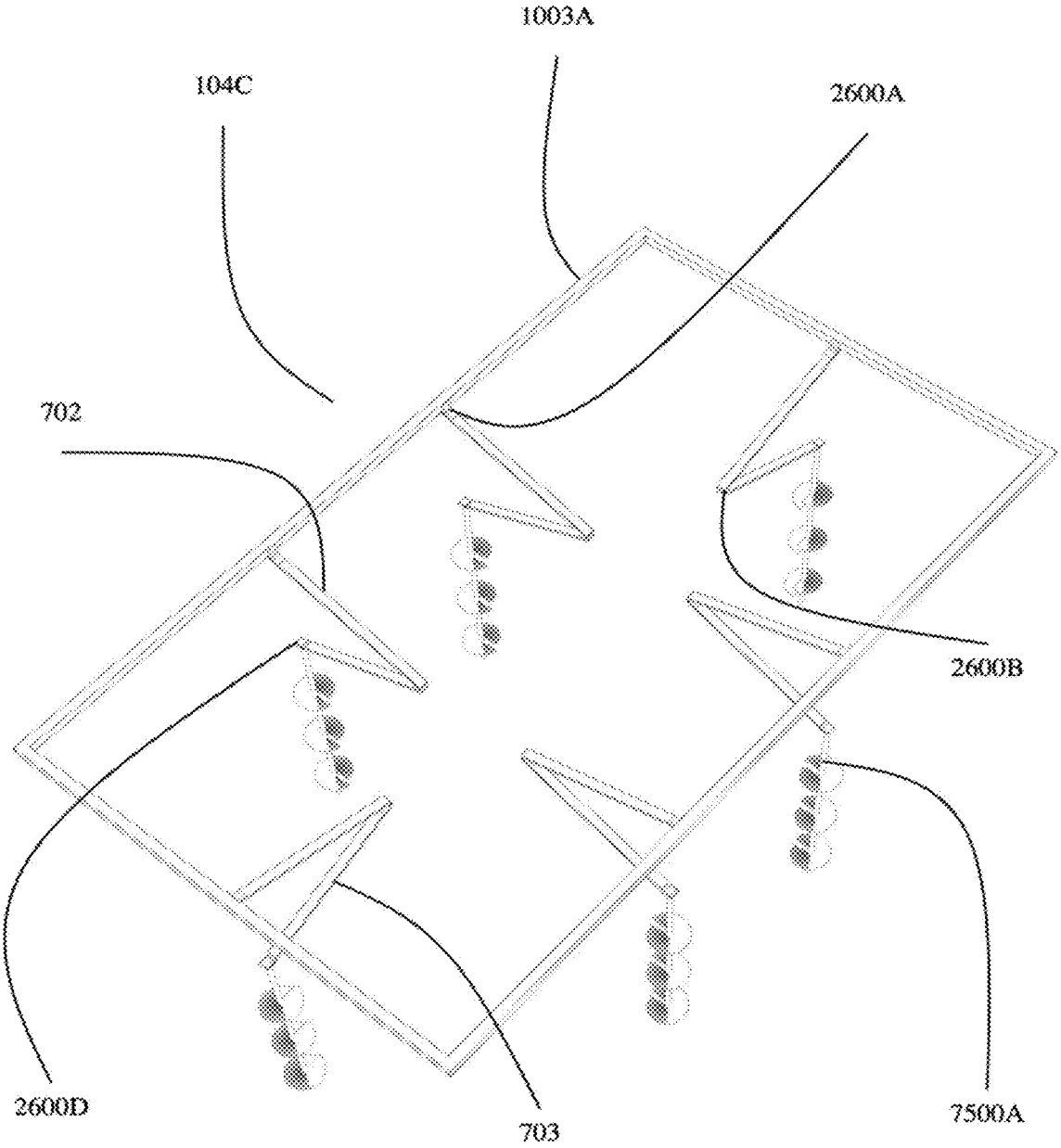
FIG. 77 illustrates a perspective view that shows one configuration of multiple primary parallel struts system units each with its upper strut anchored to a platform sill and lower strut anchored to a foundation system helical pile, that are configured in an opposing elbow system and arranged in a graded cleat positioning system, according to an example embodiment of the present disclosure.

FIG. 77 illustrates a perspective view that shows one configuration of multiple primary parallel struts system 104 units each with its upper strut 702 anchored to a platform sill 1003 and lower strut 703 anchored to a foundation system 200 helical pile 7500, that are configured in an opposing elbow system 900 and arranged in a graded cleat positioning system 3701, according to an example embodiment of the present disclosure. Primary parallel struts system 104C may be defined as an arrangement of two or more primary parallel struts system 104 assemblies. In some example embodiments, the primary parallel struts system 104C may be configured to comprise an upper strut 702, a lower strut 703, an elbow hinge 700, an object hinge 2200, and a foundation hinge 1800, allow vertical movement between the object 100 and the foundation system 200, maintain a fixed distance between the foundation hinge 1800 and the elbow hinge 700, maintain a fixed distance between the object hinge 2200 and the elbow hinge 700 and maintain the upper strut 702 and the lower strut 703 parallel to each other. In some example embodiments, the primary parallel struts system 104C may comprise orientation system 102.

Figure 78:
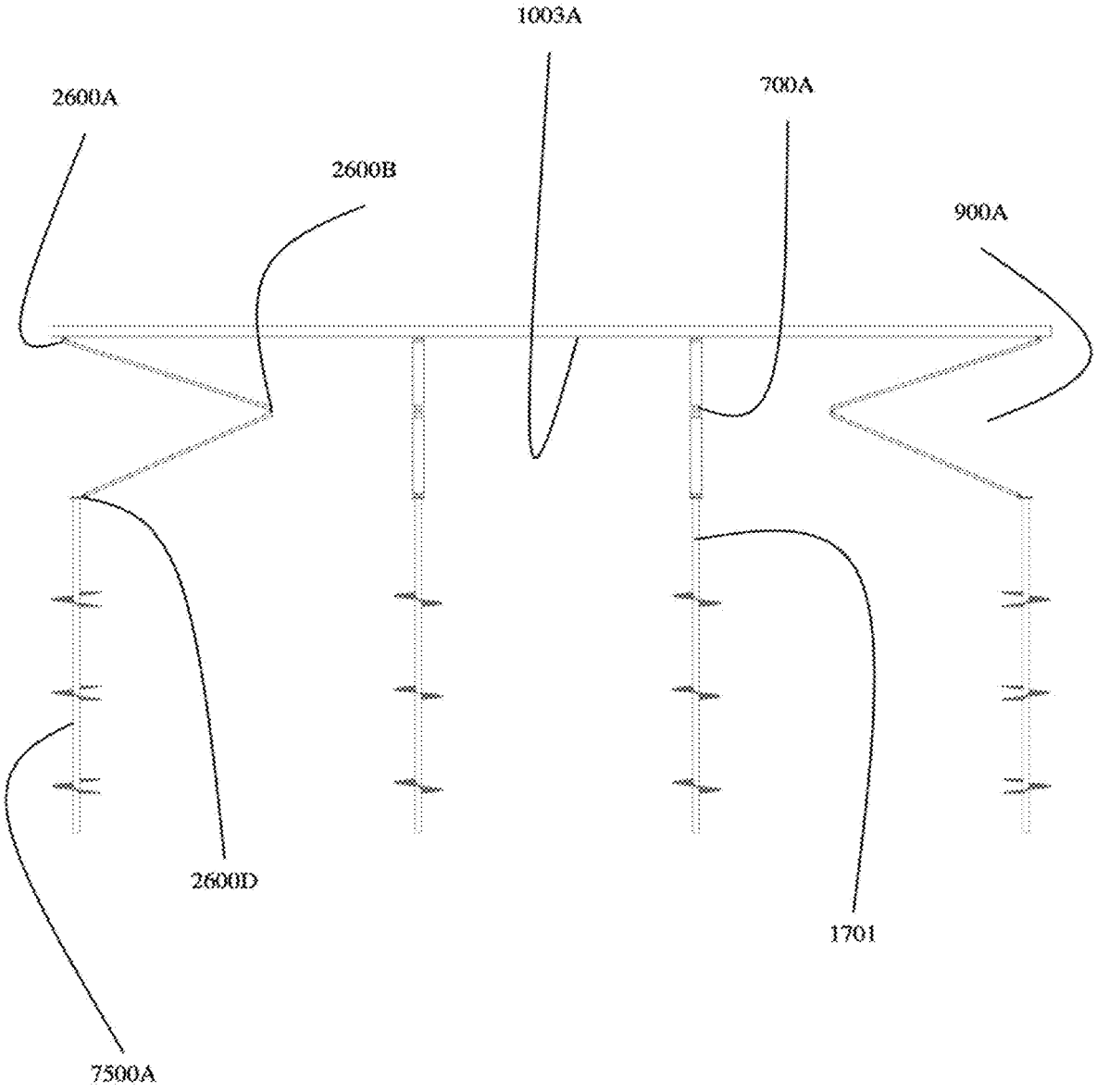
FIG. 78 illustrates an elevation view that shows one configuration of multiple primary parallel struts system units each with its upper strut anchored to a platform sill and lower strut anchored to a foundation system helical pile, that are configured in an inward acting elbow opposing elbow system and arranged in a graded cleat positioning system, according to an example embodiment of the present disclosure.

FIG. 78 illustrates an elevation view that shows one configuration of multiple primary parallel struts system 104 units each with its upper strut 702 anchored to a platform sill 1003 and lower strut 703 anchored to a foundation system 200 helical pile 7500, that are configured in an inward acting elbow opposing elbow system 900 and arranged in a graded cleat positioning system 3701, according to an example embodiment of the present disclosure.

Figure 79:
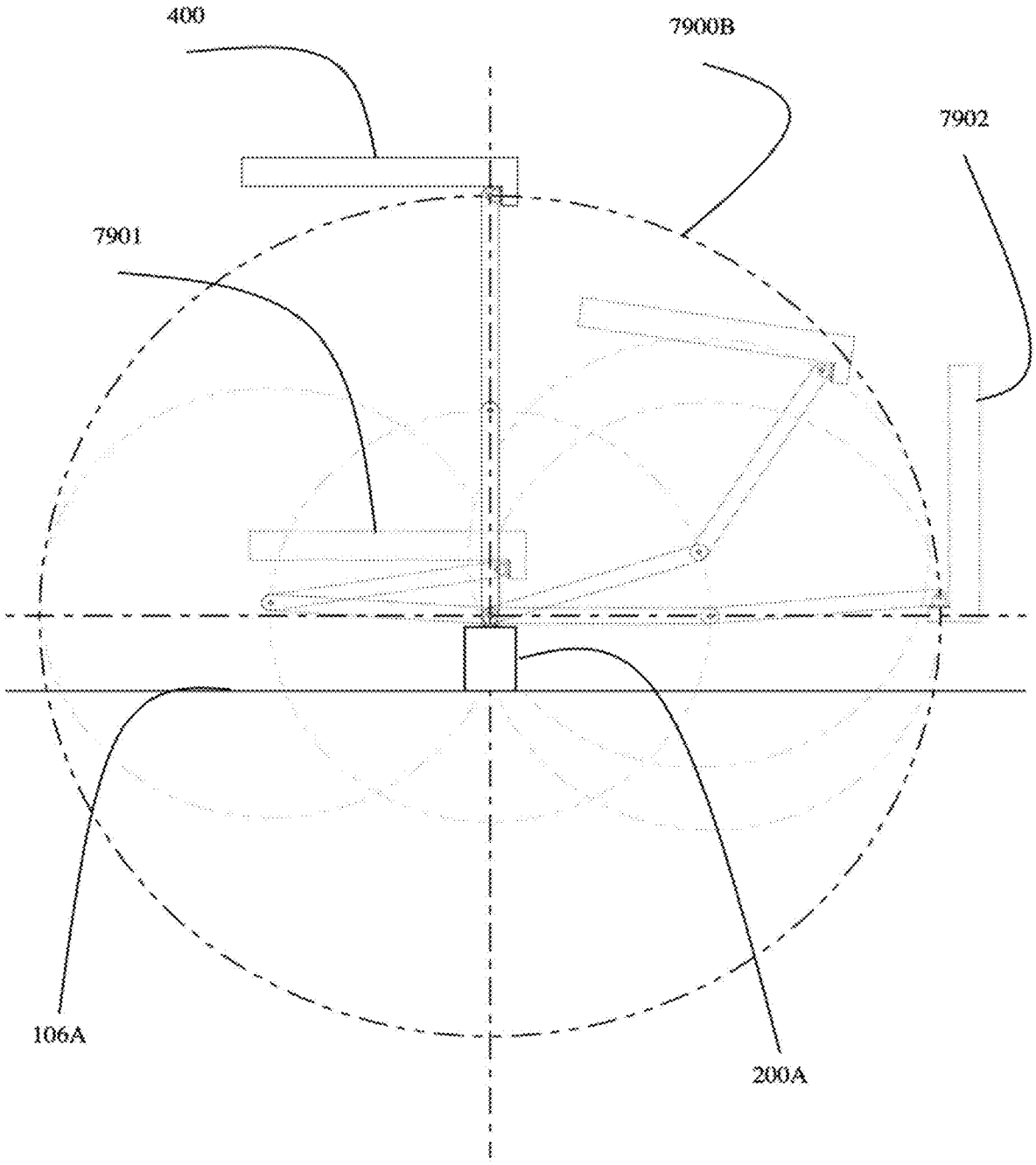
FIG. 79 illustrates an elevation view that shows four possible positions for an object platform system attached to either a single primary parallel struts system or to multiple same facing elbow system units. On the left is the normal platform at resting position. In the center is the highest vertical separation allowed where the two lower strut and upper strut are fully extended. Moving to the right is an undesirable possible limited platform position where the object platform system is unlikely to return to its original platform at resting position. Farthest to the right is the most undesirable platform at fail position where the house remains tethered to the foundation, but allowed to end up resting on its side, likely causing severe structural damage, according to an example embodiment of the present disclosure.

FIG. 79 illustrates an elevation view that shows four possible positions for an object platform system 1500 attached to either a single primary parallel struts system 104 or to multiple same facing elbow system 9800 units. On the left is the normal platform at resting position 7901. In the center is the highest vertical separation allowed where the two lower strut 703 and upper strut 702 are fully extended. Moving to the right is an undesirable possible limited platform position 400 where the object platform system 1500 is unlikely to return to its original platform at resting position 7901. Farthest to the right is the most undesirable platform at fail position 7902 where the house remains tethered to the foundation, but allowed to end up resting on its side, likely causing severe structural damage, according to an example embodiment of the present disclosure. Platform movement arc 7900B may be defined as the possible range of movement and tilt of the object platform system 1500 at the point of connection to a strut hinge system 2600 relative to the foundation system 200. In some example embodiments, the platform movement arc 7900B may be configured to illustrate the possible range of arc motion of the object hinge 2200 in a primary parallel struts system 104. Platform at resting position 7901 may be defined as the position of the object platform system 1500 when in the object at rest 301 position. In some example embodiments, the platform at resting position 7901 may be configured to illustrate the position of the object platform system 1500 at rest. Platform at fail position 7902 may be defined as the position of the object platform system 1500 when in an object separated 103 position that did not return to the original object at rest 301 position after removal of the external force 500. In some example embodiments, the platform at fail position 7902 may be configured to illustrate the position of the object platform system 1500 at a failed position.

Figure 80:
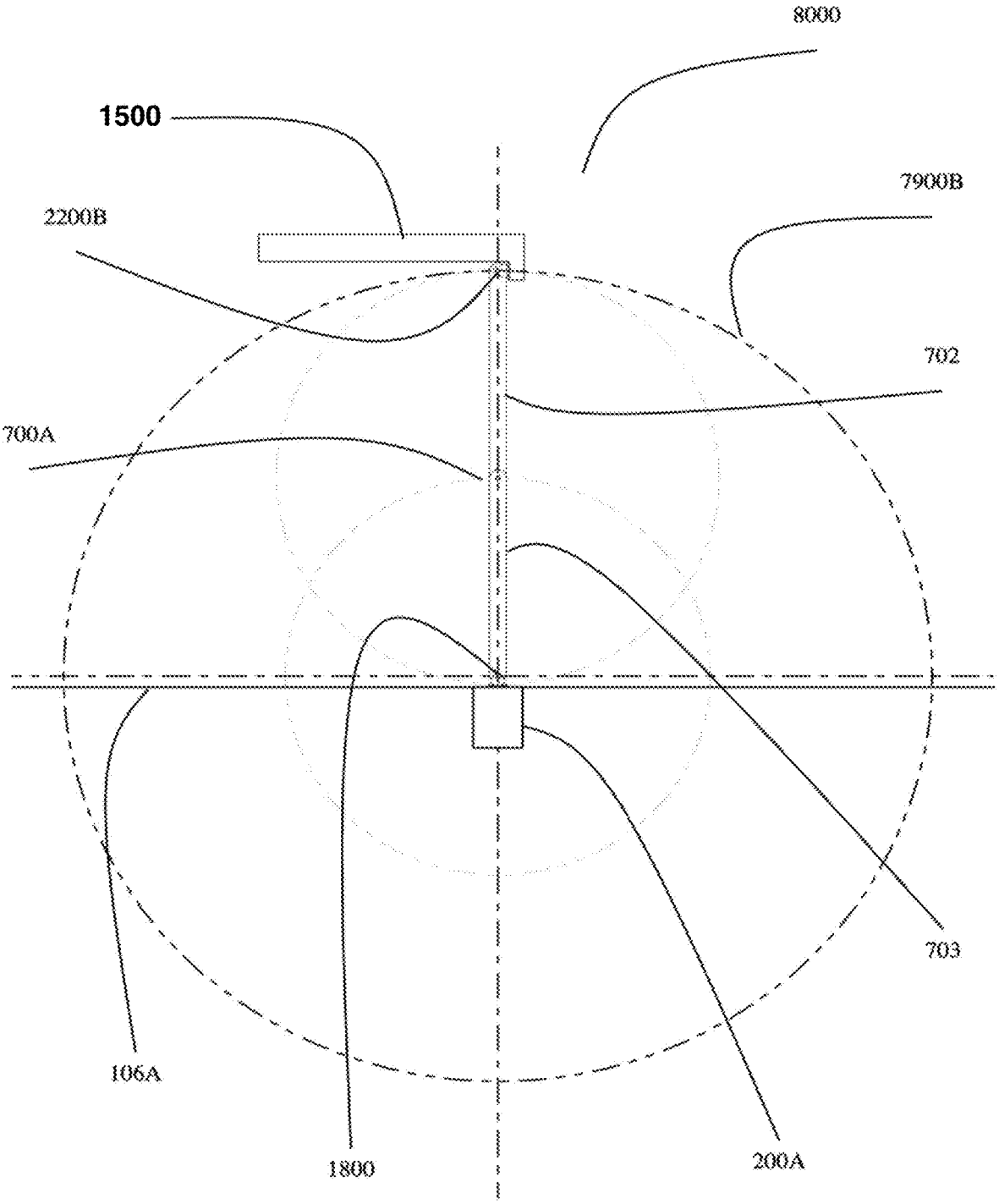
FIG. 80 illustrates an elevation view that shows a diagram tracing the outermost possible range of movement possible for single strut hinge system upper hinge unit connected to an object platform system, illustrating the absence of restricted movement to guide an object platform system, after a separation from its platform at resting position during a rising water event, to return safely to its original resting positon once waters recede, according to an example embodiment of the present disclosure.

FIG. 80 illustrates an elevation view that shows a diagram tracing the outermost possible range of movement possible for single strut hinge system 2600 upper hinge unit connected to an object platform system 1500, illustrating the absence of restricted movement used to guide an object platform system 1500, after a separation from its platform at resting position 7901 during a rising water 1202 event, to return safely to its original resting positon once waters recede, according to an example embodiment of the present disclosure. Platform movement system 8000 may be defined as the possible range of movement and tilt of the object platform system 1500 at each point of connection to a strut hinge system 2600 relative to the foundation system 200 when two or more strut hinge system 2600 assemblies are arranged in an opposing elbow system 900. In some example embodiments, the platform movement system 8000 may be configured to illustrate the possible range of motion of each object hinge 2200 in an opposing elbow system 900 that comprises a primary parallel struts system 104 and at least one secondary parallel struts system 110. In some example embodiments, the platform movement system 8000 may comprise platform position 8700 or platform movement arc 7900.

Figure 81:
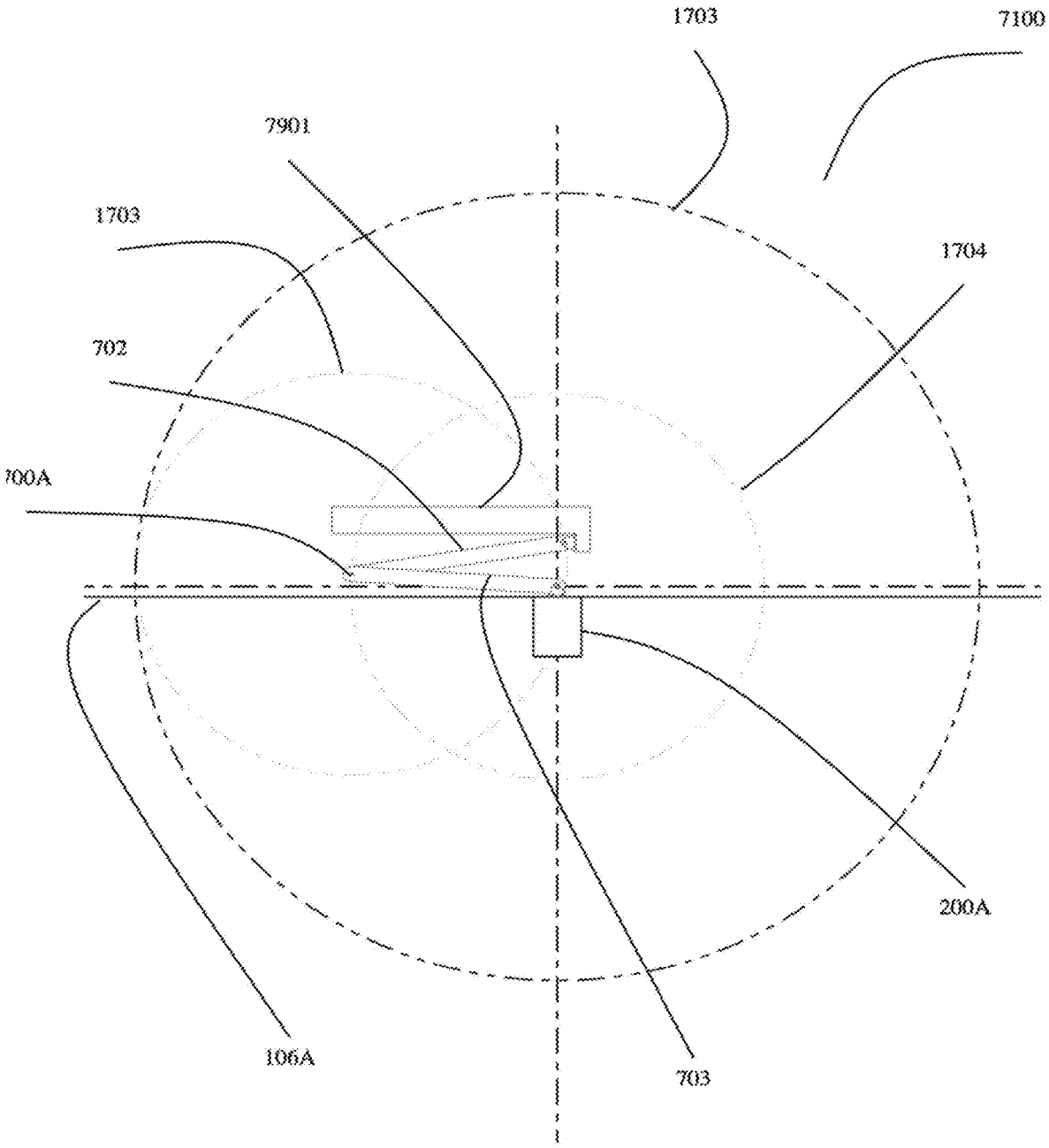
FIG. 81 illustrates an elevation view that shows a diagram tracing two upper strut movement arc possibilities and the lower strut movement arc possible for single strut hinge system where the upper strut unit is connected to an object platform system, and the lower strut unit is anchored to the foundation system. Identical movement possibilities occur in a multiple same facing movement arc system. This lack of adequate platform movement restriction will not guide the object platform system, after a separation from its platform at resting position, to return safely to its original resting positon once the external force that caused the separation is removed, according to an example embodiment of the present disclosure.

FIG. 81 illustrates an elevation view that shows a diagram tracing two upper strut movement arc 1703 possibilities and the lower strut movement arc 1704 possible for single strut hinge system 2600 where the upper strut 702 unit is connected to an object platform system 1500, and the lower strut 703 unit is anchored to the foundation system 200. Identical movement possibilities occur in a multiple same facing movement arc system 1600. This lack of adequate platform movement restriction will not guide the object platform system 1500, after a separation from its platform at resting position 7901, to return safely to its original resting positon once the external force 500 that caused the separation is removed, according to an example embodiment of the present disclosure.

Figure 82:
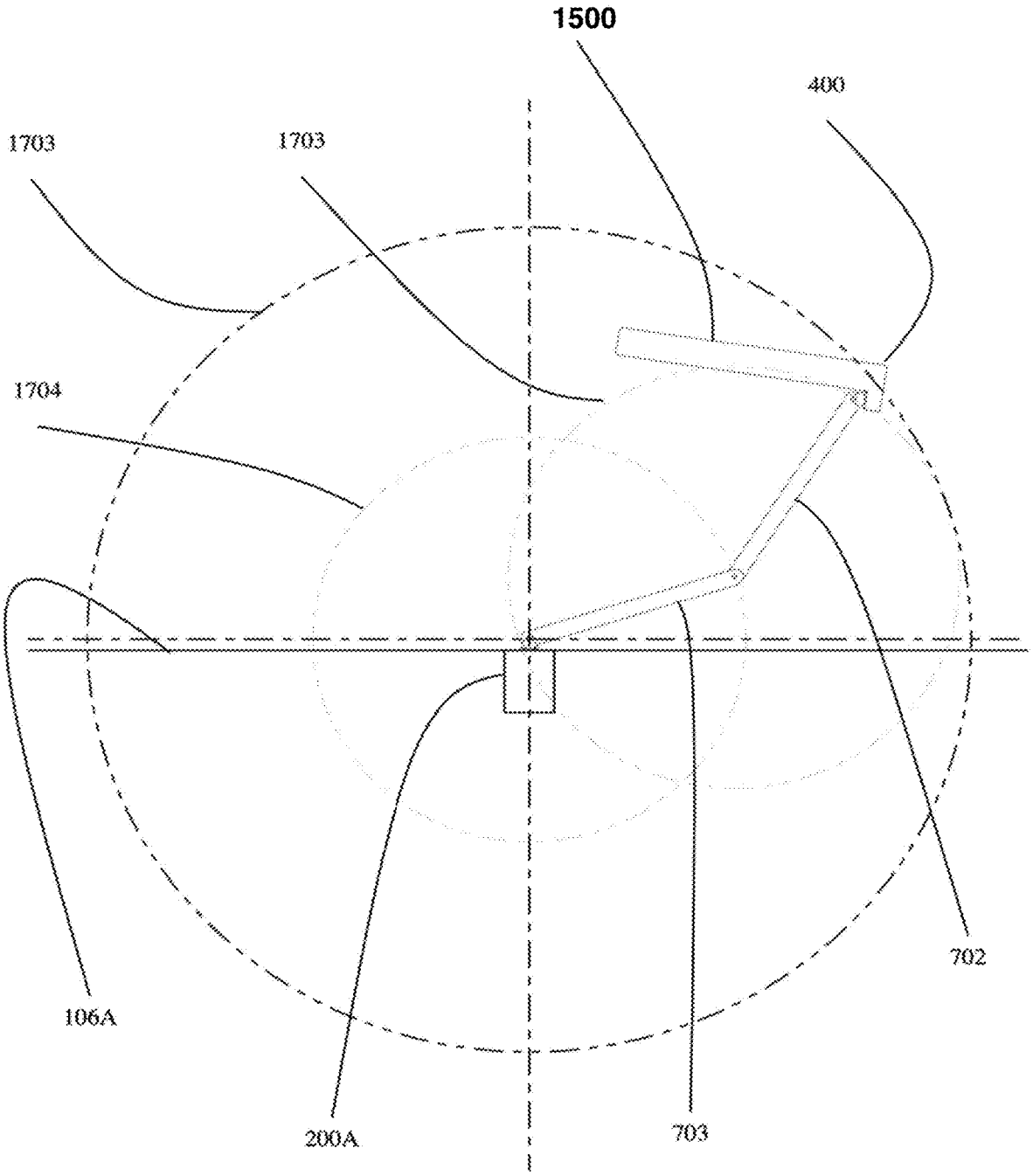
FIG. 82 illustrates an elevation view that shows a diagram of the range of possible positions for an object platform system attached to either a single primary parallel struts system or to multiple same facing elbow system units, and an object platform system is an undesirable limited platform position where the object platform system is unlikely to return to its original platform at resting position, requiring an expensive effort to return the object platform system back to its original position resting on its foundation, according to an example embodiment of the present disclosure.

FIG. 82 illustrates an elevation view that shows a diagram of the range of possible positions for object platform system 1500 attached to either a single primary parallel struts system 104 or to multiple same facing elbow system 9800 units, and an object platform system 1500 is an undesirable limited platform position 400 where the object platform system 1500 is unlikely to return to its original platform at resting position 7901, requiring an expensive effort to return the object platform system 1500 back to its original position resting on its foundation, according to an example embodiment of the present disclosure.

Figure 83:
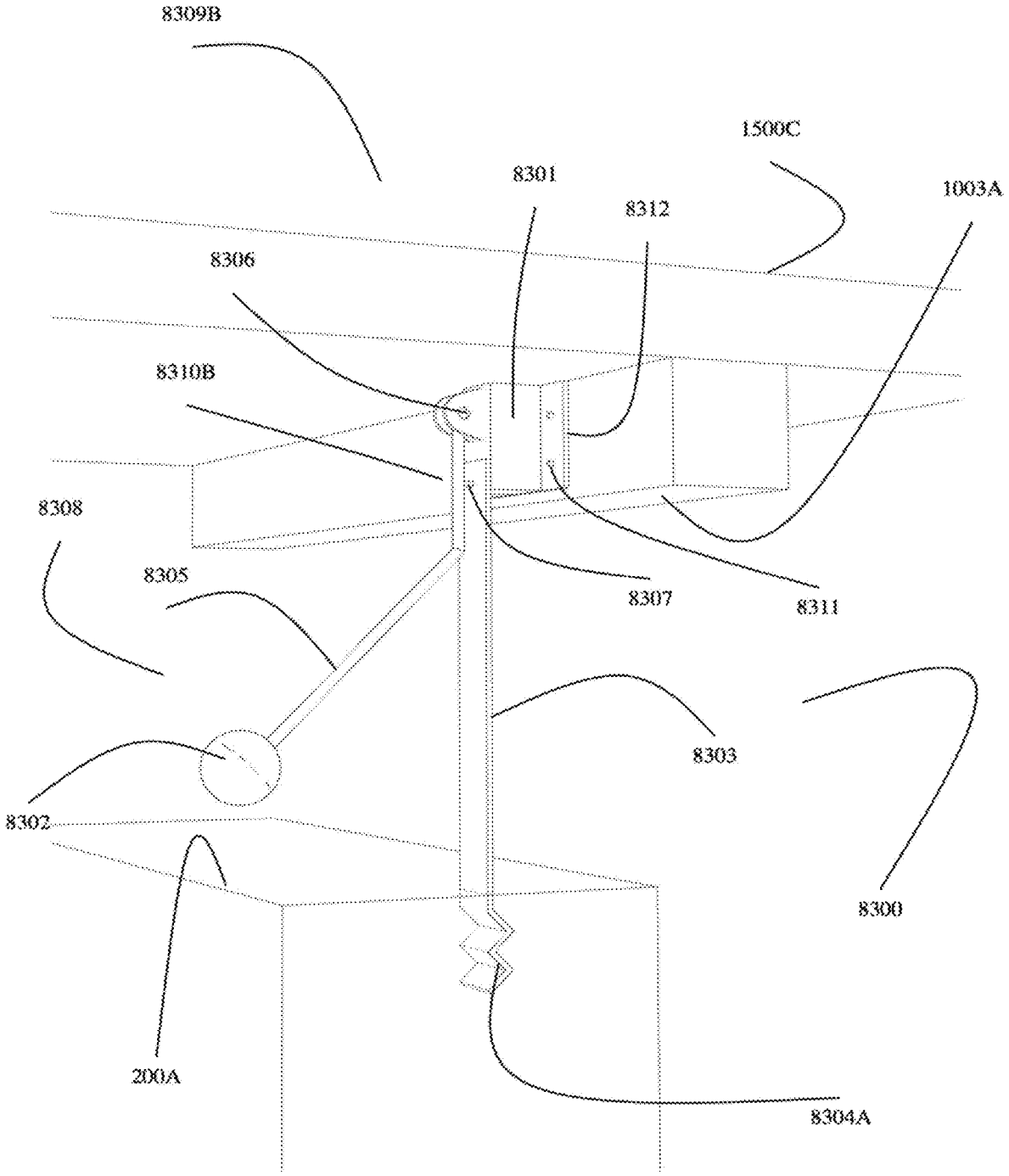
FIG. 83 illustrates a perspective view that shows a float activated system outfitted with a buoyant float anchored to a lever arm that is attached to a lever arm hinge. A strap pin is anchored to the lever arm. The float will rise with rising water and rotate the lever arm about the lever arm hinge, retracting the strap pin from the strap pin hole and disconnecting the object from the hold down system, releasing the object and allowing it to separate from the foundation system and rise with the level of rising water. The strap is configured to re-insert the strap pin into the strap pin hole and reestablish the hold down system once the water recedes, according to an example embodiment of the present disclosure.

FIG. 83 illustrates a perspective view that shows a float activated system 8308 outfitted with a buoyant float 8302 anchored to a lever arm 8305 that is attached to a lever arm hinge 8306. A strap pin 8307 is anchored to the lever arm 8305. The float will rise with rising water 1202 and rotate the lever arm 8305 about the lever arm hinge 8306, retracting the strap pin 8307 from the strap pin hole 11500 and disconnecting the object 100 from the hold down system 8300, releasing the object 100 and allowing it to separate from the foundation system 200 and rise with the level of rising water 1202. The strap 8303 is configured to re-insert the strap pin 8307 into the strap pinhole 11500 and reestablish the hold down system 8300 once the water recedes, according to an example embodiment of the present disclosure. Hold down system 8300 may be defined as a device for securing the object 100 or object platform system 1500 to the foundation system 200. Examples of the hold down system 8300 may include anchor rod, anchor bolt and hold down. In some example embodiments, the hold down system 8300 may be configured to automatically re-anchor the object 100 to the foundation system 200, release the object 100 from the foundation system 200, anchor the object 100 to the foundation system 200 and remain anchored to the foundation system 200. In some example embodiments, if the hold down system 8300 is absent then the object 100 or the object platform system 1500 will not be anchored to the foundation system 200. In some example embodiments, the hold down system 8300 may be configured to be of sufficient strength to resist the external force 500 pressures tending to separate the object 100 from the foundation system 200, contain a strap pinhole 11500 and anchor to the foundation system 200. In some example embodiments, the hold down system 8300 may be positioned below the object 100, below the object platform system 1500, fixed to the grade beam 201, fixed to the foundation support system 603, below the locking system 8309 or fixed to the pier system 105. In some example embodiments, the hold down system 8300 may be coupled with the foundation support system 603. In some example embodiments, the hold down system 8300 may interact with the strap pin 8307. In some example embodiments, the hold down system 8300 may comprise strap pinhole 11500, strap 8303 or strap anchoring system 8304. In some example embodiments, the lock assembly cleat 8301 may be configured to remain anchored to the object 100 and anchor the lever arm hinge 8306. In some example embodiments, the lock assembly cleat 8301 may comprise lock assembly mounting plate 8312 or lock assembly anchor 8311. Buoyant float 8302 may be defined as a device that displaces a sufficient volume of rising water 1202 when attached to the lever arm 8305 to lift the lever arm 8305 to rotate on the lever arm hinge 8306 and extract the strap pin 8307 from the strap pinhole 11500. Examples of the buoyant float 8302 may include a pontoon, a cork, a bladder, an air cell and a bobber. In some example embodiments, the buoyant float 8302 may be configured to displace a sufficient volume of rising water 1202 that is a greater weight than the combined weight of the lever arm 8305, the buoyant float 8302, and the additional force used to extract the strap pin 8307 from the strap pin hole 11500 and remain anchored to the lever arm 8305. In some example embodiments, the buoyant float 8302 may be configured to displace a sufficient volume of rising water 1202 to lift the lever arm 8305 to rotate on the lever arm hinge 8306 and extract the strap pin 8307 from the strap pinhole 11500. In some example embodiments, the buoyant float 8302 may be coupled with the lever arm 8305. In some example embodiments, the buoyant float 8302 may interact in multiple ways: it may interact with rising water 1202 and it also may interact with the lever arm 8305. Strap 8303 may be defined as a device for securing the object 100 or object platform system 1500 to the foundation system 200. Examples of the strap 8303 may include anchor rod, anchor bolt and hold down. In some example embodiments, the strap 8303 may be configured to anchor to the foundation system 200 and contain the strap pinhole 11500. In some example embodiments, if the strap

8303 is absent then the object 100 or the object platform system 1500 will not be anchored to the foundation system 200. In some example embodiments, the strap 8303 may be configured to anchor to the foundation system 200, contain a strap pinhole 11500 and be of sufficient strength to resist the external force 500 pressures tending to separate the object 100 from the foundation system 200. In some example embodiments, the strap 8303 may be positioned fixed to the grade beam 201, Fixed to the pier system 105, fixed to the foundation support system 603, below the object 100, below the object platform system 1500 or below the locking system 8309. In some example embodiments, the strap 8303 may be coupled with foundation support system 603. In some example embodiments, the strap 8303 may interact with the strap pin 8307. In some example embodiments, the strap 8303 may contain the material stainless steel. In some example embodiments, the strap 8303 may be shaped like flat rectangle extrusion. Strap anchoring system 8304A may be defined as a shaping of the strap 8303 end inserted in the grade beam 201 or shaft fill material 3901 intended to prevent pull-out of the strap 8303. In some example embodiments, the strap anchoring system 8304A may be configured to anchor the strap 8303 to the foundation system 200 and remain anchored to the foundation system 200. Lever arm 8305 may be defined as a rigid bar attached to a lever arm hinge 8306 that is used to remove the strap pin 8307 from the strap pinhole 11500. Examples of the lever arm 8305 may include wand, staff and stick. In some example embodiments, the lever arm 8305 may be configured to rotate about the lever arm hinge 8306, anchor the strap pin 8307 in alignment with the strap pinhole 11500, remain anchored to the lever arm hinge 8306 and anchor the buoyant float 8302. In some example embodiments, the lever arm 8305 may be configured to anchor the strap pin 8307, pivot on the lever arm hinge 8306 and anchor to the buoyant float 8302. In some example embodiments, the lever arm 8305 may be positioned below the lever arm hinge 8306 or above the buoyant float 8302. In some example embodiments, the lever arm 8305 may be coupled with the lever arm hinge 8306, the strap pin 8307 or the buoyant float 8302. In some example embodiments, the lever arm 8305 may interact with rising water 1202. In some example embodiments, the lever arm 8305 may be shaped like round extrusion. Lever arm hinge 8306 may be defined as a device that allows the lever arm 8305 to rotate around a transverse axis. Examples of the lever arm hinge 8306 may include a pivot, an axle and a joint. In some example embodiments, the lever arm hinge 8306 may be configured to anchor the lever arm 8305, allow the lever arm 8305 to have planar rotation and remain anchored to the lock assembly cleat 8301. Strap pin 8307 may be defined as a piece configured to fasten, support, or attach things. Examples of the strap pin 8307 may include post, rod, tongue, spike and tab. In some example embodiments, the strap pin 8307 may be configured to resist a designated portion of the overturning force on the object 100 from high velocity wind 4000, extract from the strap pinhole 11500, insert into the strap pinhole 11500 and remain anchored to the lever arm 8305. In some example embodiments, the strap pin 8307 may be configured to insert inside the strap pinhole 11500 and anchor to the lever arm 8305. In some example embodiments, the strap pin 8307 may be positioned attached to the lever arm 8305 or align with the strap pin hole 11500. In some example embodiments, the strap pin 8307 may be coupled with the lever arm 8305 or anchor the strap 8303 when the strap pin 8307 is inserted in the strap pinhole 11500. In some example embodiments, the strap pin 8307 may interact in multiple ways: it may interact with the strap 8303, it also may interact with the strap pin hole 11500 and it may interact with lever arm 8305. In some example embodiments, the strap pin 8307 may contain the material stainless steel. In some example embodiments, the strap pin 8307 may be shaped like cylinder. In some example embodiments, if the strap pin 8307 is absent then the lock system 8310 will not prevent the object 100 in object at rest 301 position from transitioning to an object separated 103 position. Float activated system 8308 may be defined as a device which employs a buoyant float 8302 anchored to a lever arm 8305 to unfasten the lock system 8310 and release the object 100 from the foundation system 200 during conditions of rising water 1202. In some example embodiments, the float activated system 8308 may be configured to re-anchor the lock assembly cleat 8301 to the hold down system 8300 in the absence of rising water 1202, release the lock assembly cleat 8301 from the hold down system 8300 in the presence of rising water 1202, release the lock assembly cleat 8301 from the hold down system 8300, anchor the lock assembly cleat 8301 to the hold down system 8300 and be anchored to the object 100. In some example embodiments, if the float activated system 8308 is absent then an alternative water detection system, a physical release system 4600, or a remote release system be employed to release the locking system 8309 and allow the object 100 to transition from an object at rest 301 position to an object separated 103 position. In some example embodiments, the float activated system 8308 may interact in multiple ways: it may interact with rising water 1202, it also may interact with the strap pin 8307 and it may interact with the strap pinhole 11500. In some example embodiments, the float activated system 8308 may comprise lock system 8310, buoyant float 8302, lever arm hinge 8306 or lever arm 8305. Locking system 8309B may be defined as an assembly that automatically reacts to the presence of rising water 1202 by unfastening the lock system 8310 to allow the object 100 to transition from an object at rest 301 position to an object separated 103 position. In some example embodiments, the locking system 8309B may be configured to release the object 100 from the foundation system 200 and anchor the object 100 to the foundation system 200. In some example embodiments, the locking system 8309B may comprise rising water lock release activation system 11501. Lock system 8310B may be defined as a mechanism that prevents the object 100 from separating from the foundation system 200 when the strap pin 8307 remains inserted in the strap pinhole 11500. In some example embodiments, the lock system 8310B may be configured to allow insertion of the strap pin 8307 into the strap pinhole 11500 and allow extraction of the strap pin 8307 from the strap pinhole 11500. In some example embodiments, if the lock system 8310B is absent then the lock system 8310 will not prevent the object 100 in object at rest 301 position from transitioning to an object separated 103 position. In some example embodiments, the lock system 8310B may comprise strap pin 8307. In some example embodiments, the lock assembly anchor 8311 may be configured to anchor the lock assembly mounting plate 8312 to the object 100. In some example embodiments, the lock assembly mounting plate 8312 may be configured to receive the lock assembly anchor 8311 and anchor the lever arm hinge 8306.

Figure 84:
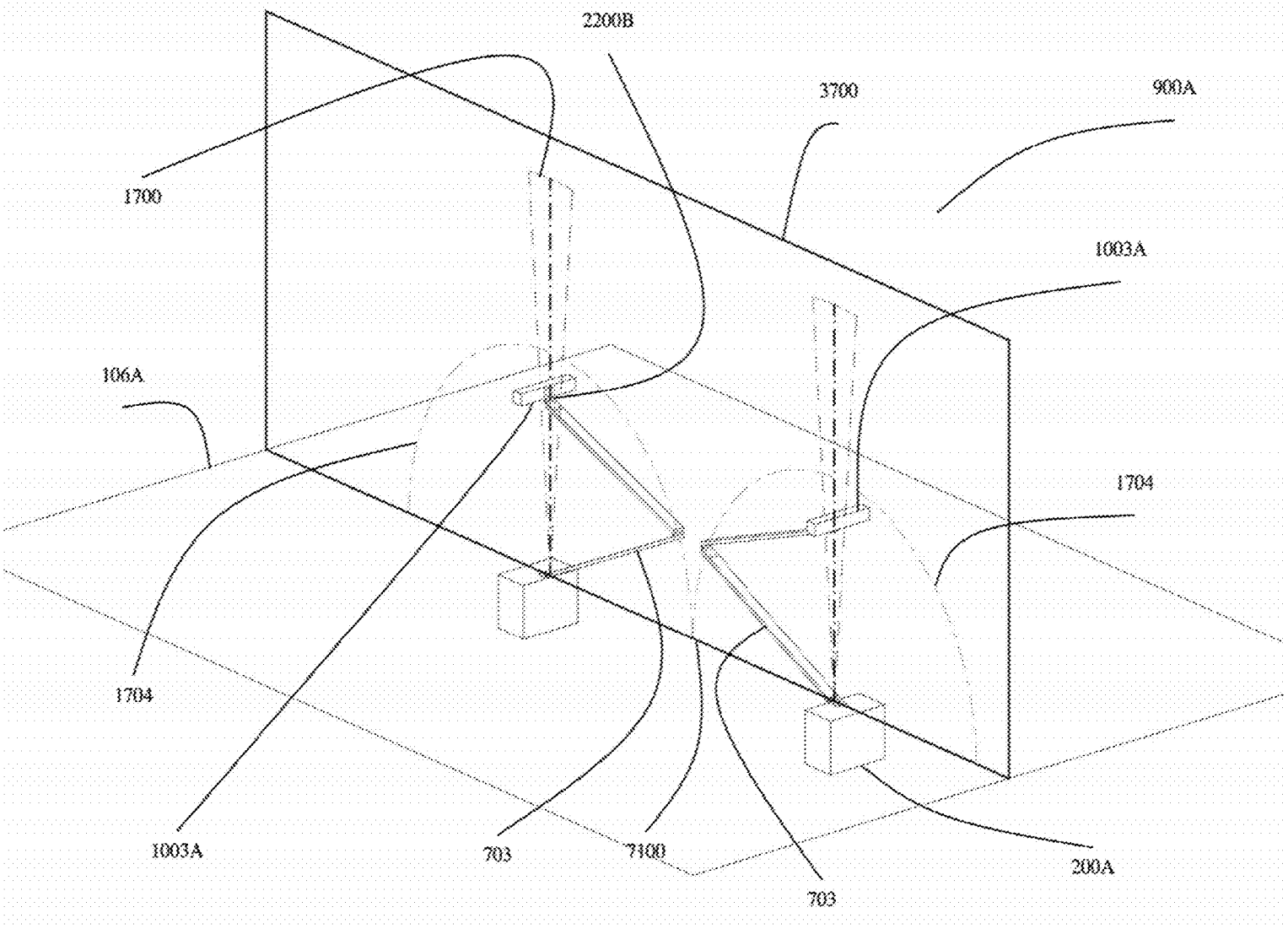
FIG. 84 illustrates a perspective view that shows a diagram of the limited cone of movement for each of two object hinge units anchored to the same object platform system in an opposing elbow system. The allowable movement of one platform sill connection is limited by the second primary parallel struts system when set at an opposing angle to the first. This diagram illustrates the opposing angle at 180 degrees. Placing each folding strut movement plane at a lesser opposing angle will also provide the restriction in possible platform movement to guide the object platform system to return to its original resting position once the external force that caused the separation of the object from its foundation system is removed, according to an example embodiment of the present disclosure.

FIG. 84 illustrates a perspective view that shows a diagram of the limited cone of movement for each of two object hinge 2200 units anchored to the same object platform system 1500 in an opposing elbow system 900. The allowable movement of one platform sill 1003 connection is limited by the second primary parallel struts system 104 when set at an opposing angle to the first. This diagram illustrates the opposing angle at 180 degrees. Placing each folding strut movement plane 3700 at a lesser opposing angle will also provide the restriction in possible platform movement used to guide the object platform system 1500 to return to its original resting position once the external force 500 that caused the separation of the object 100 from its foundation system 200 is removed, according to an example embodiment of the present disclosure. Folding strut movement plane 3700 may be defined as a diagram illustrating the possible planar range of movement of the object platform system 1500 at each point of connection to a strut hinge system 2600 relative to the foundation system 200 when two or more primary parallel struts system 104 assemblies are arranged in an opposing elbow system 900. In some example embodiments, the folding strut movement plane 3700 may be configured to illustrate the restricted possible planar movement for multiple primary parallel struts system 104 assemblies anchored to the same object 100, illustrate the possible range of planar motion of the lower strut 703 in a primary parallel struts system 104 and illustrate the possible range of planar motion of the upper strut 702 in a primary parallel struts system 104.

Figure 85:
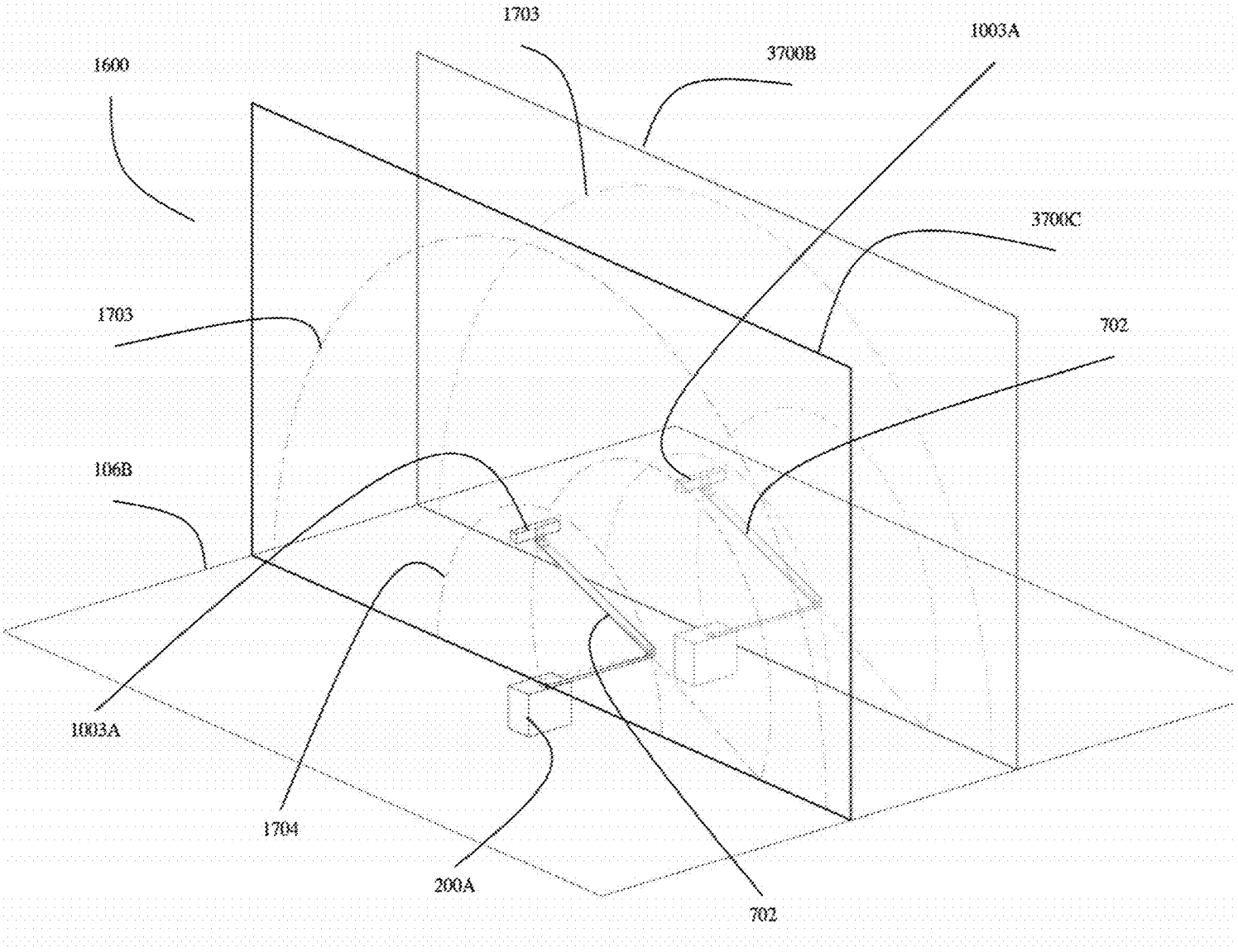
FIG. 85 illustrates a perspective view that shows a diagram comparing the identical platform movements that are allowable when tethering the object with either a single primary parallel struts system or with multiple primary parallel struts system units arranged in a same facing elbow system. The use of either system will allow the possibility for an undesirable platform movement that can return the object, not to its original resting position, but resting on grade off to the side of the foundation system, and a later re-lifting of the object in order to return it to its original resting position, according to an example embodiment of the present disclosure.

FIG. 85 illustrates a perspective view that shows a diagram comparing the identical platform movements that are allowable when tethering the object 100 with either a single primary parallel struts system 104 or with multiple primary parallel struts system 104 units arranged in a same facing elbow system 9800. The use of either system will allow the possibility for an undesirable platform movement that can return the object 100, not to its original resting position, but resting on grade off to the side of the foundation system 200, and a later re-lifting of the object 100 in order to return it to its original resting position, according to an example embodiment of the present disclosure. Folding strut movement plane 3700C may be defined as a diagram illustrating the possible planar range of movement of the object platform system 1500 at each point of connection to a strut hinge system 2600 relative to the foundation system 200 when two or more primary parallel struts system 104 assemblies are arranged in a same facing elbow system 9800. In some example embodiments, the folding strut movement plane 3700C may be configured to illustrate the restricted possible planar movement for multiple primary parallel struts system 104 assemblies anchored to the same object 100, illustrate the possible range of planar motion of the lower strut 703 in a primary parallel struts system 104 and illustrate the possible range of planar motion of the upper strut 702 in a primary parallel struts system 104. In some example embodiments, the grade 106B may be configured to support and anchor the foundation system 200 in place.

Figure 86:
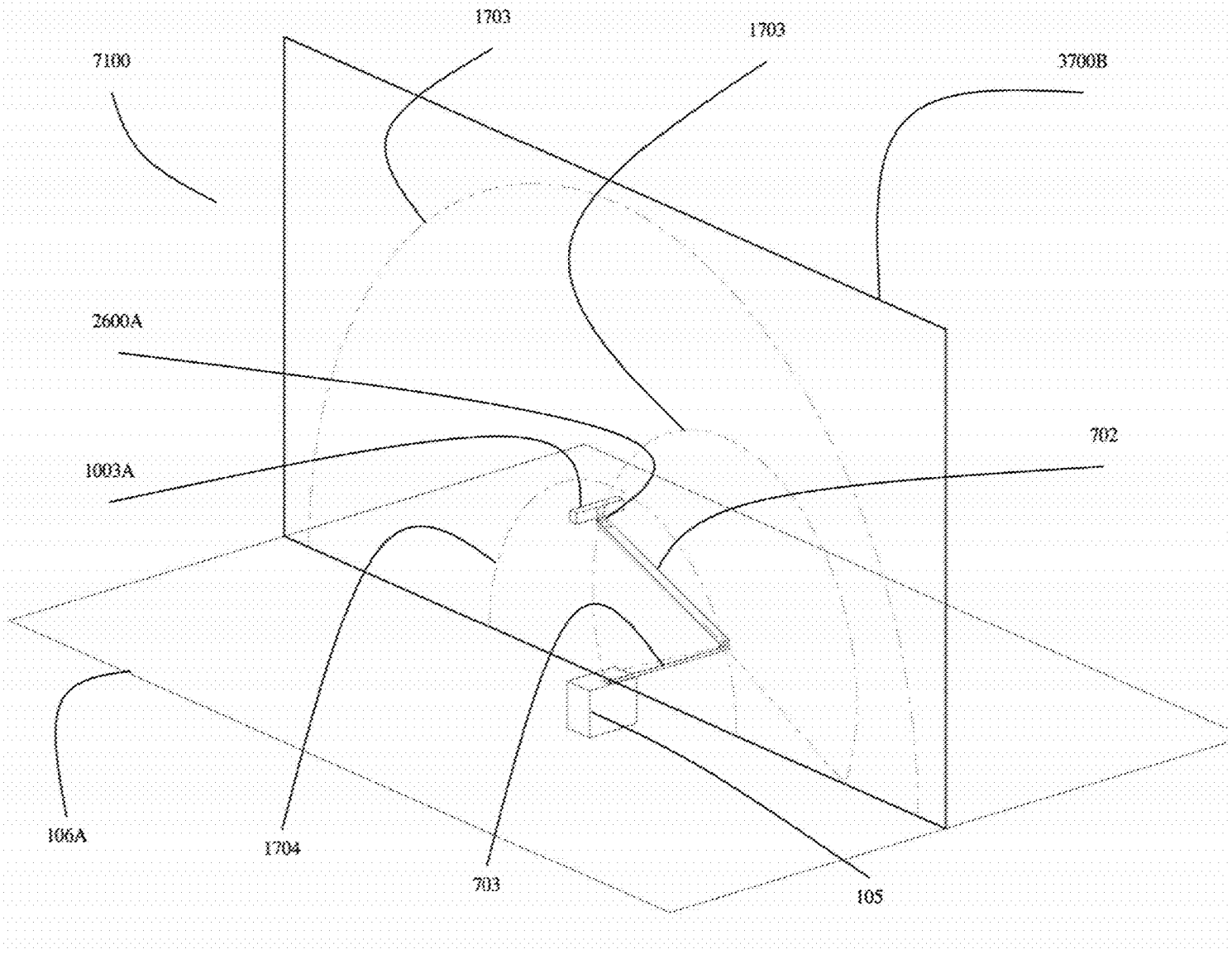
FIG. 86 illustrates a perspective view that shows a diagram of the movement of the upper hinge in a single folding strut system. When connected to either an object, an object platform, or an object platform sill, this range of motion also represents to range of motion possible for the object. The object is not returned to its original resting position; rather, this tethering system will allow the possibility for an undesirable platform movement that can return the object, not to its original resting position, but to one resting on grade and off to the side of the foundation system, according to an example embodiment of the present disclosure.

FIG. 86 illustrates a perspective view that shows a diagram of the movement of the upper hinge in a single folding strut system. When connected to either an object, an object platform, or an object platform sill, this range of motion also represents to range of motion possible for the object. The object is not to return to its original resting position; rather, this tethering system will allow the possibility for an undesirable platform movement that can return the object 100, not to its original resting position, but to one resting on grade and off to the side of the foundation system 200, according to an example embodiment of the present disclosure.

Figure 87:
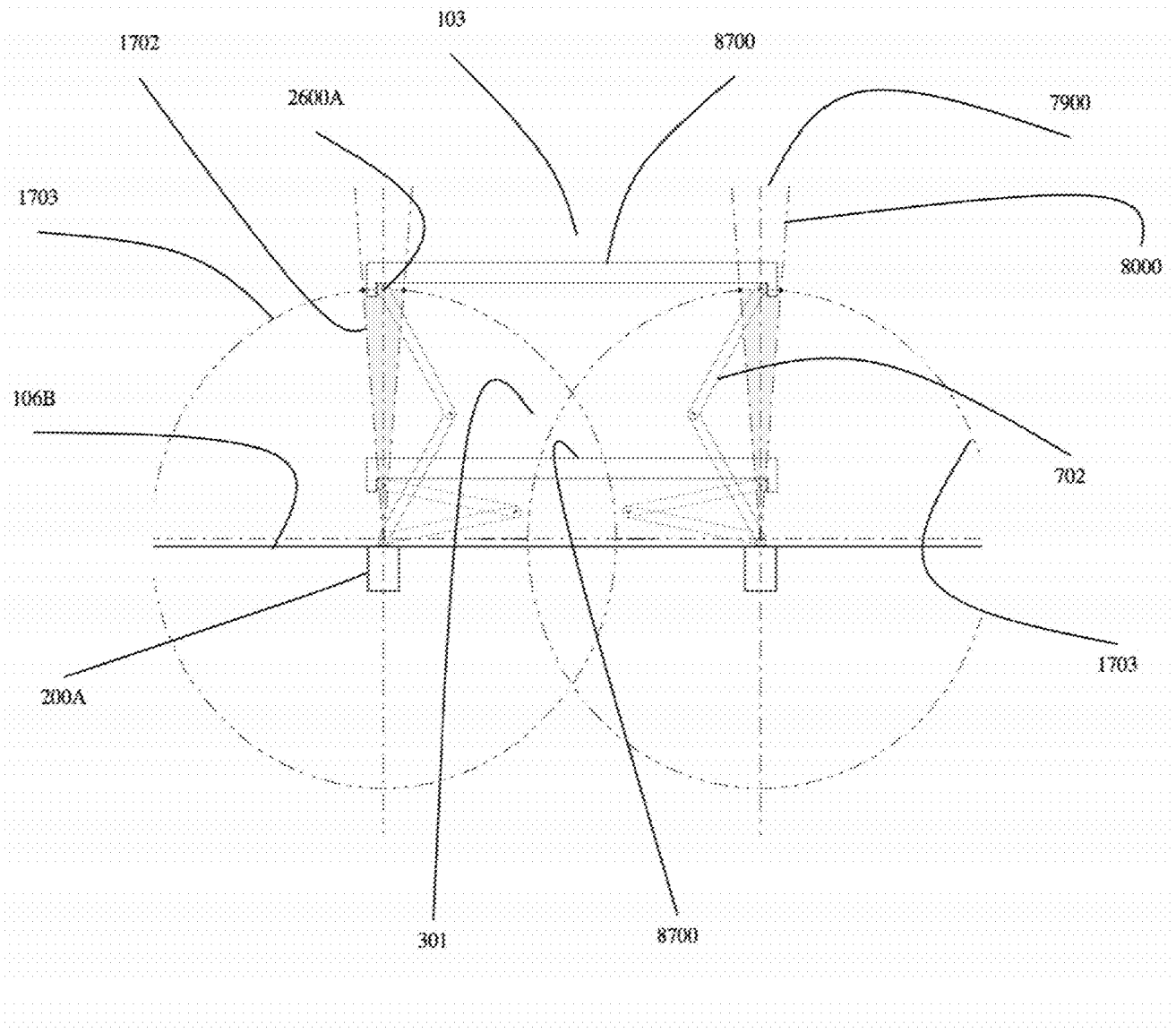
FIG. 87 illustrates an elevation view that shows a diagram overlaying two positions of the same object platform system in an opposing strut system, one with the platform near to its resting position and one at the upper limit of separation. The movement range for each upper hinge is limited to the resultant cone of possible movement. By anchoring to the same rigid platform, multiple parallel strut systems set in an opposing elbow system, the movement of the platform is also limited. The limited movement range for each connection point to the platform is restricted to fall within the illustrated conical area with its point or zero movement located at the lower hinge and the movement range widens as the upper hinge approaches the limits of the upper strut movement arc. This diagram illustrates the opposing angle at 180 degrees. Placing each folding strut movement plane at a lesser opposing angle will also provide the restriction in possible platform movement to guide the object platform system to return to its original resting position once the external force that caused the separation of the object from its foundation system is removed, according to an example embodiment of the present disclosure.

FIG. 87 illustrates an elevation view that shows a diagram overlaying two positions of the same object platform system 1500 in an opposing strut system, one with the platform near to its resting position and one at the upper limit of separation. The movement range for each upper hinge is limited to the resultant cone of possible movement. By anchoring to the same rigid platform, multiple parallel strut systems set in an opposing elbow system 900, the movement of the platform is also limited. The limited movement range for each connection point to the platform is restricted to fall within the illustrated conical area with its point or zero movement located at the lower hinge and the movement range widens as the upper hinge approaches the limits of the upper strut movement arc. This diagram illustrates the opposing angle at 180 degrees. Placing each folding strut movement plane 3700 at a lesser opposing angle will also provide the restriction in possible platform movement to guide the object platform system 1500 to return to its original resting position once the external force 500 that caused the separation of the object 100 from its foundation system 200 is removed, according to an example embodiment of the present disclosure. Platform movement arc 7900 may be defined as the possible range of movement and tilt of the object platform system 1500 at each point of connection to a strut hinge system 2600 relative to the foundation system 200 when two or more primary parallel struts system 104 assemblies are arranged in an opposing elbow system 900. Examples of the platform movement arc 7900 may include limited platform movement cone 1702. In some example embodiments, the platform movement arc 7900 may be configured to illustrate the possible range of arc motion of the object hinge 2200 in a primary parallel struts system 104. In some example embodiments, the platform movement arc 7900 may be positioned between the foundation system 200 and the object 100 or at a single point on the foundation system 200 that widens to a cone shape when approaching the fullest extension of each single folding strut movement 7100 arc. In some example embodiments, the platform movement arc 7900 may be shaped like cone. In some example embodiments, the platform movement arc 7900 may comprise limited platform movement cone 1702. Platform position 8700 may be defined as the possible range of movement and tilt of the object platform system 1500 at each point of connection to a strut hinge system 2600 relative to the foundation system 200 when two or more primary parallel struts system 104 assemblies are attached. In some example embodiments, the platform position 8700 may be configured to illustrate the position of the object platform system 1500. In some example embodiments, the platform position 8700 may be positioned above the stabilization system 108 or above each individual point of connection to one or more strut hinge system 2600 assemblies. In some example embodiments, the platform position 8700 may interact in multiple ways: it may interact with the foundation system 200 when in the condition of platform at resting position 7901 and it also may interact with the limits of the folding strut movement arc system 7101 for each strut hinge system 2600 that is attached. In some example embodiments, the platform position 8700 may comprise platform at resting position 7901, limited platform position 400 or platform at fail position 7902.

Figure 88:
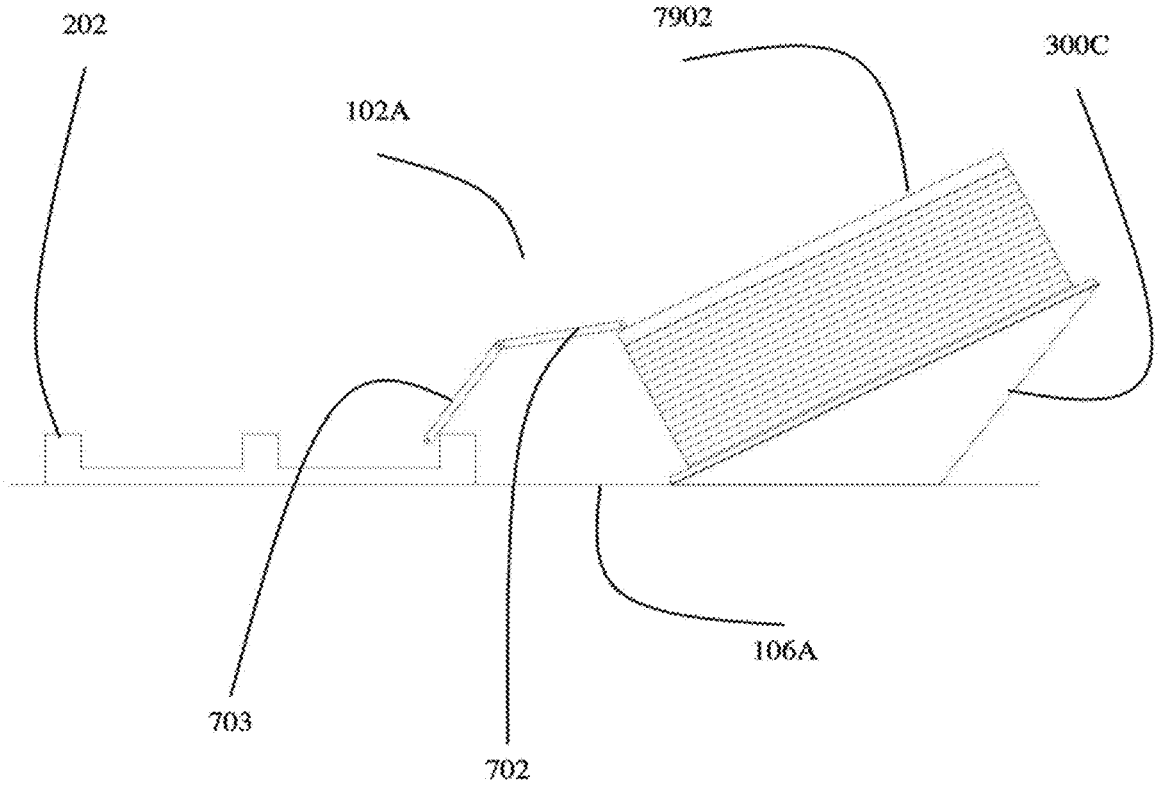
FIG. 88 illustrates an elevation view that shows a house resting after a flood in a failed positon that is allowed by a tethering system of multiple primary parallel struts system units arranged in a same facing elbow system, according to an example embodiment of the present disclosure.

FIG. 88 illustrates an elevation view that shows a house resting after a flood in a failed positon that is allowed by a tethering system of multiple primary parallel struts system 104 units arranged in a same facing elbow system 9800, according to an example embodiment of the present disclosure. In some example embodiments, the orientation system 102A may be configured to position the direction of action for multiple elbow hinge 700 units.

Figure 89:
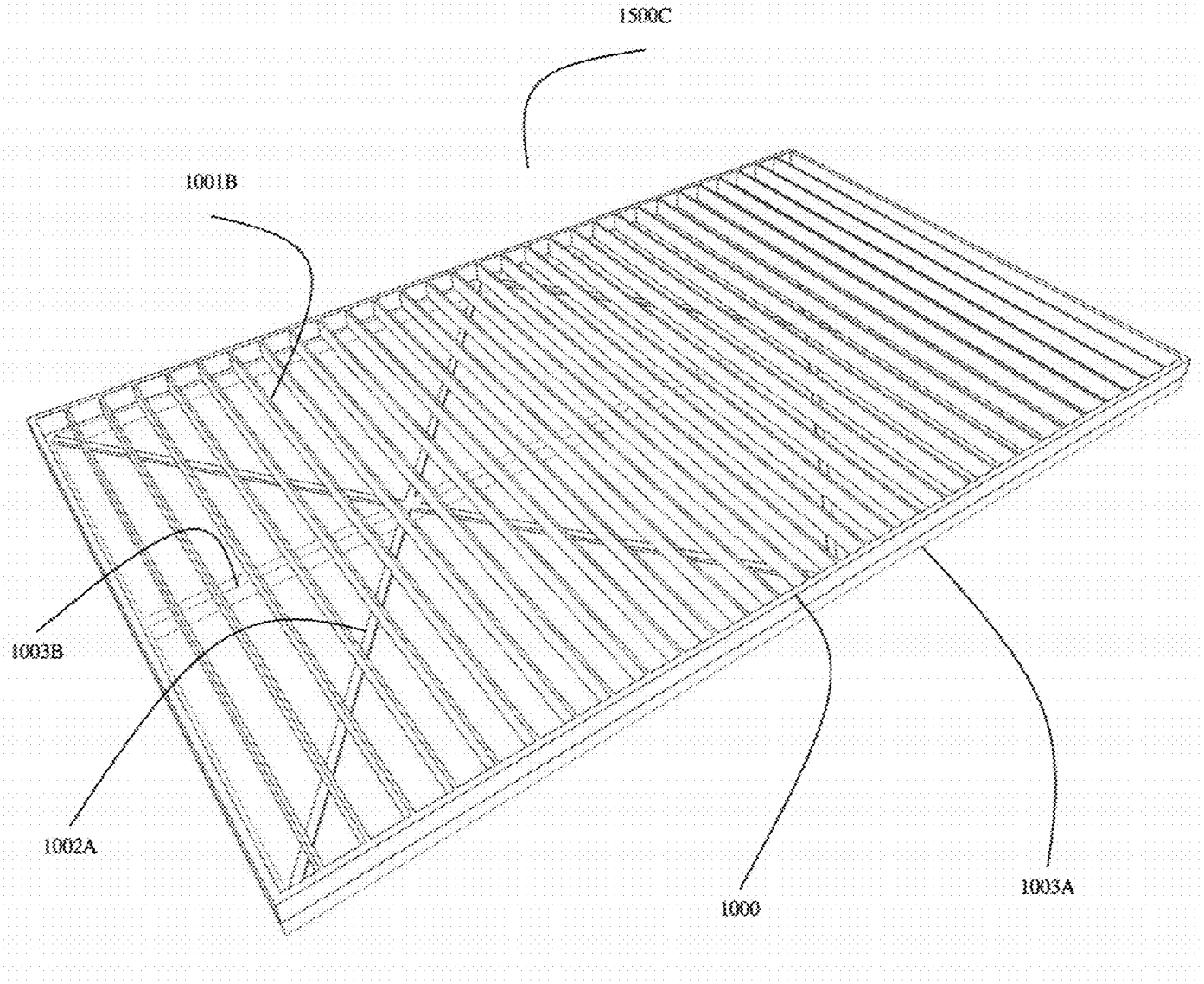
FIG. 89 illustrates a perspective view that shows the components of an object platform system showing one method of construction using a standard parallel joist system within a perimeter of rim joists, anchored to a perimeter sill and one or more intermediate sills as needed to accommodate the structural span limits of each joist with the overall platform width. The diagonal cross bracing is added to the otherwise standard building framing system in order to strengthen the structural system to accommodate the uneven and possible undulating movements resulting from water, wind, and wave action while floating, according to an example embodiment of the present disclosure.

FIG. 89 illustrates a perspective view that shows the components of an object platform system 1500 showing one method of construction using a standard parallel joist system within a perimeter of rim joists, anchored to a perimeter sill and one or more intermediate sills as needed to accommodate the structural span limits of each joist with the overall platform width. The diagonal cross bracing is added to the otherwise standard building framing system in order to strengthen the structural system to accommodate the uneven and possible undulating movements resulting from water, wind, and wave action while floating, according to an example embodiment of the present disclosure.

Figure 90:
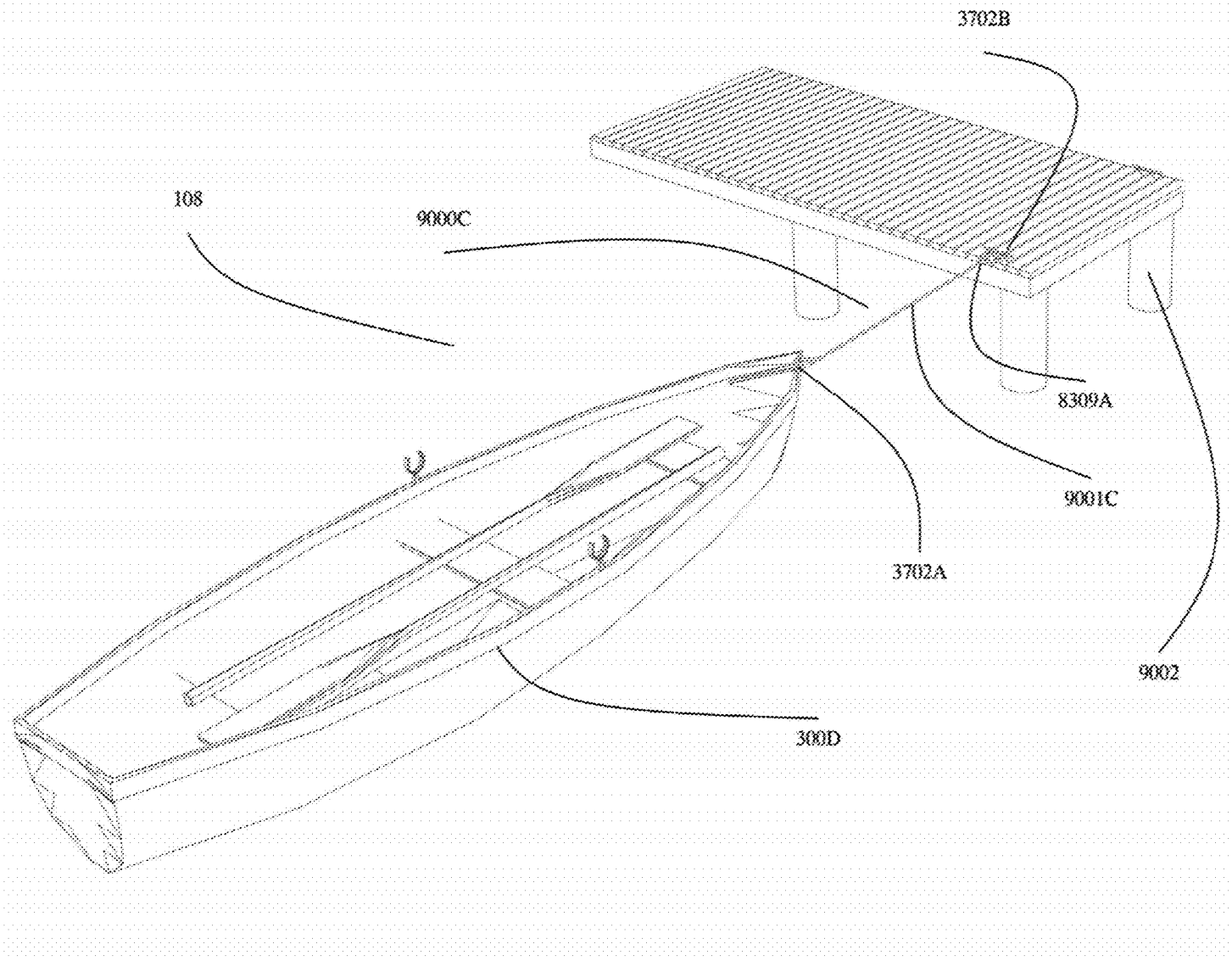
FIG. 90 illustrates a perspective view that shows a tethering solution using a fixed length tether anchored to a stationary cleat on one end and to a traveling cleat on the other, allowing vertical movement of the boat as water rises and falls, according to an example embodiment of the present disclosure.

FIG. 90 illustrates a perspective view that shows a tethering solution using a fixed length tether 9001 anchored to a stationary cleat on one end and to a traveling cleat on the other, allowing vertical movement of the boat as water rises and falls, according to an example embodiment of the present disclosure. In some example embodiments, the tethering system 9000C may be configured to allow the object 100 to separate from the foundation system 200, be anchored to the foundation system 200, be anchored to the object 100 and anchor the object 100 to the foundation system 200. In some example embodiments, the tethering system 9000C may comprise fixed length tether 9001 or cleat system 3702. In some example embodiments, the cleat system 3702B may be configured to anchor the fixed length tether 9001 to the foundation system 200 and anchor the object 100 to the fixed length tether 9001. In some example embodiments, the fixed length tether 9001C may be configured to allow vertical movement between the object 100 and the foundation system 200 and restrict the separation distance between the object 100 and the foundation system 200. In some example embodiments, the driven pile 9002 may be configured to be driven into grade 106, be connected to and support the grade beam 201, spot footing 14100, pier system 105, slab foundation 12000, or directly to the stabilization system 108, support and resist the forces transmitted through the stabilization system 108, remain stationary and remain connected to grade 106. Locking system 8309A may be defined as an assembly that uses independent action to react to the presence of rising water 1202 and unfastening the lock system 8310 to allow the object 100 to transition from an object at rest 301 position to an object separated 103 position. In some example embodiments, the locking system 8309A may be configured to release the object 100 from the foundation system 200 and anchor the object 100 to the foundation system 200. In some example embodiments, the locking system 8309A may comprise physical release system 4600 or remote release system.

Figure 91:
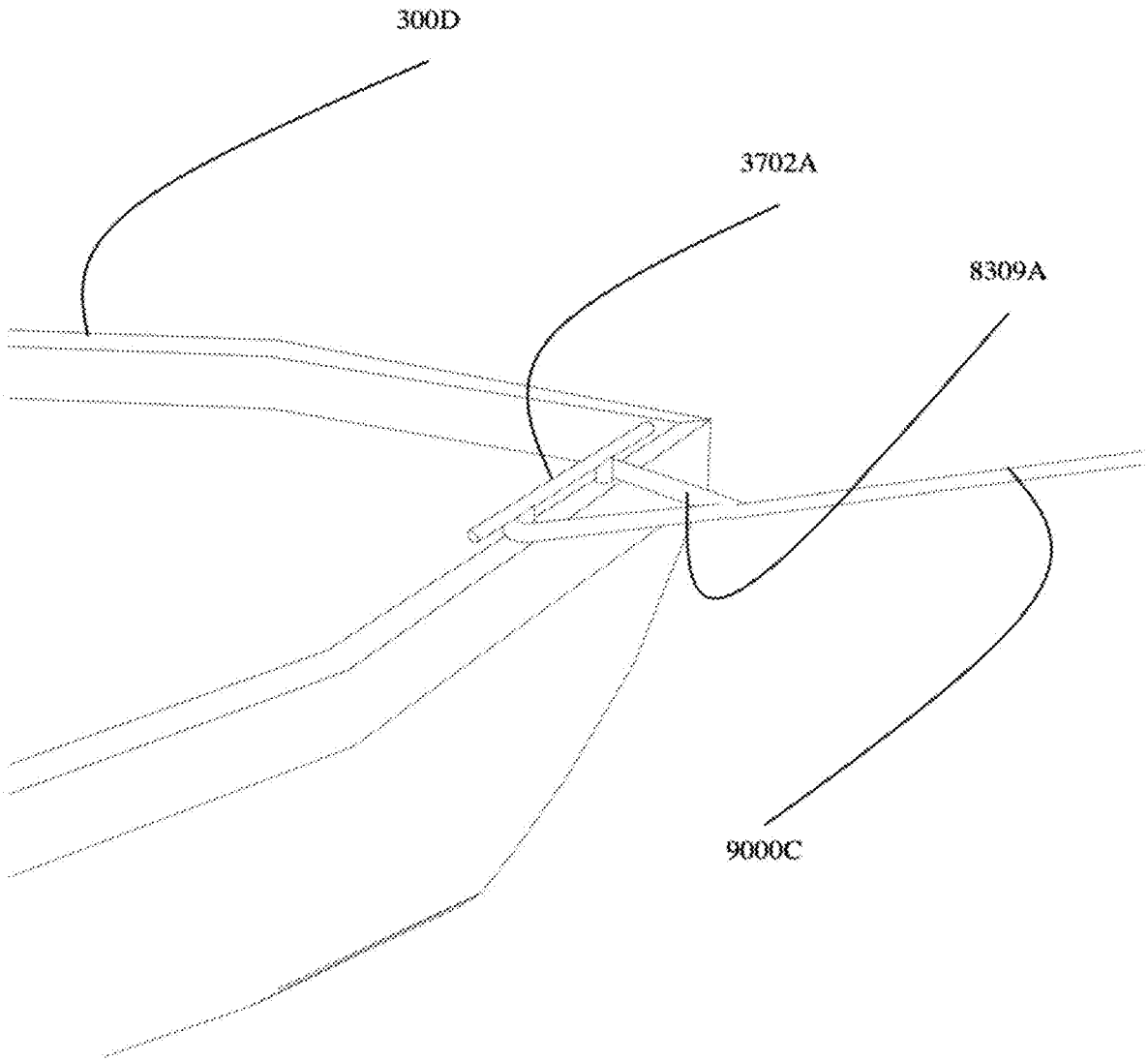
FIG. 91 illustrates a perspective view that shows a detail of a fixed length line that is anchoring a floating boat to a traveling cleat that is anchored to the boat, according to an example embodiment of the present disclosure.

FIG. 91 illustrates a perspective view that shows a detail of a fixed length line that is anchoring a floating boat to a traveling cleat that is anchored to the boat, according to an example embodiment of the present disclosure.

Figure 92:
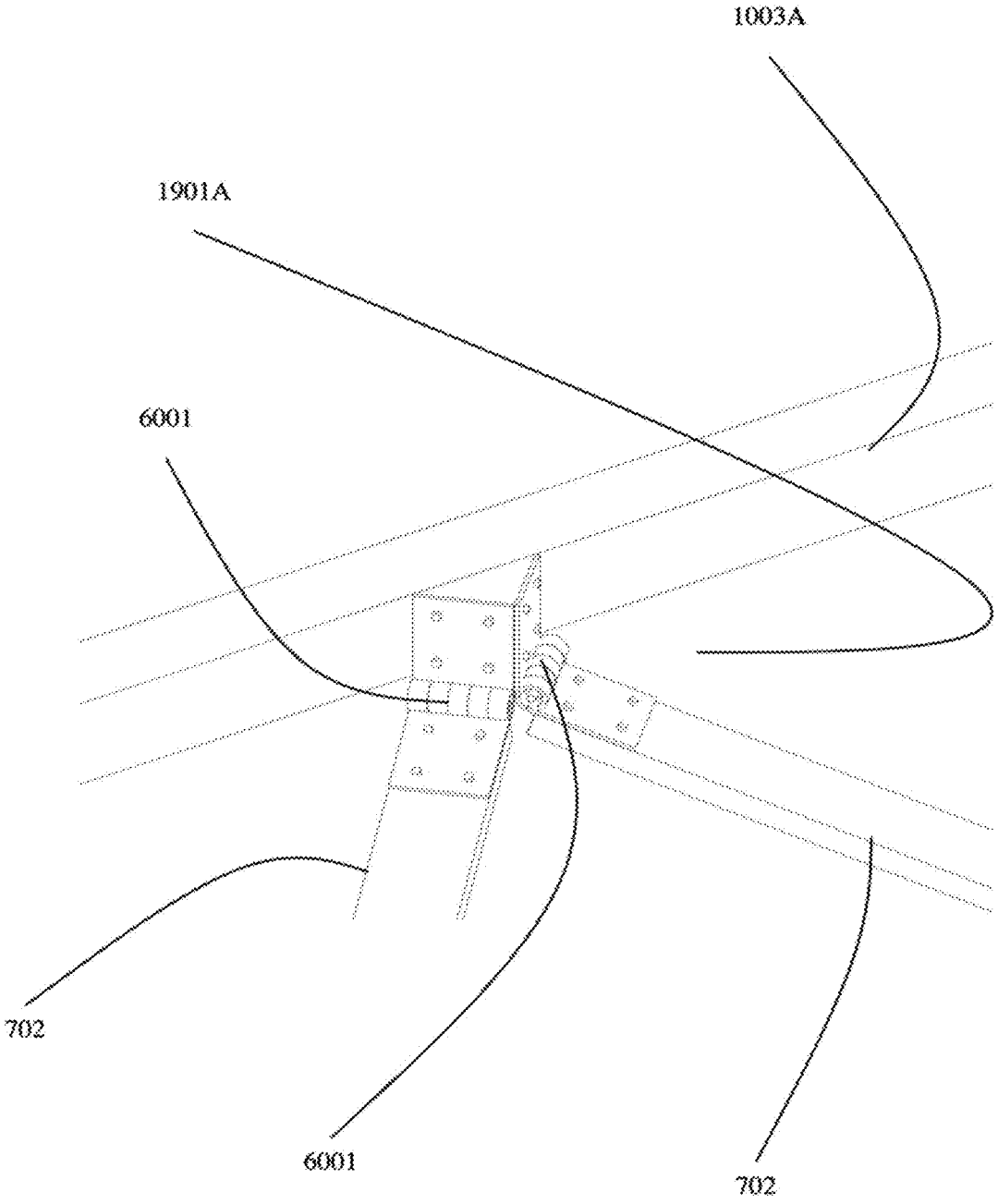
FIG. 92 illustrates a perspective view that shows a clustered hinge system with two butt hinge units set at an opposing angle such that the folding strut movement plane for one limits the movement of the other, resulting in limiting the possible lateral movement of the platform sill, according to an example embodiment of the present disclosure.

FIG. 92 illustrates a perspective view that shows a clustered hinge system 1901 with two butt hinge 6001 units set at an opposing angle such that the folding strut movement plane 3700 for one limits the movement of the other, resulting in limiting the possible lateral movement of the platform sill 1003, according to an example embodiment of the present disclosure.

Figure 93:
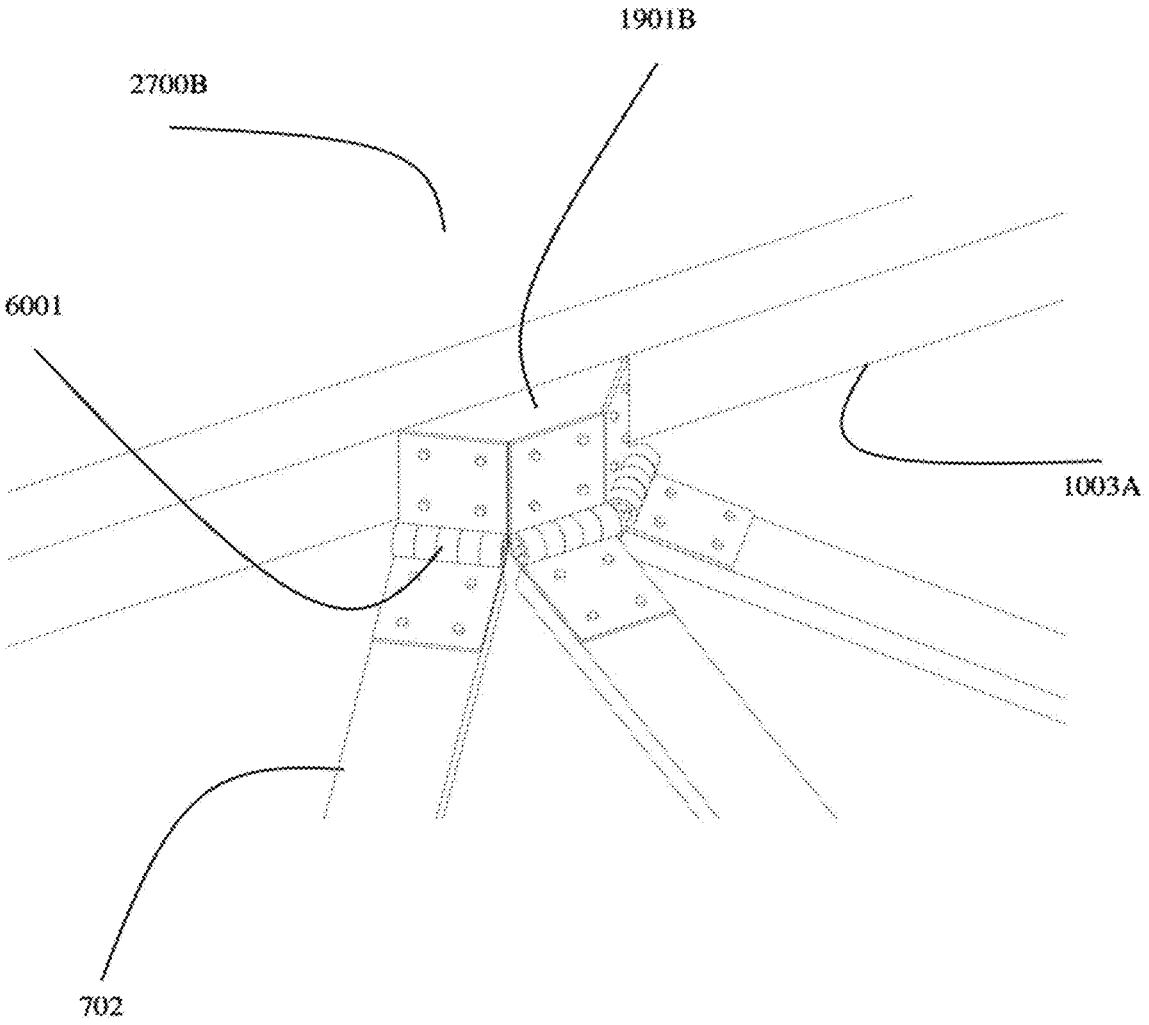
FIG. 93 illustrates a perspective view that shows a clustered hinge system with three butt hinge units set at opposing angles such that the folding strut movement plane for one limits the movement of the other two, resulting in limiting the possible lateral movement of this connection to the platform sill and of the object platform system, according to an example embodiment of the present disclosure.

FIG. 93 illustrates a perspective view that shows a clustered hinge system 1901 with three butt hinge 6001 units set at opposing angles such that the folding strut movement plane 3700 for one limits the movement of the other two, resulting in limiting the possible lateral movement of this connection to the platform sill 1003 and of the object platform system 1500, according to an example embodiment of the present disclosure.

Figure 94:
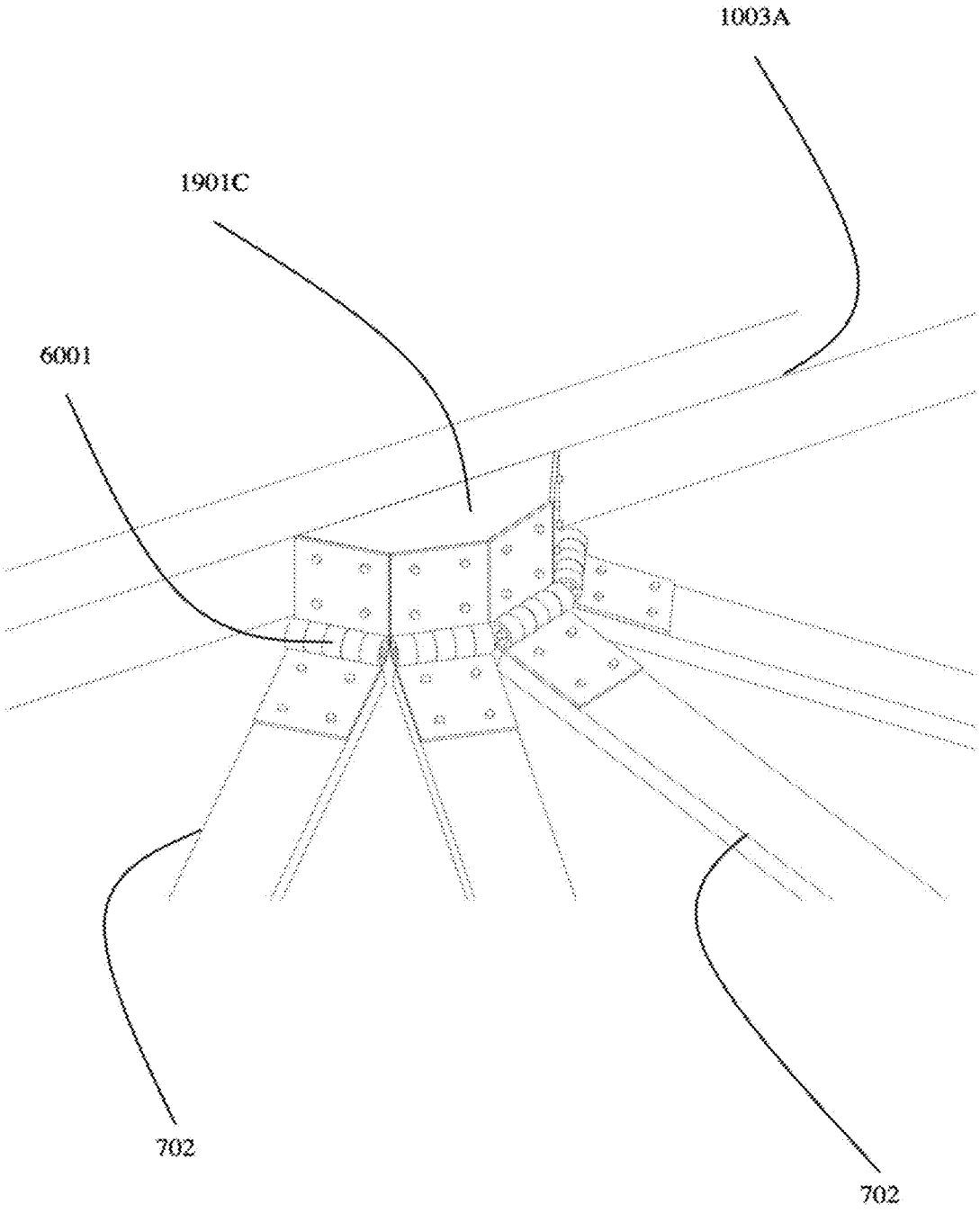
FIG. 94 illustrates a perspective view that shows a clustered hinge system with four butt hinge units anchored to the platform sill and set at opposing angles such that the folding strut movement plane for one limits the movement of the other two, resulting in limiting the possible lateral movement of this connection to the platform sill and of the object platform system, according to an example embodiment of the present disclosure.

FIG. 94 illustrates a perspective view that shows a clustered hinge system 1901 with four butt hinge 6001 units anchored to the platform sill 1003 and set at opposing angles such that the folding strut movement plane 3700 for one limits the movement of the other two, resulting in limiting the possible lateral movement of this connection to the platform sill 1003 and of the object platform system 1500, according to an example embodiment of the present disclosure.

Figure 95:
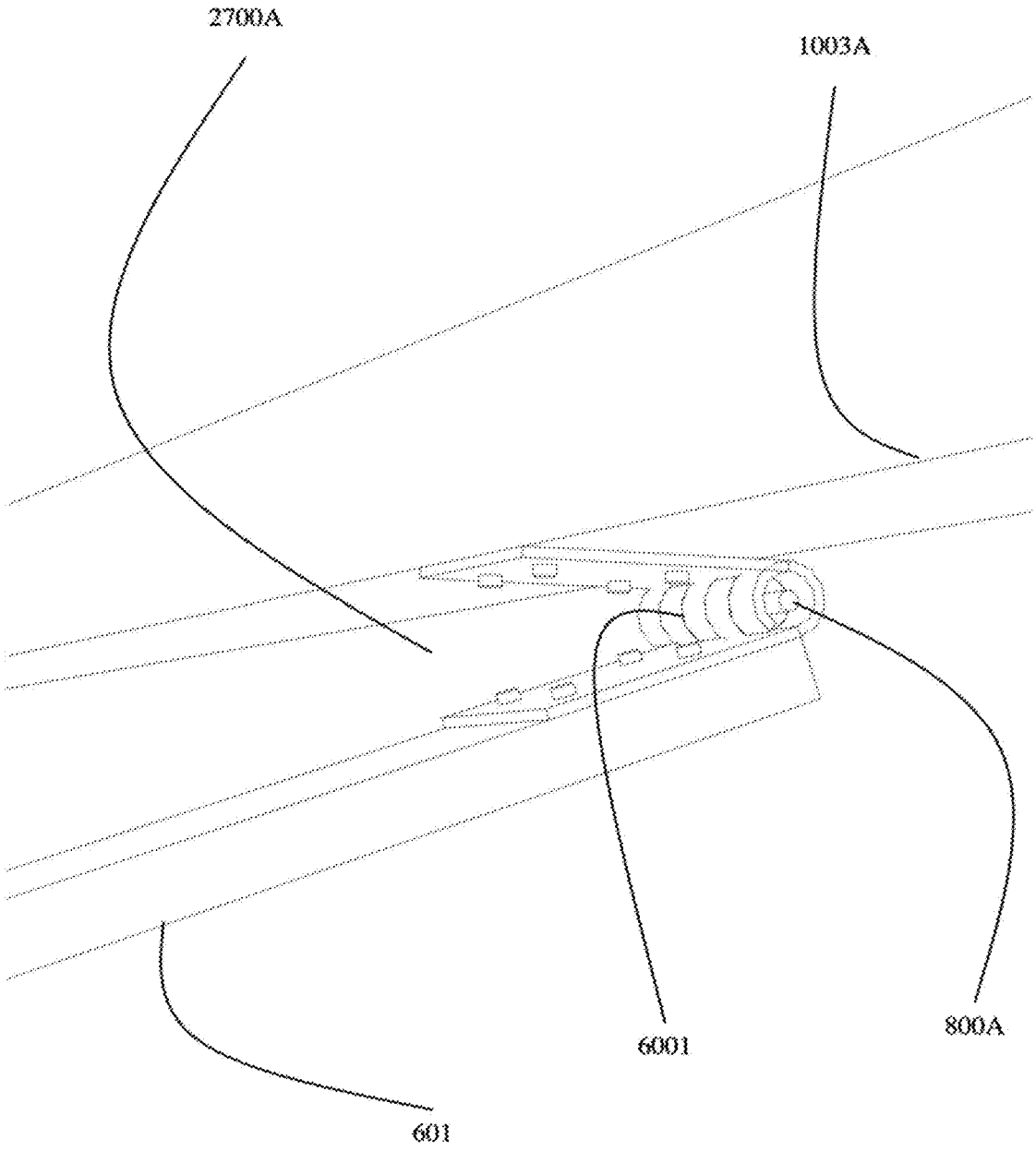
FIG. 95 illustrates a perspective view that shows a hinge block system anchored to the platform sill with a single butt hinge unit anchoring the upper strut of a primary parallel struts system unit. Using a butt hinge facilitates the use of standard lumber profiles set with their widest and strongest section dimension parallel to grade, significantly increasing the ability of the strut to resist lateral forces caused by wind pressure or moving water, and to transfer these forces to be resisted by the foundation system, according to an example embodiment of the present disclosure.

FIG. 95 illustrates a perspective view that shows a hinge block system 2700 anchored to the platform sill 1003 with a single butt hinge 6001 unit anchoring the upper strut 702 of a primary parallel struts system 104 unit. Using a butt hinge 6001 facilitates the use of standard lumber profiles set with their widest and strongest section dimension parallel to grade, significantly increasing the ability of the strut 601 to resist lateral forces caused by wind pressure or moving water, and to transfer these forces to be resisted by the foundation system, according to an example embodiment of the present disclosure.

Figure 96:
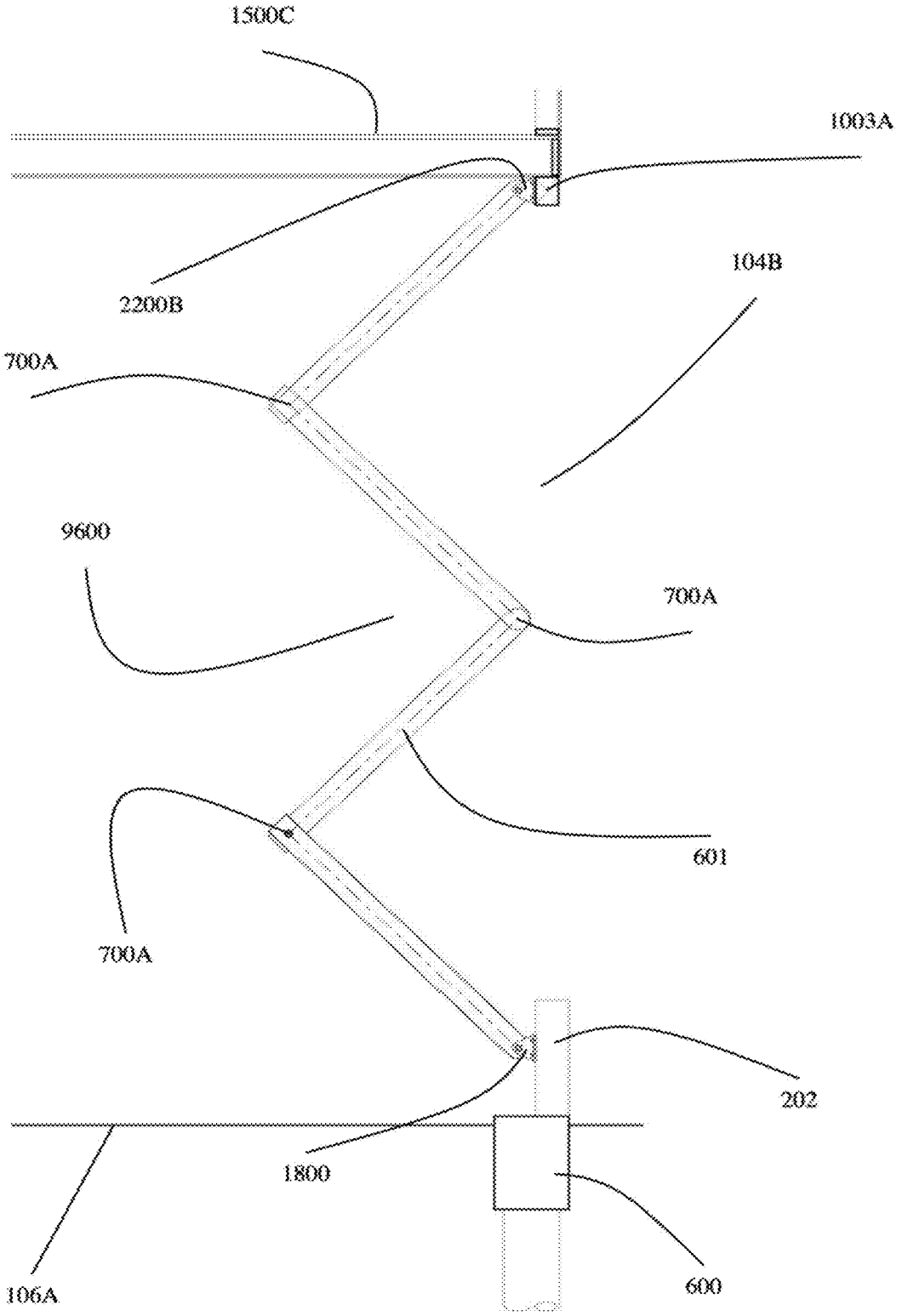
FIG. 96 illustrates an elevation view that shows a stacked primary parallel struts system of a dual set of primary parallel struts system units anchoring the lower strut of the upper unit to the upper strut of the lower unit by employing an additional elbow hinge to facilitate this connection, according to an example embodiment of the present disclosure.

FIG. 96 illustrates an elevation view that shows a stacked primary parallel struts system 104 of a dual set 9600 of primary parallel struts system 104 units anchoring the lower strut 703 of the upper unit to the upper strut 702 of the lower unit by employing an additional elbow hinge 700 to facilitate this connection, according to an example embodiment of the present disclosure. Primary parallel struts system 104B may be defined as an arrangement of two or more primary parallel struts system 104 assemblies connected stacked on top of each other, extending the possible outer limits of the single folding strut movement 7100. Examples of primary parallel struts system 104B may include an accordion hinge. In some example embodiments, the primary parallel struts system 104B may be configured to comprise an upper strut 702, a lower strut 703, an elbow hinge 700, an object hinge 2200, and a foundation hinge 1800, allow vertical movement between the object 100 and the foundation system 200, maintain a fixed distance between the foundation hinge 1800 and the elbow hinge 700, maintain a fixed distance between the object hinge 2200 and the elbow hinge 700 and maintain the upper strut 702 and the lower strut 703 parallel to each other. In some example embodiments, if the primary parallel struts system 104B is absent then the allowable movement is limited to the outer arc of the single folding strut movement 7100. In some example embodiments, the primary parallel struts system 104B may comprise stacked struts 9902. Dual set 9600 may be defined as an arrangement of two primary parallel struts system 104 assemblies connected stacked on top of each other, extending the possible outer arc limits of the single folding strut movement 7100. In some example embodiments, the dual set 9600 may be configured to comprise a set of initial struts 10002 connected to a set of reserve struts 10000, have an allowable movement as illustrated by an arrangement of two single folding strut movement 7100 assemblies connected one on top of the other, allow extended vertical movement between the object 100 and the foundation system 200 and align each strut 601 in a parallel position to the strut 601 anchored to the foundation system 200. In some example embodiments, the dual set 9600 may be configured to extend the outer arc limits of a single folding strut movement 7100.

Figure 97:
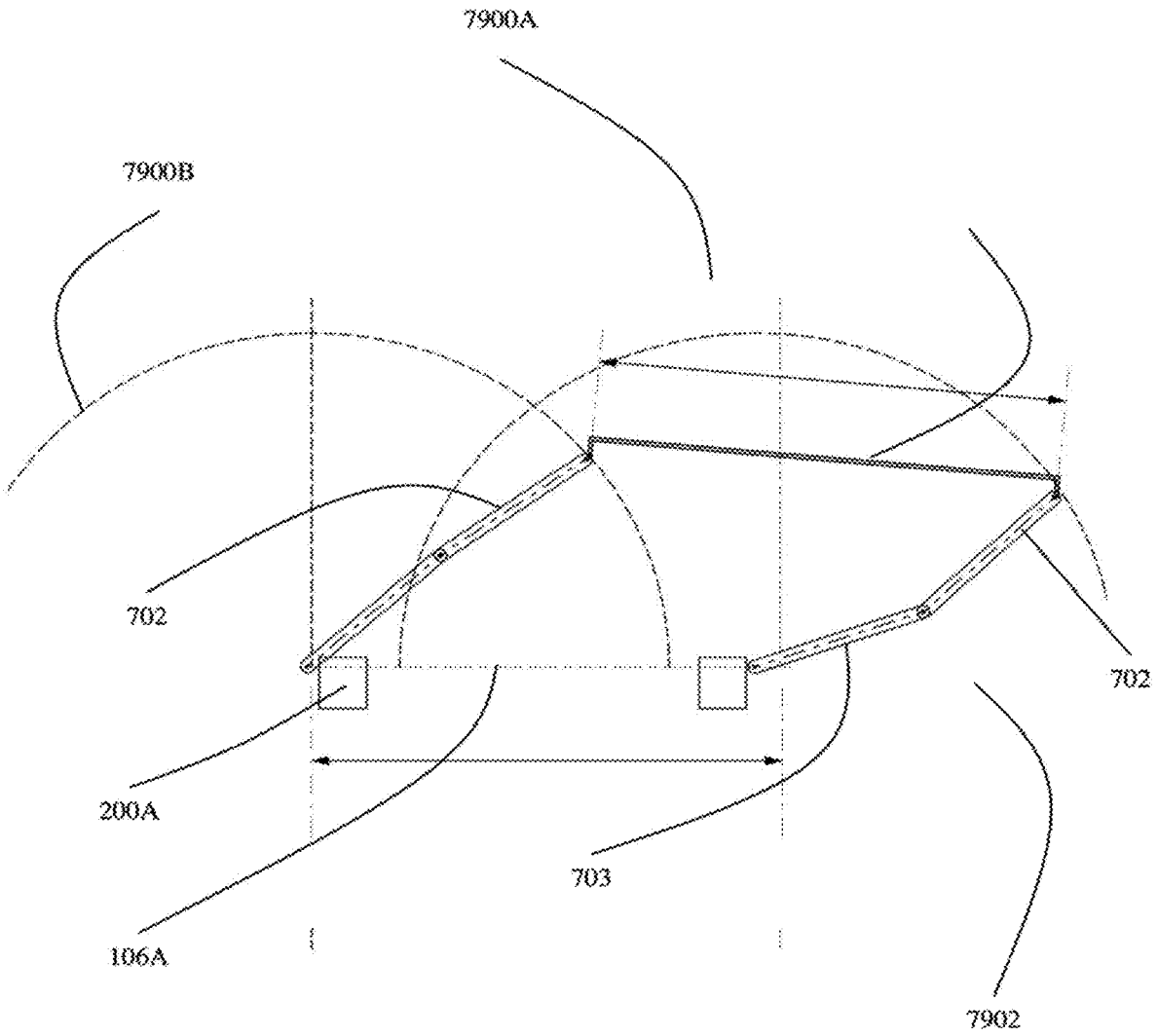
FIG. 97 illustrates an elevation view that shows a diagram of each upper strut movement arc for two primary parallel struts system units arranged in a same facing elbow system. The two arrows represent the constant distance between the two object hinge connection points as the platform separates from the foundation, made possible by the rigidity of the platform. This platform rigidity and the tethering movement allowable by the extension of each primary parallel struts system creates a resultant zone for an allowable platform movement arc. In this illustration the object platform system is positioned laterally relative to the foundation and is in an undesirable limited platform position where the object platform system is unlikely to return to its original platform at resting position, and likely to result in a platform at fail position when the external force has subsided, according to an example embodiment of the present disclosure.

FIG. 97 illustrates an elevation view that shows a diagram of each upper strut movement arc 1703 for two primary parallel struts system 104 units arranged in a same facing elbow system 9800. The two arrows represent the constant distance between the two object hinge 2200 connection points as the platform separates from the foundation, made possible by the rigidity of the platform. This platform rigidity and the tethering movement allowable by the extension of each primary parallel struts system 104 creates a resultant zone for an allowable platform movement arc 7900. In this illustration the object platform system 1500 is positioned laterally relative to the foundation and is in an undesirable limited platform position 400 where the object platform system 1500 is unlikely to return to its original platform at resting position 7901, and likely to result in a platform at fail position 7902 when the external force 500 has subsided, according to an example embodiment of the present disclosure. Platform movement arc 7900A may be defined as a diagram showing the possible range of movement and tilt that the object platform system 1500 has relative to the foundation system 200 when two or more primary parallel struts system 104 assemblies are arranged in a same facing elbow system 9800. In some example embodiments, the platform movement arc 7900A may be configured to illustrate the possible range of arc motion of the object hinge 2200 in a primary parallel struts system 104.

Figure 98:
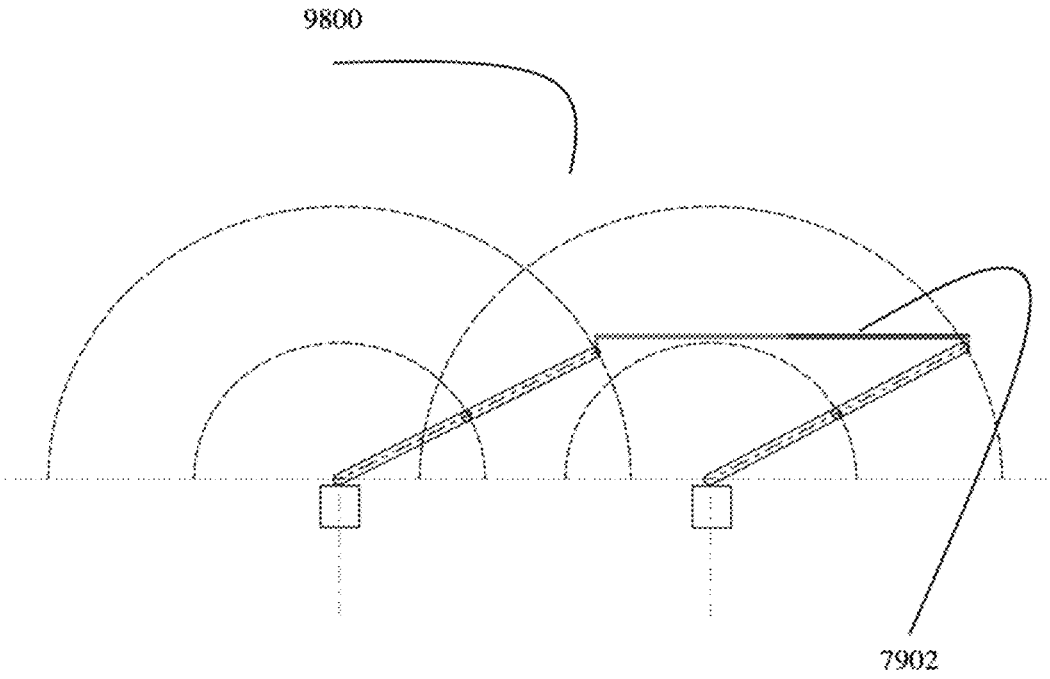
FIG. 98 illustrates a perspective view that shows the ice cream sandwich in a melted state, according to an example embodiment of the present disclosure.

FIG. 98 illustrates a perspective view that shows the ice cream sandwich in a melted state, according to an example embodiment of the present disclosure. same facing elbow system 9800 may be defined as the arrangement of two or more primary parallel struts system 104 assemblies such that the elbow hinge 700 of one folds in a similar if not parallel direction to the others when approaching its resting position. In some example embodiments, the same facing elbow system 9800 may be configured to position two or more primary parallel struts system 104 assemblies to duplicate the motion and elbow hinge 700 fold direction of each other primary parallel struts system 104, be anchored to the object 100 and be anchored to the foundation system 200. In some example embodiments, the same facing elbow system 9800 may be configured to position two or more primary parallel struts system 104 assemblies such that the single folding strut movement 7100 of one compliments and does not restrict the single folding strut movement 7100 or one or more of the others. In some example embodiments, the same facing elbow system 9800 may be positioned according to the cleat positioning system 3701 locating the upper and lower hinge block system 2700 for each primary parallel struts system 104 in matching grid or parallel geometric arrangements. In some example embodiments, the same facing elbow system 9800 may be coupled with the foundation system 200 and the object 100 or object platform system 1500. In some example embodiments, the same facing elbow system 9800 may interact with the foundation system 200 and the object platform system 1500.

Figure 99:
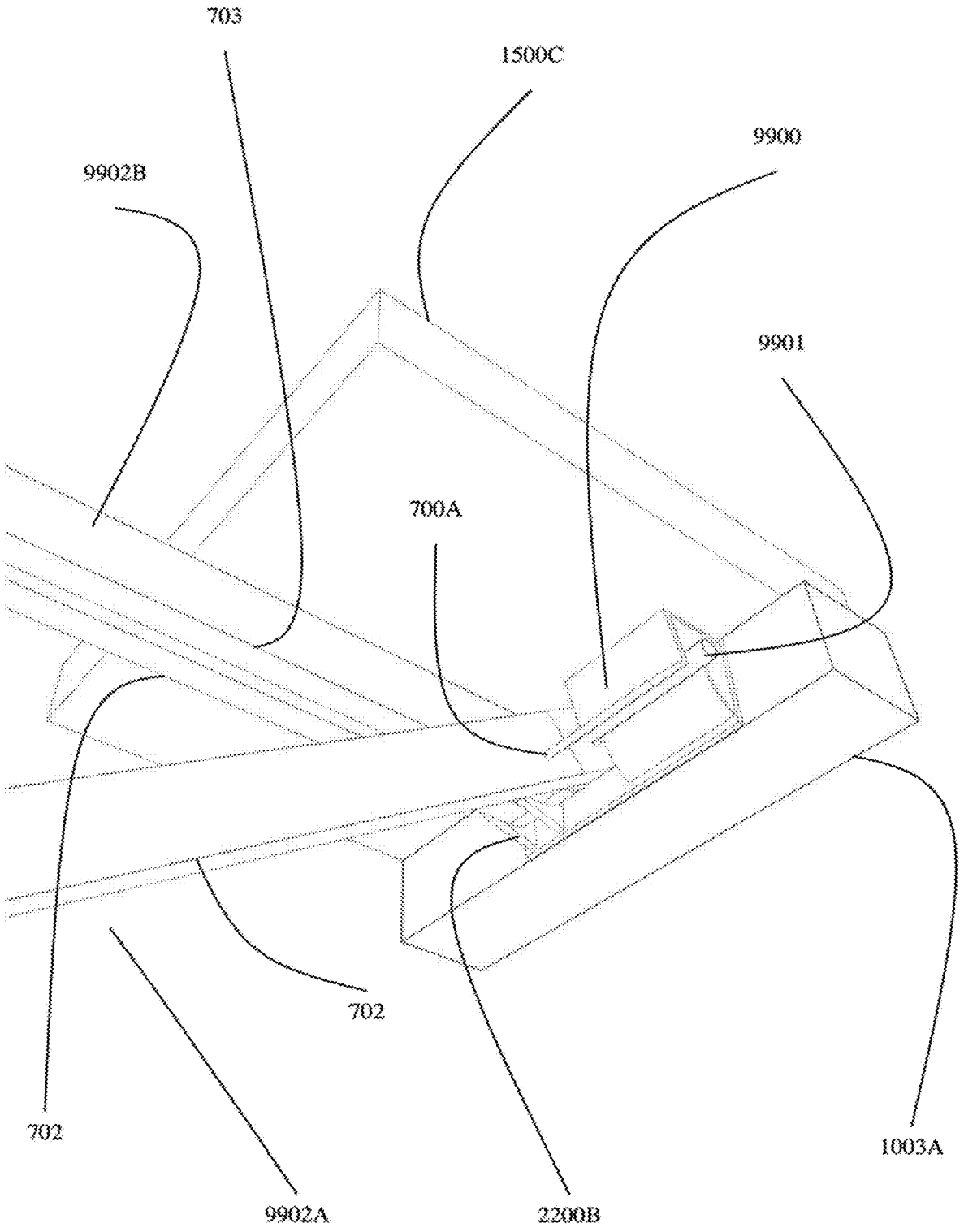
FIG. 99 illustrates a perspective view that shows a pin clip engaged in securing the extended hinge pin which also serves as the second elbow hinge that connects the upper strut of the initial set of the stacked struts to the lower strut or the reserved set. The pin clip is configured to release the extended hinge pin and activate the extended range of motion allowed by this second primary parallel struts system. This provides additional protection against water inundation of the object whenever the elevation of the rising water begins to exceed the vertical limits of the upper strut movement arc. The pin clip is configured to re-attach the extended hinge pin as the rising water recedes, and remains ready for a future extended pin release when needed, according to an example embodiment of the present disclosure.

FIG. 99 illustrates a perspective view that shows a pin clip 9900 engaged in securing the extended hinge pin 9901 which also serves as the second elbow hinge 700 that connects the upper strut 702 of the initial set of the stacked struts 9902 to the lower strut 703 or the reserved set. The pin clip 9900 is configured to release the extended hinge pin 9901 and activate the extended range of motion allowed by this second primary parallel struts system 104. This provides additional protection against water inundation of the object 100 whenever the elevation of the rising water 1202 begins to exceed the vertical limits of the upper strut movement arc 1703. The pin clip 9900 is configured to re-attach the extended hinge pin 9901 as the rising water 1202 recedes, and remains ready for a future extended pin release when needed, according to an example embodiment of the present disclosure. In some example embodiments, the pin clip 9900 may be configured to re-anchor the extended hinge pin 9901, release the extended hinge pin 9901 and anchor the extended hinge pin 9901. In some example embodiments, the extended hinge pin 9901 may be configured to allow vertical movement between the initial struts 10002 and the reserve struts 10000, release from the pin clip 9900, attach to the pin clip 9900 and anchor the reserve struts 10000 to the initial struts 10002. Stacked struts 9902A may be defined as an arrangement of two or more primary parallel struts system 104 assemblies connected stacked on top of each other, extending the possible outer limits of the single folding strut movement 7100 where the upper primary parallel struts system 104 are the reserve struts 10000 which remain inactive unless the lower primary parallel struts system 104 which are the initial struts 10002 are extended to reach their outer arc of single folding strut movement 7100 and then engage the reserve struts 10000 to increase the separation between the object 100 and the foundation system 200. In some example embodiments, the stacked struts 9902A may be configured to extend the possible outer limits of the single folding strut movement 7100, comprise two or more primary parallel struts system 104 assemblies connected one on top of the other, align the strut 601 anchored to the object hinge 2200 in a parallel position to the strut 601 anchored to the foundation system 200 and allow vertical movement between the object 100 and the foundation system 200. In some example embodiments, the stacked struts 9902A may comprise initial struts 10002. Stacked struts 9902B may be defined as an arrangement of two or more primary parallel struts system 104 assemblies connected stacked on top of each other, extending the possible outer limits of the single folding strut movement 7100 where the upper primary parallel struts system 104 which area the reserve struts 10000 remain inactive unless the lower primary parallel struts system 104 reaches the outer limits of their arc of single folding strut movement 7100 and engage the reserve struts 10000 to extend. In some example embodiments, if the stacked struts 9902B is absent then the outer limits of movement for each primary parallel struts system 104 is restricted to the outer arc of its single folding strut movement 7100. In some example embodiments, the stacked struts 9902B remain on standby until needed to extend the outer arc of the single folding strut movement 7100 of the lower companion primary parallel struts system 104 or when pulled into action extend the arc of the single folding strut movement 7100 allowing the object 100 to separate further from the foundation system 200. In some example embodiments, the stacked struts 9902B may be positioned above the lower primary parallel struts system 104 or below the object 100. In some example embodiments, the stacked struts 9902B may be coupled with the object 100, the lower primary parallel struts system 104, the clipping system 10001, the object hinge 2200 or the object platform system 1500. In some example embodiments, the stacked struts 9902B may interact in multiple ways: it may interact with the lower primary parallel struts system 104, it also may interact with the clipping system 10001 and it may interact with the object 100. In some example embodiments, the stacked struts 9902B may comprise reserve struts 10000 or clipping system 10001.

Figure 100:
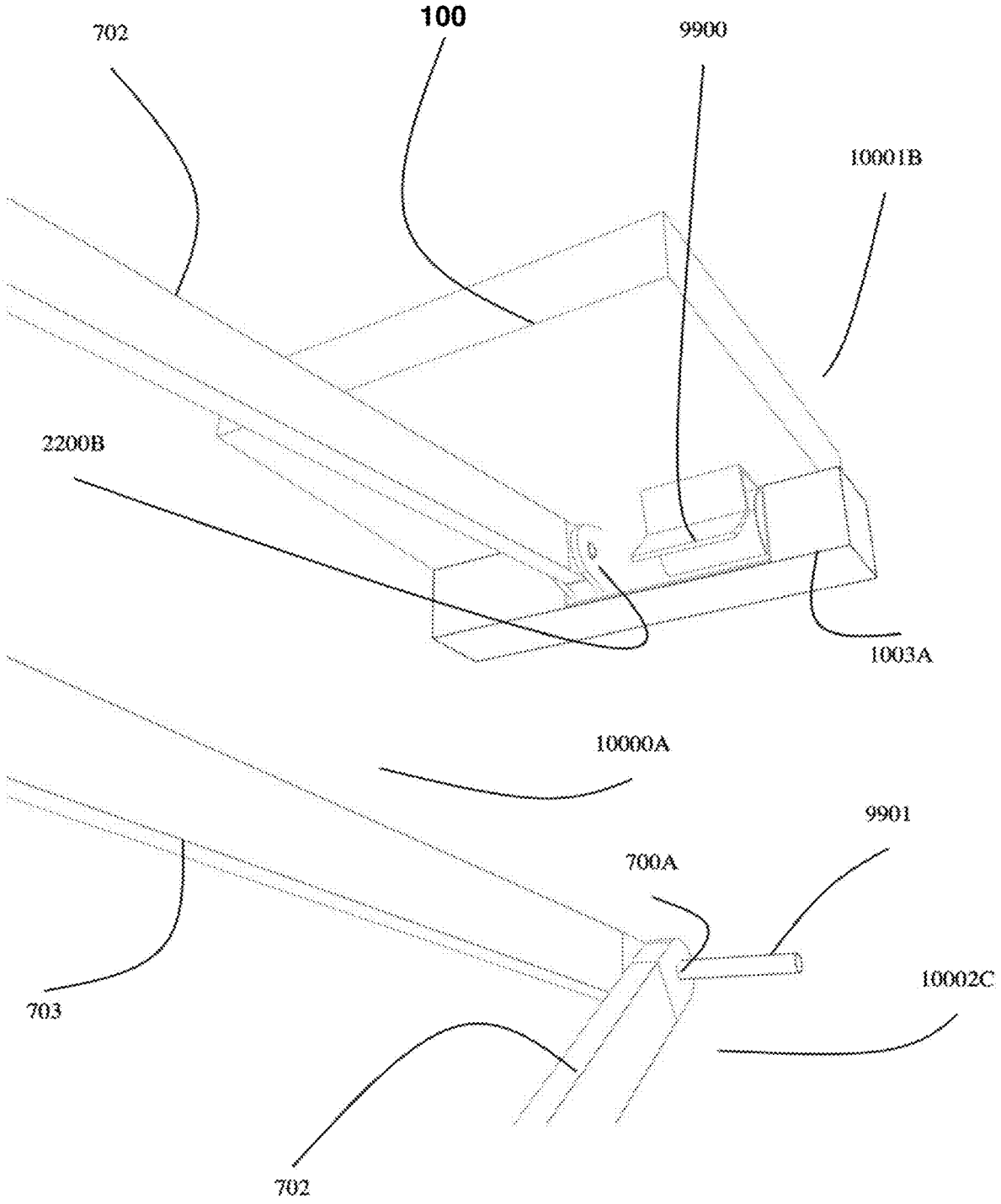
FIG. 100 illustrates a perspective view that shows a set of reserve struts in a stacked struts system that have been engaged by the upper strut of the set of initial struts reaching the upper limits of their upper strut movement arc which unclips the extended hinge pin from the pin clip engaged in securing the extended hinge pin which also serves as the second elbow hinge that connects the upper strut of the initial set of the stacked struts to the lower strut or the reserved set. This action releases the extended hinge pin and activates an extended range of motion allowed by this second primary parallel struts system, increasing the allowable vertical separation of the object from the foundation system. This increase in vertical separation provides additional protection against water inundation of the object whenever the elevation of the rising water exceeds the vertical limits of the upper strut movement arc of the set of initial struts. The pin clip is configured to re-attach the extended hinge pin as the rising water recedes, and remains ready for a future extended pin release when needed, according to an example embodiment of the present disclosure.

FIG. 100 illustrates a perspective view that shows a set of reserve struts 10000 in a stacked struts 9902 system that have been engaged by the upper strut 702 of the set of initial struts 10002 reaching the upper limits of their upper strut movement arc 1703 which unclips the extended hinge pin 9901 from the pin clip 9900 engaged in securing the extended hinge pin 9901 which also serves as the second elbow hinge 700 that connects the upper strut 702 of the initial set of the stacked struts 9902 to the lower strut 703 or the reserved set. This action releases the extended hinge pin 9901 and activates an extended range of motion allowed by this second primary parallel struts system 104, increasing the allowable vertical separation of the object 100 from the foundation system 200. This increase in vertical separation provides additional protection against water inundation of the object 100 whenever the elevation of the rising water 1202 exceeds the vertical limits of the upper strut movement arc 1703 of the set of initial struts 10002. The pin clip 9900 is configured to re-attach the extended hinge pin 9901 as the rising water 1202 recedes, and remains ready for a future extended pin release when needed, according to an example embodiment of the present disclosure. In some example embodiments, the reserve struts 10000A may be configured to allow vertical movement between the object 100 and the foundation system 200, deploy when the initial struts 10002 are fully extended, anchor to the initial struts 10002 and anchor to the object 100. Clipping system 10001B may be defined as a device, typically flexible or worked by a spring that is specifically shaped for holding the reserve struts 10000 together and in place by securing to an extended hinge pin 9901. Examples of clipping system 10001B may include a fastener. In some example embodiments, the clipping system 10001B may be configured to re-anchor the reserve struts 10000, release the reserve struts 10000 and anchor the reserve struts 10000. In some example embodiments, if the clipping system 10001B is absent then the struts clip 10300 can secure the reserve struts 10000 in place. In some example embodiments, the clipping system 10001B may be configured to secure the upper hinge of the reserve struts 10000 when not engaged, to release the upper hinge of the reserve struts 10000 when engaged and to re-secure the upper hinge of the reserve struts 10000 when the object 100 returns to its resting position on the foundation system 200. In some example embodiments, the clipping system 10001B may be positioned above the reserve struts 10000, below the object 100 or above the initial struts 10002. In some example embodiments, the clipping system 10001B may be coupled with object 100, object platform system 1500, platform sill 1003 or sill 704. In some example embodiments, the clipping system 10001B may comprise pin clip 9900 or extended hinge pin 9901. Initial struts 10002C may be defined as engaging the reserve struts 10000 when the initial struts 10002 have extended to the limit of their single folding strut movement 7100. In some example embodiments, the initial struts 10002C may be configured to anchor to the object 100 through the reserve struts 10000, anchor to the reserve struts 10000, anchor to the foundation system 200, allow vertical movement between the object 100 and the foundation system 200 and align the strut 601 anchored to the object hinge 2200 in a parallel position to the strut 601 anchored to the foundation system 200.

Figure 101:
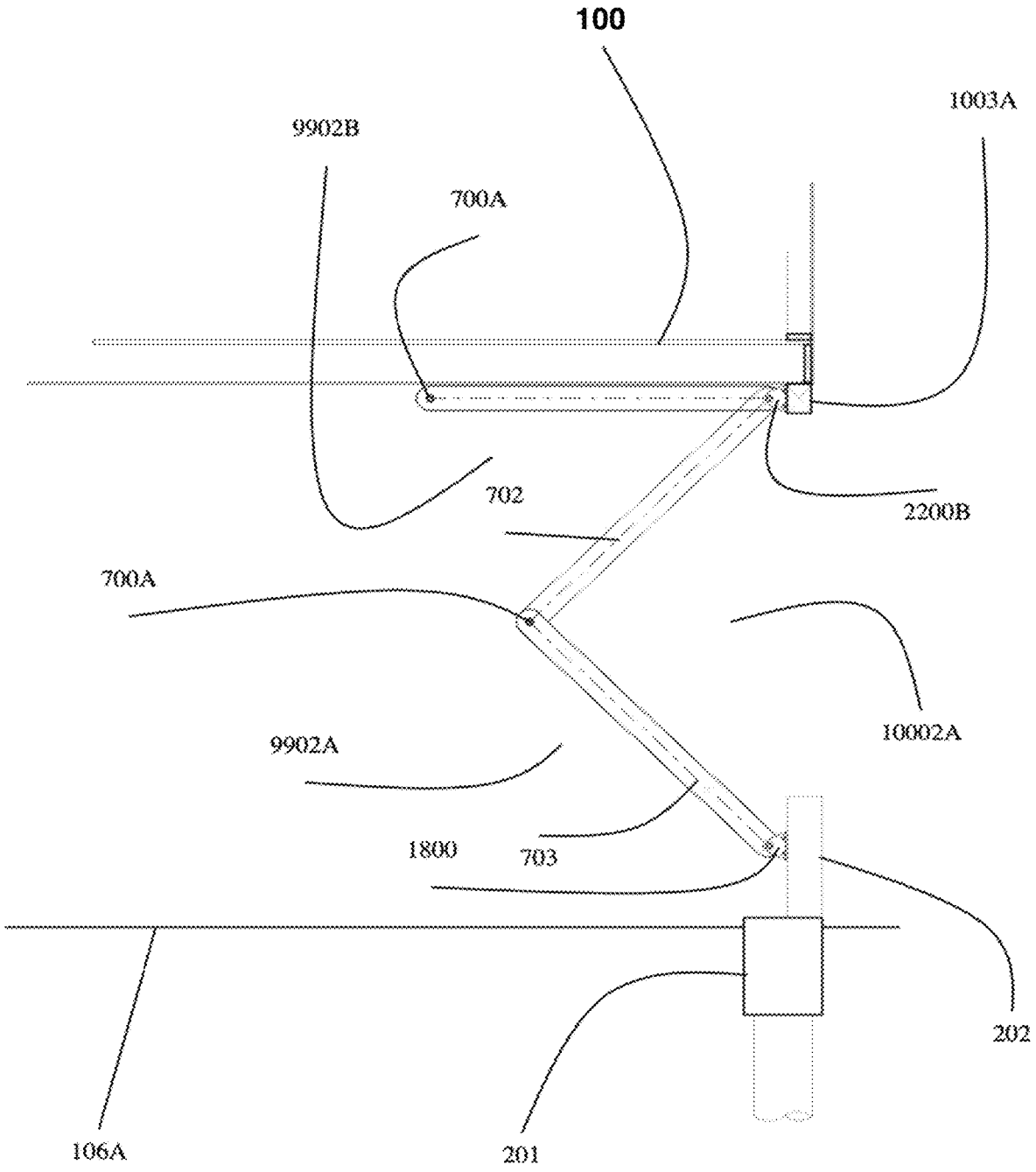
FIG. 101 illustrates a section elevation view that shows a floating house equipped with stacked struts with the set of reserve struts adjacent to the object platform system and the set of initial struts are engaged in tethering the object to a pier on grade beam system. In this illustration the upper strut of the set of initial struts has not reached the outer limits of its upper strut movement arc, and hence the set of reserve struts have not been engaged, according to an example embodiment of the present disclosure.

FIG. 101 illustrates a section elevation view that shows a floating house equipped with stacked struts 9902 with the set of reserve struts 10000 adjacent to the object platform system 1500 and the set of initial struts 10002 are engaged in tethering the object 100 to a pier on gradebeam system 202. In this illustration the upper strut 702 of the set of initial struts 10002 has not reached the outer limits of its upper strut movement arc 1703, and hence the set of reserve struts 10000 have not been engaged, according to an example embodiment of the present disclosure. Initial struts 10002A may be defined as in an extended position when allowing the object 100 to separate from the foundation system 200. In some example embodiments, the initial struts 10002A may be configured to anchor to the object 100 through the reserve struts 10000, anchor to the reserve struts 10000, anchor to the foundation system 200, allow vertical movement between the object 100 and the foundation system 200 and align the strut 601 anchored to the object hinge 2200 in a parallel position to the strut 601 anchored to the foundation system 200.

Figure 102:
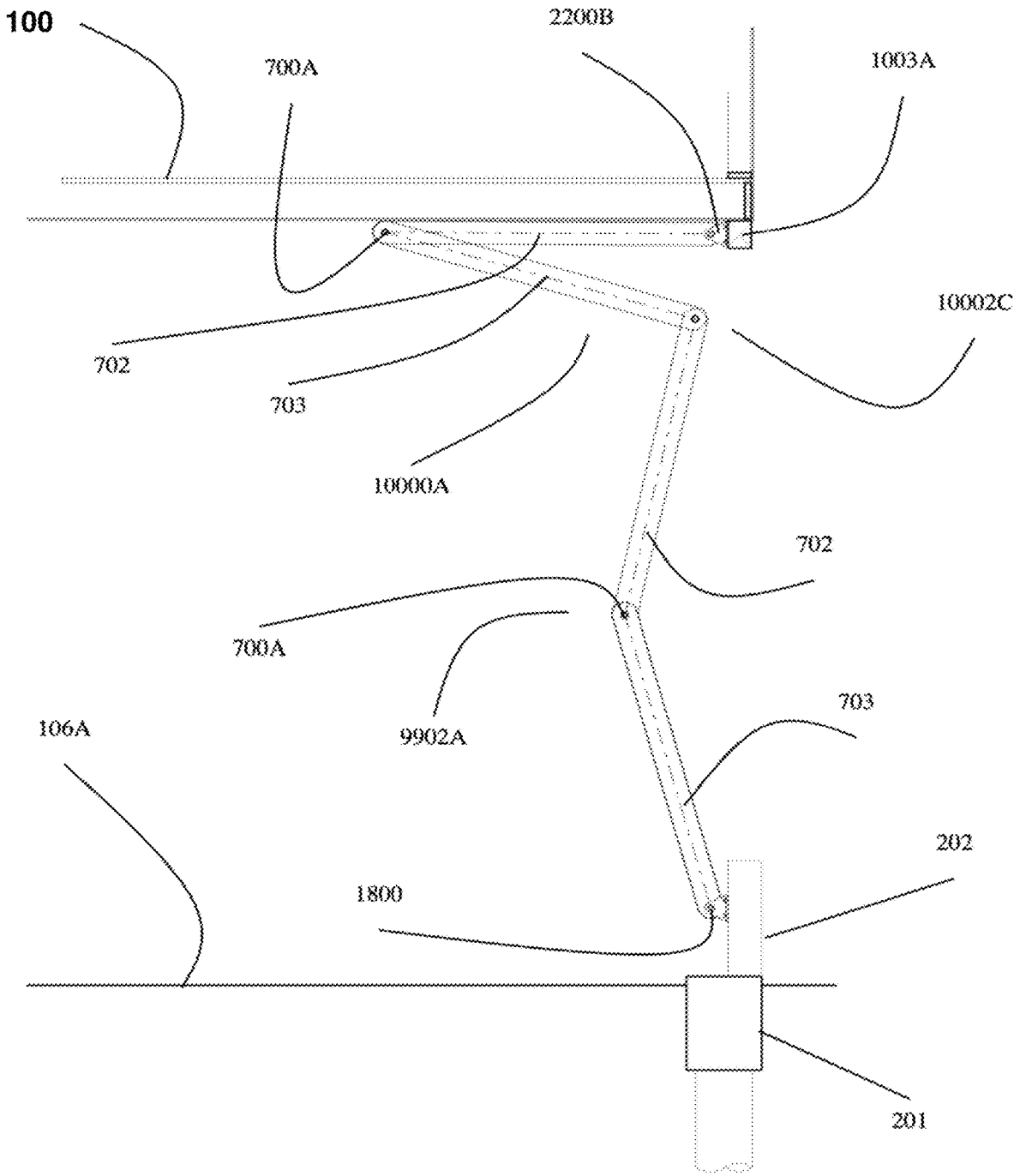
FIG. 102 illustrates a section elevation view that shows a floating house equipped with stacked struts. Both sets of struts are engaged in tethering the object to a pier on gradebeam system. In this illustration the upper strut of the set of initial struts has reached the outer limits of its upper strut movement arc and engaged the set of reserve struts in order to increase the vertical separation of the object from the foundation system, according to an example embodiment of the present disclosure.

FIG. 102 illustrates a section elevation view that shows a floating house equipped with stacked struts 9902. Both sets of struts are engaged in tethering the object 100 to a pier on gradebeam system 202. In this illustration the upper strut 702 of the set of initial struts 10002 has reached the outer limits of upper strut movement arc 1703 and engaged the set of reserve struts 10000 in order to increase the vertical separation of the object 100 from the foundation system 200, according to an example embodiment of the present disclosure.

Figure 103:
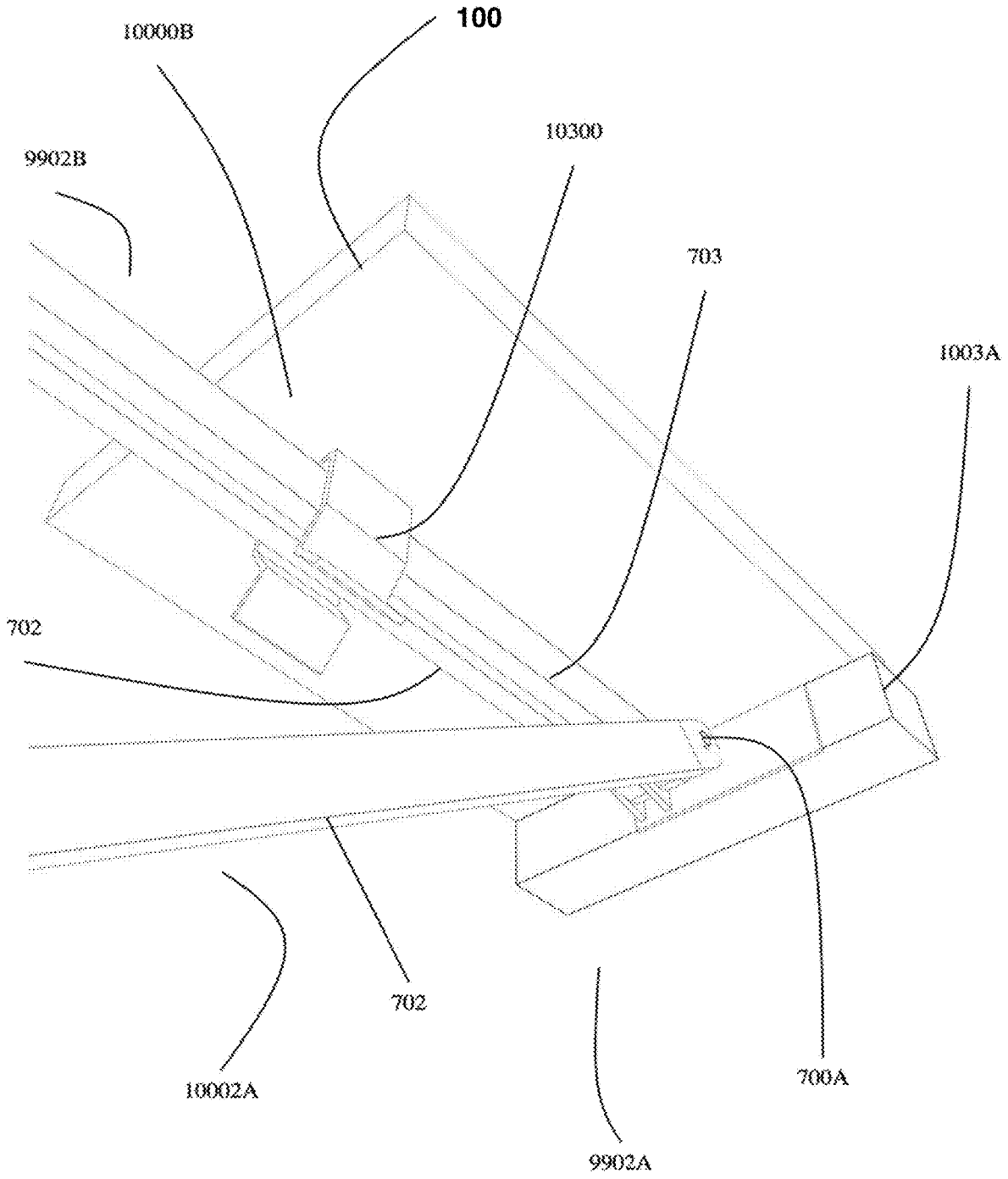
FIG. 103 illustrates a perspective view that shows a set of stacked struts with the set of reserve struts clipped to the struts clip in a condition where the set of initial struts are extended within the limits of their upper strut movement arc. In this condition the set of reserve struts remain clipped and ready when needed to engage and increase the limit of separation between the object and the foundation, according to an example embodiment of the present disclosure.

FIG. 103 illustrates a perspective view that shows a set of stacked struts 9902 with the set of reserve struts 10000 clipped to the struts clip 10300 in a condition where the set of initial struts 10002 are extended within the limits of their upper strut movement arc 1703. In this condition the set of reserve struts 10000 remain clipped and ready when needed to engage and increase the limit of separation between the object 100 and the foundation, according to an example embodiment of the present disclosure. Reserve struts 10000B may be defined as clipped when not needed to extend the separation between the object 100 and the foundation system 200. In some example embodiments, the reserve struts 10000B may be configured to allow vertical movement between the object 100 and the foundation system 200, deploy when the initial struts 10002 are fully extended, anchor to the initial struts 10002 and anchor to the object 100. Struts clip 10300 may be defined as a device, typically flexible or worked by a spring, for holding the reserve struts 10000 together and in place. In some example embodiments, the struts clip 10300 may be configured to re-anchor the reserve struts 10000, anchor the reserve struts 10000 and release the reserve struts 10000.

Figure 104:
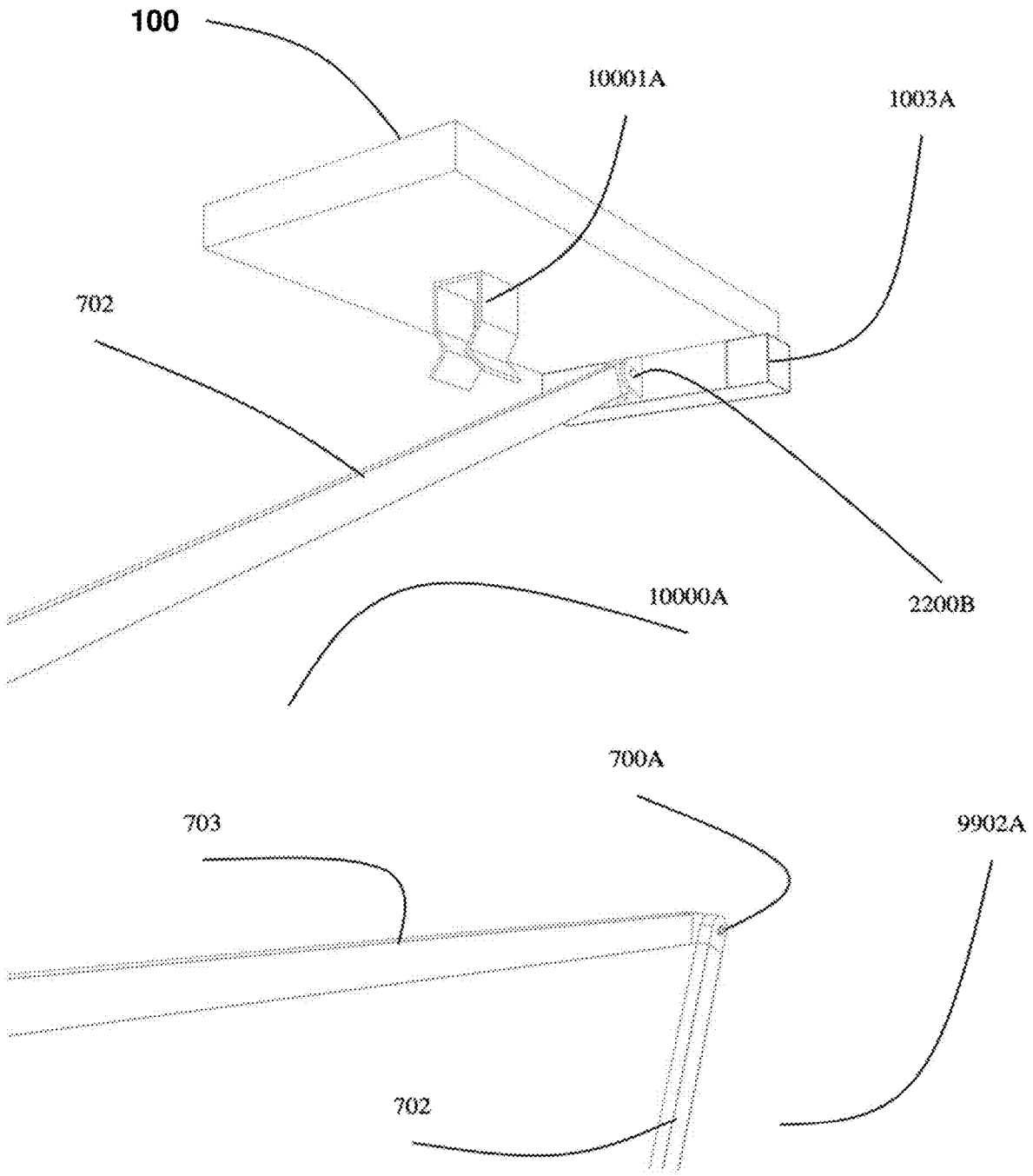
FIG. 104 illustrates a perspective view that shows an object platform system equipped with stacked struts. Both sets of struts are engaged in tethering the object. In this illustration the upper strut of the set of initial struts has reached the outer limits of its upper strut movement arc and has engaged the set of reserve struts in order to increase the vertical separation of the object from the foundation system. The two sets of primary parallel struts system units are anchored to each other with an elbow hinge, according to an example embodiment of the present disclosure.

FIG. 104 illustrates a perspective view that shows an object platform system 1500 equipped with stacked struts 9902. Both sets of struts are engaged in tethering the object 100. In this illustration the upper strut 702 of the set of initial struts 10002 has reached the outer limits of its upper strut movement arc 1703 and has engaged the set of reserve struts 10000 in order to increase the vertical separation of the object 100 from the foundation system 200. The two sets of primary parallel struts system 104 units are anchored to each other with an elbow hinge 700, according to an example embodiment of the present disclosure. Clipping system 10001A may be defined as a device, typically flexible or worked by a spring that is specifically shaped for holding the reserve struts 10000 together and in place. Examples of clipping system 10001A may include a fastener. In some example embodiments, the clipping system 10001A may be configured to re-anchor the reserve struts 10000, release the reserve struts 10000 and anchor the reserve struts 10000. In some example embodiments, if the clipping system 10001A is absent then the pin clip 9900 can secure the reserve struts 10000 in place. In some example embodiments, the clipping system 10001A may be configured to secure the reserve struts 10000 when not engaged in extending the separation between the object 100 and the foundation system 200, release the reserve struts 10000 when engaged in extending the separation between the object 100 and the foundation system 200 and re-secure the reserve struts 10000 when the object 100 returns to its resting position on the foundation system 200. In some example embodiments, the clipping system 10001A may be positioned below the object 100, above the reserve struts 10000 or above the initial struts 10002. In some example embodiments, the clipping system 10001A may be coupled with the object 100, the object platform system 1500, the hull bottom sheathing 4301 or the hull bottom framing 5101. In some example embodiments, the clipping system 10001A may comprise struts clip 10300.

Figure 105:
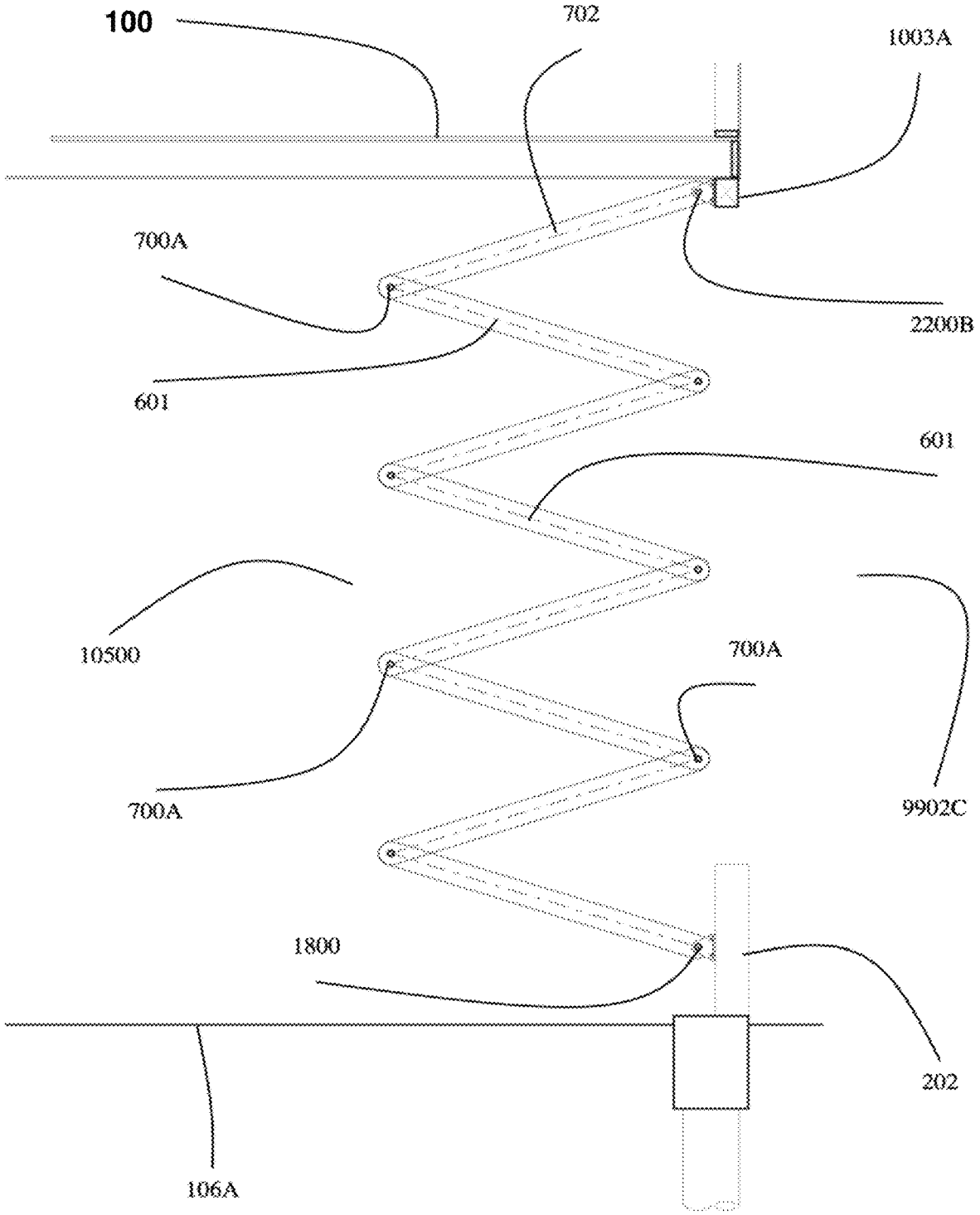
FIG. 105 illustrates a section elevation view that shows a floating house removed from and tethered to its foundation using a series of stacked struts connected to each other using elbow hinge units. As with all primary parallel struts system units, the maximum separation from the resting position on the foundation is determined by adding the lengths of each strut in the system. For example, to accommodate a storm surge of sixteen feet, using a single primary parallel struts system would result in each strut being eight feet long. A series of stacked struts by comparison would result in each strut being only two feet long. For the same anticipated maximum vertical separation, the amount of horizontal area to store a system of stacked struts is reduced, according to an example embodiment of the present disclosure.

FIG. 105 illustrates a section elevation view that shows a floating house removed from and tethered to its foundation using a series of stacked struts 9902 connected to each other using elbow hinge 700 units. As with all primary parallel struts system 104 units, the maximum separation from the resting position on the foundation is determined by adding the lengths of each strut 601 in the system. For example, to accommodate a storm surge of sixteen feet, using a single primary parallel struts system 104 would result in each strut 601 being eight feet long. A series of stacked struts 9902 by comparison would result in each strut 601 being only two feet long. For the same anticipated maximum vertical separation, the amount of horizontal area to store a system of stacked struts 9902 is reduced, according to an example embodiment of the present disclosure. Multiple set 10500 may be defined as an arrangement of three or more primary parallel struts system 104 assemblies connected stacked on top of each other, extending the possible outer arc limits of the single folding strut movement 7100. Examples of the multiple set 10500 may include a scissors hinge and an accordion hinge. In some example embodiments, the multiple set 10500 may be configured to comprise a set of initial struts 10002 connected to multiple sets of connected reserve struts 10000, extend the possible outer arc limits of the single folding strut movement 7100, have an allowable movement as illustrated by an arrangement of multiple single folding strut movement 7100 assemblies connected one on top of the other, align each strut 601 in a parallel position to the strut 601 anchored to the foundation system 200 and allow vertical movement between the object 100 and the foundation system 200. In some example embodiments, the multiple set 10500 extend the outer arc limits of a single folding strut movement 7100. Stacked struts 9902C may be defined as an arrangement of two or more primary parallel struts system 104 assemblies connected stacked on top of each other, extending the possible outer arc limits of the single folding strut movement 7100. Examples of stacked struts 9902C may include a scissors hinge and an accordion hinge. In some example embodiments, the stacked struts 9902C may be configured to extend the possible outer limits of the single folding strut movement 7100, comprise two or more primary parallel struts system 104 assemblies connected one on top of the other, align the strut 601 anchored to the object hinge 2200 in a parallel position to the strut 601 anchored to the foundation system 200 and allow vertical movement between the object 100 and the foundation system 200. In some example embodiments, if the stacked struts 9902C is absent then the allowable movement is limited to the outer arc of the single folding strut movement 7100. In some example embodiments, the stacked struts 9902C may be configured to extend the outer arc limits of a single folding strut movement 7100. In some example embodiments, the stacked struts 9902C may comprise dual set 9600 or multiple set 10500.

Figure 106:
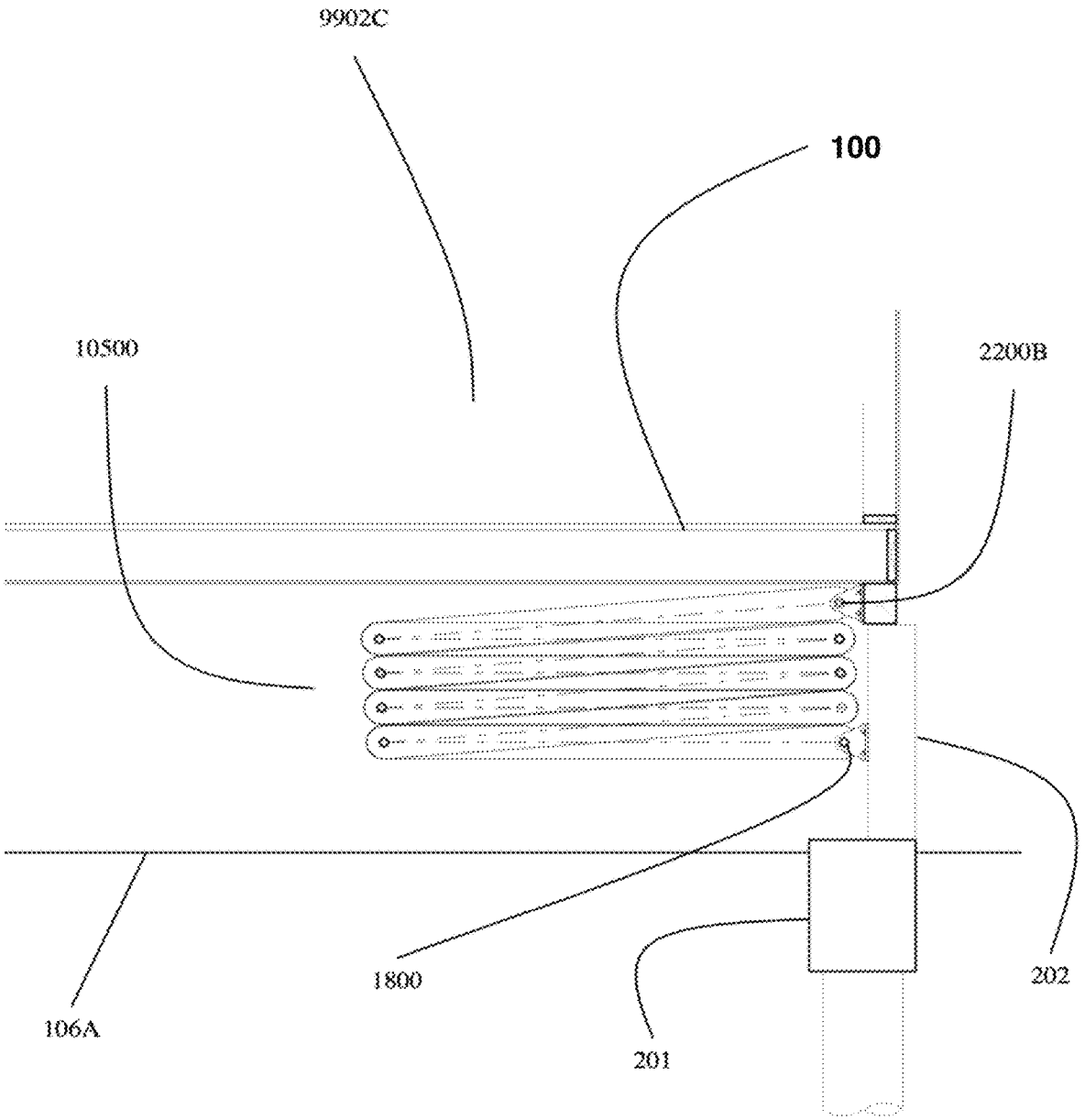
FIG. 106 illustrates a section elevation view that shows a house resting on its foundation while tethered to its foundation using a series of stacked struts connected to each other using elbow hinge units. As with all primary parallel struts system units, the maximum separation from the resting position on the foundation is determined by adding the lengths of each strut in the system. For example, to accommodate a storm surge of sixteen feet, using a single primary parallel struts system would result in each strut being eight feet long. A series of stacked struts by comparison would result in each strut being only two feet long. For the same anticipated maximum vertical separation, the amount of horizontal area to store a system of stacked struts is reduced, according to an example embodiment of the present disclosure.

FIG. 106 illustrates a section elevation view that shows a house resting on its foundation while tethered to its foundation using a series of stacked struts 9902 connected to each other using elbow hinge 700 units. As with all primary parallel struts system 104 units, the maximum separation from the resting position on the foundation is determined by adding the lengths of each strut 601 in the system. For example, to accommodate a storm surge of sixteen feet, using a single primary parallel struts system 104 would result in each strut 601 being eight feet long. A series of stacked struts 9902 by comparison would result in each strut 601 being only two feet long. For the same anticipated maximum vertical separation, the amount of horizontal area to store a system of stacked struts 9902 is reduced, according to an example embodiment of the present disclosure.

Figure 107:
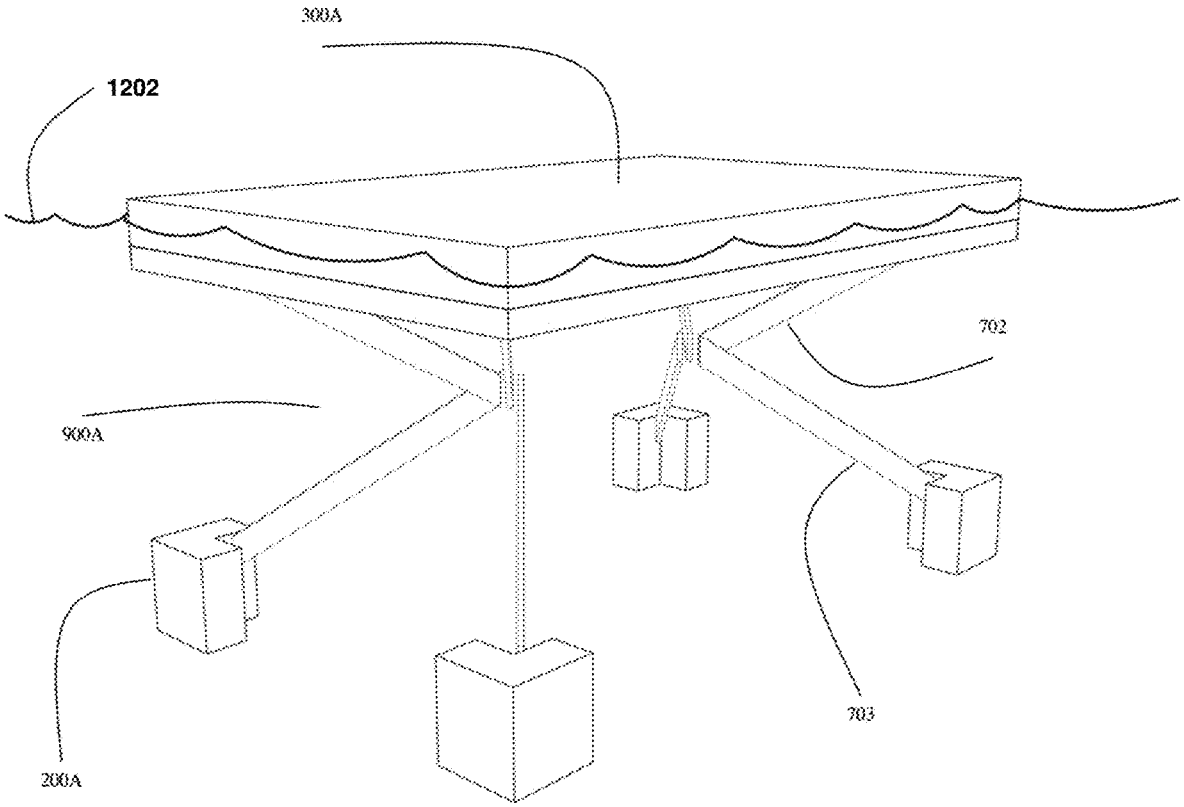
FIG. 107 illustrates a perspective view that shows a supporting platform floating in rising water and tethered to its foundation by four primary parallel struts system units arranged in an opposing elbow system each with an inward acting elbow. A buoyant platform such as this can be used to safely float a vehicle, livestock, or any other items susceptible to flood inundation, according to an example embodiment of the present disclosure.

FIG. 107 illustrates a perspective view that shows a supporting platform floating in rising water 1202 and tethered to its foundation by four primary parallel struts system 104 units arranged in an opposing elbow system 900 each with an inward acting elbow 901. A buoyant platform such as this can be used to safely float a vehicle, livestock, or any other items susceptible to flood inundation, according to an example embodiment of the present disclosure. Object type 300A may be defined as a raised level surface on which people or things can stand. Examples of object type 300A may include a parking pad, an animal pen, a stable stall, a raft, a boat pier and a boat slip. In some example embodiments, the object type 300A may be configured to be an object 100 and be susceptible to movement from an external force 500. In some example embodiments, the object type 300A may be configured to support another object. In some example embodiments, the object type 300A may be positioned above the stabilization system 108 or above the foundation system 200. In some example embodiments, the object type 300A may be coupled with the stabilization system 108.

Figure 108:
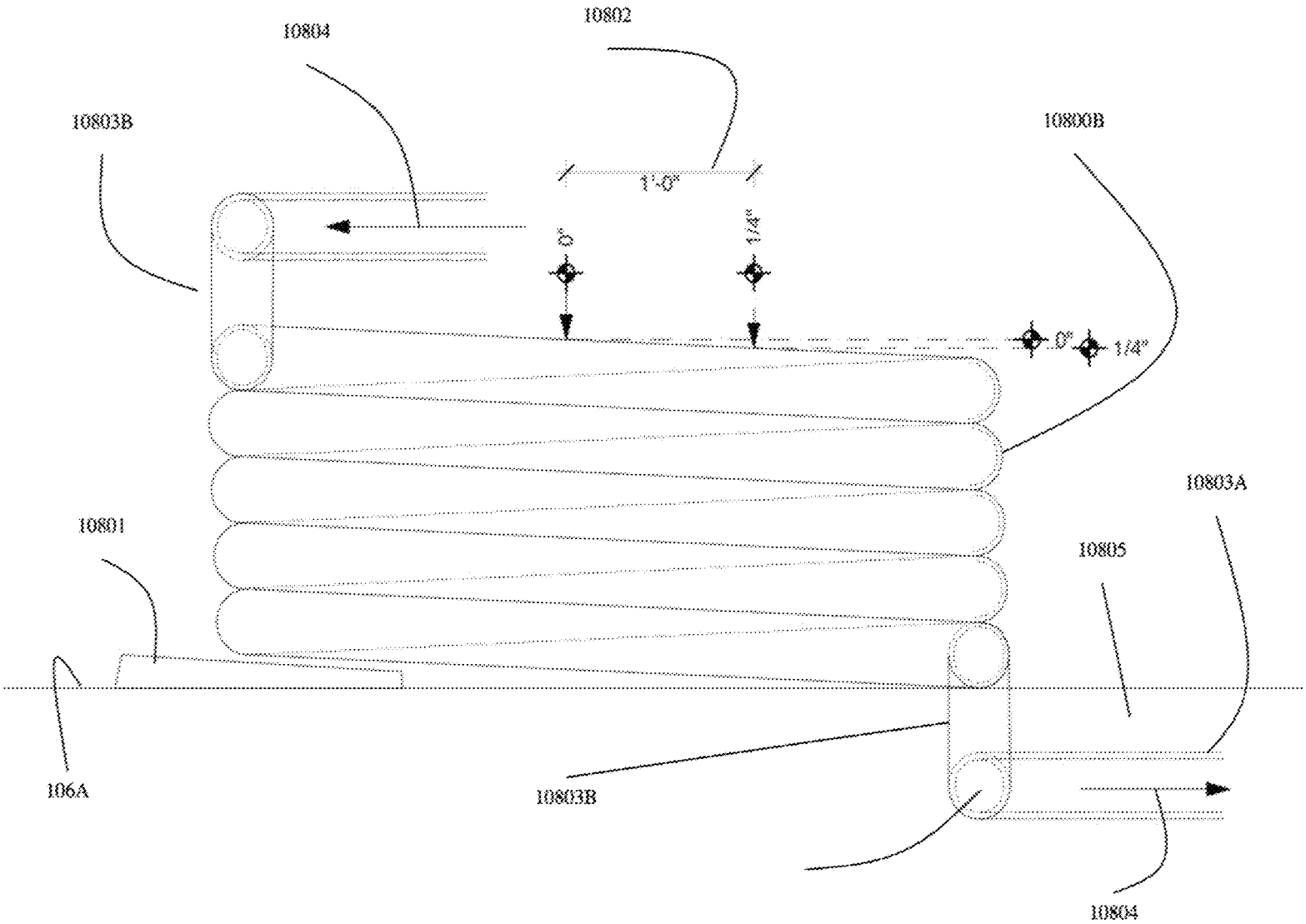
FIG. 108 illustrates an elevation view that shows a coiled sewer conduit configured in a spiral of a diameter corresponding with the diameter of the conduit such that when coiled and at rest, that the resultant slope inside the conduit is at least ¼ inch per foot of run. This minimum slope is provided at bottom most spiral by a wedged slope block located on top of grade. The utility service connection device connecting the coiled sewer conduit to the house is configured to rotate in the X axis on one end and in the Y axis at the other end. This will prevent any potential binding forces from being transmitted to the coiled sewer conduit from any asymmetrical movement of the house due to wave or wind action. The utility service connection device at the on grade location also allows fora similar free rotation of its connection to the hard connection to the underground service, according to an example embodiment of the present disclosure.

FIG. 108 illustrates an elevation view that shows a coiled sewer conduit 10800 configured in a spiral of a diameter corresponding with the diameter of the conduit such that when coiled and at rest, that the resultant slope inside the conduit is at least ¼ inch per foot of run. This minimum slope is provided at bottom most spiral by a wedged slope block 10801 located on top of grade 106. The utility service connection 10803 device connecting the coiled sewer conduit 10800 to the house is configured to rotate in the X axis on one end and in the Y axis at the other end. This will prevent any potential binding forces from being transmitted to the coiled sewer conduit 10800 from any asymmetrical movement of the house due to wave or wind action. The utility service connection 10803 device at the on grade 106 location also allows fora similar free rotation of its connection to the hard connection 14001 to the underground service 10805, according to an example embodiment of the present disclosure. In some example embodiments, the coiled sewer conduit 10800B may be configured to provide the utility services of sewer 10804 to the object 100 during the absence of rising water 1202, provide the utility services of sewer 10804 to the object 100 during the presence of rising water 1202, have at resting position a sufficient diameter that when coiled to result in a drain slope 10802 of ¼ inch per foot, remain connected to the underground service 10805 of sewer, remain connected to the object 100, allow the object 100 to separate from the foundation system 200 and allow the object 100 to return to its original static position on the foundation system 200. In some example embodiments, the coiled sewer conduit 10800B may comprise slope block 10801 or minimum drain slope 10802. In some example embodiments, the slope block 10801 may be configured to elevate one end of the coiled sewer conduit when at resting position to result in a drain slope 10802 of ¼ inch per foot. In some example embodiments, the minimum drain slope 10802 may be configured to have at resting position a sufficient diameter that when coiled to result in a drain slope

10802 of ¼ inch per foot. In some example embodiments, the utility service connection 10803A may be configured to connect utility services to the object 100. In some example embodiments, the utility service connection 10803A may comprise conduit system 11000. In some example embodiments, the underground service 10805 may be configured to supply utility services from a location removed from the object 100 through an underground conduit system 11000.

Figure 109:
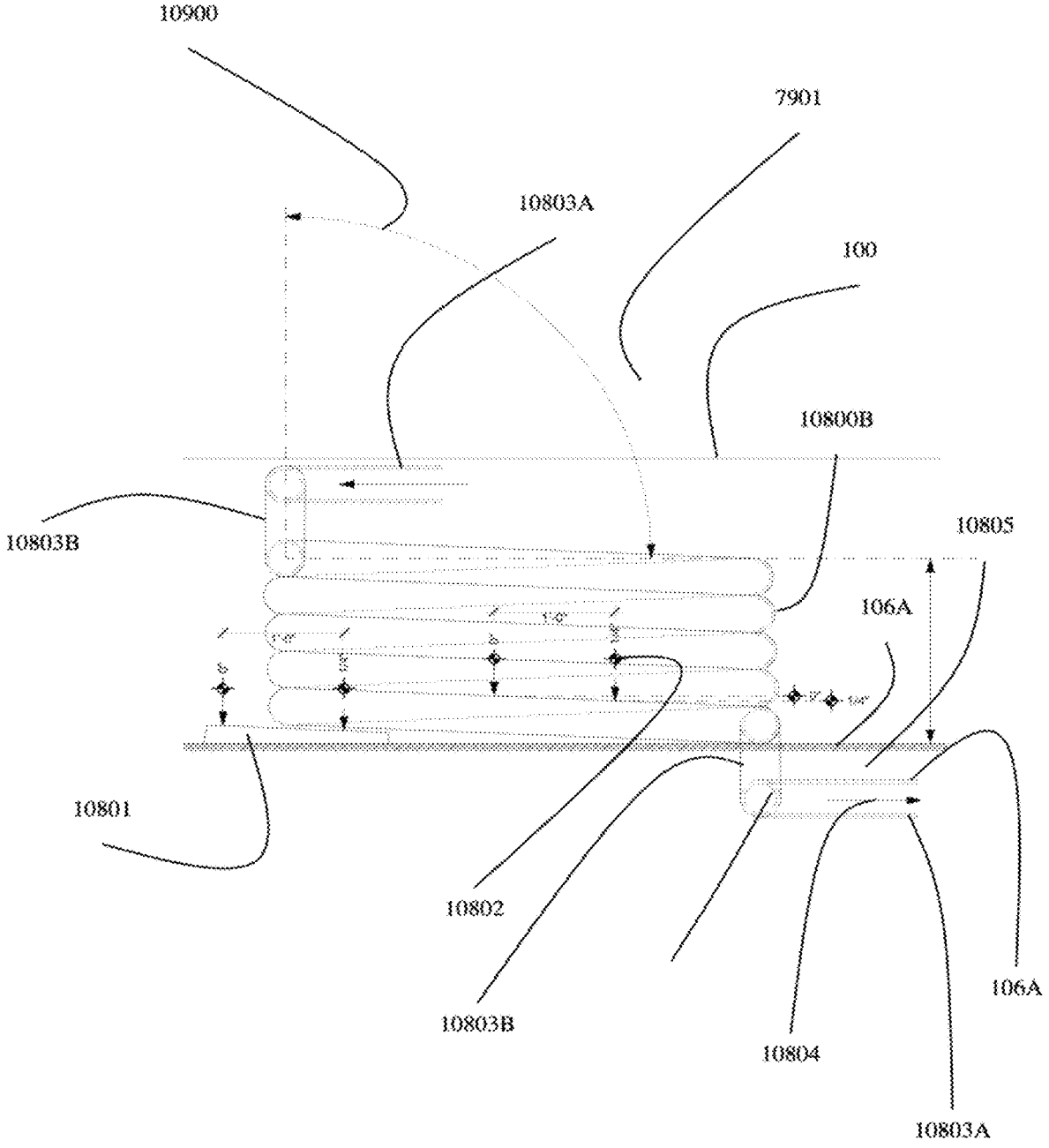
FIG. 109 illustrates a section elevation view that shows a coiled utility conduit configured in a spiral of a diameter corresponding with the diameter of the conduit such that when coiled and at rest, that the resultant slope inside the conduit is at least ¼ inch per foot of run. This minimum slope is provided at bottom most spiral by a wedged slope block located on top of grade. The utility service connection device connecting the coiled sewer conduit to the house is configured to rotate in the X axis on one end and in the Y axis at the other end. This will prevent any potential binding forces from being transmitted to the coiled sewer conduit from a tilting angle due to asymmetrical movement of the house caused by wave or wind action. The utility service connection device at the on grade location also allows for the free rotation of its connection to the hard connection to the underground service, according to an example embodiment of the present disclosure.

FIG. 109 illustrates a section elevation view that shows a coiled utility conduit 11400 configured in a spiral of a diameter corresponding with the diameter of the conduit such that when coiled and at rest, that the resultant slope inside the conduit is at least ¼ inch per foot of run. This minimum slope is provided at bottom most spiral by a wedged slope block 10801 located on top of grade 106. The utility service connection 10803 device connecting the coiled sewer conduit 10800 to the house is configured to rotate in the X axis on one end and in the Y axis at the other end. This will prevent any potential binding forces from being transmitted to the coiled sewer conduit 10800 from a tilting angle 10900 due to asymmetrical movement of the house caused by wave or wind action. The utility service connection 10803 device at the on grade 106 location also allows for the free rotation of its connection to the hard connection 14001 to the underground service 10805, according to an example embodiment of the present disclosure.

Figure 110:
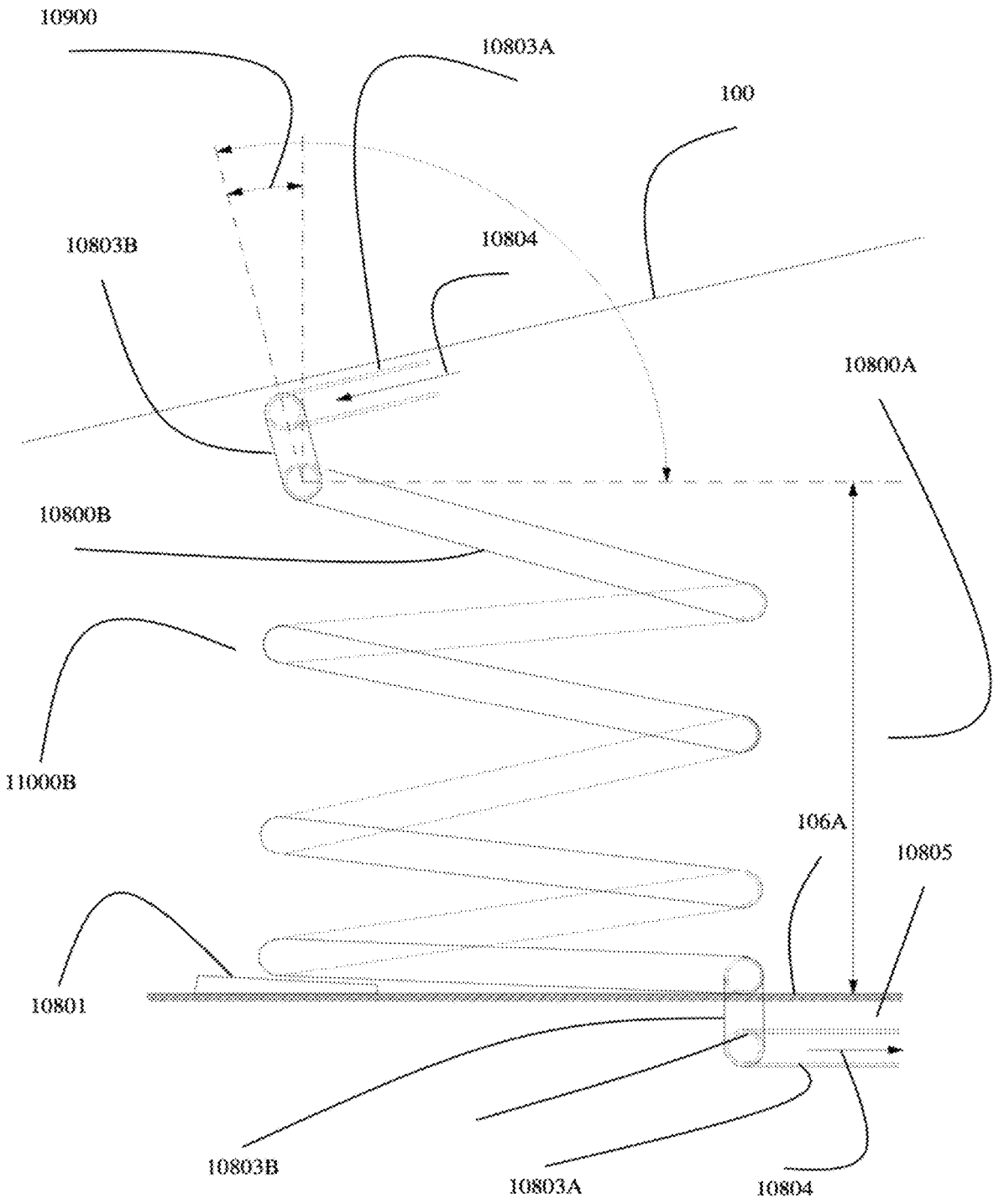
FIG. 110 illustrates a section elevation view that shows a tilting angle of a floating house resulting from asymmetrical movements due to wave or wind action. The utility service connection from the house is connected to the utility service connection conduit connection device, which connects to the coiled sewer conduit. Acting as a flexible gooseneck joint. Rotation between the two conduits occurs in the device in lieu of transferring these rotational forces between conduits. The coiled sewer conduit is configured to extend up and down following the vertical rise and fall of the house. The utility service connection device on grade allows for a similar free rotation of its connections between the coiled sewer conduit and the hard connection to the underground service. Using coiled utility conduits allows for uninterrupted utility services to continue serving the house during flooding events, according to an example embodiment of the present disclosure.

FIG. 110 illustrates a section elevation view that shows a tilting angle 10900 of a floating house resulting from asymmetrical movements due to wave or wind action. The utility service connection 10803 from the house is connected to the utility service connection 10803 conduit connection device, which connects to the coiled sewer conduit 10800. Acting as a flexible gooseneck joint. Rotation between the two conduits occurs in the device in lieu of transferring these rotational forces between conduits. The coiled sewer conduit 10800 is configured to extend up and down following the vertical rise and fall of the house. The utility service connection 10803 device on grade 106 allows for a similar free rotation of its connections between the coiled sewer conduit 10800 and the hard connection 14001 to the underground service 10805. Using coiled utility conduits allows for uninterrupted utility services to continue serving the house during flooding events, according to an example embodiment of the present disclosure. In some example embodiments, the coiled sewer conduit 10800A may be configured to provide the utility services of sewer 10804 to the object 100 during the absence of rising water 1202, provide the utility services of sewer 10804 to the object 100 during the presence of rising water 1202, have at resting position a sufficient diameter that when coiled to result in a drain slope 10802 of ¼ inch per foot, remain connected to the underground service 10805 of sewer, remain connected to the object 100, allow the object 100 to separate from the foundation system 200 and allow the object 100 to return to its original static position on the foundation system 200. In some example embodiments, the conduit system 11000B may be configured to deliver one or more utility services to the object 100.

Figure 111:
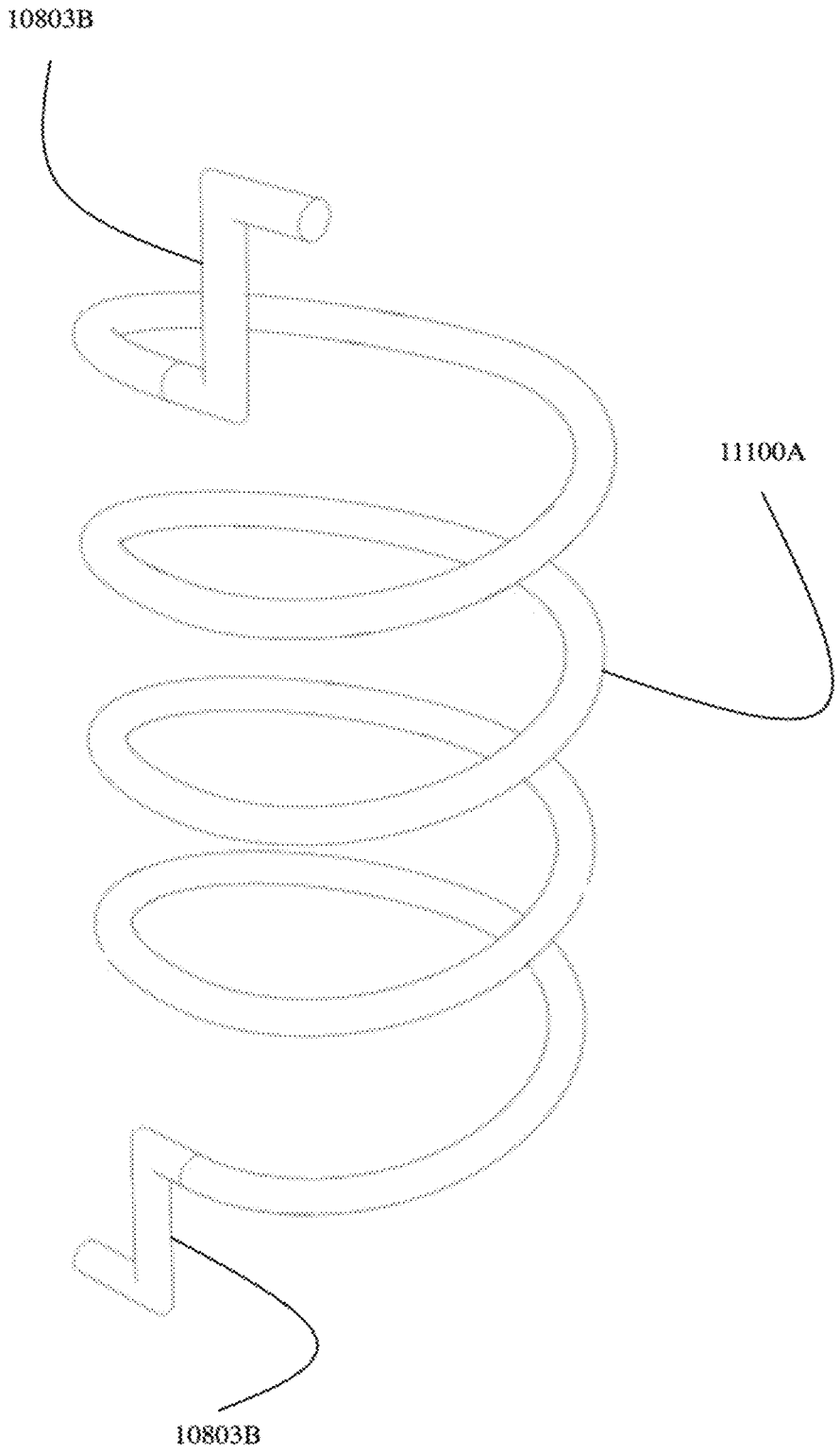
FIG. 111 illustrates a perspective view that shows a coiled utility conduit attached to gooseneck connection devices at each end. Using coiled utility conduits allows for uninterrupted utility services to continue serving the house during flooding events, according to an example embodiment of the present disclosure.

FIG. 111 illustrates a perspective view that shows a coiled utility conduit 11400 attached to gooseneck connection devices at each end. Using coiled utility conduits allows for uninterrupted utility services to continue serving the house during flooding events, according to an example embodiment of the present disclosure. In some example embodiments, the coiled conduit 11100A may be configured to allow the object 100 to return to its original static position on the foundation system 200, allow the object 100 to separate from the foundation system 200, remain connected to the object 100, remain connected to the underground service 10805, provide one or more utility services to the object 100 during the presence of rising water 1202 and deliver one or more utility services to the object 100 during the absence of rising water 1202. In some example embodiments, the coiled conduit 11100A may comprise coiled sewer conduit 10800 or coiled utility conduit 11400.

Figure 112:
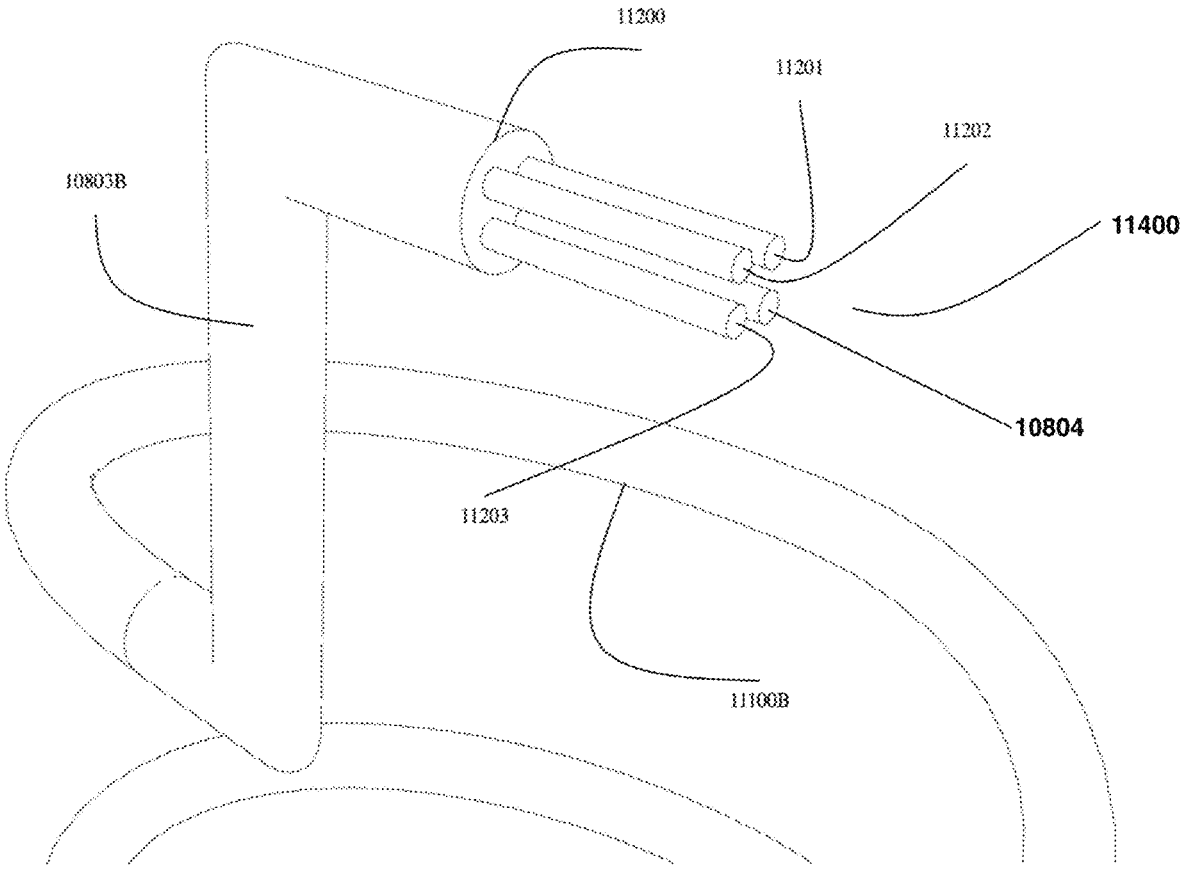
FIG. 112 illustrates a perspective view that shows a coiled utility conduit attached to gooseneck connection devices at each end. Using coiled utility conduits allows for uninterrupted utility services to continue serving the house during flooding events, according to an example embodiment of the present disclosure.

FIG. 112 illustrates a perspective view that shows a coiled utility conduit 11400 attached to gooseneck connection devices at each end. Using coiled utility conduits allows for uninterrupted utility services to continue serving the house during flooding events, according to an example embodiment of the present disclosure. In some example embodiments, the coiled conduit 11100B may be configured to allow the object 100 to return to its original static position on the foundation system 200, allow the object 100 to separate from the foundation system 200, remain connected to the object 100, remain connected to the underground service 10805, provide one or more utility services to the object 100 during the presence of rising water 1202 and deliver one or more utility services to the object 100 during the absence of rising water 1202. In some example embodiments, the coiled conduit 11100B may comprise utility connection manifold 11300 or protective sheath 11200. Protective sheath 11200 may be defined as a method of securing together and armoring against possible external damage a collective of coiled utility conduit 11400 into a single continuous coiled unit. Examples of the protective sheath 11200 may include a conduit, a tube, an armored tube and wrapping. In some example embodiments, the protective sheath 11200 may be configured to deliver one or more utility services to the object 100 during the absence of rising water 1202, protect the coiled conduit 11100 for one or more utility services from external damage, house the coiled conduit 11100 for one or more utility services, remain connected to the object 100, allow the object 100 to separate from the foundation system 200 and allow the object 100 to return to its original static position on the foundation system 200. In some example embodiments, if the protective sheath 11200 is absent then each coiled conduit 11100 will move independently. In some example embodiments, the protective sheath 11200 may be configured to protect each coiled conduit 11100 from possible external damage from debris, affix two or more coiled utility conduit 11400 together to move up and down as a single coiled conduit 11100 and reduce the possibility of entangled coiled utility conduit 11400. In some example embodiments, the potable water 11202 may be configured to provide potable water 11202 to the object 100.

Figure 113:
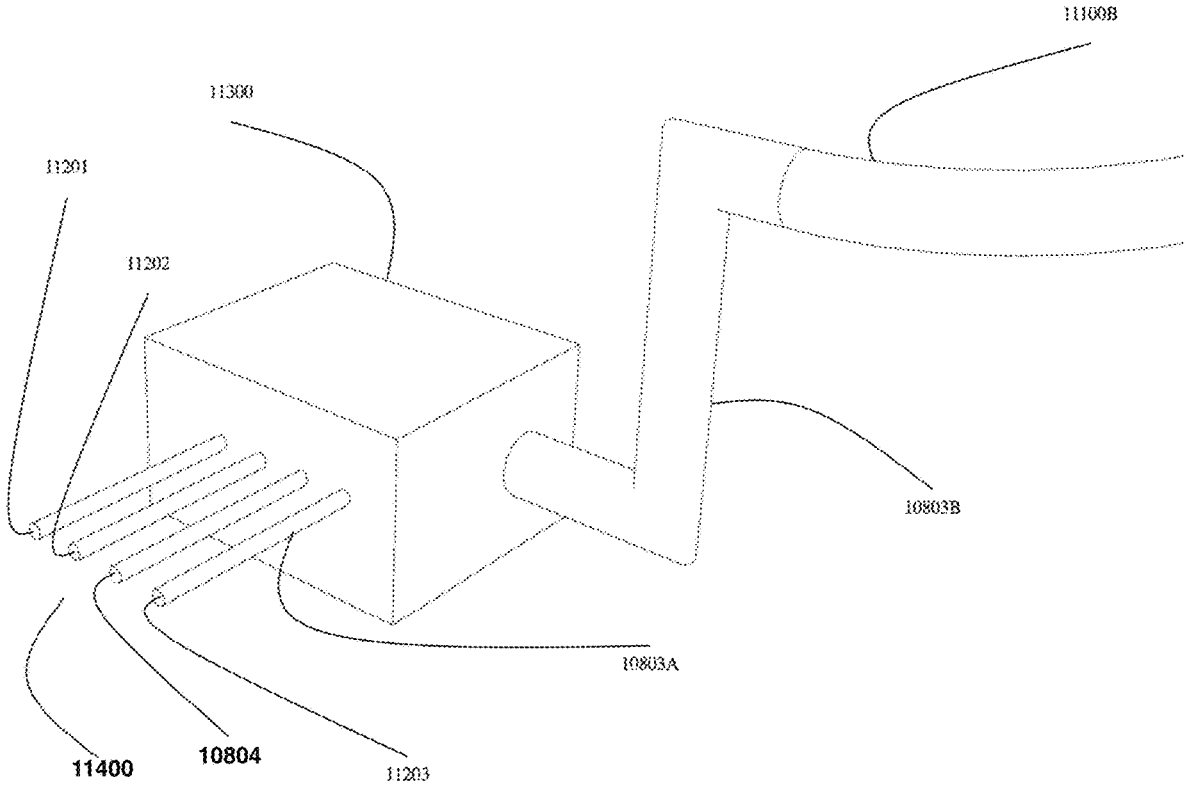
FIG. 113 illustrates a perspective view that shows the lower end of a coiled utility conduit containing multiple utility services, that is connected to a utility connection manifold through a connection device that can rotate both horizontally and vertically in gooseneck like movements. The utility connection manifold is located at or below grade and provides access to the utility service connection for each utility type. Clustering multiple services reduces the exposure to damaged conduits and subsequent service interruption caused from the potential of moving submerged debris during a flooding event, according to an example embodiment of the present disclosure.

FIG. 113 illustrates a perspective view that shows the lower end of a coiled utility conduit 11400 containing multiple utility services, that is connected to a utility connection manifold 11300 through a connection device that can rotate both horizontally and vertically in gooseneck like movements. The utility connection manifold 11300 is located at or below grade 106 and provides access to the utility service connection 10803 for each utility type. Clustering multiple services reduces the exposure to damaged conduits and subsequent service interruption caused from the potential of moving submerged debris during a flooding event, according to an example embodiment of the present disclosure. Utility connection manifold 11300 may be defined as a chamber receiving the conduit system 11000 from a multiple of utility services and contains the individual utility service connection 10803 for each of the utility services that are contained in the coiled conduit 11100 connected to the object 100. In some example embodiments, the utility connection manifold 11300 may be configured to provide an accessible terminal vessel for the connection of multiple utility services to each connected respective coiled conduit 11100, allow the vertical movement in the coiled utility conduit 11400 for the object 100 to separate from the foundation system 200, provide an accessible terminal vessel for the connection of each utility coiled conduit to the respective utility services, remain connected to one or more utility services and their respective coiled conduit 11100, remain connected to one or more utility services and remain connected to the protective sheath 11200.

Figure 114:
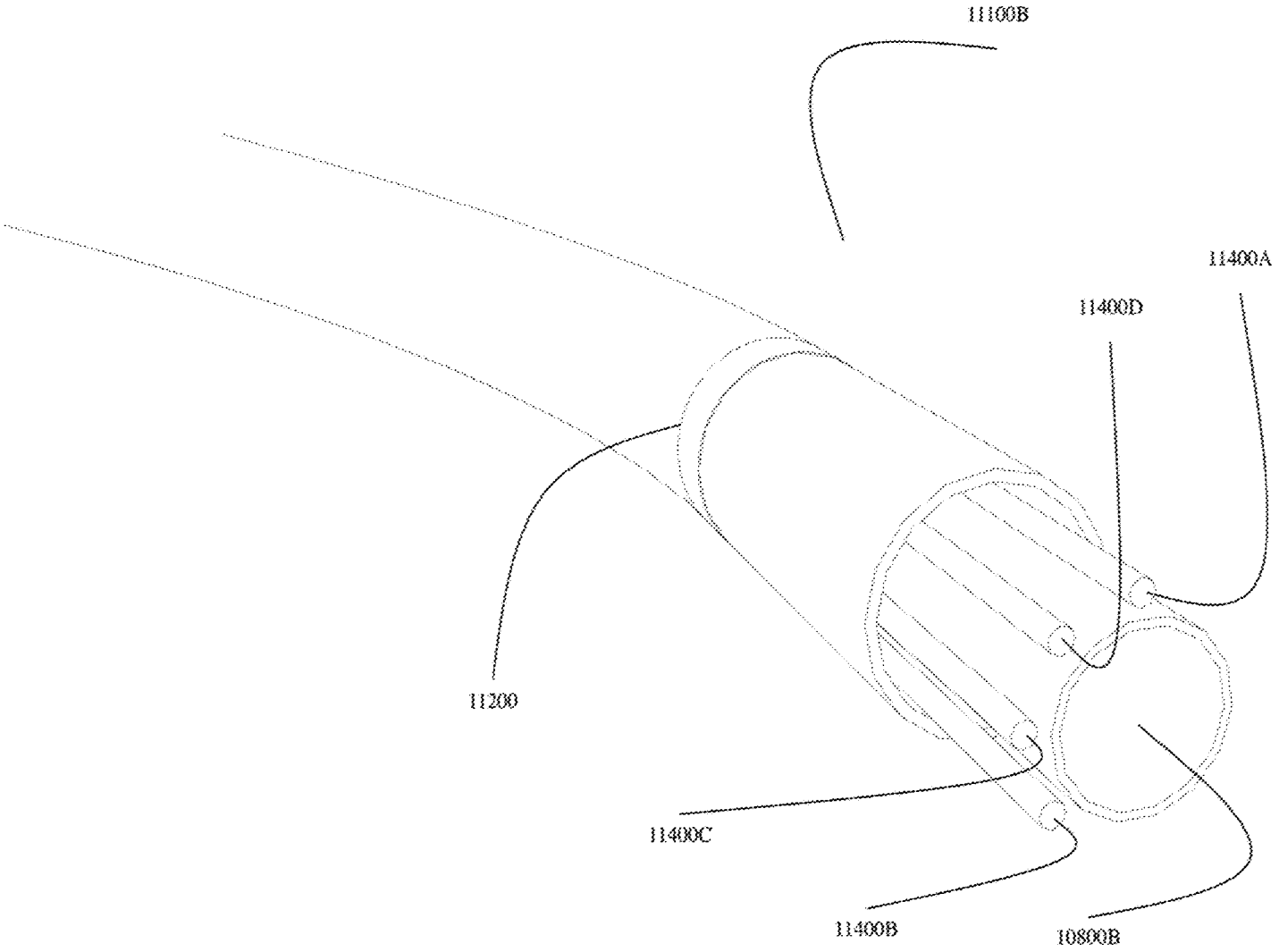
FIG. 114 illustrates a perspective view that shows a protective sheath wrapped over a coiled utility conduit containing multiple utility conduits. Wrapping the collection of conduits with an armored protective sheath fortifies the system to resist impact damage and subsequent service interruption caused from the potential of moving and submerged debris during a flooding event, according to an example embodiment of the present disclosure.

FIG. 114 illustrates a perspective view that shows a protective sheath 11200 wrapped over a coiled utility conduit 11400 containing multiple utility conduits. Wrapping the collection of conduits with an armored protective sheath 11200 fortifies the system to resist impact damage and subsequent service interruption caused from the potential of moving and submerged debris during a flooding event, according to an example embodiment of the present disclosure. Coiled utility conduit 11400A may be defined as a flexible and waterproof conduit system 11000 appropriate for delivering gas 11201 to the object 100. In some example embodiments, the coiled utility conduit 11400A may be configured to allow the object 100 to return to its original static position on the foundation system 200, allow the object 100 to separate from the foundation system 200, remain connected to the object 100, remain connected to the underground service 10805, provide multiple utility services to the object 100 in a single conduit during the presence of rising water 1202 and provide multiple utility services to the object 100 in a single conduit during the absence of rising water 1202. Coiled utility conduit 11400D may be defined as a flexible and waterproof conduit system 11000 appropriate for delivering potable water 11202 to the object 100. Coiled utility conduit 11400C may be defined as a flexible and waterproof conduit system 11000 appropriate for delivering electrical service 11203 to the object 100. Coiled utility conduit 11400B may be defined as a flexible and waterproof conduit system 11000 appropriate for delivering communications to the object 100.

Figure 115:
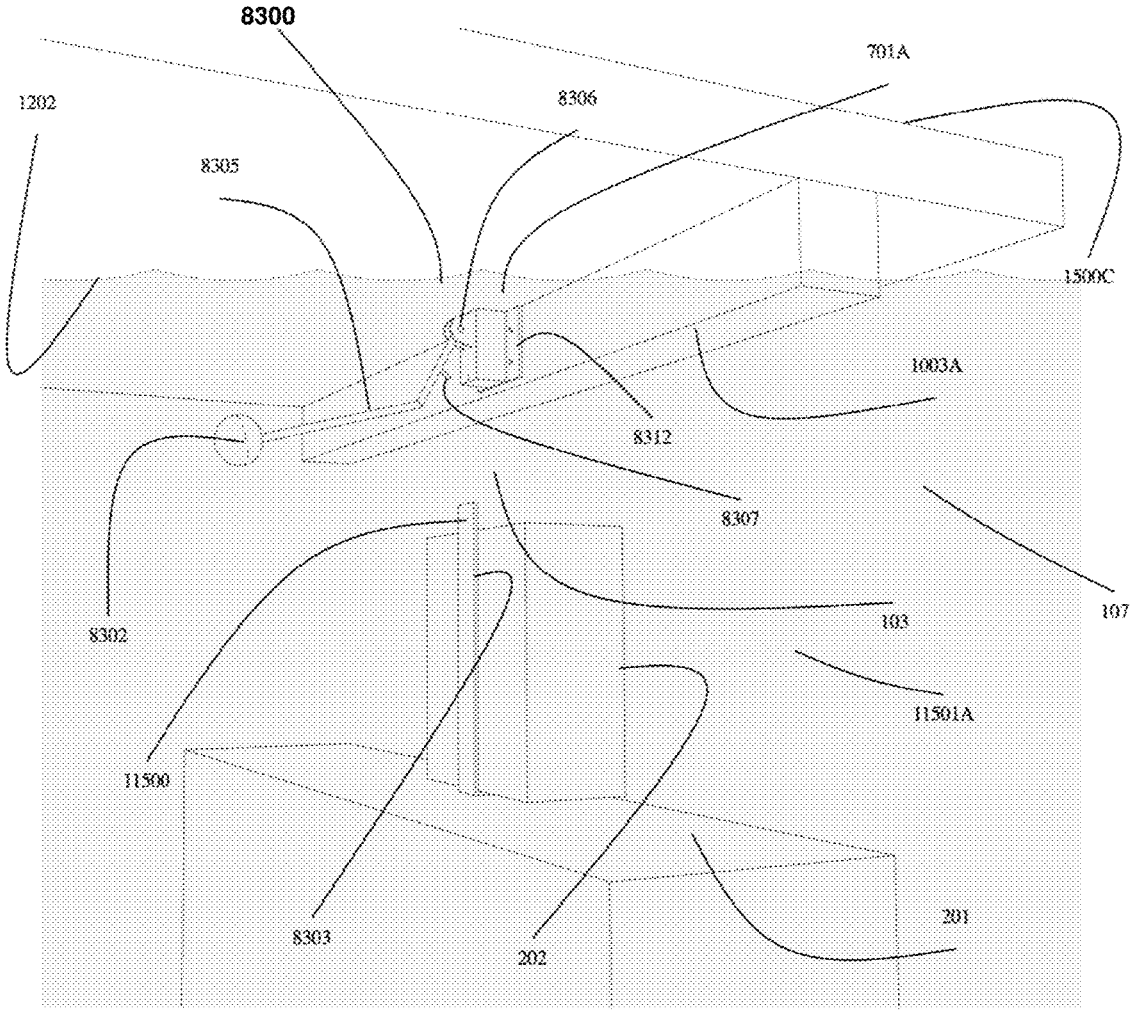
FIG. 115 illustrates a perspective view that shows a rising water lock release activation system with the object platform system separated from the foundation. The buoyant float has risen with the rising water and forced the lever arm to rotate about the lever arm hinge causing the strap pin to exit its locking position inside the strap pin hole, unlocking the hold down system and allowing the object to vertically separate from the foundation system and to float in the rising water. Configuring the hold down system to automatically release in the presence of flood waters provides a level of flood damage protection without monitoring or physically releasing in times of flooding. In the absence of flooding, the hold down system is a Building Code requirement to prevent high velocity wind forces from shifting or overturning a house from its foundation, according to an example embodiment of the present disclosure.

FIG. 115 illustrates a perspective view that shows a rising water lock release activation system 11501 with the object platform system 1500 separated from the foundation. The buoyant float 8302 has risen with the rising water 1202 and forced the lever arm 8305 to rotate about the lever arm hinge 8306 causing the strap pin 8307 to exit its locking position inside the strap pin hole 11500, unlocking the hold down system 8300 and allowing the object 100 to vertically separate from the foundation system 200 and to float in the rising water 1202. Configuring the hold down system 8300 to automatically release in the presence of flood waters provides a level of flood damage protection without monitoring or physically releasing in times of flooding. In the absence of flooding the hold down system 8300 is a Building Code requirement to prevent high velocity wind 4000 forces from shifting or overturning a house from its foundation, according to an example embodiment of the present disclosure. Strap pinhole 11500 may be defined as an opening in the strap 8303 configured to receive the strap pin 8307. Examples of the strap pinhole 11500 may include socket, pocket, recess and cavity. In some example embodiments, the strap pinhole 11500 may be configured to release the strap pin 8307, automatically receive and re-anchor the strap pin 8307 and be integral to the strap 8303. In some example embodiments, the strap pinhole 11500 may be configured to receive the strap pin 8307 and allow the strap pin 8307 to withdraw. In some example embodiments, the strap pin hole 11500 may be positioned to align with the strap pin 8307 when the object 100 or object platform system 1500 are in an object at rest 301 position or on the strap 8303. In some example embodiments, the strap pinhole 11500 may be coupled with the strap 8303. In some example embodiments, the strap pinhole 11500 may interact with the strap pin 8307. In some example embodiments, the strap pinhole 11500 may be shaped like round. Rising water lock release activation system 11501A may be defined as an assembly that reacts to the presence of rising water 1202 by unfastening the lock system 8310 to allow the object 100 to transition from an object at rest 301 position to an object separated 103 position. In some example embodiments, the rising water lock release activation system 11501A may be configured to release the object 100 from the foundation system 200 in the presence of rising water 1202, re-anchor the object 100 to the foundation system 200 in the absence of rising water 1202, release the object 100 from the foundation system 200 and anchor the object 100 to the foundation system 200. In some example embodiments, if the rising water lock release activation system 11501A is absent then an alternative water detection system, a physical release system 4600, or a remote release system be employed to release the locking system 8309 and allow the object 100 to transition from an object at rest 301 position to an object separated 103 position. In some example embodiments, the rising water lock release activation system 11501A may comprise float activated system 8308, hold down system 8300 or lock assembly cleat 8301.

Figure 116:
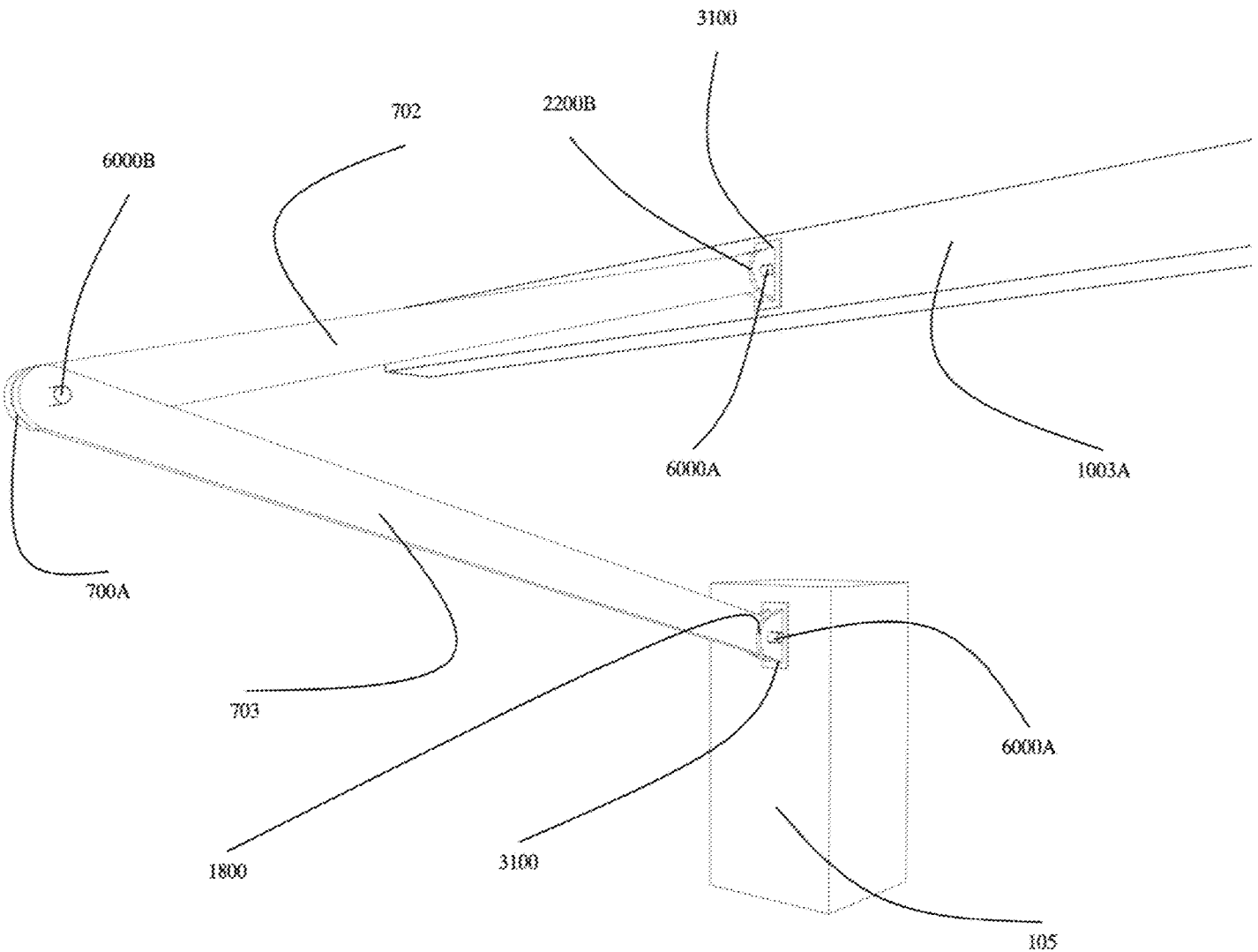
FIG. 116 illustrates a perspective view that shows the components of the strut anchor system and the strut cleat system. Each strut is anchored on one end to the elbow hinge. The upper strut is anchored to the object hinge and the lower strut is anchored to the foundation hinge, according to an example embodiment of the present disclosure.

FIG. 116 illustrates a perspective view that shows the components of the strut anchor system 6000 and the strut cleat system 3100. Each strut 601 is anchored on one end to the elbow hinge 700. The upper strut 702 is anchored to the object hinge 2200 and the lower strut 703 is anchored to the foundation hinge 1800, according to an example embodiment of the present disclosure. In some example embodiments, the strut anchor system 6000B may be configured to anchor the strut 601 to the hinge block system 2700 and anchor the strut 601 to the elbow hinge 700. In some example embodiments, the strut anchor system 6000B may comprise strut to elbow fastener 5900.

Figure 117:
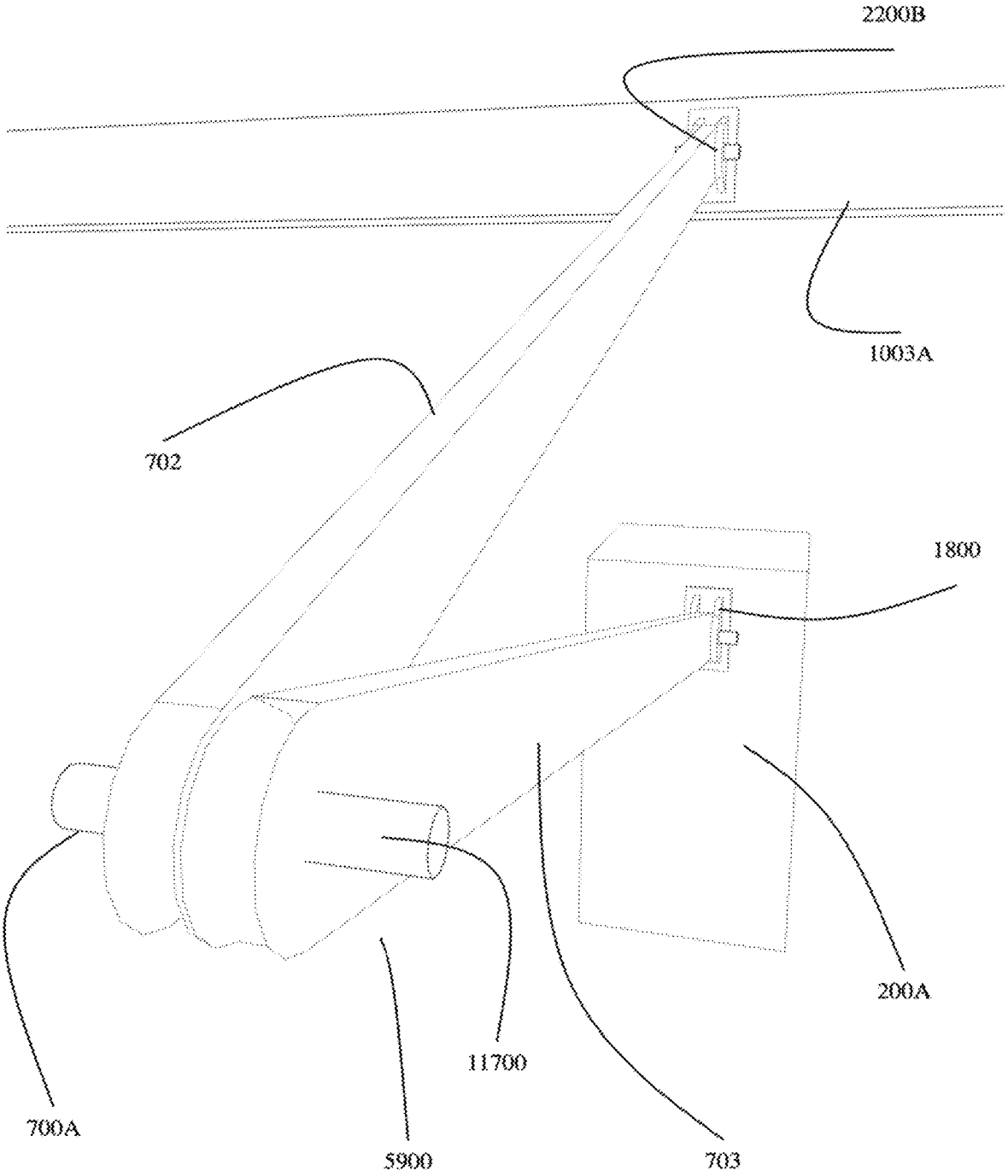
FIG. 117 illustrates a perspective detail view that shows the elbow hinge as an Axle Shaft that anchors the upper strut and lower strut to each other while allowing rotational movement of the primary parallel struts system in a plane perpendicular to the axis of the hinge pin, according to an example embodiment of the present disclosure.

FIG. 117 illustrates a perspective detail view that shows the elbow hinge 700 as an Axle Shaft that anchors the upper strut 702 and lower strut 703 to each other while allowing rotational movement of the primary parallel struts system 104 in a plane perpendicular to the axis of the hinge pin 800, according to an example embodiment of the present disclosure. In some example embodiments, the axle shaft 11700 may be configured to secure the upper strut 702 to the lower strut 703 and allow the upper strut 702 to rotate relative to the lower strut 703.

Figure 118:
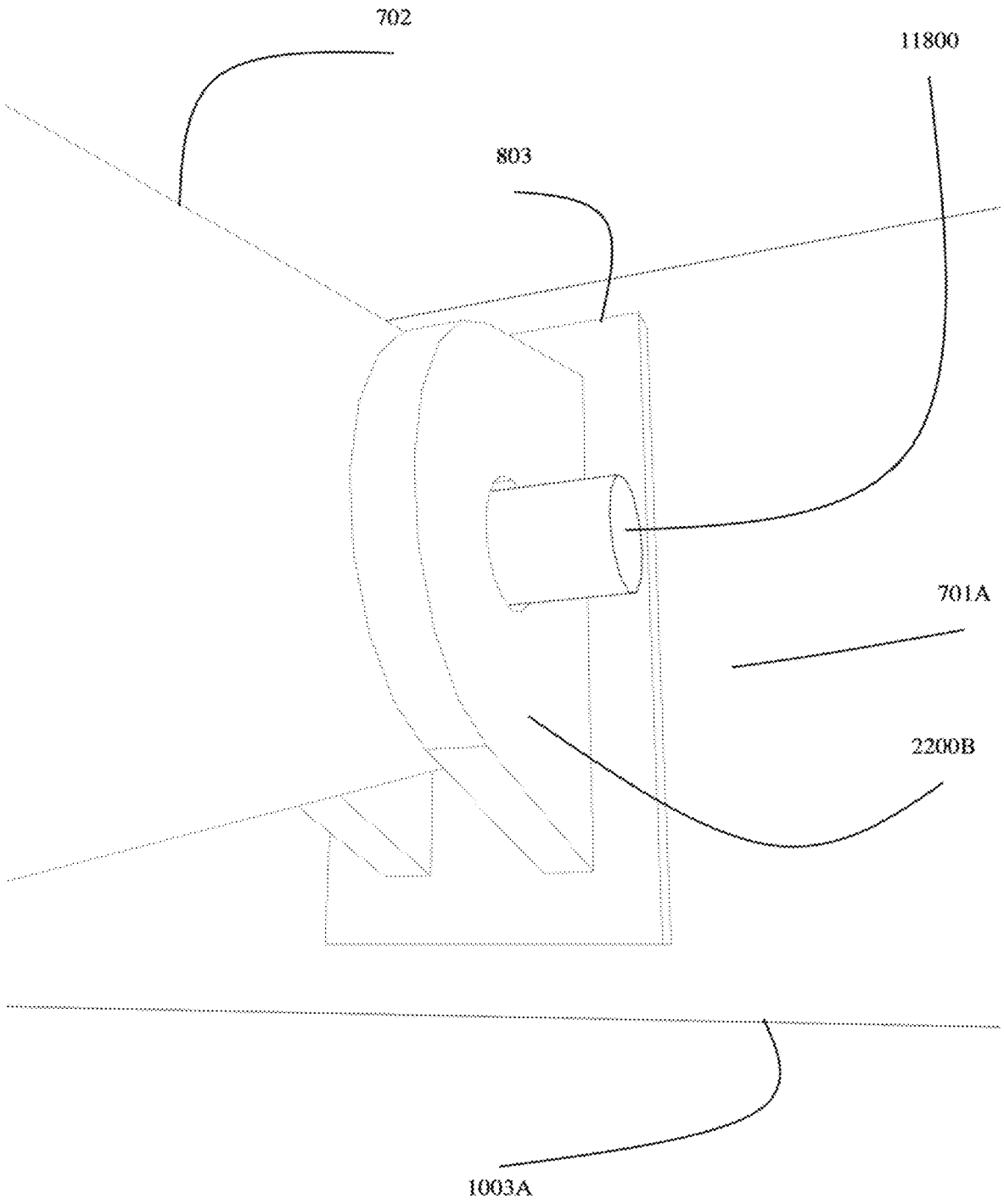
FIG. 118 illustrates a perspective detail view that shows the object hinge anchored to platform sill and fastening the upper end of the upper strut with a hinge pin serving as a strut to cleat fastener as well as allowing the upper strut to rotate along an axis perpendicular to the axis of the hinge pin, according to an example embodiment of the present disclosure.

FIG. 118 illustrates a perspective detail view that shows the object hinge 2200 anchored to platform sill 1003 and fastening the upper end of the upper strut 702 with a hinge pin 800 serving as a strut to cleat fastener 11800 as well as allowing the upper strut 702 to rotate along an axis perpendicular to the axis of the hinge pin 800, according to an example embodiment of the present disclosure. In some example embodiments, the strut to cleat fastener 11800 may be configured to anchor the strut 601 to the hinge block system 2700.

Figure 119:
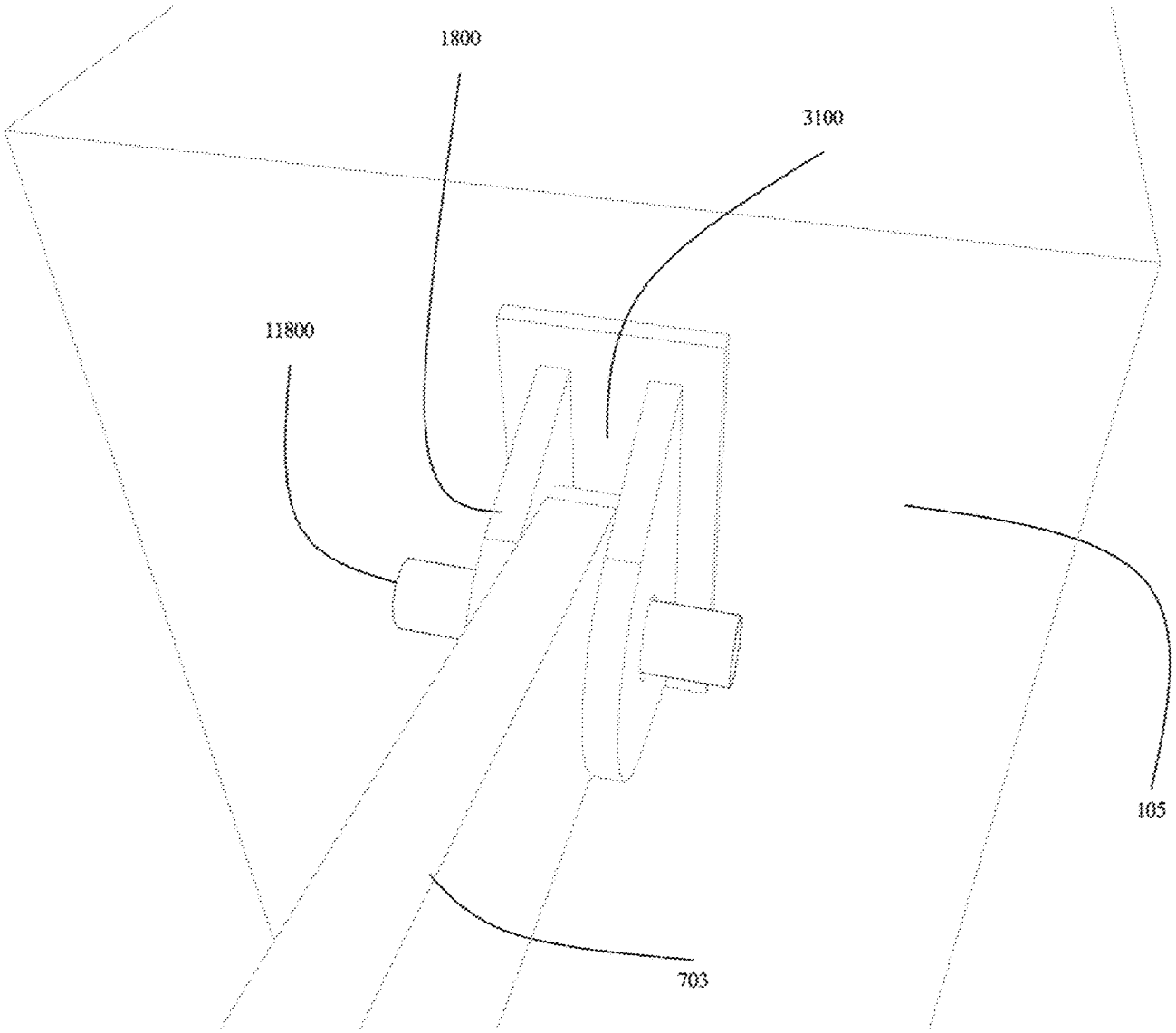
FIG. 119 illustrates a perspective detail view that shows the foundation hinge anchored to the foundation pier system and fastening the lower end of the lower strut with a hinge pin serving as the strut to cleat fastener as well as allowing the lower strut to rotate along an axis perpendicular to the axis of the hinge pin, according to an example embodiment of the present disclosure.

FIG. 119 illustrates a perspective detail view that shows the foundation hinge 1800 anchored to the foundation pier system 105 and fastening the lower end of the lower strut 703 with a hinge pin 800 serving as the strut to cleat fastener 11800 as well as allowing the lower strut 703 to rotate along an axis perpendicular to the axis of the hinge pin 800, according to an example embodiment of the present disclosure.

FIG. 120 illustrates a perspective view that shows a car equipped as a buoyant object that is floating above grade 106 while tethered to its foundation system 200 using two double hinge clustered hinge system 1901 units that are anchored to a shaft as pier foundation. The two upper clustered hinge system 1901 units have been attached to the front and rear bumpers of the car using a tilting hinge 12001 which allows for asymmetrical movement of the car due to the forces of high velocity wind 4000 or from water waves 501 as the vehicle floats on the water surface, according to an example embodiment of the present disclosure. In some example embodiments, the slab foundation 12000A may be configured to support the object 100 and remain anchored to grade 106. Tilting hinge 12001 may be defined as a device or assembly that allows the object anchor 4100 to twist relative to the buoyant object connector 12200. Examples of the tilting hinge 12001 may include a pivot and axle. In some example embodiments, the tilting hinge 12001 may be configured to anchor to the object anchor 4100, allow the tilting object 401 to freely rotate and tilt due to high velocity wind 4000 and or water waves 501 and anchor to the stabilization system 108. In some example embodiments, the tilting hinge 12001 may be configured to anchor to the buoyant object, anchor to the stabilization system 108, to rotate the object anchor 4100 relative to the object hinge 2200 and anchor the object hinge 2200. In some example embodiments, the tilting hinge 12001 may be positioned above the stabilization system 108, on the buoyant object or on the supporting frame 101.

FIG. 121 illustrates a perspective view that shows a mobile home floating in rising water 1202 while tethered to its foundation by a series of primary parallel struts system 104 units arranged in an opposing elbow system 900 oriented with inward acting elbow 901 hinges that are concealed beneath in the crawl space when the mobile is in an object at rest 301 position. This system of using a series of anchored girders 12100 to support two or more parallel main beam 12600 units that support the supporting frame 101, is a cost efficient alternative for retrofitting existing houses on raised foundations in order to give them the amphibious architecture qualities of being safely tethered while riding on the water's surface during flooding events, and returning to the original resting position as the water inundation recedes. Utilizing a drilled pile 3900 foundation system allows access for machinery to insert these stabilizing anchor devices into the existing grade 106, according to an example embodiment of the present disclosure. Girders 12100 may be defined as a large beam that supports each main beam 12600 of a mobile home or the platform joist 1001 system and platform sill 1003 system of a typical framed structure. In some example embodiments, the girders 12100 may be configured to support the main beam 12600, anchor the keel 12101, anchor to the object hinge 2200, anchor the object 100 or supporting floor 1100 and support the object 100. In some example embodiments, the girders 12100 may be configured to support the main beam 12600 set of a typical mobile home to accept an opposing elbow system 900, support the platform joist 1001 system of a supporting frame 101 to accept an opposing elbow system 900, support the platform sill 1003 system to accept an opposing elbow system 900, retrofit an existing mobile home to accept an opposing elbow system 900 and anchor each object hinge 2200 of an opposing elbow system 900 to the object 100. In some example embodiments, the girders 12100 may be positioned below the main beam 12600 or above the object hinge 2200. In some example embodiments, the girders 12100 may be coupled with the object hinge 2200, the main beam 12600, the platform joist 1001 system or the platform sill 1003 system. Keel 12101 may be defined as a high density material attached to and suspended below the buoyant object as low as possible to lower the center of gravity and provide a righting moment to resist overturning. In some example embodiments, the keel 12101 may be configured to lower the center of gravity of the object 100 and provide a righting moment to resist lateral forces on the buoyant object and prevent overturning. In some example embodiments, the keel 12101 may be configured to lower the center of gravity of the buoyant object. In some example embodiments, the keel 12101 may be positioned below the buoyant object or above grade 106. In some example embodiments, the keel 12101 may be coupled with the buoyant object, the object platform system 1500 or the girders 12100.

FIG. 122 illustrates a perspective detail view that shows a car equipped as a buoyant object that is floating above grade 106 while tethered to its foundation system 200 using a double hinge clustered hinge system 1901 unit anchored to a shaft as pier foundation. The upper clustered hinge system 1901 unit is attached to the front bumper of the car using a Buoyant Object Connector and a tilting hinge 12001 which allows for asymmetrical movement of the car due to the forces of high velocity wind 4000 or from water waves 501 as the vehicle floats on the water surface, according to an example embodiment of the present disclosure. Buoyant object connector 12200 may be defined as a device or assembly that anchors the buoyant object to the stabilization system 108. In some example embodiments, the buoyant object connector 12200 may be configured to anchor the buoyant object to the stabilization system 108. In some example embodiments, the buoyant object connector 12200 may be configured to anchor the object 100 to the stabilization system 108, allow the object 100 to tilt as a result of resisting high velocity wind 4000, allow the object 100 to tilt as a result of floating on top of water waves 501 and disconnect from the object 100 in the absence of rising water 1202. In some example embodiments, the buoyant object connector 12200 may comprise tilting hinge 12001 or object anchor 4100.

FIG. 123 illustrates a perspective detail view that shows a tilting hinge 12001 which allows for asymmetrical movement of the car due to the forces of high velocity wind 4000 or from water waves 501 as a buoyant vehicle floats on the water surface. The tilting hinge 12001 is anchored to a buoyant object connector 12200 that is attached to the vehicle, according to an example embodiment of the present disclosure.

FIG. 124 illustrates a perspective view that shows a tilting hinge 12001 which allows for asymmetrical movement of the car due to the forces of high velocity wind 4000 or from water waves 501 as a buoyant vehicle floats on the water surface. The tilting hinge 12001 is anchored to a buoyant object connector 12200 that is attached to the vehicle, according to an example embodiment of the present disclosure.

FIG. 125 illustrates a perspective view that shows a tilting hinge 12001 which allows for asymmetrical movement of the car due to the forces of high velocity wind 4000 or from water waves 501 as a buoyant vehicle floats on the water surface. The tilting hinge 12001 is anchored to a buoyant object connector 12200 that is attached to the vehicle, according to an example embodiment of the present disclosure.

FIG. 126 illustrates a worm's eye plan view that shows the underside framing for a typical mobile home structure tethered to a series of primary parallel struts system 104 units. This structural system is also applicable for retrofitting existing structures using a pier on gradebeam system 202 with a crawlspace. The system supports the object platform system 1500 of multiple parallel platform joist 1001 units with two or more main beam 12600 units that are supported by a multiplicity of girders 12100. Each end of girders 12100 is anchored to a primary parallel struts system 104 whose opposite ends are anchored to a foundation system 200. The structure rests on a pier system 105. To anchor the tethering system a more resilient foundation system is disclosed, hence each primary parallel struts system 104 unit is attached to a piling that has been inserted deep into the soil, according to an example embodiment of the present disclosure. Main beam 12600 may be defined as part of a system of supporting a manufactured home on wheels while it is being transported and while sitting on the pier system 105 when at rest. In some example embodiments, the main beam 12600 may be configured to span between girders 12100, anchor to the platform joist 1001 and support the platform joist 1001.

FIG. 127 illustrates a worm's eye perspective view that shows the underside of an existing building resting on a pier on gradebeam system 202 that has been retrofitted with a series of main beam 12600 units resting on girders 12100 that are anchored to primary parallel struts system 104 units whose foundation hinge 1800 blocks are anchored to a driven pile 9002, drilled pile 3900, helical pile 7500, or some other form of foundation system 200. Weighted keel 12101 units are suspended from the supporting frame 101 to lower the center of gravity of the structure and lessen the possibility of its capsizing or overturning due to an otherwise high center of gravity. The crawl space between the supporting frame 101 and grade 106 accommodates and conceals the primary parallel struts system 104 units as well as any hull buoyancy system to convert the structure into a buoyant object so that it can float up with rising water 1202, according to an example embodiment of the present disclosure.

FIG. 128 illustrates an a perspective cut-away detail view that shows one method of attaching a weighted ballast keel 12101 to lower the center of gravity of a structure. In this illustration the keel 12101 is made of concrete suspended from one of a series of girders 12100. Each of the supporting girders 12100 supports two or more main beam 12600 units that run the length of the platform structure to support the supporting frame 101 of the building. Each end of the girders 12100 is anchored to the object hinge 2200 of a primary parallel struts system 104 that tethers the building to its foundation system 200. The object hinge 2200 of each primary parallel struts system 104 is anchored to one of the girders 12100 while the foundation hinge 1800 is cleated to the shaft system 12800 which provides the stationary support to anchor the system during flooding events, according to an example embodiment of the present disclosure. Object platform system 1500B may be defined as a heavy material placed low in or attached below a buoyant object to improve its stability and resist overturning. Examples of object platform system 1500B may include keel and weight. In some example embodiments, the object platform system 1500B may be configured to be able to support the object 100. In some example embodiments, the object platform system 1500B may be configured to counteract lateral loads from high velocity wind 4000 from causing the buoyant object to overturn and to lower the relative center of gravity of the buoyant object in an effort to prevent the object platform system 1500 from overturning in high velocity wind 4000 and water waves 501. In some example embodiments, the object platform system 1500B may be positioned below the object platform system 1500, below the object 100, above the foundation system 200, above grade 106, to avoid the folding strut movement plane 3700 of nearby #fold or below the girders 12100. In some example embodiments, the object platform system 1500B may be coupled with the girders 12100 or the keel 12101. In some example embodiments, the object platform system 1500B may comprise keel 12101. In some example embodiments, the shaft system 12800 may be configured to support and resist the forces transmitted through the stabilization system 108, support the object 100 and remain connected to grade 106. In some example embodiments, the shaft system 12800 may comprise drilled pile 3900, helical pile 7500 or driven pile 9002. In some example embodiments, the shaft system 12800A may comprise supporting foundation 600 or supporting platform 1701. In some example embodiments, the pier location system 502A may be configured to locate the pier 14600 on either the grade beam 201, spot footing 14100, or slab foundation 12000.

FIG. 129 illustrates a section view that shows the two main beam 12600 units of a typical mobile home structure that is floating while anchored to and resting on a series of inserted girders 12100 from which a weighted keel 12101 is suspended. The weighted ballast of the keel 12101 lowers the center of gravity of the mobile home structure and lessens the possibility of its overturning or capsizing. The entire assembly is tethered to the foundation system 200 with multiple primary parallel struts system 104 units arranged in an opposing elbow system 900 which limits the possible lateral and vertical movement of each platform cleat to within a limited platform movement cone 1702. This limited movement allows the platform to rise to the elevation of the rising water 1202 and to return to its original platform at resting position 7901 once the water subsides. In this example each foundation hinge 1800 is anchored to a drilled pile 3900 that is independent of the pier system 105 which supports the mobile home structure when at rest. The drilled pile 3900 shafts anchor each primary parallel struts system 104, according to an example embodiment of the present disclosure.

FIG. 130 illustrates a perspective view that shows a mobile home floating in rising water 1202 that is counterbalanced against overturning by a series of suspended keel 12101 weights attached below the girders. The building is safely tethered to its foundation by a series of primary parallel struts system 104 units arranged in an opposing elbow system 900 oriented with inward acting elbow 901 hinges that are concealed beneath in the crawl space when the mobile is in an object at rest 301 position. This system of using a series of anchored girders 12100 to support two or more parallel main beam 12600 units that support the supporting frame 101, is a cost efficient alternative for retrofitting existing houses on raised foundations in order to give them the amphibious architecture qualities of being safely tethered while riding on the water's surface during flooding events, and returning to the original resting position as the water inundation recedes. Utilizing a drilled pile 3900 foundation system allows access for machinery to insert these stabilizing anchor devices into the existing grade 106, according to an example embodiment of the present disclosure.

FIG. 131 illustrates a section elevation view that shows a building at rest on its pier on gradebeam system 202. Under the object platform system 1500 the building is outfitted with a tethering system of stacked struts 9902. The lower of these two primary parallel struts system 104 units acts first when rising water 1202 lifts the building to separate vertically from its resting position. This lower set of parallel struts are the initial struts 10002. Whenever the vertical separation of the building reaches the outer limits of the upper strut movement arc 1703, the upper strut 702 of the set of initial struts 10002, because it is attached to the lower strut 703 of the set of reserve struts 10000, with further vertical movement it unclips the reserve struts 10000 unit from the struts clip 10300 and allows additional vertical movement. When the rising water 1202 recedes and the building returns to its original resting position, the set of reserve struts 10000 moves back inside the struts clip 10300, according to an example embodiment of the present disclosure. Initial struts 10002B may be defined as in an at rest position when the object 100 is resting on the foundation system 200 in its normal position. In some example embodiments, the initial struts 10002B may be configured to anchor to the object 100 through the reserve struts 10000, anchor to the reserve struts 10000, anchor to the foundation system 200, allow vertical movement between the object 100 and the foundation system 200 and align the strut 601 anchored to the object hinge 2200 in a parallel position to the strut 601 anchored to the foundation system 200.

FIG. 132 illustrates a perspective view that shows a platform in an object separated 103 position overlaid with diagrams illustrating each of the four upper strut movement arc 1703 paths and the resultant limited platform movement cone 1702 for the point of attachment to the platform for each upper strut 702 when arranged in an opposing elbow system 900. When anchoring each lower strut 703 to a rigid foundation system 200, the distance between each foundation hinge 1800 becomes fixed. When the object hinge 2200 of each primary parallel struts system 104 is anchored to a rigid platform, the distance between each object hinge 2200 becomes fixed. As the rigid platform moves vertically, the arc of limited movement of each is tied to the others. The result is a limited platform movement cone 1702 of movement for each point of connection to the platform. This movement cone is a single point at its base, the point of rotation for the lower strut 703 anchored to the foundation hinge 1800. This cone widens vertically, allowing each connection point to freely move within its boundaries. The resultant combination of possible movement points that lie within the restricted boundaries of each cone allows for the asymmetrical positioning of the platform caused by wind forces or wave action, according to an example embodiment of the present disclosure.

FIG. 133 illustrates an elevation view that shows a mechanical force 13300 device acting as the external force 500 in raising and lowering the object platform system 1500 tethered by a primary parallel struts system 104, according to an example embodiment of the present disclosure.

FIG. 134 illustrates an elevation view that shows a human force 13400 acting as the external force 500 in raising and lowering the object 100, according to an example embodiment of the present disclosure.

FIG. 135 illustrates an elevation view that shows a telescoping system 13500 of tethering an object 100 while allowing vertical movement about an arc whose center is the stationary cleat and whose length is variable, according to an example embodiment of the present disclosure. In some example embodiments, the telescoping system 13500 may be configured to be made of concentric tubular parts that slide into itself to become longer or shorter in length, anchor the object 100 to the foundation system 200, elongate and allow the object 100 to separate from the foundation system 200 and shorten in length to allow the object 100 to return to the foundation system 200. Tethering system 9000B may be defined as a device or system that is anchored on one end to an object 100 and anchored to the foundation system 200 on the other while allowing restricted movement of the object 100. Examples of tethering system 9000B may include a rope, a chain, a strut and a telescoping strut. In some example embodiments, the tethering system 9000B may be configured to allow the object 100 to separate from the foundation system 200, be anchored to the foundation system 200, be anchored to the object 100 and anchor the object 100 to the foundation system 200.

FIG. 136 illustrates an elevation view that shows a piling with sleeve 13600 device to tether an amphibious house using multiple driven pile 9002 units to guide sleeves or rollers attached to the object 100 or house. This system allows vertical separation of the object platform system 1500 from the foundation system 200 however, this system does not allow for the asymmetrical movement of a tilting object 401 subjected to the tilting forces of high winds or wave action on the surface of rising water 1202, according to an example embodiment of the present disclosure. In some example embodiments, the piling with sleeve 13600 may be configured to remain vertical, be rigid and resist horizontal movement, extend vertically above grade 106, anchor into grade 106, allow vertical movement between the object 100 and the foundation system 200, allow the object 100 to separate from the foundation system 200 and guide the object 100 to return to its original static position on the foundation system 200.

FIG. 137 illustrates an elevation view that shows a retractable tether system 13700 used to anchor an #object while allowing an extendable length vertical movement about an arc whose center is the core of the retractable tether system 13700 device, according to an example embodiment of the present disclosure. In some example embodiments, the retractable tether system 13700 may be configured to anchor to the object 100, anchor to the foundation system 200, wind in or out to become longer or shorter in length, allow vertical movement between the object 100 and the foundation system 200, allow the object 100 to separate from the foundation system 200 and guide the object 100 to return to its original static position on the foundation system 200.

FIG. 138 illustrates a perspective view that shows the ice cream sandwich in a melted state, according to an example embodiment of the present disclosure. In some example embodiments, the on board utility 13800A may be configured to move with the object 100 during periods of rising water 1202, provide one or more of the utility services to the object 100 and be anchored to the object 100. In some example embodiments, the on board delivery 13801 may be configured to supply utility services from a location on the object 100. In some example embodiments, the on board delivery 13801 may comprise on board utility 13800.

FIG. 139 illustrates a perspective view that shows the ice cream sandwich in a melted state, according to an example embodiment of the present disclosure. In some example embodiments, the overhead service 13900 may be configured to supply utility services from a location removed from the object 100 through an elevated above ground conduit system 11000. In some example embodiments, the off-site 13901 may be configured to supply utility services from a location removed from the object 100. In some example embodiments, the off-site 13901 may comprise underground service 10805 or overhead service 13900.

FIG. 140 illustrates a perspective view that shows a cutaway view showing underground service 10805 delivering utilities to a house. The utility service origination 14000 for delivery method is from off-site 13901. The connections between the house and the linear conduits involve a hard connection 14001 to the rigid conduit pipes for potable water 11202, gas 11201, and sewer 10804. The hard connection 14001 to the electrical service 11203 is a hard wired connection, according to an example embodiment of the present disclosure. In some example embodiments, the utility service origination 14000 may be configured to supply utility services. In some example embodiments, the utility service origination 14000 may comprise off-site 13901 or on board delivery 13801. In some example embodiments, the conduit system 11000A may be configured to deliver one or more utility services to the object 100. In some example embodiments, the conduit system 11000A may comprise linear conduit system 14002. In some example embodiments, the linear conduit system 14002 may be configured to deliver one or more utility services to the object 100 during the absence of rising water 1202, provide one or more utility services to the object 100 during the presence of rising water 1202, remain connected to the underground service 10805, remain connected to the object 100, allow the object 100 to separate from the foundation system 200 and allow the object 100 to return to its original static position on the foundation system 200.

FIG. 141 illustrates a section view that shows a pier resting on top of a spot footing 14100 that widens for area footprint on the soil to increase the weight capacity that each pier can safely support on grade 106 without undesirable settlement or failure, according to an example embodiment of the present disclosure. In some example embodiments, the spot footing 14100 may be configured to remain in a place when the external force 500 acts upon the object 100, remain connected to grade 106, remain connected to the pier system 105 and support the object 100.

FIG. 142 illustrates an Elevation view that shows multiple possible asymmetrical platform anchor positions with two opposing folding strut assemblies that have their lower struts anchored to the foundation and their upper struts anchored to a platform, according to an example embodiment of the present disclosure.

FIG. 143 illustrates a perspective view that shows a primary parallel struts system 104 anchored directly to a slab foundation 12000A, according to an example embodiment of the present disclosure. In some example embodiments, the slab foundation 12000A may be configured to support the object 100 and remain anchored to grade 106A at anchor point 1800.

FIG. 144 illustrates a perspective view that shows a primary parallel struts system 104 anchored directly to a slab foundation 12000 that is attached to a grade beam 201 that is anchored to grade 106, according to an example embodiment of the present disclosure. In some example embodiments, the slab foundation 12000D may be configured to support the object 100 and remain anchored to grade 106.

FIG. 145 illustrates a perspective view that shows an object 100 tethered to the foundation system 200 by a primary parallel struts system 104 that is anchored to a slab foundation 12000 that is supported and anchored to grade 106 by a shaft system 12800, according to an example embodiment of the present disclosure. In some example embodiments, the slab foundation 12000C may be configured to support the object 100 and remain anchored to grade 106.

FIG. 146 illustrates a perspective view that shows an object 100 tethered to the foundation system 200 by a primary parallel struts system 104 that is anchored to a pier on slab foundation 12000 that is supported by and anchored to grade 106, according to an example embodiment of the present disclosure. In some example embodiments, the slab foundation 12000B may be configured to support the object 100 and remain anchored to grade 106. In some example embodiments, the pier 14600A may be configured to elevate the object 100 above grade 106, remain connected to either the grade beam 201, spot footing 14100, or slab foundation 12000 and support the object 100.

FIG. 147 is a method diagram which describes the flood hinge system 109 according to an example embodiment of the present disclosure. If the variables of soil conditions, forces of anticipated winds and moving water, and the expected rise in water level are determined for a specific location (Step 14700), the layout/design of the stabilization system 108 can be chosen based on the soil conditions and anticipated forces and rise in water level that will act upon the object and transferred to the foundation by the tethering system via the layout system (Step 14701). Then the elements installed meet or exceed the minimum determined for a specific location (Step 14702). Then the stabilization system 108 has been installed properly via the installation system (Step 14703). If external force 500 hits an object 100 (Step 14704), the object 100 separates from the foundation system 200 and remains vertically separated and moves asymmetrically with the water waves 501 until the rising water 1202 subsides and then the object 100 returns to the object at rest 301 position via the stabilization system 108 (Step 14705).

FIG. 148 is a method diagram which describes the layout system according to an example embodiment of the present disclosure.

FIG. 149 is a method diagram which describes the stabilization system 108 according to an example embodiment of the present disclosure. If an external force 500 (for example, flood water) inundates the object 100 (Step 14900), the object 100 displaces a volume of water (Step 14901). If the volume of rising water 1202 displaced by the object 100 is of a weight equal to that of the object 100 including its contents (Step 14902), the object 100 lifts as the external force 500 (for example, flood water) was applied to the object 100 via the buoyancy system 1200 (Step 14903). If an external force 500 (for example, wind gusts or moving water) pushes against the object 100 in a horizontal direction (Step 14904), the buoyancy system 1200 attempts to carry away the object 100 (Step 14905). If the tethering system 9000 remains connected to the grade 106 via the foundation system 200 (Step 14906), the object 100 (ex. storage unit) retains its horizontal positioning by connection to the ground and does not get carried away via the tethering system 9000 (Step 14907).

FIG. 150 is a method diagram which describes the tethering system 9000 according to an example embodiment of the present disclosure.

FIG. 151 is a method diagram which describes the primary parallel struts system 104 according to an example embodiment of the present disclosure. In use, first, each strut 601 remains a fixed length and anchored to the elbow hinge 700 and to either the object hinge 2200 or the foundation hinge 1800 via the strut 601 (Step 15100). If the upper strut 702 remains a fixed length (Step 15101), the distance stays constant between the elbow hinge 700 and the object hinge 2200 via the upper strut 702 (Step 15102). If the lower strut 703 remains a fixed length (Step 15103), the distance stays constant between the elbow hinge 700 and the foundation hinge 1800 via the lower strut 703 (Step 15104). If the external force 500 moves the object 100 (Step 15105), the possible range of motion of each object hinge 2200 is limited to that illustrated in a same facing elbow system 9800 (Step 15106). If the external force 500 acting on the tethering system 9000 is within the anticipated range determined from the layout system (Step 15107), each strut 601 remains anchored to the strut cleat system 3100 and to the strut hinge system 2600 via the strut attachment system 1900 (Step 15108). Then the positions of the upper strut 702 and the lower strut 703 remain in a parallel position via the strut alignment system 7400 (Step 15109).

FIG. 152 is a method diagram which describes the strut attachment system 1900A according to an example embodiment of the present disclosure.

FIG. 153 is a method diagram which describes the strut hinge system 2600A according to an example embodiment of the present disclosure.

FIG. 154 is a method diagram which describes the strut hinge system 2600B according to an example embodiment of the present disclosure.

FIG. 155 is a method diagram which describes the elbow hinge 700A according to an example embodiment of the present disclosure.

FIG. 156 is a method diagram which describes the elbow hinge 700B according to an example embodiment of the present disclosure.

FIG. 157 is a method diagram which describes the strut hinge system 2600C according to an example embodiment of the present disclosure.

FIG. 158 is a method diagram which describes the hinge block system 2700A according to an example embodiment of the present disclosure.

FIG. 159 is a method diagram which describes the single hinge system 602 according to an example embodiment of the present disclosure.

FIG. 160 is a method diagram which describes the hinge leaf system 5801 according to an example embodiment of the present disclosure.

FIG. 161 is a method diagram which describes the hinge block system 2700B according to an example embodiment of the present disclosure.

FIG. 162 is a method diagram which describes the strut hinge system 2600D according to an example embodiment of the present disclosure.

FIG. 163 is a method diagram which describes the strut attachment system 1900 according to an example embodiment of the present disclosure. If the strut to cleat fastener 11800 is secured to the upper strut 702 (Step 16300), the upper strut 702 is fastened to the object hinge 2200 (Step 16301). If the strut to elbow fastener 5900 is secured to the upper strut 702 (Step 16302), the upper strut 702 is secured to the elbow hinge 700 (Step 16303). If the strut to elbow fastener 5900 is secured to the lower strut 703 (Step 16304), the lower strut 703 is secured to the elbow hinge 700 (Step 16305). If the strut to cleat fastener 11800 is secured to the lower strut 703 (Step 16306), the lower strut 703 is fastened to the foundation hinge 1800 (Step 16307). Then the strut 601 remains anchored to the cleat anchor system 801 and to the strut anchor system 6000 via the strut cleat system 3100 (Step 16308).

FIG. 164 is a method diagram which describes the strut cleat system 3100 according to an example embodiment of the present disclosure.

FIG. 165 is a method diagram which describes the cleat anchor system 801 according to an example embodiment of the present disclosure.

FIG. 166 is a method diagram which describes the strut anchor system 6000A according to an example embodiment of the present disclosure.

FIG. 167 is a method diagram which describes the strut anchor system 6000B according to an example embodiment of the present disclosure.

FIG. 168 is a method diagram which describes the primary parallel struts system 104A according to an example embodiment of the present disclosure.

FIG. 169 is a method diagram which describes the primary parallel struts system 104B according to an example embodiment of the present disclosure.

FIG. 170 is a method diagram which describes the stacked struts 9902A according to an example embodiment of the present disclosure.

FIG. 171 is a method diagram which describes the stacked struts 9902B according to an example embodiment of the present disclosure.

FIG. 172 is a method diagram which describes the clipping system 10001A according to an example embodiment of the present disclosure.

FIG. 173 is a method diagram which describes the clipping system 10001B according to an example embodiment of the present disclosure.

FIG. 174 is a method diagram which describes the stacked struts 9902C according to an example embodiment of the present disclosure.

FIG. 175 is a method diagram which describes the primary parallel struts system 104C according to an example embodiment of the present disclosure.

FIG. 176 is a method diagram which describes the secondary parallel struts system 110 according to an example embodiment of the present disclosure. In use, first, the primary parallel struts system 104 is positioned (Step 17600). If the secondary parallel struts system 110 is positioned non-parallel and opposed to the folding strut movement plane 3700 of the primary parallel struts system 104 (Step 17601), the possible range of motion of each object hinge 2200 is limited to that illustrated for an opposing strut allowable movement 1700 via the platform movement system 8000 (Step 17602).

FIG. 177 is a method diagram which describes the platform movement system 8000 according to an example embodiment of the present disclosure. If the secondary parallel struts system 110 is positioned non-parallel and opposed to the folding strut movement plane 3700 of the primary parallel struts system 104 (Step 17700), the possible range of arc motion of each object hinge 2200 in an opposing elbow system 900 is limited to within the arc illustrated via the platform movement arc 7900 (Step 17701). If the object hinge 2200 of both the primary parallel struts system 104 and the secondary parallel struts system 110 are connected to the same supporting platform 1701 (Step 17702), platform position 8700 is limited to fall within the platform movement system 8000 (Step 17703). Then the position of the object platform system 1500 is illustrated via the platform position 8700 (Step 17704).

FIG. 178 is a method diagram which describes the platform position 8700 according to an example embodiment of the present disclosure.

FIG. 179 is a method diagram which describes the platform movement arc 7900 according to an example embodiment of the present disclosure.

FIG. 180 is a method diagram which describes the tethering system 9000C according to an example embodiment of the present disclosure.

FIG. 181 is a method diagram which describes the foundation system 200 according to an example embodiment of the present disclosure. If the object 100 is at the object at rest 301 position (Step 18100), the object 100 is supported by the Foundation (Step 18101). If the object 100 moves to the object separated 103 position (Step 18102), the object 100 remains connected to the tethering system 9000 (Step 18103). If the tethering system 9000 remains connected to the foundation support system 603 (Step 18104) and the object 100 remains tethered to the foundation support system 603 (Step 18105), the object 100 is supported and the foundation support system 603 remains stationary and connected to the stabilization system 108 via the foundation support system 603 (Step 18106).

FIG. 182 is a method diagram which describes the foundation support system 603 according to an example embodiment of the present disclosure. In use, first, the object 100 rests on grade 106 (Step 18200). Then the shaft system 12800 remains connected to grade 106 and supports and resists the forces transmitted through the stabilization system 108 via the shaft system 12800 (Step 18201). Then the object 100 rests on a slab foundation 12000 (Step 18202). Then the object 100 is supported and the slab foundation 12000 is anchored to grade 106 via the slab foundation 12000 (Step 18203). Then the object 100 rests on a spot footing 14100 (Step 18204). Then the object 100 is supported and the spot footing 14100 remains in place and anchored to grade 106 via the spot footing 14100 (Step 18205). Then the object 100 rests on a grade beam 201 (Step 18206). Then the object 100 is supported and the grade beam 201 remains in place and anchored to grade 106 via the grade beam 201 (Step 18207). Then the object 100 rests on a pier system 105 (Step 18208). Then the object 100 is elevated above grade 106 and the pier 14600 remains connected to either the grade beam 201, spot footing 14100, or slab foundation 12000 via the pier system 105 (Step 18209).

FIG. 183 is a method diagram which describes the pier system 105 according to an example embodiment of the present disclosure.

FIG. 184 is a method diagram which describes the pier location system 502B according to an example embodiment of the present disclosure.

FIG. 185 is a method diagram which describes the shaft system 12800A according to an example embodiment of the present disclosure.

FIG. 186 is a method diagram which describes the shaft system 12800 according to an example embodiment of the present disclosure.

FIG. 187 is a method diagram which describes the drilled pile 3900 according to an example embodiment of the present disclosure.

FIG. 188 is a method diagram which describes the shaft fill material 3901B according to an example embodiment of the present disclosure.

FIG. 189 is a method diagram which describes the helical pile 7500A according to an example embodiment of the present disclosure.

FIG. 190 is a method diagram which describes the buoyancy system 1200 according to an example embodiment of the present disclosure. If the rising water 1202 level inundates the site (Step 19000), the object displaces a volume of water (Step 19001). If the volume of water displaced is of a weight equal to that of the object including its contents (Step 19002), the object begins to float (Step 19003). Then the external force 500 (rising water) threatens to inundate the interior of the object 100 (Step 19004). If the external force 500 (rising water) threatens to inundate the bottom of the object 100 (Step 19005), rising water 1202 does not penetrate the object bottom via the hull bottom sealing system 6302 (Step 19006). If the external force 500 (rising water) threatens to inundate the sides of the object 100 (Step 19007), rising water 1202 does not penetrate the hull sides via the hull side sealing system 1201 (Step 19008). If the external force 500 (rising water) threatens to inundate the fenestration of the object 100 (Step 19009), rising water 1202 does not penetrate the fenestration via the fenestration buoyancy system 4400 (Step 19010). Then the object remains buoyant (Step 19011).

FIG. 191 is a method diagram which describes the hull bottom sealing system 6302 according to an example embodiment of the present disclosure. If the object 100 floats (Step 19100), the external force 500 live loads and the buoyancy loads of the partially submerged object 100 act on the hull bottom (Step 19101). Then the structural dead loads, buoyancy water displacement loads, and the external force 500 live loads transmitted through the hull bottom sheathing 4301 are supported via the hull bottom framing 5101 (Step 19102). Then the buoyancy water displacement loads acting on either the sub flooring 5100 or on the hull sheathing on the spans between each member of the hull bottom framing 5101 are supported via the hull bottom sheathing 4301 (Step 19103). Then remaining waterproof at all connections and penetrations and the object 100 becomes buoyant and remains dry in the presence of rising water 1202 via the hull bottom waterproof membrane 6200 (Step 19104). Then the object 100 remains floating (Step 19105).

FIG. 192 is a method diagram which describes the hull bottom sheathing 4301A according to an example embodiment of the present disclosure.

FIG. 193 is a method diagram which describes the hull bottom sheathing 4301 according to an example embodiment of the present disclosure. If the object 100 begins to float (Step 19300), the water displacement loads are supported in the spans between each member of the hull bottom framing 5101 when the object 100 is immersed in rising water 1202 via the hull sheathing (Step 19301).

FIG. 194 is a method diagram which describes the hull side sealing system 1201 according to an example embodiment of the present disclosure. If the object 100 floats (Step 19400), the external force 500 live loads and the buoyancy loads of the partially submerged object 100 act on the hull sides (Step 19401). Then the structural dead loads and the external force 500 live loads transmitted through the hull side sheathing 6301 are supported via the hull side framing 6300 (Step 19402). Then the structural dead loads and the external force 500 live loads in the spans between each member of the hull side framing 6300 are supported via the hull side sheathing 6301 (Step 19403). Then the partially submerged walls of the object 100 remain dry while floating in the presence of rising water 1202 via the hull side waterproof membrane 6201 (Step 19404). Then the object 100 remains floating (Step 19405).

FIG. 195 is a method diagram which describes the fenestration buoyancy system 4400 according to an example embodiment of the present disclosure. If the object 100 floats (Step 19500), the external force 500 live loads in the spans between each fenestration member of the hull side framing 6300 are supported (Step 19501). If the external force 500 (rising water) threatens to inundate the interior of the object 100 (Step 19502), rising water 1202 does not enter into the object 100 via the window buoyancy system (Step 19503). Then the object 100 continues to float (Step 19504). Then rising water 1202 does not enter into the object 100 via the door buoyancy system (Step 19505). Then refer back to Step 19504 "the object 100 continues to float".

FIG. 196 is a method diagram which describes the fenestration buoyancy system according to an example embodiment of the present disclosure.

FIG. 197 is a method diagram which describes the window frame buoyancy system 6700B according to an example embodiment of the present disclosure.

FIG. 198 is a method diagram which describes the window frame buoyancy system 6700C according to an example embodiment of the present disclosure.

FIG. 199 is a method diagram which describes the fenestration buoyancy system according to an example embodiment of the present disclosure.

FIG. 200 is a method diagram which describes the door frame buoyancy system 6400B according to an example embodiment of the present disclosure.

FIG. 201 is a method diagram which describes the door frame buoyancy system 6400C according to an example embodiment of the present disclosure.

FIG. 202 is a method diagram which describes the buoyancy system 1200A according to an example embodiment of the present disclosure.

FIG. 203 is a method diagram which describes the deployable buoyancy 5200A according to an example embodiment of the present disclosure.

FIG. 204 is a method diagram which describes the deflated tanks 5300 according to an example embodiment of the present disclosure.

FIG. 205 is a method diagram which describes the buoyancy system 1200B according to an example embodiment of the present disclosure.

FIG. 206 is a method diagram which describes the static buoyancy installation 5000B according to an example embodiment of the present disclosure.

FIG. 207 is a method diagram which describes the buoyancy system 1200C according to an example embodiment of the present disclosure.

FIG. 208 is a method diagram which describes the buoyant object connector 12200 according to an example embodiment of the present disclosure.

FIG. 209 is a method diagram which describes the object platform system 1500A according to an example embodiment of the present disclosure.

FIG. 210 is a method diagram which describes the platform sill 1003A according to an example embodiment of the present disclosure.

FIG. 211 is a method diagram which describes the impact dampening system 4200A according to an example embodiment of the present disclosure.

FIG. 212 is a method diagram which describes the impact dampening system 4200B according to an example embodiment of the present disclosure.

FIG. 213 is a method diagram which describes the impact dampening system 4200C according to an example embodiment of the present disclosure.

FIG. 214 is a method diagram which describes the object platform system 1500B according to an example embodiment of the present disclosure.

FIG. 215 is a method diagram which describes the object platform system 1500C according to an example embodiment of the present disclosure.

FIG. 216 is a method diagram which describes the supporting frame 101A according to an example embodiment of the present disclosure.

FIG. 217 is a method diagram which describes the supporting frame 101B according to an example embodiment of the present disclosure.

FIG. 218 is a method diagram which describes the supporting frame 101D according to an example embodiment of the present disclosure.

FIG. 219 is a method diagram which describes the utility service origination 14000 according to an example embodiment of the present disclosure.

FIG. 220 is a method diagram which describes the off-site 13901 according to an example embodiment of the present disclosure.

FIG. 221 is a method diagram which describes the on board delivery 13801 according to an example embodiment of the present disclosure.

FIG. 222 is a method diagram which describes the utility service connection 10803A according to an example embodiment of the present disclosure.

FIG. 223 is a method diagram which describes the conduit system 11000A according to an example embodiment of the present disclosure.

FIG. 224 is a method diagram which describes the coiled conduit 11100A according to an example embodiment of the present disclosure.

FIG. 225 is a method diagram which describes the coiled sewer conduit 10800B according to an example embodiment of the present disclosure.

FIG. 226 is a method diagram which describes the coiled conduit 11100B according to an example embodiment of the present disclosure.

FIG. 227 is a method diagram which describes the outward acting elbow 902 according to an example embodiment of the present disclosure.

FIG. 228 is a method diagram which describes the opposing elbow system 900A according to an example embodiment of the present disclosure.

FIG. 229 is a method diagram which describes the folding strut movement arc system 7101 according to an example embodiment of the present disclosure.

FIG. 230 is a method diagram which describes the single folding strut movement 7100 according to an example embodiment of the present disclosure.

FIG. 231 is a method diagram which describes the locking system 8309A according to an example embodiment of the present disclosure.

FIG. 232 is a method diagram which describes the locking system 8309B according to an example embodiment of the present disclosure.

FIG. 233 is a method diagram which describes the rising water lock release activation system 11501A according to an example embodiment of the present disclosure.

FIG. 234 is a method diagram which describes the float activated system 8308 according to an example embodiment of the present disclosure.

FIG. 235 is a method diagram which describes the lock system 8310B according to an example embodiment of the present disclosure.

FIG. 236 is a method diagram which describes the hold down system 8300 according to an example embodiment of the present disclosure.

FIG. 237 is a method diagram which describes the lock assembly cleat 8301 according to an example embodiment of the present disclosure.

FIG. 238 is a method diagram which describes the rising water lock release activation system 11501B according to an example embodiment of the present disclosure.

The invention claimed is:

1. A system comprising:

a building configured to separate from a foundation system when the building is acted upon by an external force; and a stabilization system comprising:

a tethering system configured to anchor the building to the foundation system; and a buoyancy system configured to:

allow the building to vertically separate from the foundation system;

allow the building to move asymmetrically in multiple directions substantially simultaneously, the multiple directions comprising up and down, side to side, front and back, and combinations thereof until the external force subsides; and return the building to the foundation system.

2. The system of claim 1, wherein the tethering system comprises a first strut system comprising:

a first upper strut movable in a first upper strut plane, the first upper strut attached to the building;

a first lower strut movable in a first lower strut plane, the first lower strut attached to the foundation system; and a first elbow hinge connecting the first upper strut to the first lower strut, the first upper strut plane parallel to the first lower strut plane.

3. The system of claim 2, wherein the tethering system comprises a second strut system comprising:

a second upper strut movable in a second upper strut plane, the second upper strut attached to the building;

a second lower strut movable in a second lower strut plane, the second lower strut attached to the foundation system; and a second elbow hinge connecting the second upper strut to the second lower strut, the second upper strut plane parallel to the second lower strut plane; and at least one second strut plane non-parallel to at least one first strut plane.

4. The system of claim 2, wherein the first strut system comprises:

an object hinge configured to connect the first upper strut to the building; and a foundation hinge configured to connect the first lower strut to the foundation system.

5. The system of claim 3, wherein the second strut system comprises:

an object hinge configured to connect the second upper strut to the building; and a foundation hinge configured to connect the second lower strut to the foundation system.

6. The system of claim 1, wherein the foundation system comprises a foundation support system comprising a shaft system connected to a grade, the shaft system configured to support and resist forces transmitted through the stabilization system.

7. The system of claim 1, wherein the foundation system comprises a pier system foundation support system comprising:

a pier configured to elevate the building above a grade;

the pier located on at least one of a grade beam, spot footing, and slab foundation; and anchored to the at least one of a grade beam, spot footing, and slab foundation.

8. A system comprising:

a stabilization system configured to:

receive input parameters including at least one of soil conditions, anticipated water levels, water currents, wind loads, and resultant horizontal forces acting on a building and to enable the selection of element and arrangement options;

anchor the building to a foundation system;

allow the building to vertically separate from the foundation system;

allow the object to move asymmetrically in multiple directions substantially simultaneously, the multiple directions comprising up and down, side to side, front and back, and combinations thereof until an external force subsides; and return the building to the foundation system.

9. The system of claim 8, wherein the building is anchored to the foundation system by a first strut system comprising:

a first upper strut movable in a first upper strut plane, the first upper strut attached to the building;

a first lower strut movable in a first lower strut plane, the first lower strut attached to the foundation system; and a first elbow hinge connecting the first upper strut to the first lower strut, the first upper strut plane parallel to the first lower strut plane.

10. The system of claim 9, wherein the building is further anchored by a second strut system comprising:

a second upper strut movable in a second upper strut plane, the second upper strut attached to the building;

a second lower strut movable in a second lower strut plane, the second lower strut attached to the foundation system; and a second elbow hinge connecting the second upper strut to the second lower strut, the second upper strut plane parallel to the second lower strut plane, and at least one second strut plane non-parallel to at least one first strut plane.

11. The system of claim 8, wherein the first strut system comprises a building hinge configured to connect the first upper strut to the building; and a foundation hinge configured to connect the first lower strut to the foundation system.

12. The system of claim 10, wherein the second strut system comprises:

a building hinge configured to connect the second upper strut to the building; and a foundation hinge configured to connect the second lower strut to the foundation system.

13. The system of claim 8, wherein the foundation system comprises a foundation support system comprising a shaft system connected to a grade, the shaft system configured to support and resist forces transmitted through the stabilization system.

14. The system of claim 8, wherein the foundation system comprises a pier system foundation support system comprising:

a pier configured to elevate the building above a grade, the pier located on at least one of a grade beam, spot footing and slab foundation; and anchored to the at least one of a grade beam, spot footing and slab foundation.

15. A method comprising:

receiving input parameters including at least one of soil conditions, anticipated water levels, water currents, wind loads, and resultant horizontal forces acting on a building; anchoring the building to a foundation system; allowing the building to vertically separate from the foundation system; and selecting at least one element and arrangement options for a stabilization system configured to allow the building to move asymmetrically in multiple directions substantially simultaneously, the multiple directions comprising up and down, side to side, front and back, and combinations thereof until an external force subsides.

16. The method of claim 15, further comprising:

returning the building to the foundation system.

17. The method of claim 16, wherein the anchoring comprises:

attaching a first upper strut to the building, the first upper strut movable in a first upper strut plane;

attaching a first lower strut to the foundation system, the first lower strut movable in a first lower strut plane; and connecting the first upper strut to the first lower strut with a first elbow hinge, the first upper strut plane parallel to the first lower strut plane.

18. The method of claim 16, wherein allowing the object to move until an external force subsides comprises allowing the building to move asymmetrically in multiple directions substantially simultaneously, the multiple directions comprising up and down, side to side, front and back, and combinations thereof.

19. The method of claim 17, wherein the anchoring further comprises:

attaching a second upper strut to the building, the second upper strut movable in a second upper strut plane;

attaching a second lower strut to the foundation system, the second lower strut movable in a second lower strut plane; and connecting the second upper strut to the second lower strut with a second elbow hinge, the second upper strut plane parallel to the second lower strut plane and at least one second strut plane non-parallel to at least one first strut plane.

20. The method of claim 15, further comprising elevating the building above a grade with a pier;

locating the pier on at least one of a grade beam, spot footing, and slab foundation; and anchoring the pier to at least one of a grade beam, spot footing, and slab foundation.

* * * * *